US007556092B2

(12) United States Patent
Cook et al.

(10) Patent No.: US 7,556,092 B2
(45) Date of Patent: Jul. 7, 2009

(54) FLOW CONTROL SYSTEM FOR AN APPARATUS FOR RADIALLY EXPANDING TUBULAR MEMBERS

(75) Inventors: Robert Lance Cook, Katy, TX (US); David Paul Brisco, Duncan, OK (US); Lev Ring, Houston, TX (US); Michael Bullock, The Woodlands, TX (US)

(73) Assignee: Enventure Global Technology, LLC, Houston, TX (US)

( * ) Notice: Subject to any disclaimer, the term of this patent is extended or adjusted under 35 U.S.C. 154(b) by 841 days.

(21) Appl. No.: 10/076,660

(22) Filed: Feb. 15, 2002

(65) Prior Publication Data

US 2002/0100595 A1 Aug. 1, 2002

Related U.S. Application Data

(62) Division of application No. 09/512,895, filed on Feb. 24, 2000, now Pat. No. 6,568,471.

(60) Provisional application No. 60/121,841, filed on Feb. 26, 1999, provisional application No. 60/154,047, filed on Sep. 16, 1999.

(51) Int. Cl.
*E21B 23/00* (2006.01)
*E21B 43/10* (2006.01)

(52) U.S. Cl. ..... 166/207; 166/217; 166/216

(58) Field of Classification Search ..... 166/184, 166/187, 177.4, 287, 212, 319, 325, 329, 166/207, 206, 216, 217, 384; 137/14, 883, 137/533.11, 861, 872, 12; 261/62, 63, 63.5; 251/62, 63, 63.5
See application file for complete search history.

(56) References Cited

U.S. PATENT DOCUMENTS 46,818 A 3/1865 Patterson
0,331,940 A 12/1885 Bole
0,332,184 A 12/1885 Bole
341,237 A 5/1886 Healey
0,519,805 A 5/1894 Bavier
0,802,880 A 10/1905 Phillips
0,806,156 A 12/1905 Marshall
958,517 A 5/1910 Mettler
984,449 A 2/1911 Stewart
0,984,449 A 2/1911 Stewart (Continued)

FOREIGN PATENT DOCUMENTS

AU 9201859 2/1992
AU 767364 2/2004
AU 770008 7/2004
AU 770359 7/2004
AU 771884 8/2004
AU 776580 1/2005
AU 780123 3/2005
AU 2001269810 8/2005
AU 782901 9/2005
AU 783245 10/2005

(Continued)

OTHER PUBLICATIONS

Letter From Baker Oil Tools to William Norvell in Regards to Enventure's Claims of Baker Infringement Of Enventure's Expandable Patents Apr. 1, 2005.
Offshore, "Agbada Well Solid Tubulars Expanded Bottom Up, Screens Expanded Top Down" William Furlow, Jan. 2002.(copy not available).

(Continued)

*Primary Examiner*—John Rivell
*Assistant Examiner*—Cloud K Lee
(74) *Attorney, Agent, or Firm*—Conley Rose, P.C.

(57) ABSTRACT

A flow control system for an apparatus for radially expanding tubular members.

15 Claims, 79 Drawing Sheets

U.S. PATENT DOCUMENTS

| | | | | |
|---|---|---|---|---|
| 1,166,040 | A | 12/1915 | Burlingham | |
| 1,233,888 | A | 7/1917 | Leonard | |
| 1,494,128 | A | 5/1924 | Primrose | |
| 1,589,781 | A | 6/1926 | Anderson | |
| 1,590,357 | A | 6/1926 | Feisthamel | |
| 1,597,212 | A | 8/1926 | Spengler | |
| 1,613,461 | A | 1/1927 | Johnson | |
| 1,756,531 | A | 4/1930 | Aldeen et al. | |
| 1,880,218 | A | 10/1932 | Simmons | |
| 1,981,525 | A | 11/1934 | Price | |
| 2,046,870 | A | 7/1936 | Clasen et al. | |
| 2,087,185 | A | 7/1937 | Dillom | |
| 2,122,757 | A | 7/1938 | Scott | |
| 2,145,168 | A | 1/1939 | Flagg | |
| 2,160,263 | A | 5/1939 | Fletcher | |
| 2,187,275 | A | 1/1940 | McLennan | |
| 2,204,586 | A | 6/1940 | Grau | |
| 2,211,173 | A | 8/1940 | Shaffer | |
| 2,214,226 | A | 9/1940 | English | |
| 2,226,804 | A | 12/1940 | Carroll | |
| 2,246,038 | A | 6/1941 | Graham | |
| 2,273,017 | A | 2/1942 | Boynton | |
| 2,301,495 | A | 11/1942 | Abegg | |
| 2,305,282 | A | 12/1942 | Taylor, Jr., et al. | |
| 2,371,840 | A | 3/1945 | Otis | |
| 2,383,214 | A | 8/1945 | Prout | |
| 2,447,629 | A | 8/1948 | Beissinger et al. | |
| 2,546,295 | A | 3/1951 | Boice | |
| 2,583,316 | A | 1/1952 | Bannister | |
| 2,609,258 | A | 11/1952 | Taylor, Jr., et al. | |
| 2,627,891 | A | 2/1953 | Clark | |
| 2,647,847 | A | 8/1953 | Black et al. | |
| 2,664,952 | A | 1/1954 | Losey | |
| 2,691,418 | A | 10/1954 | Connolly | |
| 2,723,721 | A | 11/1955 | Corsette | |
| 2,734,580 | A | 2/1956 | Layne | |
| 2,796,134 | A | 6/1957 | Binkley | |
| 2,812,025 | A | 11/1957 | Teague et al. | |
| 2,877,822 | A | 3/1959 | Buck | |
| 2,907,589 | A | 10/1959 | Knox | |
| 2,919,741 | A | 1/1960 | Strock et al. | |
| 2,929,741 | A | 1/1960 | Strock et al. | |
| 3,015,362 | A | 1/1962 | Moosman | |
| 3,015,500 | A | 1/1962 | Barnett | |
| 3,018,547 | A | 1/1962 | Marskell | |
| 3,039,530 | A | 6/1962 | Condra | |
| 3,067,801 | A | 12/1962 | Sortor | |
| 3,067,819 | A | 12/1962 | Gore | |
| 3,068,563 | A | 12/1962 | Reverman | |
| 3,104,703 | A | 9/1963 | Rike et al. | |
| 3,111,991 | A | 11/1963 | O'Neal | |
| 3,167,122 | A | 1/1965 | Lang | |
| 3,175,618 | A | 3/1965 | Lang et al. | |
| 3,179,168 | A | 4/1965 | Vincent | |
| 3,188,816 | A | 6/1965 | Koch | |
| 3,191,677 | A | 6/1965 | Kinley | |
| 3,191,680 | A | 6/1965 | Vincent | |
| 3,203,451 | A | 8/1965 | Vincent | |
| 3,203,483 | A | 8/1965 | Vincent | |
| 3,209,546 | A | 10/1965 | Lawton | |
| 3,210,102 | A | 10/1965 | Joslin | |
| 3,233,315 | A | 2/1966 | Levake | |
| 3,245,471 | A | 4/1966 | Howard | |
| 3,270,817 | A | 9/1966 | Papaila | |
| 3,297,092 | A | 1/1967 | Jennings | |
| 3,326,293 | A | 6/1967 | Skipper | |
| 3,343,252 | A | 9/1967 | Reesor | |
| 3,353,599 | A | 11/1967 | Swift | |
| 3,354,955 | A | 11/1967 | Berry | |
| 3,358,760 | A | 12/1967 | Blagg | |
| 3,358,769 | A | 12/1967 | Berry | |
| 3,364,993 | A | 1/1968 | Skipper | |
| 3,371,717 | A | 3/1968 | Chenowith | |
| 3,381,756 | A * | 5/1968 | Reagan | 166/319 |
| 3,397,745 | A | 8/1968 | Owens et al. | |
| 3,412,565 | A | 11/1968 | Lindsey et al. | |
| 3,419,080 | A | 12/1968 | Lebourg | |
| 3,422,902 | A | 1/1969 | Bouchillon | |
| 3,424,244 | A | 1/1969 | Kinley | |
| 3,427,707 | A | 2/1969 | Nowosadko | |
| 3,463,228 | A | 8/1969 | Hearn | |
| 3,477,506 | A | 11/1969 | Malone | |
| 3,489,220 | A | 1/1970 | Kinley | |
| 3,489,437 | A | 1/1970 | Duret | |
| 3,498,376 | A | 3/1970 | Sizer et al. | |
| 3,504,515 | A | 4/1970 | Reardon | |
| 3,508,771 | A | 4/1970 | Duret | |
| 3,520,049 | A | 7/1970 | Lysenko et al. | |
| 3,528,498 | A | 9/1970 | Carothers | |
| 3,532,174 | A | 10/1970 | Diamantides et al. | |
| 3,568,773 | A | 3/1971 | Chancellor | 166/315 |
| 3,574,357 | A | 4/1971 | Alexandru et al. | |
| 3,578,081 | A | 5/1971 | Bodine | |
| 3,579,805 | A | 5/1971 | Kast | |
| 3,581,817 | A | 6/1971 | Kammerer, Jr. | |
| 3,605,887 | A | 9/1971 | Lambie | |
| 3,631,926 | A | 1/1972 | Young | |
| 3,665,591 | A | 5/1972 | Kowal | |
| 3,667,547 | A | 6/1972 | Ahlstone | |
| 3,669,190 | A | 6/1972 | Sizer et al. | 166/315 |
| 3,678,727 | A | 7/1972 | Jackson | |
| 3,682,256 | A | 8/1972 | Stuart | |
| 3,687,196 | A | 8/1972 | Mullins | 166/217 |
| 3,691,624 | A | 9/1972 | Kinley | 29/523 |
| 3,693,717 | A | 9/1972 | Wuenschel | 166/285 |
| 3,704,730 | A | 12/1972 | Witzig | |
| 3,709,306 | A | 1/1973 | Curington | |
| 3,711,123 | A | 1/1973 | Arnold | 285/18 |
| 3,712,376 | A | 1/1973 | Owen et al. | 166/277 |
| 3,746,068 | A | 7/1973 | Deckert et al. | |
| 3,746,091 | A | 7/1973 | Owen et al. | 166/207 |
| 3,746,092 | A | 7/1973 | Land | 166/207 |
| 3,764,168 | A | 10/1973 | Kisling, III et al. | 285/302 |
| 3,776,307 | A | 12/1973 | Young | 166/125 |
| 3,779,025 | A | 12/1973 | Godley et al. | 61/53.52 |
| 3,780,562 | A | 12/1973 | Kinley | 72/479 |
| 3,781,966 | A | 1/1974 | Lieberman | |
| 3,785,193 | A | 1/1974 | Kinley et al. | 72/393 |
| 3,797,259 | A | 3/1974 | Kammerer, Jr. | 61/53.68 |
| 3,805,567 | A | 4/1974 | Agius-Sincero | |
| 3,812,912 | A | 5/1974 | Wuenschel | 166/207 |
| 3,818,734 | A | 6/1974 | Bateman | 72/75 |
| 3,826,124 | A | 7/1974 | Baksay | |
| 3,830,294 | A | 8/1974 | Swanson | |
| 3,830,295 | A | 8/1974 | Crowe | |
| 3,834,742 | A | 9/1974 | McPhillips | |
| 3,848,668 | A | 11/1974 | Sizer et al. | |
| 3,866,954 | A | 2/1975 | Slator et al. | |
| 3,874,446 | A | 4/1975 | Crowe | |
| 3,885,298 | A | 5/1975 | Pogonowski | |
| 3,887,006 | A | 6/1975 | Pitts | 166/124 |
| 3,893,718 | A | 7/1975 | Powell | |
| 3,898,163 | A | 8/1975 | Mott | |
| 3,915,478 | A | 10/1975 | Al et al. | |
| 3,915,763 | A | 10/1975 | Jennings et al. | |
| 3,935,910 | A | 2/1976 | Gaudy et al. | 175/17 |
| 3,942,824 | A | 3/1976 | Sable | |
| 3,945,444 | A | 3/1976 | Knudson | 175/92 |
| 3,948,321 | A | 4/1976 | Owen et al. | 166/277 |
| 3,963,076 | A | 6/1976 | Winslow | |
| 3,970,336 | A | 7/1976 | O'Sickey et al. | |
| 3,977,473 | A | 8/1976 | Page, Jr. | 166/315 |
| 3,989,280 | A | 11/1976 | Schwarz | |
| 3,997,193 | A | 12/1976 | Tsuda et al. | 285/47 |

3,999,605 A 12/1976 Braddick
4,011,652 A 3/1977 Black
4,018,634 A 4/1977 Fenci
4,019,579 A 4/1977 Thuse
4,026,583 A 5/1977 Gottlieb
4,053,247 A 10/1977 Marsh, Jr.
4,069,573 A 1/1978 Rogers, Jr. et al. ..... 29/421 R
4,076,287 A 2/1978 Bill et al. ..... 285/382.4
4,096,913 A 6/1978 Kenneday et al. ..... 166/290
4,098,334 A 7/1978 Crowe ..... 166/208
4,099,563 A 7/1978 Hutchison et al.
4,125,937 A 11/1978 Brown et al.
4,152,821 A 5/1979 Scott
4,168,747 A 9/1979 Youmans
4,190,108 A 2/1980 Webber ..... 166/202
4,204,312 A 5/1980 Tooker
4,205,422 A 6/1980 Hardwick ..... 29/402.13
4,226,449 A 10/1980 Cole
4,253,687 A 3/1981 Maples ..... 285/332
4,257,155 A 3/1981 Hunter
4,274,665 A 6/1981 Marsh, Jr.
RE30,802 E 11/1981 Rogers, Jr. ..... 29/421 R
4,304,428 A 12/1981 Grigorian et al.
4,328,983 A 5/1982 Gibson
4,355,664 A 10/1982 Cook et al.
4,359,889 A 11/1982 Kelly ..... 72/62
4,363,358 A 12/1982 Ellis ..... 166/212
4,366,971 A 1/1983 Lula
4,368,571 A 1/1983 Cooper, Jr. ..... 29/421 R
4,379,471 A 4/1983 Kuenzel
4,380,347 A 4/1983 Sable
4,384,625 A 5/1983 Roper et al.
4,391,325 A 7/1983 Baker et al. ..... 166/208
4,393,931 A 7/1983 Muse et al. ..... 166/208
4,397,484 A 8/1983 Miller
4,401,325 A 8/1983 Tsuchiya et al.
4,402,372 A 9/1983 Cherrington
4,407,681 A 10/1983 Ina et al. ..... 148/12
4,411,435 A 10/1983 McStravick ..... 277/9.5
4,413,395 A 11/1983 Garnier
4,413,682 A 11/1983 Callihan et al. ..... 166/382
4,420,866 A 12/1983 Mueller ..... 29/421 R
4,421,169 A 12/1983 Dearth et al. ..... 166/285
4,422,317 A 12/1983 Mueller
4,422,507 A 12/1983 Reimert
4,423,889 A 1/1984 Weise ..... 285/39
4,423,986 A 1/1984 Skogberg ..... 405/259
4,424,865 A 1/1984 Payton, Jr.
4,429,741 A 2/1984 Hyland ..... 166/63
4,440,233 A 4/1984 Baugh et al. ..... 166/382
4,442,586 A 4/1984 Ridenour
4,444,250 A 4/1984 Keithahn et al.
4,449,713 A 5/1984 Ishido et al.
4,458,925 A 7/1984 Raulins et al.
4,462,471 A 7/1984 Hipp
4,467,630 A 8/1984 Kelly
4,468,309 A 8/1984 White
4,469,356 A 9/1984 Duret et al.
4,473,245 A 9/1984 Raulins et al.
4,483,399 A 11/1984 Colgate ..... 166/308
4,485,847 A 12/1984 Wentzell ..... 138/89
4,491,001 A 1/1985 Yoshida et al.
4,495,073 A 1/1985 Beimgraben
4,501,327 A 2/1985 Retz ..... 166/285
4,505,017 A 3/1985 Schukei ..... 29/157.3 R
4,505,987 A 3/1985 Yamada et al.
4,506,432 A 3/1985 Smith
4,507,019 A 3/1985 Thompson
4,508,129 A 4/1985 Brown
4,508,167 A 4/1985 Weinberg et al.
4,511,289 A 4/1985 Herron ..... 405/259
4,513,995 A 4/1985 Niehaus et al.
4,519,456 A 5/1985 Cochran
4,526,232 A 7/1985 Hughson et al. ..... 166/339
4,526,839 A 7/1985 Herman et al.
4,527,815 A 7/1985 Frick
4,530,231 A 7/1985 Main
4,531,552 A 7/1985 Kim
4,537,429 A 8/1985 Landriault
4,538,442 A 9/1985 Reed
4,538,840 A 9/1985 DeLange
4,541,655 A 9/1985 Hunter
4,550,782 A 11/1985 Lawson
4,550,937 A 11/1985 Duret
4,553,776 A 11/1985 Dodd ..... 285/212
4,573,248 A 3/1986 Hackett
4,576,386 A 3/1986 Benson et al. ..... 277/165
4,581,817 A 4/1986 Kelly
4,582,348 A 4/1986 Dearden et al.
4,590,227 A 5/1986 Nakamura et al.
4,590,995 A 5/1986 Evans ..... 166/127
4,592,577 A 6/1986 Ayres et al.
4,595,063 A 6/1986 Jennings et al.
4,596,913 A 6/1986 Takechi
4,601,343 A 7/1986 Lindsey et al.
4,603,889 A 8/1986 Welsh
4,605,063 A 8/1986 Ross ..... 166/216
4,611,662 A 9/1986 Harrington ..... 166/339
4,614,233 A 9/1986 Menard
4,627,488 A * 12/1986 Szarka ..... 166/51
4,629,218 A 12/1986 Dubois ..... 285/176
4,629,224 A 12/1986 Lanriault
4,630,849 A 12/1986 Fukui et al.
4,632,944 A 12/1986 Thompson
4,634,317 A 1/1987 Skogberg et al. ..... 405/259
4,635,333 A 1/1987 Finch ..... 29/157.4
4,637,436 A 1/1987 Stewart, Jr. et al. ..... 138/89
4,646,787 A 3/1987 Rush et al.
4,649,492 A 3/1987 Sinha et al.
4,651,836 A 3/1987 Richards
4,656,779 A 4/1987 Fedeli
4,660,863 A 4/1987 Bailey et al. ..... 285/145
4,662,446 A 5/1987 Brisco et al. ..... 166/278
4,669,541 A 6/1987 Bissonnette ..... 166/154
4,674,572 A 6/1987 Gallus
4,676,563 A 6/1987 Curlett et al.
4,682,797 A 7/1987 Hildner
4,685,191 A 8/1987 Mueller et al. ..... 29/523
4,685,834 A 8/1987 Jordan
4,693,498 A 9/1987 Baugh et al.
4,711,474 A 12/1987 Patrick
4,714,117 A 12/1987 Dech
4,730,851 A 3/1988 Watts ..... 285/4
4,732,416 A 3/1988 Dearden et al.
4,735,444 A 4/1988 Skipper
4,739,654 A 4/1988 Pilkington et al.
4,739,916 A 4/1988 Ayres et al.
4,754,781 A 7/1988 Putter
4,758,025 A 7/1988 Frick
4,762,344 A 8/1988 Perkins et al.
4,776,394 A 10/1988 Lynde et al.
4,778,088 A 10/1988 Miller
4,779,445 A 10/1988 Rabe
4,793,382 A 12/1988 Szalvay ..... 138/98
4,796,668 A 1/1989 Depret
4,799,544 A 1/1989 Curlett
4,817,710 A 4/1989 Edwards et al. ..... 166/242
4,817,712 A 4/1989 Bodine
4,817,716 A 4/1989 Taylor et al. ..... 166/277
4,822,081 A 4/1989 Blose
4,825,674 A 5/1989 Tanaka et al.
4,826,347 A 5/1989 Baril et al.
4,827,594 A 5/1989 Cartry et al.
4,828,033 A 5/1989 Frison
4,830,109 A 5/1989 Wedel ..... 166/277
4,832,382 A 5/1989 Kapgan 4,836,278 A 6/1989 Stone et al.
4,836,579 A 6/1989 Wester et al.
4,838,349 A 6/1989 Berzin
4,842,082 A 6/1989 Springer
4,848,459 A 7/1989 Blackwell et al.
4,854,338 A 8/1989 Grantham
4,856,592 A 8/1989 Van Bilderbeek et al.
4,865,127 A 9/1989 Koster ..... 166/277
4,871,199 A 10/1989 Ridenour et al.
4,872,253 A 10/1989 Carstensen
4,887,646 A 12/1989 Groves
4,888,975 A 12/1989 Soward et al.
4,892,337 A 1/1990 Gunderson et al.
4,893,658 A 1/1990 Kimura et al.
4,904,136 A 2/1990 Matsumoto
4,907,828 A 3/1990 Change
4,911,237 A 3/1990 Melenyzer
4,913,758 A 4/1990 Koster ..... 156/191
4,915,177 A 4/1990 Claycomb
4,915,426 A 4/1990 Skipper
4,917,409 A 4/1990 Reeves
4,919,989 A 4/1990 Colangelo
4,921,045 A 5/1990 Richardson
4,921,577 A * 5/1990 Eubank ..... 166/311
4,924,949 A 5/1990 Curlett
4,930,573 A 6/1990 Lane et al.
4,934,038 A 6/1990 Caudill
4,934,312 A 6/1990 Koster et al. ..... 118/410
4,938,291 A 7/1990 Lynde et al.
4,941,512 A 7/1990 McParland ..... 138/97
4,941,532 A 7/1990 Hurt et al. ..... 166/216
4,942,925 A 7/1990 Themig
4,942,926 A 7/1990 Lessi
4,949,745 A * 8/1990 McKeon ..... 137/15.09
4,958,691 A 9/1990 Hipp
4,968,184 A 11/1990 Reid ..... 405/225
4,971,152 A 11/1990 Koster et al. ..... 166/277
4,976,322 A 12/1990 Abdrakhmanov et al. ..... 175/57
4,981,250 A 1/1991 Persson ..... 228/107
4,995,464 A 2/1991 Watkins et al.
5,014,779 A 5/1991 Meling et al. ..... 166/55.7
5,015,017 A 5/1991 Geary
5,026,074 A 6/1991 Hoes et al.
5,031,370 A 7/1991 Jewett
5,031,699 A 7/1991 Artynov et al. ..... 166/285
5,040,283 A 8/1991 Pelgrom ..... 29/447
5,044,676 A 9/1991 Burton et al.
5,048,871 A 9/1991 Pfeiffer et al.
5,052,483 A 10/1991 Hudson ..... 166/55
5,059,043 A 10/1991 Kuhne
5,064,004 A 11/1991 Lundel
5,079,837 A 1/1992 Vanselow
5,083,608 A 1/1992 Abdrakhmanov et al. ..... 166/55
5,093,015 A 3/1992 Oldiges
5,095,991 A 3/1992 Milberger
5,097,710 A 3/1992 Palynchuk
5,101,653 A 4/1992 Hermes et al.
5,105,888 A 4/1992 Pollock
5,107,221 A 4/1992 N'Guyen et al. ..... 328/233
5,119,661 A 6/1992 Abdrakhmanov et al. ..... 72/276
5,134,891 A 8/1992 Canevet
5,150,755 A 9/1992 Cassel et al.
5,156,043 A 10/1992 Ose ..... 73/49.8
5,156,213 A 10/1992 George et al.
5,156,223 A 10/1992 Hipp
5,174,340 A 12/1992 Peterson et al.
5,174,376 A 12/1992 Singeetham ..... 166/208
5,180,010 A * 1/1993 Stout et al. ..... 166/212
5,181,571 A 1/1993 Mueller et al.
5,195,583 A 3/1993 Toon et al.
5,197,553 A 3/1993 Leturno ..... 175/57
5,209,600 A 5/1993 Koster ..... 403/344
5,226,492 A 7/1993 Solaeche P. et al. ..... 166/196
5,242,017 A 9/1993 Hailey
5,249,628 A 10/1993 Surjaatmadia
5,253,713 A 10/1993 Gregg et al.
RE34,467 E 12/1993 Reeves
5,273,075 A * 12/1993 Skaer ..... 137/883
5,275,242 A 1/1994 Payne
5,282,508 A 2/1994 Ellingsen et al.
5,286,393 A 2/1994 Oldiges et al.
5,306,101 A 4/1994 Rockower et al.
5,309,621 A 5/1994 ODonnell et al.
5,314,014 A 5/1994 Tucker
5,314,209 A 5/1994 Kuhne
5,318,122 A 6/1994 Murray et al. ..... 166/313
5,318,131 A 6/1994 Baker ..... 166/382
5,325,923 A 7/1994 Surjaatmadja et al. ..... 166/308
5,326,137 A 7/1994 Lorenz et al.
5,327,964 A 7/1994 ODonnell et al.
5,330,850 A 7/1994 Suzuki et al.
5,332,038 A 7/1994 Tapp et al. ..... 166/278
5,332,049 A 7/1994 Tew
5,333,692 A 8/1994 Baugh et al.
5,335,696 A * 8/1994 McKenzie ..... 137/883
5,335,736 A 8/1994 Windsor ..... 175/57
5,337,808 A 8/1994 Graham ..... 166/191
5,337,823 A 8/1994 Nobileau
5,337,827 A 8/1994 Hromas et al.
5,339,894 A 8/1994 Stotler
5,343,949 A 9/1994 Ross et al.
5,346,007 A 9/1994 Dillon et al. ..... 166/254
5,348,087 A 9/1994 Williamson, Jr. ..... 166/115
5,348,093 A 9/1994 Wood et al.
5,348,095 A 9/1994 Worrall et al. ..... 166/380
5,348,668 A 9/1994 Oldiges et al.
5,351,752 A 10/1994 Wood et al.
5,360,239 A 11/1994 Klementich
5,360,292 A 11/1994 Allen et al. ..... 405/249
5,361,836 A 11/1994 Sorem et al.
5,361,843 A 11/1994 Shy et al. ..... 166/297
5,366,010 A 11/1994 Zwart ..... 166/120
5,366,012 A 11/1994 Lohbeck ..... 166/277
5,368,075 A 11/1994 Baro et al.
5,370,425 A 12/1994 Dougherty et al.
5,375,661 A 12/1994 Daneshy et al.
5,388,648 A 2/1995 Jordan, Jr. ..... 166/380
5,390,735 A 2/1995 Williamson, Jr. ..... 166/115
5,390,742 A 2/1995 Dines et al. ..... 166/297
5,396,957 A 3/1995 Surjaatmadja et al. ..... 166/308
5,400,827 A 3/1995 Baro et al.
5,405,171 A 4/1995 Allen et al.
5,411,301 A 5/1995 Moyer et al.
5,413,180 A 5/1995 Ross et al.
5,419,595 A 5/1995 Yamamoto et al.
5,425,559 A 6/1995 Nobileau ..... 285/330
5,426,130 A 6/1995 Thurder et al.
5,431,831 A 7/1995 Vincent
5,435,395 A 7/1995 Connell ..... 166/384
5,439,320 A 8/1995 Abrams ..... 405/154
5,443,129 A 8/1995 Bailey et al.
5,447,201 A 9/1995 Mohn
5,454,419 A 10/1995 Vloedman
5,456,319 A 10/1995 Schmidt et al.
5,458,194 A 10/1995 Brooks
5,462,120 A 10/1995 Gondouin
5,467,822 A 11/1995 Zwart ..... 166/179
5,472,055 A 12/1995 Simson et al. ..... 166/382
5,474,334 A 12/1995 Eppink
5,492,173 A 2/1996 Kilgore et al.
5,494,106 A 2/1996 Gueguen et al. ..... 166/277
5,507,343 A 4/1996 Carlton et al. ..... 166/277
5,511,620 A 4/1996 Baugh et al.
5,524,937 A 6/1996 Sides, III et al.
5,535,824 A 7/1996 Hudson ..... 166/207
5,536,422 A 7/1996 Oldiges et al.

5,540,281 A 7/1996 Round
5,554,244 A 9/1996 Ruggles et al.
5,566,772 A 10/1996 Coone et al.
5,567,335 A 10/1996 Baessler et al.
5,576,485 A 11/1996 Serata
5,584,512 A 12/1996 Carstensen
5,606,792 A 3/1997 Schafer ..... 29/727
5,611,399 A 3/1997 Richard et al.
5,613,557 A 3/1997 Blount et al. ..... 166/277
5,617,918 A 4/1997 Cooksey et al. ..... 166/115
5,642,560 A 7/1997 Tabuchi et al.
5,642,781 A 7/1997 Richard
5,662,180 A 9/1997 Coffman et al.
5,664,327 A 9/1997 Swars ..... 29/888.08
5,667,011 A 9/1997 Gill et al. ..... 166/295
5,667,252 A 9/1997 Schafer et al. ..... 285/15
5,678,609 A 10/1997 Washburn
5,685,369 A 11/1997 Ellis et al. ..... 166/195
5,689,871 A 11/1997 Carstensen
5,695,008 A 12/1997 Bertet et al. ..... 166/187
5,695,009 A 12/1997 Hipp
5,697,442 A 12/1997 Baldridge
5,697,449 A 12/1997 Hennig et al.
5,718,288 A * 2/1998 Bertet et al. ..... 166/287
5,738,146 A 4/1998 Abe
5,743,335 A 4/1998 Bussear
5,749,419 A 5/1998 Coronado et al.
5,749,585 A 5/1998 Lembcke
5,755,895 A 5/1998 Tamehiro et al.
5,775,422 A 7/1998 Wong et al.
5,785,120 A 7/1998 Smalley et al. ..... 166/55
5,787,933 A 8/1998 Russ et al.
5,791,419 A 8/1998 Valisalo ..... 175/53
5,794,702 A 8/1998 Nobileau ..... 166/380
5,797,454 A 8/1998 Hipp
5,829,520 A 11/1998 Johnson ..... 166/250.01
5,829,524 A 11/1998 Flanders et al. ..... 166/277
5,829,797 A 11/1998 Yamamoto et al.
5,833,001 A 11/1998 Song et al. ..... 16/287
5,845,945 A 12/1998 Carstensen
5,849,188 A 12/1998 Voll et al.
5,857,524 A 1/1999 Harris ..... 166/382
5,862,866 A 1/1999 Springer
5,875,851 A 3/1999 Vick, Jr. et al. ..... 166/386
5,885,941 A 3/1999 Sateva et al.
5,895,079 A 4/1999 Carstensen et al.
5,901,789 A 5/1999 Donnelly et al. ..... 166/381
5,918,677 A 7/1999 Head
5,924,745 A 7/1999 Campbell ..... 285/90
5,931,511 A 8/1999 DeLange et al.
5,933,945 A 8/1999 Thomeer et al.
5,944,100 A 8/1999 Hipp
5,944,107 A 8/1999 Ohmer ..... 166/313
5,944,108 A 8/1999 Baugh et al.
5,951,207 A 9/1999 Chen ..... 405/232
5,957,195 A 9/1999 Bailey et al. ..... 166/55
5,964,288 A 10/1999 Leighton et al.
5,971,443 A 10/1999 Noel et al.
5,975,587 A 11/1999 Wood et al.
5,979,560 A 11/1999 Nobileau ..... 166/381
5,984,369 A 11/1999 Crook et al.
5,984,568 A 11/1999 Lohbeck ..... 403/375
6,012,521 A 1/2000 Zunkel et al.
6,012,522 A 1/2000 Donnelly et al. ..... 166/276
6,012,523 A 1/2000 Campbell et al. ..... 166/277
6,012,874 A 1/2000 Groneck et al. ..... 405/239
6,015,012 A 1/2000 Reddick
6,017,168 A 1/2000 Fraser et al. ..... 405/224.4
6,021,850 A 2/2000 Wood et al. ..... 166/380
6,024,181 A 2/2000 Richardson et al.
6,027,145 A 2/2000 Tsuru et al.
6,029,748 A 2/2000 Forsyth et al. ..... 166/380
6,035,954 A 3/2000 Hipp
6,044,906 A 4/2000 Saltel ..... 166/187
6,047,505 A 4/2000 Willow
6,047,774 A 4/2000 Allen
6,050,341 A 4/2000 Metcalf ..... 166/383
6,050,346 A 4/2000 Hipp
6,056,059 A 5/2000 Ohmer ..... 166/313
6,056,324 A 5/2000 Reimert et al.
6,062,324 A 5/2000 Hipp
6,065,500 A 5/2000 Metcalfe ..... 138/118
6,070,671 A 6/2000 Cumming et al. ..... 166/381
6,073,332 A 6/2000 Turner
6,073,692 A 6/2000 Wood et al.
6,073,698 A 6/2000 Schultz et al.
6,074,133 A 6/2000 Kelsey ..... 405/244
6,078,031 A 6/2000 Bliault et al. ..... 219/607
6,079,495 A 6/2000 Ohmer ..... 166/313
6,085,838 A 7/2000 Vercaemer et al. ..... 166/277
6,089,320 A 7/2000 LaGrange ..... 166/313
6,098,717 A 8/2000 Bailey et al. ..... 166/382
6,102,119 A 8/2000 Raines ..... 166/244.1
6,109,355 A 8/2000 Reid ..... 166/380
6,112,818 A 9/2000 Campbell ..... 166/384
6,131,265 A 10/2000 Bird
6,135,208 A * 10/2000 Gano et al. ..... 166/313
6,138,761 A 10/2000 Freeman et al.
6,142,230 A 11/2000 Smalley et al. ..... 166/277
6,148,915 A * 11/2000 Mullen et al. ..... 166/278
6,155,613 A 12/2000 Quadflieg et al.
6,158,785 A 12/2000 Beaulier et al.
6,158,963 A 12/2000 Hollis
6,167,970 B1 1/2001 Stout
6,182,775 B1 2/2001 Hipp
6,183,013 B1 2/2001 Mackenzie et al.
6,183,573 B1 2/2001 Fujiwara et al.
6,196,336 B1 3/2001 Fincher et al.
6,216,509 B1 4/2001 Lotspaih et al.
6,220,306 B1 4/2001 Omura et al.
6,226,855 B1 5/2001 Maine ..... 29/507
6,231,086 B1 5/2001 Tierling
6,237,967 B1 5/2001 Yamamoto et al.
6,250,385 B1 6/2001 Montaron ..... 166/207
6,253,846 B1 7/2001 Nazzai et al.
6,253,850 B1 7/2001 Nazzai et al.
6,263,966 B1 7/2001 Haut et al.
6,263,968 B1 7/2001 Freeman et al. ..... 166/313
6,263,972 B1 7/2001 Richard et al.
6,267,181 B1 7/2001 Rhein-Knudsen et al.
6,273,634 B1 8/2001 Lohbeck
6,275,556 B1 8/2001 Kinney et al.
6,283,211 B1 9/2001 Vloedman ..... 166/277
6,286,558 B1 9/2001 Quigley et al.
6,302,211 B1 10/2001 Nelson et al.
6,311,792 B1 11/2001 Scott et al.
6,315,040 B1 11/2001 Donnelly
6,315,043 B1 11/2001 Farrant et al.
6,318,457 B1 11/2001 Den Boer et al.
6,318,465 B1 11/2001 Coon et al.
6,322,109 B1 11/2001 Campbell et al.
6,325,148 B1 12/2001 Trahan et al.
6,328,113 B1 12/2001 Cook
6,334,351 B1 1/2002 Tsuchiya
6,343,495 B1 2/2002 Cheppe et al.
6,343,657 B1 2/2002 Baugh et al.
6,345,373 B1 2/2002 Chakradhar et al.
6,345,431 B1 2/2002 Greig
6,349,521 B1 2/2002 McKeon et al.
6,354,373 B1 3/2002 Vercaemer et al.
6,390,720 B1 5/2002 LeBegue et al.
6,405,761 B1 6/2002 Shimizu et al.
6,406,063 B1 6/2002 Pfeiffer
6,409,175 B1 6/2002 Evans et al.
6,419,025 B1 7/2002 Lohbeck et al.
6,419,026 B1 7/2002 MacKenzie et al.

6,419,033 B1 7/2002 Hahn et al.
6,419,147 B1 7/2002 Daniel
6,425,444 B1 7/2002 Metcalfe et al.
6,431,277 B1 8/2002 Cox et al.
6,443,247 B1 9/2002 Wardley
6,446,724 B2 9/2002 Baugh et al.
6,447,025 B1 9/2002 Smith
6,450,261 B1 9/2002 Baugh
6,454,013 B1 9/2002 Metcalfe
6,454,024 B1 9/2002 Nackerud
6,457,532 B1 10/2002 Simpson
6,457,533 B1 10/2002 Metcalfe
6,457,749 B1 10/2002 Heijnen
6,460,615 B1 10/2002 Heijnen
6,464,008 B1 10/2002 Roddy et al.
6,464,014 B1 10/2002 Bernat
6,470,966 B2 10/2002 Cook et al.
6,470,996 B1 10/2002 Kyle et al.
6,478,092 B2 11/2002 Voll et al.
6,491,108 B1 12/2002 Slup et al.
6,497,289 B1 12/2002 Cook et al.
6,513,243 B1 2/2003 Bignucolo et al.
6,516,887 B2 2/2003 Nguyen et al.
6,517,126 B1 2/2003 Peterson et al.
6,527,049 B2 3/2003 Metcalfe et al.
6,543,545 B1 4/2003 Chatterji et al.
6,543,552 B1 4/2003 Metcalfe et al.
6,550,539 B2 4/2003 Maguire et al.
6,550,821 B2 4/2003 DeLange et al.
6,557,640 B1 5/2003 Cook et al.
6,557,906 B1 5/2003 Carcagno
6,561,227 B2 5/2003 Cook et al.
6,561,279 B2 5/2003 MacKenzie et al.
6,564,875 B1 5/2003 Bullock
6,568,471 B1 5/2003 Cook et al.
6,568,488 B2 5/2003 Wentworth et al.
6,575,240 B1 * 6/2003 Cook et al. ..... 166/207
6,578,630 B2 6/2003 Simpson et al.
6,585,053 B2 7/2003 Coon
6,585,299 B1 7/2003 Quadflieg et al.
6,591,905 B2 7/2003 Coon
6,598,677 B1 7/2003 MacKenzie et al.
6,598,678 B1 7/2003 Simpson
6,604,763 B1 8/2003 Ring et al.
6,607,220 B2 8/2003 Sivley
6,609,735 B1 8/2003 DeLange et al.
6,619,696 B2 9/2003 Baugh et al.
6,622,797 B2 9/2003 Sivley, IV
6,629,567 B2 10/2003 Lauritzen et al.
6,631,759 B2 10/2003 Cook et al.
6,631,760 B2 10/2003 Cook et al.
6,631,765 B2 10/2003 Baugh et al.
6,631,769 B2 10/2003 Cook et al.
6,634,431 B2 10/2003 Cook et al.
6,640,895 B2 11/2003 Murray
6,640,903 B1 11/2003 Cook et al.
6,648,075 B2 11/2003 Badrak et al.
6,659,509 B2 12/2003 Goto et al.
6,662,876 B2 12/2003 Lauritzen
6,668,937 B1 12/2003 Murray
6,672,759 B2 1/2004 Feger
6,675,841 B2 * 1/2004 Burns ..... 141/59
6,679,328 B2 1/2004 Davis et al.
6,681,862 B2 1/2004 Freeman
6,684,947 B2 2/2004 Cook et al.
6,688,397 B2 2/2004 McClurkin et al.
6,695,012 B1 2/2004 Ring et al.
6,695,065 B2 2/2004 Simpson et al.
6,698,517 B2 3/2004 Simpson
6,701,598 B2 3/2004 Chen et al.
6,702,030 B2 3/2004 Simpson
6,705,395 B2 3/2004 Cook et al.
6,708,767 B2 3/2004 Harrall et al.
6,712,154 B2 3/2004 Cook et al.
6,712,401 B2 3/2004 Coulon et al.
6,719,064 B2 4/2004 Price Smith et al.
6,722,427 B2 4/2004 Gano et al.
6,722,437 B2 4/2004 Vercaemer et al.
6,722,443 B1 4/2004 Metcalfe
6,725,917 B2 4/2004 Metcalfe
6,725,919 B2 4/2004 Cook et al.
6,725,934 B2 4/2004 Coronado et al.
6,725,939 B2 4/2004 Richard
6,732,806 B2 5/2004 Mauldin et al.
6,739,392 B2 5/2004 Cook et al.
6,745,845 B2 6/2004 Cook et al.
6,755,447 B2 6/2004 Galle, Jr. et al.
6,758,278 B2 7/2004 Cook et al.
6,772,841 B2 8/2004 Gano
6,796,380 B2 9/2004 Xu
6,814,147 B2 11/2004 Baugh
6,817,633 B2 11/2004 Brill et al.
6,820,690 B2 11/2004 Vercaemer et al.
6,823,937 B1 11/2004 Cook et al.
6,832,649 B2 12/2004 Bode et al.
6,834,725 B2 12/2004 Whanger et al.
6,843,322 B2 1/2005 Burtner et al.
6,857,473 B2 2/2005 Cook et al.
6,880,632 B2 4/2005 Tom et al.
6,892,819 B2 5/2005 Cook et al.
6,902,000 B2 6/2005 Simpson et al.
6,902,652 B2 6/2005 Heijnen
6,923,261 B2 8/2005 Metcalfe et al.
6,935,429 B2 8/2005 Badrak
6,935,430 B2 8/2005 Harrell et al.
6,966,370 B2 11/2005 Cook et al.
6,976,539 B2 12/2005 Metcalfe et al.
6,976,541 B2 12/2005 Brisco et al.
7,000,953 B2 2/2006 Berghaus
7,007,760 B2 3/2006 Lohbeck
7,021,390 B2 4/2006 Cook et al.
7,036,582 B2 5/2006 Cook et al.
7,044,221 B2 5/2006 Cook et al.
7,048,062 B2 5/2006 Ring et al.
7,066,284 B2 6/2006 Wylie et al.
7,077,211 B2 7/2006 Cook et al.
7,077,213 B2 7/2006 Cook et al.
7,086,475 B2 8/2006 Cook
7,100,685 B2 9/2006 Cook et al.
7,121,337 B2 10/2006 Cook et al.
7,121,352 B2 10/2006 Cook et al.
7,124,821 B2 10/2006 Metcalfe et al.
7,124,823 B2 10/2006 Oosterling
7,124,826 B2 10/2006 Simpson
2001/0002626 A1 6/2001 Frank et al. ..... 175/57
2001/0020532 A1 9/2001 Baugh et al.
2001/0045284 A1 11/2001 Simpson et al.
2001/0045289 A1 11/2001 Cook et al.
2001/0047870 A1 12/2001 Cook et al.
2002/0011339 A1 1/2002 Murray
2002/0014339 A1 2/2002 Ross
2002/0020524 A1 2/2002 Gano
2002/0020531 A1 2/2002 Ohmer
2002/0033261 A1 3/2002 Metcalfe
2002/0060068 A1 5/2002 Cook et al.
2002/0062956 A1 5/2002 Murray et al.
2002/0066576 A1 6/2002 Cook et al.
2002/0066578 A1 6/2002 Broome
2002/0070023 A1 6/2002 Turner et al.
2002/0070031 A1 6/2002 Voll et al.
2002/0079101 A1 6/2002 Baugh et al.
2002/0084070 A1 7/2002 Voll et al.
2002/0092654 A1 7/2002 Coronado et al.
2002/0108756 A1 8/2002 Harrall et al.
2002/0139540 A1 10/2002 Lauritzen
2002/0144822 A1 10/2002 Hackworth et al.

2002/0148612 A1 10/2002 Cook et al.
2002/0185274 A1 12/2002 Simpson et al.
2002/0189816 A1 12/2002 Cook et al.
2002/0195252 A1 12/2002 Maguire et al.
2002/0195256 A1 12/2002 Metcalfe et al.
2003/0024708 A1 2/2003 Ring et al.
2003/0024711 A1 2/2003 Simpson et al.
2003/0034177 A1 2/2003 Chitwood et al.
2003/0042022 A1 3/2003 Lauritzen et al.
2003/0047322 A1 3/2003 Maguire et al.
2003/0047323 A1 3/2003 Jackson et al.
2003/0056991 A1 3/2003 Hahn et al.
2003/0066655 A1 4/2003 Cook et al.
2003/0067166 A1 4/2003 Maguire
2003/0075337 A1 4/2003 Maguire
2003/0075338 A1 4/2003 Sivley
2003/0075339 A1 4/2003 Gano et al.
2003/0094277 A1 5/2003 Cook et al.
2003/0094278 A1 5/2003 Cook et al.
2003/0094279 A1 5/2003 Ring et al.
2003/0098154 A1 5/2003 Cook et al.
2003/0098162 A1 5/2003 Cook
2003/0107217 A1 6/2003 Daigle et al.
2003/0111234 A1 6/2003 McClurkin et al.
2003/0116318 A1 6/2003 Metcalfe
2003/0116325 A1 6/2003 Cook et al.
2003/0121558 A1 7/2003 Cook et al.
2003/0121655 A1 7/2003 Lauritzen et al.
2003/0121669 A1 7/2003 Cook et al.
2003/0140673 A1 7/2003 Marr et al.
2003/0150608 A1 8/2003 Smith, Jr. et al.
2003/0168222 A1 9/2003 Maguire et al.
2003/0173090 A1 9/2003 Cook et al.
2003/0192705 A1 10/2003 Cook et al.
2003/0221841 A1 12/2003 Burtner et al.
2003/0222455 A1 12/2003 Cook et al.
2004/0011534 A1 1/2004 Simonds et al.
2004/0045616 A1 3/2004 Cook et al.
2004/0045718 A1 3/2004 Brisco et al.
2004/0060706 A1 4/2004 Stephenson
2004/0065446 A1 4/2004 Tran et al.
2004/0069499 A1 4/2004 Cook et al.
2004/0112589 A1 6/2004 Cook et al.
2004/0112606 A1 6/2004 Lewis et al.
2004/0118574 A1 6/2004 Cook et al.
2004/0123983 A1 7/2004 Cook et al.
2004/0123988 A1 7/2004 Cook et al.
2004/0129431 A1 7/2004 Jackson
2004/0159446 A1 8/2004 Haugen et al.
2004/0188099 A1 9/2004 Cook et al.
2004/0216873 A1 11/2004 Frost et al.
2004/0221996 A1 11/2004 Burge
2004/0231839 A1 11/2004 Ellington et al.
2004/0231855 A1 11/2004 Cook et al.
2004/0238181 A1 12/2004 Cook et al.
2004/0244968 A1 12/2004 Cook et al.
2004/0262014 A1 12/2004 Cook et al.
2005/0011641 A1 1/2005 Cook et al.
2005/0015963 A1 1/2005 Costa et al.
2005/0028988 A1 2/2005 Cook et al.
2005/0039910 A1 2/2005 Lohbeck
2005/0039928 A1 2/2005 Cook et al.
2005/0045324 A1 3/2005 Cook et al.
2005/0045341 A1 3/2005 Cook et al.
2005/0045342 A1 3/2005 Luke et al.
2005/0056433 A1 3/2005 Ring et al.
2005/0056434 A1 3/2005 Watson et al.
2005/0077051 A1 4/2005 Cook et al.
2005/0081358 A1 4/2005 Cook et al.
2005/0087337 A1 4/2005 Brisco et al.
2005/0098323 A1 5/2005 Cook et al.
2005/0103502 A1 5/2005 Watson et al.
2005/0123639 A1 6/2005 Ring et al.
2005/0133225 A1 6/2005 Oosterling
2005/0138790 A1 6/2005 Cook et al.
2005/0144771 A1 7/2005 Cook et al.
2005/0144772 A1 7/2005 Cook et al.
2005/0144777 A1 7/2005 Cook et al.
2005/0150098 A1 7/2005 Cook et al.
2005/0150660 A1 7/2005 Cook et al.
2005/0161228 A1 7/2005 Cook et al.
2005/0166387 A1 8/2005 Cook et al.
2005/0166388 A1 8/2005 Cook et al.
2005/0173108 A1 8/2005 Cook et al.
2005/0175473 A1 8/2005 Cook et al.
2005/0183863 A1 8/2005 Cook et al.
2005/0205253 A1 9/2005 Cook et al.
2005/0217768 A1 10/2005 Asahi et al.
2005/0217865 A1 10/2005 Ring
2005/0217866 A1 10/2005 Watson et al.
2005/0223535 A1 10/2005 Cook et al.
2005/0224225 A1 10/2005 Cook et al.
2005/0230102 A1 10/2005 Cook et al.
2005/0230103 A1 10/2005 Cook et al.
2005/0230104 A1 10/2005 Cook et al.
2005/0230123 A1 10/2005 Waddell et al.
2005/0236159 A1 10/2005 Costa et al.
2005/0236163 A1 10/2005 Cook et al.
2005/0244578 A1 11/2005 Van Egmond et al.
2005/0246883 A1 11/2005 Alliot et al.
2005/0247453 A1 11/2005 Shuster et al.
2005/0265788 A1 12/2005 Renkema
2005/0269107 A1 12/2005 Cook et al.
2006/0027371 A1 2/2006 Gorrara
2006/0032640 A1 2/2006 Costa et al.
2006/0048948 A1 3/2006 Noel
2006/0054330 A1 3/2006 Metcalfe et al.
2006/0065403 A1 3/2006 Watson et al.
2006/0065406 A1 3/2006 Shuster et al.
2006/0096762 A1 5/2006 Brisco
2006/0102360 A1 5/2006 Brisco et al.
2006/0112768 A1 6/2006 Shuster et al.
2006/0113086 A1 6/2006 Costa et al.
2006/0266527 A1 11/2006 Brisco et al.
2006/0272826 A1 12/2006 Shuster et al.

FOREIGN PATENT DOCUMENTS

AU 2001294802 10/2005
AU 2001283026 7/2006
AU 2002239857 8/2006
AU 2001292695 10/2006
CA 736288 6/1966
CA 771462 11/1967
CA 1171310 7/1984
CA 2292171 6/2000
CA 2298139 8/2000
CA 2234386 3/2003
CA 2414449 9/2006
CA 2289811 1/2007
DE 174521 4/1953
DE 2458188 6/1975
DE 203767 11/1983
DE 233607 A1 3/1986
DE 278517 A1 5/1990
DK 9711306 3/1997
EP 0084940 A1 8/1983
EP 0272511 12/1987
EP 0294264 5/1988
EP 9325799 12/1993
EP 9325800 12/1993
EP 0633391 A2 1/1995
EP 0713953 B1 11/1995
EP 9717524 5/1997
EP 9800626 1/1998
EP 0823534 2/1998

| | | | |
|---|---|---|---|
| EP | 9822690 | | 5/1998 |
| EP | 9849423 | | 11/1998 |
| EP | 0881354 | | 12/1998 |
| EP | 0881359 | | 12/1998 |
| EP | 9906670 | | 2/1999 |
| EP | 9908827 | | 2/1999 |
| EP | 9908828 | | 2/1999 |
| EP | 0899420 | | 3/1999 |
| EP | 9935368 | | 7/1999 |
| EP | 0937861 | | 8/1999 |
| EP | 9943923 | | 9/1999 |
| EP | 0952305 | | 10/1999 |
| EP | 0952306 | | 10/1999 |
| EP | 0001926 | | 1/2000 |
| EP | 0026500 | | 5/2000 |
| EP | 0026501 | | 5/2000 |
| EP | 0046484 | | 8/2000 |
| EP | 1141515 | A | 10/2001 |
| EP | 1152120 | A2 | 11/2001 |
| EP | 1152120 | A3 | 11/2001 |
| EP | 1235972 | A | 9/2002 |
| EP | 1555386 | A1 | 7/2005 |
| FR | 1325596 | | 6/1962 |
| FR | 2583398 | A1 | 12/1986 |
| FR | 9421887 | | 9/1994 |
| FR | 9425655 | | 11/1994 |
| FR | 2771133 | A | 5/1995 |
| FR | 2717855 | A1 | 9/1995 |
| FR | 9601937 | | 1/1996 |
| FR | 9621083 | | 7/1996 |
| FR | 9706346 | | 2/1997 |
| FR | 2741907 | A1 | 6/1997 |
| FR | 9925951 | | 5/1999 |
| FR | 2780751 | | 1/2000 |
| GB | 557823 | | 12/1943 |
| GB | 788150 | | 12/1957 |
| GB | 851096 | | 10/1960 |
| GB | 961750 | | 6/1964 |
| GB | 1000383 | | 10/1965 |
| GB | 1062610 | | 3/1967 |
| GB | 1111536 | | 5/1968 |
| GB | 1448304 | | 9/1976 |
| GB | 1460864 | | 1/1977 |
| GB | 1542847 | | 3/1979 |
| GB | 1563740 | | 3/1980 |
| GB | 8100132 | | 1/1981 |
| GB | 2058877 | A | 4/1981 |
| GB | 2108228 | A | 5/1983 |
| GB | 2115860 | A | 9/1983 |
| GB | 2125876 | A | 3/1984 |
| GB | 2211573 | A | 7/1989 |
| GB | 2216926 | A | 10/1989 |
| GB | 2243191 | A | 10/1991 |
| GB | 9208875 | | 5/1992 |
| GB | 2256910 | A | 12/1992 |
| GB | 2257184 | A | 6/1993 |
| GB | 9637681 | | 11/1996 |
| GB | 2305682 | A | 4/1997 |
| GB | 9717526 | | 5/1997 |
| GB | 9717527 | | 5/1997 |
| GB | 9720130 | | 6/1997 |
| GB | 9721901 | | 6/1997 |
| GB | 2325949 | A | 5/1998 |
| GB | 9826152 | | 6/1998 |
| GB | 2322655 | A | 9/1998 |
| GB | 9842947 | | 10/1998 |
| GB | 2326896 | A | 1/1999 |
| GB | 9902818 | | 1/1999 |
| GB | 2329916 | A | 4/1999 |
| GB | 2329918 | A | 4/1999 |
| GB | 2331103 | A | 5/1999 |
| GB | 9923354 | | 5/1999 |
| GB | 9925524 | | 5/1999 |
| GB | 2336383 | A | 10/1999 |
| GB | 0008301 | | 2/2000 |
| GB | 2355738 | A | 4/2000 |
| GB | 0026502 | | 5/2000 |
| GB | 2343691 | A | 5/2000 |
| GB | 0037767 | | 6/2000 |
| GB | 0037768 | | 6/2000 |
| GB | 0037771 | | 6/2000 |
| GB | 0037772 | | 6/2000 |
| GB | 2344606 | A | 6/2000 |
| GB | 2345308 | A | 7/2000 |
| GB | 2368865 | A | 7/2000 |
| GB | 2346165 | A | 8/2000 |
| GB | 2346632 | A | 8/2000 |
| GB | 2347445 | A | 9/2000 |
| GB | 2347446 | A | 9/2000 |
| GB | 2347950 | A | 9/2000 |
| GB | 2347952 | A | 9/2000 |
| GB | 2348223 | A | 9/2000 |
| GB | 2348657 | A | 10/2000 |
| GB | 2357099 | A | 12/2000 |
| GB | 2356651 | A | 5/2001 |
| GB | 2350137 | B | 8/2001 |
| GB | 2361724 | | 10/2001 |
| GB | 2365898 | A | 2/2002 |
| GB | 2359837 | B | 4/2002 |
| GB | 2370301 | A | 6/2002 |
| GB | 2371064 | A | 7/2002 |
| GB | 2371574 | A | 7/2002 |
| GB | 2373524 | | 9/2002 |
| GB | 2367842 | A | 10/2002 |
| GB | 2374098 | A | 10/2002 |
| GB | 2374622 | A | 10/2002 |
| GB | 2375560 | A | 11/2002 |
| GB | 2380213 | A | 4/2003 |
| GB | 2380503 | A | 4/2003 |
| GB | 2381019 | A | 4/2003 |
| GB | 2343691 | B | 5/2003 |
| GB | 2382364 | A | 5/2003 |
| GB | 2382828 | A | 6/2003 |
| GB | 2344606 | B | 8/2003 |
| GB | 2347950 | B | 8/2003 |
| GB | 2380213 | B | 8/2003 |
| GB | 2380214 | B | 8/2003 |
| GB | 2380215 | B | 8/2003 |
| GB | WO03/064813 | A1 | 8/2003 |
| GB | 2348223 | B | 9/2003 |
| GB | 2347952 | B | 10/2003 |
| GB | 2348657 | B | 10/2003 |
| GB | 2384800 | B | 10/2003 |
| GB | 2384801 | B | 10/2003 |
| GB | 2384802 | B | 10/2003 |
| GB | 2384803 | B | 10/2003 |
| GB | 2384804 | B | 10/2003 |
| GB | 2384805 | B | 10/2003 |
| GB | 2384806 | B | 10/2003 |
| GB | 2387405 | A | 10/2003 |
| GB | 2387861 | A | 10/2003 |
| GB | 2388134 | A | 11/2003 |
| GB | 2388860 | A | 11/2003 |
| GB | 2355738 | B | 12/2003 |
| GB | 2374622 | B | 12/2003 |
| GB | 2388391 | B | 12/2003 |
| GB | 2388392 | B | 12/2003 |
| GB | 2388393 | B | 12/2003 |
| GB | 2388394 | B | 12/2003 |
| GB | 2388395 | B | 12/2003 |
| GB | 2356651 | B | 2/2004 |
| GB | 2368865 | B | 2/2004 |
| GB | 2388860 | B | 2/2004 |
| GB | 2388861 | B | 2/2004 |
| GB | 2388862 | B | 2/2004 |
| GB | 2391886 | A | 2/2004 |

| | | | |
|---|---|---|---|
| GB | 2390628 | B | 3/2004 |
| GB | 2391033 | B | 3/2004 |
| GB | 2392686 | A | 3/2004 |
| GB | 2393199 | A | 3/2004 |
| GB | 2373524 | B | 4/2004 |
| GB | 2390387 | B | 4/2004 |
| GB | 2392686 | B | 4/2004 |
| GB | 2392691 | B | 4/2004 |
| GB | 2391575 | B | 5/2004 |
| GB | 2394979 | A | 5/2004 |
| GB | 2395506 | A | 5/2004 |
| GB | 2392932 | B | 6/2004 |
| GB | 2395734 | A | 6/2004 |
| GB | 2396635 | A | 6/2004 |
| GB | 2396639 | A | 6/2004 |
| GB | 2396640 | A | 6/2004 |
| GB | 2396641 | A | 6/2004 |
| GB | 2396642 | A | 6/2004 |
| GB | 2396643 | A | 6/2004 |
| GB | 2396644 | A | 6/2004 |
| GB | 2396646 | A | 6/2004 |
| GB | 2373468 | B | 7/2004 |
| GB | 2397261 | A | 7/2004 |
| GB | 2397262 | A | 7/2004 |
| GB | 2397263 | A | 7/2004 |
| GB | 2397264 | A | 7/2004 |
| GB | 2397265 | A | 7/2004 |
| GB | 2390622 | B | 8/2004 |
| GB | 2398087 | A | 8/2004 |
| GB | 2398317 | A | 8/2004 |
| GB | 2398318 | A | 8/2004 |
| GB | 2398319 | A | 8/2004 |
| GB | 2398320 | A | 8/2004 |
| GB | 2398321 | A | 8/2004 |
| GB | 2398322 | A | 8/2004 |
| GB | 2398323 | A | 8/2004 |
| GB | 2398326 | A | 8/2004 |
| GB | 2382367 | B | 9/2004 |
| GB | 2396643 | B | 9/2004 |
| GB | 2397261 | B | 9/2004 |
| GB | 2397262 | B | 9/2004 |
| GB | 2397263 | B | 9/2004 |
| GB | 2397264 | B | 9/2004 |
| GB | 2397265 | B | 9/2004 |
| GB | 2399120 | A | 9/2004 |
| GB | 2399579 | A | 9/2004 |
| GB | 2399580 | A | 9/2004 |
| GB | 2399848 | A | 9/2004 |
| GB | 2399849 | A | 9/2004 |
| GB | 2399850 | A | 9/2004 |
| GB | 2384502 | B | 10/2004 |
| GB | 2396644 | B | 10/2004 |
| GB | 2400126 | A | 10/2004 |
| GB | 2400393 | A | 10/2004 |
| GB | 2400624 | A | 10/2004 |
| GB | 2396640 | B | 11/2004 |
| GB | 2396642 | B | 11/2004 |
| GB | 2401136 | A | 11/2004 |
| GB | 2401137 | A | 11/2004 |
| GB | 2401138 | A | 11/2004 |
| GB | 2401630 | A | 11/2004 |
| GB | 2401631 | A | 11/2004 |
| GB | 2401632 | A | 11/2004 |
| GB | 2401633 | A | 11/2004 |
| GB | 2401634 | A | 11/2004 |
| GB | 2401635 | A | 11/2004 |
| GB | 2401636 | A | 11/2004 |
| GB | 2401637 | A | 11/2004 |
| GB | 2401638 | A | 11/2004 |
| GB | 2401639 | A | 11/2004 |
| GB | 2381019 | B | 12/2004 |
| GB | 2382368 | B | 12/2004 |
| GB | 2394979 | B | 12/2004 |
| GB | 2401136 | B | 12/2004 |
| GB | 2401137 | B | 12/2004 |
| GB | 2401138 | B | 12/2004 |
| GB | 2403970 | A | 1/2005 |
| GB | 2403971 | A | 1/2005 |
| GB | 2403972 | A | 1/2005 |
| GB | 2400624 | B | 2/2005 |
| GB | 2404402 | A | 2/2005 |
| GB | 2404676 | A | 2/2005 |
| GB | 2404680 | A | 2/2005 |
| GB | 2384807 | C | 3/2005 |
| GB | 2388134 | B | 3/2005 |
| GB | 2398320 | B | 3/2005 |
| GB | 2398323 | B | 3/2005 |
| GB | 2399120 | B | 3/2005 |
| GB | 2399848 | B | 3/2005 |
| GB | 2399849 | B | 3/2005 |
| GB | 2405893 | A | 3/2005 |
| GB | 2406117 | A | 3/2005 |
| GB | 2406118 | A | 3/2005 |
| GB | 2406119 | A | 3/2005 |
| GB | 2406120 | A | 3/2005 |
| GB | 2406125 | A | 3/2005 |
| GB | 2406126 | A | 3/2005 |
| GB | 2410518 | A | 3/2005 |
| GB | 2406599 | A | 4/2005 |
| GB | 2389597 | B | 5/2005 |
| GB | 2399119 | B | 5/2005 |
| GB | 2399580 | B | 5/2005 |
| GB | 2401630 | B | 5/2005 |
| GB | 2401631 | B | 5/2005 |
| GB | 2401632 | B | 5/2005 |
| GB | 2401633 | B | 5/2005 |
| GB | 2401634 | B | 5/2005 |
| GB | 2401635 | B | 5/2005 |
| GB | 2401636 | B | 5/2005 |
| GB | 2401637 | B | 5/2005 |
| GB | 2401638 | B | 5/2005 |
| GB | 2401639 | B | 5/2005 |
| GB | 2408278 | A | 5/2005 |
| GB | 2399579 | B | 6/2005 |
| GB | 2409216 | A | 6/2005 |
| GB | 2409218 | A | 6/2005 |
| GB | 2401893 | B | 7/2005 |
| GB | 2414749 | A | 7/2005 |
| GB | 2414750 | A | 7/2005 |
| GB | 2414751 | A | 7/2005 |
| GB | 2398326 | B | 8/2005 |
| GB | 2403970 | B | 8/2005 |
| GB | 2403971 | B | 8/2005 |
| GB | 2403972 | B | 8/2005 |
| GB | 2380503 | B | 10/2005 |
| GB | 2382828 | B | 10/2005 |
| GB | 2398317 | B | 10/2005 |
| GB | 2398318 | B | 10/2005 |
| GB | 2398319 | B | 10/2005 |
| GB | 2398321 | B | 10/2005 |
| GB | 2398322 | B | 10/2005 |
| GB | 2412681 | A | 10/2005 |
| GB | 2412682 | A | 10/2005 |
| GB | 2413136 | A | 10/2005 |
| GB | 2414493 | A | 11/2005 |
| GB | 2409217 | B | 12/2005 |
| GB | 2410518 | B | 12/2005 |
| GB | 2415003 | A | 12/2005 |
| GB | 2415219 | A | 12/2005 |
| GB | 2395506 | B | 1/2006 |
| GB | 2412681 | B | 1/2006 |
| GB | 2412682 | B | 1/2006 |
| GB | 2415979 | A | 1/2006 |
| GB | 2415983 | A | 1/2006 |
| GB | 2415987 | A | 1/2006 |
| GB | 2415988 | A | 1/2006 |

| | | | |
|---|---|---|---|
| GB | 2416177 | A | 1/2006 |
| GB | 2416361 | A | 1/2006 |
| GB | 2416556 | A | 2/2006 |
| GB | 2416794 | A | 2/2006 |
| GB | 2416795 | A | 2/2006 |
| GB | 2417273 | A | 2/2006 |
| GB | 2417275 | A | 2/2006 |
| GB | 2418216 | A | 3/2006 |
| GB | 2418217 | A | 3/2006 |
| GB | 2418690 | A | 4/2006 |
| GB | 2418941 | A | 4/2006 |
| GB | 2418942 | A | 4/2006 |
| GB | 2418943 | A | 4/2006 |
| GB | 2418944 | A | 4/2006 |
| GB | 2419907 | A | 5/2006 |
| GB | 2419913 | A | 5/2006 |
| GB | 2400126 | B | 6/2006 |
| GB | 2414749 | B | 6/2006 |
| GB | 2420810 | A | 6/2006 |
| GB | 2421257 | A | 6/2006 |
| GB | 2421258 | A | 6/2006 |
| GB | 2421259 | A | 6/2006 |
| GB | 2421262 | A | 6/2006 |
| GB | 2421529 | A | 6/2006 |
| GB | 2422164 | A | 7/2006 |
| GB | 2406599 | B | 8/2006 |
| GB | 2418690 | B | 8/2006 |
| GB | 2421257 | B | 8/2006 |
| GB | 2421258 | B | 8/2006 |
| GB | 2422859 | A | 8/2006 |
| GB | 2422860 | A | 8/2006 |
| GB | 2423317 | | 8/2006 |
| GB | 2404676 | B | 9/2006 |
| GB | 2414493 | B | 9/2006 |
| GB | 2424077 | A | 9/2006 |
| GB | 2408277 | A | 5/2008 |
| ID | P01.012.197/2005 | | 1/2005 |
| ID | 03.09.044.392/2005 | | 9/2005 |
| ID | 03.09.046.2804/2006 | | 8/2006 |
| IL | 0077431 | A2 | 12/2000 |
| JP | 208458 | | 6/1985 |
| JP | 6475715 | | 3/1989 |
| JP | 102875 | | 4/1995 |
| JP | 11-169975 | | 6/1999 |
| JP | 94068 | | 4/2000 |
| JP | 107870 | | 4/2000 |
| JP | 162192 | | 6/2000 |
| JP | 2001-47161 | | 2/2001 |
| NL | 9001081 | | 12/1991 |
| NL | 0039432 | | 7/2000 |
| RO | 113267 | B1 | 5/1998 |
| RU | 1786241 | A1 | 1/1993 |
| RU | 1804543 | A3 | 3/1993 |
| RU | 1810482 | A1 | 4/1993 |
| RU | 1818459 | A1 | 5/1993 |
| RU | 2016345 | C1 | 7/1994 |
| RU | 1295799 | A1 | 2/1995 |
| RU | 9503476 | | 2/1995 |
| RU | 2039214 | C1 | 7/1995 |
| RU | 2056201 | C1 | 3/1996 |
| RU | 2064357 | C1 | 7/1996 |
| RU | 2068940 | C1 | 11/1996 |
| RU | 2068943 | C1 | 11/1996 |
| RU | 2079633 | C1 | 5/1997 |
| RU | 2083798 | C1 | 7/1997 |
| RU | 2091655 | C1 | 9/1997 |
| RU | 2095179 | C1 | 11/1997 |
| RU | 2105128 | C1 | 2/1998 |
| RU | 2108445 | C1 | 4/1998 |
| RU | 2144128 | C1 | 1/2000 |
| SU | 350833 | | 9/1972 |
| SU | 511468 | | 9/1976 |
| SU | 607950 | | 5/1978 |
| SU | 612004 | | 5/1978 |
| SU | 620582 | | 7/1978 |
| SU | 641070 | | 1/1979 |
| SU | 909114 | | 5/1979 |
| SU | 832049 | | 5/1981 |
| SU | 853089 | | 8/1981 |
| SU | 874952 | | 10/1981 |
| SU | 894169 | | 1/1982 |
| SU | 899850 | | 1/1982 |
| SU | 907220 | | 2/1982 |
| SU | 953172 | | 8/1982 |
| SU | 959878 | | 9/1982 |
| SU | 976019 | | 11/1982 |
| SU | 976020 | | 11/1982 |
| SU | 989038 | | 1/1983 |
| SU | 1002514 | | 3/1983 |
| SU | 1041671 | A | 9/1983 |
| SU | 1051222 | A | 10/1983 |
| SU | 1086118 | A | 4/1984 |
| SU | 1158400 | A | 5/1985 |
| SU | 1212575 | A | 2/1986 |
| SU | 1250637 | A1 | 8/1986 |
| SU | 1324722 | A1 | 7/1987 |
| SU | 1411434 | | 7/1988 |
| SU | 1430498 | A1 | 10/1988 |
| SU | 1432190 | A1 | 10/1988 |
| SU | 9005598 | | 3/1990 |
| SU | 1601330 | A1 | 10/1990 |
| SU | 1627663 | A2 | 2/1991 |
| SU | 1659621 | A1 | 6/1991 |
| SU | 1663179 | A2 | 7/1991 |
| SU | 1663180 | A1 | 7/1991 |
| SU | 1677225 | A1 | 9/1991 |
| SU | 1677248 | A1 | 9/1991 |
| SU | 1686123 | A1 | 10/1991 |
| SU | 1686124 | A1 | 10/1991 |
| SU | 1686125 | A1 | 10/1991 |
| SU | 1698413 | A1 | 12/1991 |
| SU | 1710694 | A | 2/1992 |
| SU | 1730429 | A1 | 4/1992 |
| SU | 1745873 | A1 | 7/1992 |
| SU | 1747673 | A1 | 7/1992 |
| SU | 1749267 | A1 | 7/1992 |
| WO | 9626350 | | 8/1996 |
| WO | WO97/35084 | | 9/1997 |
| WO | 9807957 | | 2/1998 |
| WO | 9809053 | | 3/1998 |
| WO | 9904135 | | 1/1999 |
| WO | 9918328 | | 4/1999 |
| WO | 0004271 | | 1/2000 |
| WO | 0031375 | | 6/2000 |
| WO | WO00/37766 | | 6/2000 |
| WO | 0050727 | | 8/2000 |
| WO | 0050732 | | 8/2000 |
| WO | 0050733 | | 8/2000 |
| WO | WO01/04520 | A1 | 1/2001 |
| WO | WO01/04535 | A1 | 1/2001 |
| WO | WO01/18354 | A1 | 3/2001 |
| WO | WO01/21929 | A1 | 3/2001 |
| WO | WO01/26860 | A1 | 4/2001 |
| WO | WO01/33037 | A1 | 5/2001 |
| WO | WO01/38693 | A1 | 5/2001 |
| WO | WO01/60545 | A1 | 8/2001 |
| WO | WO01/83943 | A1 | 11/2001 |
| WO | WO01/98623 | A1 | 12/2001 |
| WO | WO02/01102 | A1 | 1/2002 |
| WO | WO02/10550 | A1 | 2/2002 |
| WO | WO02/10551 | A1 | 2/2002 |
| WO | WO 02/20941 | A1 | 3/2002 |
| WO | WO02/23007 | A1 | 3/2002 |
| WO | WO02/25059 | A1 | 3/2002 |
| WO | WO02/29199 | A1 | 4/2002 |
| WO | WO02/40825 | A1 | 5/2002 |

| | | | |
|---|---|---|---|
| WO | WO02/095181 | A1 | 5/2002 |
| WO | WO02/053867 | A2 | 7/2002 |
| WO | WO02/053867 | A3 | 7/2002 |
| WO | WO02/059456 | A1 | 8/2002 |
| WO | WO02/066783 | A1 | 8/2002 |
| WO | WO02/068792 | A1 | 9/2002 |
| WO | WO02/073000 | A1 | 9/2002 |
| WO | WO02/075107 | A1 | 9/2002 |
| WO | WO02/077411 | A1 | 10/2002 |
| WO | WO02/081863 | A1 | 10/2002 |
| WO | WO02/081864 | A2 | 10/2002 |
| WO | WO02/086285 | A1 | 10/2002 |
| WO | WO02/086286 | A2 | 10/2002 |
| WO | WO02/090713 | | 11/2002 |
| WO | WO02/095181 | A1 | 11/2002 |
| WO | WO02/103150 | A2 | 12/2002 |
| WO | WO03/004819 | A2 | 1/2003 |
| WO | WO03/004819 | A3 | 1/2003 |
| WO | WO03/004820 | A2 | 1/2003 |
| WO | WO03/004820 | A3 | 1/2003 |
| WO | WO03/008756 | A1 | 1/2003 |
| WO | WO03/012255 | A1 | 2/2003 |
| WO | WO03/016669 | A2 | 2/2003 |
| WO | WO03/016669 | A3 | 2/2003 |
| WO | WO03/023178 | A2 | 3/2003 |
| WO | WO03/023178 | A3 | 3/2003 |
| WO | WO03/023179 | A2 | 3/2003 |
| WO | WO03/023179 | A3 | 3/2003 |
| WO | WO03/029607 | A1 | 4/2003 |
| WO | WO03/029608 | A1 | 4/2003 |
| WO | WO03/036018 | A2 | 5/2003 |
| WO | WO03/042486 | A2 | 5/2003 |
| WO | WO03/042486 | A3 | 5/2003 |
| WO | WO03/042487 | A2 | 5/2003 |
| WO | WO03/042489 | A2 | 5/2003 |
| WO | WO03/048520 | A1 | 6/2003 |
| WO | WO03/048521 | A2 | 6/2003 |
| WO | WO03/055616 | A2 | 7/2003 |
| WO | WO03/058022 | A2 | 7/2003 |
| WO | WO03/058022 | A3 | 7/2003 |
| WO | WO03/059549 | A1 | 7/2003 |
| WO | WO03/069115 A30 | | 8/2003 |
| WO | WO03/071086 | A2 | 8/2003 |
| WO | WO03/071086 | A3 | 8/2003 |
| WO | WO03/078785 | A2 | 9/2003 |
| WO | WO03/078785 | A3 | 9/2003 |
| WO | WO03/086675 | A2 | 10/2003 |
| WO | WO03/086675 | A3 | 10/2003 |
| WO | WO03/089161 | A2 | 10/2003 |
| WO | WO03/089161 | A3 | 10/2003 |
| WO | WO03/093623 | A2 | 11/2003 |
| WO | WO03/093623 | A3 | 11/2003 |
| WO | WO03/102365 | A1 | 12/2003 |
| WO | WO03/104601 | A2 | 12/2003 |
| WO | WO03/104601 | A3 | 12/2003 |
| WO | WO03/106130 | A2 | 12/2003 |
| WO | WO03/106130 | A3 | 12/2003 |
| WO | WO2004/003337 | A1 | 1/2004 |
| WO | WO2004/009950 | A1 | 1/2004 |
| WO | WO2004/010039 | A2 | 1/2004 |
| WO | WO2004/010039 | A3 | 1/2004 |
| WO | WO2004/011776 | A2 | 2/2004 |
| WO | WO2004/011776 | A3 | 2/2004 |
| WO | WO2004/018823 | A2 | 3/2004 |
| WO | WO2004/018823 | A3 | 3/2004 |
| WO | WO2004/018824 | A2 | 3/2004 |
| WO | WO2004/018824 | A3 | 3/2004 |
| WO | WO2004/020895 | A2 | 3/2004 |
| WO | WO2004/020895 | A3 | 3/2004 |
| WO | WO2004/023014 | A2 | 3/2004 |
| WO | WO2004/023014 | A3 | 3/2004 |
| WO | WO2004/026017 | A2 | 4/2004 |
| WO | WO2004/026017 | A3 | 4/2004 |
| WO | WO2004/026073 | A2 | 4/2004 |
| WO | WO2004/026073 | A3 | 4/2004 |
| WO | WO2004/026500 | A2 | 4/2004 |
| WO | WO2004/026500 | A3 | 4/2004 |
| WO | WO2004/027200 | A2 | 4/2004 |
| WO | WO2004/027200 | A3 | 4/2004 |
| WO | WO2004/027204 | A2 | 4/2004 |
| WO | WO2004/027204 | A3 | 4/2004 |
| WO | WO2004/027205 | A2 | 4/2004 |
| WO | WO2004/027205 | A3 | 4/2004 |
| WO | WO2004/027392 | A1 | 4/2004 |
| WO | WO2004/027786 | A2 | 4/2004 |
| WO | WO2004/027786 | A3 | 4/2004 |
| WO | WO2004/053434 | A2 | 6/2004 |
| WO | WO2004/053434 | A3 | 6/2004 |
| WO | WO2004/057715 | A2 | 7/2004 |
| WO | WO2004/057715 | A3 | 7/2004 |
| WO | WO2004/067961 | A2 | 8/2004 |
| WO | WO2004/067961 | A3 | 8/2004 |
| WO | WO2004/072436 | A1 | 8/2004 |
| WO | WO2004/074622 | A2 | 9/2004 |
| WO | WO2004/074622 | A3 | 9/2004 |
| WO | WO2004/076798 | A2 | 9/2004 |
| WO | WO2004/076798 | A3 | 9/2004 |
| WO | WO2004/081346 | A2 | 9/2004 |
| WO | WO2004/083591 | A2 | 9/2004 |
| WO | WO2004/083591 | A3 | 9/2004 |
| WO | WO2004/083592 | A2 | 9/2004 |
| WO | WO2004/083592 | A3 | 9/2004 |
| WO | WO2004/083593 | A2 | 9/2004 |
| WO | WO2004/083594 | A2 | 9/2004 |
| WO | WO2004/083594 | A3 | 9/2004 |
| WO | WO2004/085790 | A2 | 10/2004 |
| WO | WO2004/089608 | A2 | 10/2004 |
| WO | WO2004/092527 | A2 | 10/2004 |
| WO | WO2004/092528 | A2 | 10/2004 |
| WO | WO2004/092528 | A3 | 10/2004 |
| WO | WO2004/092530 | A2 | 10/2004 |
| WO | WO2004/092530 | A3 | 10/2004 |
| WO | WO2004/094766 | A2 | 11/2004 |
| WO | WO2004/094766 | A3 | 11/2004 |
| WO | WO2005/017303 | A2 | 2/2005 |
| WO | WO05/028803 | A2 | 3/2005 |
| WO | WO2005/021921 | A2 | 3/2005 |
| WO | WO2005/021921 | A3 | 3/2005 |
| WO | WO2005/021922 | A2 | 3/2005 |
| WO | WO2005/021922 | A3 | 3/2005 |
| WO | WO2005/024170 | A2 | 3/2005 |
| WO | WO2005/024170 | A3 | 3/2005 |
| WO | WO2005/024171 | A2 | 3/2005 |
| WO | WO2005/071212 | A1 | 4/2005 |
| WO | WO2005/079186 | A2 | 9/2005 |
| WO | WO2005/079186 | A3 | 9/2005 |
| WO | WO2005/081803 | A2 | 9/2005 |
| WO | WO2005/086614 | A2 | 9/2005 |
| WO | WO2006/014333 | A2 | 2/2006 |
| WO | WO2006/020723 | A2 | 2/2006 |
| WO | WO2006/020726 | A2 | 2/2006 |
| WO | WO2006/020734 | A2 | 2/2006 |
| WO | WO2006/020809 | A2 | 2/2006 |
| WO | WO2006/020810 | A2 | 2/2006 |
| WO | WO2006/020810 | A3 | 2/2006 |
| WO | WO2006/020827 | A2 | 2/2006 |
| WO | WO2006/020827 | A3 | 2/2006 |
| WO | WO2006/020913 | A2 | 2/2006 |
| WO | WO2006/020913 | A3 | 2/2006 |
| WO | WO2006/020960 | A2 | 2/2006 |
| WO | WO2006/033720 | A2 | 3/2006 |
| WO | WO2004/089608 | A3 | 7/2006 |
| WO | WO2006/079072 | A2 | 7/2006 |
| WO | WO2006/088743 | A2 | 8/2006 |
| WO | WO2006/102171 | A2 | 9/2006 |

WO WO2006/102556 A2 9/2006

OTHER PUBLICATIONS

Drilling Contractor, "Solid Expandable Tubulars are Enabling Technology" Mar./Aprl. 2001 .(copy not available).
Hart's E & P, "SET Technology: Setting the Standard" Mar. 2002.
Hart's E & P, "An Expanded Horizon" Jim Brock, Lev Ring, Scott Costa, Andrei Filippov. Feb. 2000.
Hart's E & P, "Technology Strategy Breeds Value" Ali Daneshy. May 2004.
Hart's E & P, "Solid Expandable Tubulars Slimwell: Stepping Stone to MonoDiameter" Jun. 2003.
Innovators Chart the Course, Shell Exploration & Production.
"Case Study: Value in Drilling Derived From Application-Specific Technology" Langley, Diane., Oct. 2004.
L'Usine Nouvelle, "Les Tubes Expansibles Changent La Face Du Forage Petrolier" Demoulin, Laurence, No. 2878 . pp. 50-52, 3 Juillet 2003.
Offshore, "Monodiameter Technology Keeps Hole Diameter to TD", Hull, Jennifer., Oct. 2002.
News Release, "Shell and Halliburton Agree to Form Company to Develop and Market Expandable Casing Technology", 1998.
Offshore, "Expandable Tubulars Enable Multilaterals Without Compromise on Hole Size," DeMong, Karl, et al., Jun. 2003.
Offshore Engineer, "From Exotic to Routine- the offshore quickstep" Apr. 2004, pp. 77-83.
Offshore, "Expandable Solid Casing Reduces Telescope Effect," Furlow, William, Aug. 1998, pp. 102 & 140.
Offshore, "Casing Expansion, Test Process Fine Tuned on Ultra-deepwater Well," Furlow, William, Dec. 2000.
Offshore Engineer, "Oilfield Service Trio Target Jules Verne Territory," Von Flater, Rick., Aug. 2001.
Offshore, "Expandable Casing Program Helps Operator Hit TD With Larger Tubulars" Furlow, William, Jan. 2000.
Offshore, "Same Internal Casing Diameter From Surface to TD", Cook, Lance., Jul. 2002.
Oil and Gas Investor, "Straightening the Drilling Curve," Williams, Peggy. Jan. 2003.
Petroleum Engineer International, "Expandable Casing Accesses Remote Reservoirs" Apr. 1999.
New Technology Magazine, "Pipe Dream Reality," Smith, Maurice, Dec. 2003.
Roustabout, "First ever SET Workshop Held in Aberdeen," Oct. 2004.
Roustabout, "Enventure Ready to Rejuvenate the North Sea" Sep. 2004.
EP Journal of Technology, "Solid Expandable Tubulars (SET) Provide Value to Operators Worldwide in a Variety of Applications," Fonlova, Rick, Apr. 2005.
The American Oil & Gas Reporter, "Advances Grow Expandable Applications," Bullock, Michael D., Sep. 2004.
Upstream, "Expandable Tubulars Close in on the Holy Grail of Drilling", Cottrill, Adrian, Jul. 26, 2002.
Oil and Gas, "Shell Drills World's First Monodiameter Weil in South Texas" Sumrow, Mike., Oct. 21, 2002.
World Oil, "Expandables and the Dream of the Monodiameter Well: A Status Report", Fischer, Perry, Jul. 2004.
World Oil, "Well Remediation Using Expandable Cased-Hole Liners", Merritt, Randy et al., Jul. 2002.
World Oil, "How in Situ Expansion Affects Casing and Tubing Properties", Mack, R.D., et al., Jul. 1999. pp. 69-71.
Enventure Global Technology "Expandable Tubular Technology—Drill Deeper, Farther, More Economically" Mark Rivenbark.
Society of Petroleum Engineers, "Addressing Common Drilling Challenges Using Solid Expandable Tubular Technology" Perez-Roca, Eduardo, et al., 2003.
Society of Petroleum Engineers, "Monodiameter Drilling Liner—From Concept to Reality" Dean, Bill, et al. 2003.
Offshore Technology Conference, "Expandable Liner Hangers: Case Histories" Moore, Melvin, J., et al., 2002.
Offshore Technology Conference, "Deepwater Expandable Openhole Liner Case Histories: Learnings Through Field Applications" Grant, Thomas P., et al., 2002.
Offshore Technology Conference, "Realization of the MonoDiameter Well: Evolution of a Game-Changing Technology" Dupal, Kenneth, et al., 2002.
Offshore Technology Conference, "Water Production Reduced Using Solid Expandable Tubular Technology to "Clad" in Fractured Carbonate Formation" van Noort, Roger, et al., 2003.
Offshore Technology Conference, "Overcoming Well Control Challenges with Solid Expandable Tubular Technology" Patin, Michael, et al., 2003.
Offshore Technology Conference, "Expandable Cased-hole Liner Remediates Prolific Gas Well and Minimizes Loss of Production" Buckler Bill, et al., 2002.
Offshore Technology Conference, "Development and Field Testing of Solid Expandable Corrosion Resistant Cased-hole Liners to Boost Gas Production in Corrosive Environments" Siemers Gértjan, et al., 2003.
"Practices for Providing Zonal Isolation in Conjunction with Expandable Casing Jobs-Case Histories" Sanders, T, et al. 2003.
Society of Petroleum Engineers, "Increasing Solid Expandable Tubular Technology Reliability in a Myriad of Downhole Environments", Escobar, C. et al., 2003.
Society of Petroleum Engineers, "Water Production Management—PDO's Successful Application of Expandable Technology", Braas, JCM., et al., 2002.
Society of Petroleum Engineers, "Expandable Tubular Solutions", Filippov, Andrei, et al., 1999.
Society of Petroleum Engineers, "Expandable Liner Hanger Provides Cost-Effective Alternative Solution" Lohoefer, C. Lee, et al., 2000.
Society of Petroleum Engineers, "Solid Expandable Tubular Technology—A Year of Case Histories in the Drilling Environment" Dupal, Kenneth, et al., 2001.
"In-Situ Expansion of Casing and Tubing" Mack, Robert et al.
Society of Petroleum Engineers, "Expandable Tubulars: Field Examples of Application in Well Construction and Remediation" Diagle, Chan, et al., 2000.
AADE Houston Chapter, "Subsidence Remediation—Extending Well Life Through the Use of Solid Expandable Casing Systems" Shepherd, David, et al., Mar. 2001 Conference.
Society of Petroleum Engineers, "Planning the Well Construction Process for the Use of Solid Expandable Casing" DeMong, Karl, et al., 2003.
Enventure Global Technology, "The Development and Applications of Solid Expandable Tubular Technology" Cales, GL., 2003.
Society of Petroleum Engineers, "Installation of Solid Expandable Tubular Systems Through Milled Casing Windows" Waddell, Kevin, et al., 2004.
Society of Petroleum Engineers, "Solid Expandable Tubular Technology in Mature Basins" Blasingame, Kate, et al., 2003.
"Casing Design in Complex Wells: The Use of Expandables and Multilateral Technology to Attack the size Reduction Issue" DeMong, Karl., et al.
"Well Remediation Using Expandable Cased-Hole Liners- Summary of Case Histories"-Merritt, Randy, et al.
Offshore Technology Conference, "Transforming Conventional Wells to Bigbore Completions Using Solid Expandable Tubular Technology" Mohd Nor, Norlizah, et al., 2002.
Society of Petroleum Engineers, "Using Solid Expandable Tubulars for Openhole Water Shutoff" van Noort, Roger, et al., 2002.
Society of Petroleum Engineers, "Case Histories- Drilling and Recompletion Applications Using Solid Expandable Tubular Technology" Campo. Don, et al., 2002.
Society of Petroleum Engineers, "Reaching Deep Reservoir Targets Using Solid Expandable Tubulars" Gusevik Rune, et al., 2002.
Society of Petroleum Engineers, "Breakthroughs Using Solid Expandable Tubulars to Construct Extended Reach Wells" Demond, Karl, et al., 2004.
Deep Offshore Technology Conference "Meeting Economic Challenges of Deepwater Drilling with Expandable-Tubular Technology" Haut, Richard, et al., 1999.

Offshore Technology Conference, "Field Trial Proves Upgrades to Solid Expandable Tubulars" Moore, Melvin, et al., 2002.
"Well Design with Expandable Tubulars Reduces Cost and Increases Success in Deepwater Applications" Dupal, Ken, et al., Deep Shore Technology 2000.
Offshore Technology Conference, "Reducing Non-Productive Time Through the Use of Solid Expandable Tubulars: How to Beat the Curve Through Pre-Planning" Cales, Gerry, et al., 2004.
Offshore Technology Conference, "Three Diverse Applications on Three Continents for a Single Major Operator" Sanders, Tom, et al., 2004.
Offshore Technology Conference,, "Expanding Oil Field Tubulars Through a Window Demonstrates Value and Provides New Well Construction Option" Sparling, Steven, et al., 2004.
Society of Petroleum Engineers, "Advances in Single-diameter Well Technology: The Next Step to Cost-Effective Optimization" Waddell, Kevin, et al., 2004.
Society of Petroleum Engineers, "New Technologies Combine to Reduce Drilling Cost in Ultradeepwater Applications" Touboul, Nicolas, et al., 2004.
Society of Petroleum Engineers, "Solid Expandable Tubular Technology: The Value of Planned Installation vs. Contingency" Rivenbark, Mark, et al., 2004.
Society of Petroleum Engineers, "Changing Safety Paradigms in the Oil and Gas Industry" Ratliff, Matt, et al., 2004.
"Casing Remediation- Extending Well Life Through The Use of Solid Expandable Casing Systems" Merritt, Randy, et al.
Society of Petroleum Engineers, "Window Exit Sidetrack Enhancements Through the Use of Solid Expandable Casing", Rivenbark, Mark, et al., 2004.
"Solid Expandable Tubular Technology: The Value of Planned Installations vs. Contingency", Carstens, Chris, et al.
Data Sheet, "Enventure Cased-Hole Liner (CHL) System" Enventure Global Technology, Dec. 2002.
Case History, "Graham Ranch No. 1 Newark East Barnett Field" Enventure Global Technology, Feb. 2002.
Case History, "K.K. Camel No. 1 Ridge Field Lafayette Parish, Louisiana" Enventure Global Technology, Feb. 2002.
Case History, "Eernskanaal—2 Groningen" Enventure Global Technology, Feb. 2002.
Case History, "Yibal 381 Oman" Enventure Global Technology, Feb. 2002.
Case History, "Mississippi Canyon 809 URSA TLP, OSC-G 5868, No. A-12" Enventure Global Technology, Mar. 2004.
Case History, "Unocal Sequoia Mississippi Canyon 941 Well No. 2" Enventure Global Technology, 2005.
"SET Technology: The Facts" Enventure Global Technology, 2004.
Data Sheet, "Enventure Openhole Liner (OHL) System" Enventure Global Technology, Dec. 2002.
Data Sheet, "Window Exit Applications OHL Window Exit Expansion" Enventure Global Technology, Jun. 2003.
"Expand Your Opportunities." *Enventure*. CD-ROM. Jun. 1999.
"Expand Your Opportunities." *Enventure*, CD-ROM. May 2001.
International Examination Report, Application PCT/US02/25608; Jun. 1, 2005.
International Examination Report, Application PCT/US02/36267, Jan. 4, 2004.
International Examination Report, Application PCT/US02/39418, Feb. 18, 2005.
International Examination Report, Application PCT/US03/04837, Dec. 9, 2004.
International Examination Report, Application PCT/US03/06544, May 10, 2005.
International Examination Report, Application PCT/US03/11765; Dec. 10, 2004.
International Examination Report, Application PCT/US03/11765;; Jan. 25, 2005.
International Examination Report, Application PCT/US03/13787; Apr. 7, 2005.
International Examination Report, Application PCT/US03/13787; Mar. 2, 2005.
International Examination Report, Application PCT/US03/14153; May 12, 2005.
International Examination Report, Application PCT/US03/15020, May 9, 2005.
International Examination Report, Application PCT/US03/25667, May 25, 2005.
International Search Report, Application PCT/US03/25716; Jan. 13, 2005.
International Search Report, Application PCT/US03/25742; Dec. 20, 2004.
International Search Report, Application PCT/US03/29460; May 25, 2004.
International Examination Report, Application PCT/US03/29460; Dec. 8, 2004.
International Examination Report, Application PCT/US03/29858; May 23, 2005.
International Search Report, Application PCT/US03/38550; May 23, 2005.
International Preliminary Report on Patentability, Application PCT/US04/02122; May 13, 2005.
International Preliminary Report on Patentability, Application PCT/US04/04740; Apr. 27, 2005.
International Preliminary Report on Patentability, Application PCT/US04/06246; May 5, 2005.
International Preliminary Report on Patentability, Application PCT/US04/08030; Apr. 7, 2005.
International Preliminary Report on Patentability, Application PCT/US04/08030; Jun. 10, 2005.
International Preliminary Report on Patentability, Application PCT/US04/08073; May 9, 2005.
International Preliminary Report on Patentability, Application PCT/US04/11177;Jun. 9, 2005.
Examination Report to Application No. AU 2001278196 ,Apr. 21, 2005.
Examination Report to Application No. AU 2002237757 ,Apr. 28, 2005.
Examination Report to Application No. AU 2002240366 ,Apr. 13, 2005.
Search Report to Application No. EP 02806451.7; Feb. 9, 2005.
Examination Report to Application No. GB 0225505.7 Feb. 15, 2005.
Examination Report to Application No. GB 0314846.7, Jul. 15, 2004.
Search and Examination Report to Application No. GB 0400018.8; May 17, 2005.
Examination Report to Application No. GB 0400019.6; May 19, 2005.
Examination Report to Application No. GB 0403891.5, Feb. 14, 2005.
Examination Report to Application No. GB 0403893.1, Feb. 14, 2005.
Examination Report to Application No. GB 0403894.9, Feb. 15, 2005.
Examination Report to Application No. GB 0403920.2, Feb. 15, 2005.
Examination Report to Application No. GB 0403921.0, Feb. 15, 2005.
Examination Report to Application No. GB 0404796.5; Apr. 14, 2005.
Examination Report to Application No. GB 0406257.6, Jan. 25, 2005.
Examination Report to Application No. GB 0406258.4; Jan. 12, 2005.
Examination Report to Application No. GB 0408672.4, Mar. 21, 2005.
Examination Report to Application No. GB 0411698.4, Jan. 24, 2005.
Examination Report to Application No. GB 0411892.3, Feb. 21, 2005.
Examination Report to Application No. GB 0412533.2, May 20, 2005.
Search Report to Application No. GB 0415835.8, Dec. 2, 2004.
Search Report to Application No. GB 0415835.8; Mar. 10, 2005.
Examination Report to Application No. 0416625.2 Jan. 20, 2005.
Search and Examination Report to Application No. GB 0416834.0, Nov. 16, 2004.
Examination Report to Application No. GB 0422419.2 Dec. 8, 2004.

Search and Examination Report to Application No. GB 0422893.8 Nov. 24, 2004.
Search and Examination Report to Application No. GB 0425948.7 Apr. 13, 2005.
Search and Examination Report to Application No. GB 0425951.1 Apr. 14, 2005.
Search and Examination Report to Application No. GB 042596.0 Apr. 14, 2005.
Search and Examination Report to Application No. GB 0426155.8 Jan. 12, 2005.
Search and Examination Report to Application No. GB 0426156.6 Jan. 12, 2005.
Search and Examination Report to Application No. GB 0426157.4 Jan. 12, 2005.
Examination Report to Application No. GB 0428141.6 Feb. 9, 2005.
Examination Report to Application No. GB 0500184.7 Feb. 9, 2005.
Search and Examination Report to Application No. GB 0500600.2 Feb. 15, 2005.
Examination Report to Application No. GB 0501667.0 May 27, 2005.
Search and Examination Report to Application No. GB 0503470.7 Mar. 21, 2005.
Search and Examination Report to Application No. GB 0506697.2 May 20, 2005.
Written Opinion to Application No. PCT/US02/25608 Feb. 2, 2005.
Written Opinion to Application No. PCT/US02/39425; Apr. 11, 2005.
Written Opinion to Application No. PCT/US03/06544; Feb. 18, 2005.
Written Opinion to Application No. PCT/US03/25675 May 9, 2005.
Written Opinion to Application No. PCT/US03/29858 Jan. 21, 2004.
Written Opinion to Application No. PCT/US03/38550 Dec. 10, 2004.
Written Opinion to Application No. PCT/US04/08171 May 5, 2005.
Combined Search Report and Written Opinion to Application No. PCT/US04/00631; Mar. 28, 2005.
Combined Search Report and Written Opinion to Application No. PCT/US04/02122 Feb. 24, 2005.
Combined Search Report and Written Opinion to Application No. PCT/US04/04740 Jan. 19, 2005.
Combined Search Report and Written Opinion to Application No. PCT/US04/06246 Jan. 26, 2005.
Combined Search Report and Written Opinion to Application No. PCT/US04/08030 Jan. 6, 2005.
Combined Search Report and Written Opinion to Application No. PCT/US04/08073 Mar. 4, 2005.
Combined Search Report and Written Opinion to Application No. PCT/US04/08170 Jan. 13, 2005.
Combined Search Report and Written Opinion to Application No. PCT/US04/08171 Feb. 16, 2005.
Combined Search Report and Written Opinion to Application No. PCT/US04/11172 Feb. 14, 2005.
Combined Search Report and Written Opinion to Application No. PCT/US04/28438 Mar. 14, 2005.
Adams, "Drilling Engineering: A Complete Well Planning Approach," 1985.
Enventure Global Technology, "SET Technology: The Facts," 2004.
Flatern, "Oilfield Service Trio Target Jules Verne Territory," at http://www.oilonline.com.
Mohawk Energy, :Minimizing Drilling Ecoprints Houston, Dec. 16, 2005.
"Pipeline Rehabilitation by Sliplining with Polyethylene Pipe" 2006.
Rivenbark, "Expandable Tubular Technology—Drill Deeper, Farther, More Economically," Enventure Global Technology.
Tumey, "Letter: IP Analysis" May 6, 2006.
www.RIGZONE.com/news/article.asp?a_id=1755, "Tesco Provides Casing Drilling Operations Update," 2001.
www.RIGZONE.com/news/article.asp?a_id=2603, Conoco and Tesco Unveil Revolutionary Drilling Rig 2002.
International Preliminary Examination Report, Application PCT/US01/28690, Sep. 4, 2003.
International Preliminary Examination Report, Application PCT/US03/15020, May 9, 2005.
International Preliminary Examination Report, Application PCT/US03/15020 (corrected), Nov. 14, 2004.
International Preliminary Report on Patentability, Application PCT/US04/00631, Mar. 2, 2006.
International Preliminary Report on Patentability, Application PCT/US04/04740, Jun. 27, 2006.
International Preliminary Report on Patentability, Application PCT/US04/08030, Jun. 10, 2005.
International Preliminary Report on Patentability, Application PCT/US04/10317, Jun. 23, 2006.
International Preliminary Report on Patentability, Application PCT/US04/028423, Mar. 9, 2006.
International Preliminary Report on Patentability, Application PCT/US04/028423, Jun. 19, 2006.
International Preliminary Report on Patentability, Application PCT/US04/28438, Sep. 20, 2005.
International Preliminary Report on Patentability, Application PCT/US04/28889, Aug. 1, 2006.
Combined Search Report and Written Opinion to Application No. PCT/US04/00631, Mar. 28, 2005.
Combined Search Report and Written Opinion to Application No. PCT/US04/07711, Nov. 28, 2006.
Combined Search Report and Written Opinion to Application No. PCT/US04/10317, May 25, 2006.
Combined Search Report and Written Opinion to Application No. PCT/US04/28831, Dec. 19, 2005.
Combined Search Report and Written Opinion to Application No. PCT/US04/28889, Nov. 14, 2005.
Combined Search Report and Written Opinion to Application No. PCT/US05/28473, Sep. 1, 2006.
Combined Search Report and Written Opinion to Application No. PCT/US05/28642, Jul. 14, 2006.
Combined Search Report and Written Opinion to Application No. PCT/US05/28819, Aug. 3, 2006.
Combined Search Report and Written Opinion to Application No. PCT/US05/28869, Apr. 17, 2006.
Combined Search Report and Written Opinion to Application No. PCT/US06/04809, Aug. 29, 2006.
Combined Search Report and Written Opinion to Application No. PCT/US06/09886, Dec. 4, 2006.
Search Report to Application No. GB 0507980.1, Apr. 24, 2006.
Examination Report to Application No. GB 0219757.2, Oct. 31, 2004.
Examination Report to Application No. GB 03701281.2, Jan. 31, 2006.
Examination Report to Application No. GB 0400019.6, Nov. 4, 2005.
Examination Report to Application No. GB 0406257.6, Mar. 3, 2005.
Examination Report to Application No. GB 0406257.6, Nov. 9, 2005.
Examination Report to Application No. GB 0406257.6, Apr. 28, 2006.
Examination Report to Application No. GB 0406258.4, Dec. 20, 2005.
Examination Report to Application No. GB 0412876.5, Feb. 13, 2006.
Examination Report to Application No. GB 0415835.8, Dec. 23, 2005.
Examination Report to Application No. GB 0422419.2, Nov. 8, 2005.
Examination Report to Application No. GB 0422893.8, Aug. 8, 2005.
Examination Report to Application No. GB 0422893.8, Dec. 15, 2005.
Examination Report to Application No. GB 0425948.7, Nov. 24, 2005.
Examination Report to Application No. GB 0425956.0, Nov. 24, 2005.
Examination Report to Application No. GB 0428141.6, Feb. 21, 2006.
Examination Report to Application No. GB 0428141.6, Jul. 18, 2006.
Examination Report to Application No. GB 0500275.3, Apr. 5, 2006.
Examination Report to Application No. GB 0501667.0, Jan. 27, 2006.
Examination Report to Application No. GB 0503250.3, Nov. 15, 2005.
Examination Report to Application No. GB 0503250.3, Mar. 2, 2006.

Examination Report to Application No. GB 0503250.3, Aug. 11, 2006.
Examination Report to Application No. GB 0506699.8 May 11, 2006.
Examination Report to Application No. GB 0506700.4, May 16, 2006.
Examination Report to Application No. GB 0506702.0, May 11, 2006.
Examination Report to Application No. GB 0506702.0, Jul. 24, 2006.
Examination Report to Application No. GB 0507979.3, Jun. 16, 2005.
Examination Report to Application No. GB 0507979.3, Jan. 17, 2006.
Examination Report to Application No. GB 0507979.3, Jun. 6, 2006.
Examination Report to Application No. GB 0507980.1, Sep. 29, 2005.
Examination Report to Application No. GB 0509618.5, Feb. 3, 2006.
Examination Report to Application No. GB 0509620.1, Feb. 14, 2006.
Examination Report to Application No. GB 0509627.6, Feb. 3, 2006.
Examination Report to Application No. GB 0509629.2, Feb. 3, 2006.
Examination Report to Application No. GB 0509630.0, Feb. 3, 2006.
Examination Report to Application No. GB 0509630.0, May 11, 2006.
Examination Report to Application No. GB 0509630.0, Jun. 6, 2006.
Examination Report to Application No. GB 0509631.8, Feb. 14, 2006.
Examination Report to Application No. GB 0517448.7, Nov. 9, 2005.
Examination Report to Application No. GB 0517448.7, Jul. 19, 2006.
Examination Report to Application No. GB 0518025.2, Oct. 27, 2005.
Examination Report to Application No. GB 0518025.2, May 25, 2006.
Examination Report to Application No. GB 0518039.3, Nov. 29, 2005.
Examination Report to Application No. GB 0518039.3, Aug. 2, 2006.
Examination Report to Application No. GB 0518252.2, Oct. 28, 2005.
Examination Report to Application No. GB 0518252.2, May 25, 2006.
Examination Report to Application No. GB 0518799.2, Nov. 9, 2005.
Examination Report to Application No. GB 0518799.2, Jun. 14, 2006.
Examination Report to Application No. GB 0518893.3, Dec. 16, 2005.
Examination Report to Application No. GB 0518893.3, Jul. 28, 2006.
Examination Report to Application No. GB 0519989.8, Mar. 8, 2006.
Examination Report to Application No. GB 0521024.0, Dec. 22, 2005.
Examination Report to Application No. GB 0521931.6, Nov. 8, 2006.
Examination Report to Application No. GB 0522050.4, Dec. 13, 2005.
Examination Report to Application No. GB 0522892.9, Aug. 14, 2006.
Examination Report to Application No. GB 0602877.3, Mar. 20, 2006.
Examination Report to Application No. GB 0603576.0, Apr. 5, 2006.
Examination Report to Application No. GB 0603576.0, Nov. 9, 2006.
Examination Report to Application No. GB 0603656.0, May 3, 2006.
Examination Report to Application No. GB 0603656.0, Nov. 10, 2006.
Examination Report to Application No. GB 0603995.2, Apr. 25, 2006.
Examination Report to Application No. GB 0603996.0, Apr. 27, 2006.
Examination Report to Application No. GB 0604357.4, Apr. 27, 2006.
Examination Report to Application No. GB 0604359.0, Apr. 27, 2006.
Examination Report to Application No. GB 0604360.8, Apr. 26, 2006.
Search and Examination Report to Application No. GB 0412876.5, Sep. 27, 2005.
Search and Examination Report to Application No. GB 0507980.1, Jun. 20, 2006.
Search and Examination Report to Application No. GB 0516429.8, Nov. 7, 2005.
Search and Examination Report to Application No. GB 0516430.6, Nov. 8, 2005.
Search and Examination Report to Application No. GB 0516431.4, Nov. 8, 2005.
Search and Examination Report to Application No. GB 0522052.0, Aug. 8, 2006.
Search and Examination Report to Application No. GB 0522155.1, Mar. 7, 2006.
Search and Examination Report to Application No. GB 0522892.9 Jan. 5, 2006.
Search and Examination Report to Application No. GB 0523075.0, Jan. 12, 2006.
Search and Examination Report to Application No. GB 0523076.8, Dec. 14, 2005.
Search and Examination Report to Application No. GB 0523078.4, Dec. 13, 2005.
Search and Examination Report to Application No. GB 0523132.9, Jan. 12, 2006.
Search and Examination Report to Application No. GB 0524692.1, Dec. 19, 2005.
Search and Examination Report to Application No. GB 0525768.8, Feb. 3, 2006.
Search and Examination Report to Application No. GB 0525770.4, Feb. 3, 2006.
Search and Examination Report to Application No. GB 0525772.0, Feb. 2, 2006.
Search and Examination Report to Application No. GB 0525774.6, Feb. 2, 2006.
Search and Examination Report to Application No. GB 0602877.3, Sep. 25, 2006.
Search and Examination Report to Application No. GB 0609173.0, Jul. 19, 2006.
Search and Examination Report to Application No. GB 0613405.0, Nov. 2, 2006.
Search and Examination Report to Application No. GB 0613406.8, Nov. 2, 2006.
Examination Report to Application No. AU 2003257878, Jan. 19, 2006.
Examination Report to Application No. AU 2003257878, Jan. 30, 2006.
Examination Report to Application No. AU 2003257881, Jan. 19, 2006.
Examination Report to Application No. AU 2003257881, Jan. 30, 2006.
Examination Report to Application No. AU 2004202805, Jun. 14, 2006.
Examination Report to Application No. AU 2004202809, Jun. 14, 2006.
Examination Report to Application No. AU 2004202812, Jun. 14, 2006.
Examination Report to Application No. AU 2004202813, Jun. 14, 2006.
Examination Report to Application No. AU 2004202815, Jun. 14, 2006.
Search Report to Application No. EP 03071281.2; Nov. 7, 2005.
Search Report to Application No. EP 03071281.2; Nov. 14, 2005.
Search Report to Application No. EP 03723674.2; Nov. 22, 2005.
Search Report to Application No. EP 03723674.2; May 2, 2006.
Search Report to Application No. EP 03728326.4; Mar. 13, 2006.
Search Report to Application No. EP 03728326.4; Apr. 24, 2006.
Search Report to Application No. EP 03752486.5; Feb. 8, 2006.
Examination Report to Application No. EP 03752486.5; Jun. 28, 2006.
Search Report to Application No. EP 03759400.9; Mar. 3, 2006.
Search Report to Application No. EP 03759400.9; Mar. 24, 2006.
Search Report to Application No. EP 03793078.1; Mar. 21, 2006.
Search Report to Application No. EP 03793078.1; Jun. 16, 2006.
Search Report to Application No. Norway 1999 5593, Aug. 20, 2002.

Search Report to Application No. GB 0003251.6, Claims Searched 1-5, Jul. 13, 2000.
Search Report to Application No. GB 0004285.3, Claims Searched 2-3, 8-9, 13-16, Jan. 17, 2001.
Search Report to Application No. GB 0005399.1, Claims Searched 25-29, Feb. 15, 2001.
Search Report to Application No. GB 9930398.4, Claims Searched 1-35, Jun. 27, 2000.
International Search Report, Application No. PCT/US00/30022, Oct. 31, 2000.
International Search Report, Application No. PCT/US01/19014, Jun. 12, 2001.
Power Ultrasonics, "Design and Optimisation of an Ultrasonic Die System For Form" Chris Cheers (1999, 2000).
Research Area—Sheet Metal Forming—Superposition of Vibra; Fraunhofer IWU (2001).
Research Projects;" Analysis of Metal Sheet Formability and It's Factors of Influence" Prof. Dorel Banabic (2003).
www.materialsresources.com, "Low Temperature Bonding of Dissimilar and Hard-to-Bond Materials and Metal-Including.." (2004).
www.tribtech.com. "Trib-gel A Chemical Cold Welding Agent" G R Linzell (Sep. 14, 1999).
www.spurind.com, "Galvanic Protection, Metallurgical Bonds, Custom Fabrication—Spur Industries" (2000).
Lubrication Engineering, "Effect of Micro-Surface Texturing on Breakaway Torque and Blister Formation on Carbon-Graphite Faces in a Mechanical Seal" Philip Guichelaar, Karalyn Folkert, Izhak Etsion, Steven Pride (Aug. 2002).
Surface Technologies Inc., "Improving Tribological Performance of Mechanical Seals by Laser Surface Texturing" Izhak Etsion.
Tribology Transactions "Experimental Investigation of Laser Surface Texturing for Reciprocating Automotive Components" G Ryk, Y Klingerman and I Etsion (2002).
Proceeding of the International Tribology Conference, "Microtexturing of Functional Surfaces for Improving Their Tribological Performance" Henry Haefke, Yvonne Gerbig, Gabriel Dumitru and Valerio Romano (2002).
Sealing Technology, "A laser surface textured hydrostatic mechanical seal" Izhak Etsion and Gregory Halperin (Mar. 2003).
Metalforming Online, "Advanced Laser Texturing Tames Tough Tasks" Harvey Arbuckle.
Tribology Transactions, "A Laser Surface Textured Parallel Thrust Bearing" V. Brizmer, Y. Klingerman and I. Etsion (Mar. 2003).
PT Design, "Scratching the Surface" Todd E. Lizotte (Jun. 1999).
Tribology Transactions, "Friction-Reducing Surface-Texturing in Reciprocating Automotive Components" Aviram Ronen, and Izhak Etsion (2001).
Michigan Metrology "3D Surface Finish Roughness Texture Wear WYKO Veeco" C.A. Brown, PHD; Charles, W.A. Johnsen, S. Chester.
International Search Report, Application PCT/US02/00677, Feb. 24, 2004.
International Search Report, Application PCT/US02/20477; Oct. 31, 2003.
International Search Report, Application PCT/US02/20477; Apr. 6, 2004.
International Search Report, Application PCT/US02/24399; Feb. 27, 2004.
International Search Report, Application PCT/US02/25608; May 24, 2004.
International Search Report, Application PCT/US02/25727; Feb. 19, 2004.
International Search Report, Application PCT/US02/29856, Dec. 16, 2002.
International Search Report, Application PCT/US02/36157; Sep. 29, 2003.
International Search Report, Application PCT/US02/36157; Apr. 14, 2004.
International Search Report, Application PCT/US02/36267; May 21, 2004.
International Search Report, Application PCT/US02/39418, Mar. 24, 2003.
International Search Report, Application PCT/US02/39425, May 28, 2004.
International Search Report, Application PCT/US03/00609, May 20, 2004.
International Search Report, Application PCT/US03/04837, May 28, 2004.
International Search Report, Application PCT/US03/06544, Jun. 9, 2004.
International Search Report, Application PCT/US03/10144; Oct. 31, 2003.
International Search Report, Application PCT/US03/11765; Nov. 13, 2003.
International Search Report, Application PCT/US03/13787; May 28, 2004.
International Search Report, Application PCT/US03/14153; May 28, 2004.
International Search Report, Application PCT/US03/15020; Jul. 30, 2003.
International Search Report, Application PCT/US03/19993; May 24, 2004.
International Search Report, Application PCT/US03/20694; Nov. 12, 2003.
International Search Report, Application PCT/US03/20870; May 24, 2004.
International Search Report, Application PCT/US03/24779; Mar. 3, 2004.
International Search Report, Application PCT/US03/25675; May 25, 2004.
International Search Report, Application PCT/US03/25676; May 17, 2004.
International Search Report, Application PCT/US03/25677; May 21, 2004.
International Search Report, Application PCT/US03/25715; Apr. 9, 2004.
International Search Report, Application PCT/US03/25742; May 27, 2004.
International Search Report, Application PCT/US03/29460; May 25, 2004.
International Search Report, Application PCT/US03/25667; Feb. 26, 2004.
International Search Report, Application PCT/US03/29859; May 21, 2004.
International Search Report, Application PCT/US03/38550; Jun. 15, 2004.
Search and Examination Report to Application No. GB 0004282.0, Jun. 3, 2003.
Search Report to Application No. GB 0004285.3, Jul. 12, 2000.
Search Report to Application No. GB 0004285.3, Jan. 19, 2001.
Examination Report to Application No. GB 0005399.1; Jul. 24, 2000.
Examination Report to Application No. GB 0005399.1; Oct. 14, 2002.
Examination Report to Application No. GB 0013661.4, Nov. 25, 2003.
Search Report to Application No. GB 0013661.4, Oct. 20, 2003.
Examination Report to Application No. GB 0208367.3, Nov. 4, 2003.
Examination Report to Application No. GB 0208367.3, Nov. 17, 2003.
Examination Report to Application No. GB 0208367.3, Jan. 30, 2004.
Examination Report to Application No. GB 0216409.3, Feb. 9, 2004.
Examination Report to Application No. GB 0219757.2, May 10, 2004.
Examination Report to Application No. GB 0300085.8, Nov. 28, 2003.
Examination Report to Application No. GB 030086.6, Dec. 1, 2003.
Search and Examination Report to Application No. GB 0308293.0, Jul. 14, 2003.
Search and Examination Report to Application No. GB 0308294.8, Jul. 14, 2003.
Search and Examination Report to Application No. GB 0308295.5, Jul. 14, 2003.
Search and Examination Report to Application No. GB 0308296.3, Jul. 14, 2003.

Search and Examination Report to Application No. GB 0308297.1, Jul. 2003.
Search and Examination Report to Application No. GB 0308303.7, Jul. 14, 2003.
Examination Report to Application No. GB 0311596.1, May 18, 2004.
Search and Examination Report to Application No. GB 0313406.1, Sep. 3, 2003.
Search and Examination Report to Application No. GB 0316883.8, Nov. 25, 2003.
Search and Examination Report to Application No. GB 0316886.1, Nov. 25, 2003.
Search and Examination Report to Application No. GB 0316887.9, Nov. 25, 2003.
Search and Examination Report to Application No. GB 0318545.1, Sep. 3, 2003.
Search and Examination Report to Application No. GB 0318547.4; Sep. 3, 2003.
Search and Examination Report to Application No. GB 0318549.3; Sep. 3, 2003.
Search and Examination Report to Application No. GB 0318550.1, Sep. 3, 2003.
Search and Examination Report to Application No. GB 0320579.6, Dec. 16, 2003.
Search and Examination Report to Application No. GB 0320580.4, Dec. 17, 2003.
Examination Report to Application No. GB 0320747.9, May 25, 2004.
Search and Examination Report to Application No. GB 0323891.2, Dec. 19, 2003.
Search and Examination Report to Application No. GB 0324172.6, Nov. 4, 2003.
Search and Examination Report to Application No. GB 0324174.2, Nov. 4, 2003.
Search and Examination Report to Application No. GB 0325071.9, Nov. 18, 2003.
Examination Report to Application No. GB 0325071.9, Feb. 2, 2004.
Examination Report to Application No. GB 0325072.7, Feb. 5, 2004.
Search and Examination Report to Application No. GB 0325072.7; Dec. 3, 2003.
Examination Report to Application No. GB 0325072.7; Apr. 13, 2004.
Examination Report to Application No. GB 0404796.5; May 20, 2004.
Search and Examination Report to Application No. GB 0404826.0, Apr. 21, 2004.
Search and Examination Report to Application No. GB 0404828.6, Apr. 21, 2004.
Search and Examination Report to Application No. GB 0404830.2, Apr. 21, 2004.
Search and Examination Report to Application No. GB 0404832.8, Apr. 21, 2004.
Search and Examination Report to Application No. GB 0404833.6, Apr. 21, 2004.
Search and Examination Report to Application No. GB 0404837.7, May 17, 2004.
Search and Examination Report to Application No. GB 0404839.3, May 14, 2004.
Search and Examination Report to Application No. GB 0404842.7, May 14, 2004.
Search and Examination Report to Application No. GB 0404845.0, May 14, 2004.
Search and Examination Report to Application No. GB 0404849.2, May 17, 2004.
Examination Report to Application No. GB 0406258.4, May 20, 2004.
Written Opinion to Application No. PCT/US01/19014; Dec. 10, 2002.
Written Opinion to Application No. PCT/US01/23815; Jul. 25, 2002.
Written Opinion to Application No. PCT/US01/28960; Dec. 2, 2002.
Written Opinion to Application No. PCT/US01/30256; Nov. 11, 2002.
Written Opinion to Application No. PCT/US02/00093; Apr. 21, 2003.
Written Opinion to Application No. PCT/US02/00677; Apr. 17, 2003.
Written Opinion to Application No. PCT/US02/04353; Apr. 11, 2003.
Written Opinion to Application No. PCT/US02/20256; May 9, 2003.
Written Opinion to Application No. PCT/US02/39418; Jun. 9, 2004.
Written Opinion to Application No. PCT/US03/11765 May 11, 2004.
Turcotte and Schubert, Geodynamics (1982) John Wiley & Sons, Inc., pp. 9, 432.
Baker Hughes Incorporated, "EXPatch Expandable Cladding System" (2002).
Baker Hughes Incorporated, "EXPress Expandable Screen System".
High-Tech Wells, "World's First Completion Set Inside Expandable Screen" (2003) Gilmer, J.M., Emerson, A.B.
Baker Hughes Incorporated, "Technical Overview Production Enhancement Technology" (Mar. 10, 2003) Geir Owe Egge.
Baker Hughes Incorporated, "FORMlock Expandable Liner Hangers".
Weatherford Completion Systems, "Expandable Sand Screens" (2002).
Expandable Tubular Technology, "EIS Expandable Isolation Sleeve" (Feb. 2003).
Oilfield Catalog; "Jet-Lok Product Application Description" (Aug. 8, 2003).
International Search Report, Application PCT/US01/04753, Jul. 3, 2001.
International Search Report, Application PCT/IL00/00245, Sep. 18, 2000.
International Search Report, Application PCT/US00/18635, Nov. 24, 2000.
International Search Report, Application PCT/US00/30022, Mar. 27, 2001.
International Search Report, Application PCT/US00/27645, Dec. 29, 2000.
International Search Report, Application PCT/US01/19014, Nov. 23, 2001.
International Search Report, Application PCT/US01/41446, Oct. 30, 2001.
International Search Report, Application PCT/US01/23815, Nov. 16, 2001.
International Search Report, Application PCT/US01/28960, Jan. 22, 2002.
Intenational Search Report, Application PCT/US01/30256, Jan. 3, 2002.
International Search Report, Application PCT/US02/04353, Jun. 24, 2002.
International Search Report, Application PCT/US02/00677, Jul. 17, 2002.
International Search Report, Application PCT/US02/00093, Aug. 6, 2002.
International Search Report, Application PCT/US02/29856, Dec. 16, 2002.
International Search Report, Application PCT/US02/20256, Jan. 3, 2003.
International Search Report, Application PCT/US02/39418, Mar. 24, 2003.
International Search Report, Application PCT/US03/15020; Jul. 30, 2003.
Search Report to Application No. GB 9926450.9, Feb. 28, 2000.
Search Report to Application No. GB 9926449.1, Mar. 27, 2000.
Search Report to Application No. GB 0004285.3, Jul. 12, 2000.
Search Report to Application No. GB 0004282.0, Jul. 31, 2000.
Search Report to Application No. GB 0013661.4, Oct. 20, 2000.
Search Report to Application No. GB 0004282.0 Jan. 15, 2001.
Search Report to Application No. GB 0013661.4, Apr. 17, 2001.
Examination Report to Application No. GB 9926450.9, May 15, 2002.
Search Report to Application No. GB 9926449.1, Jul. 4, 2001.
Search Report to Application No. GB 9926449.1, Sep. 5, 2001.
Search Report to Application No. 1999 5593, Aug. 20, 2002.
Search Report to Application No. GB 0004285.3, Aug. 28, 2002.

Examination Report to Application No. GB 9926450.9, Nov. 22, 2002.
Search Report to Application No. GB 0219757.2, Nov. 25, 2002.
Search Report to Application No. GB 0220872.6, Dec. 5, 2002.
Search Report to Application No. GB 0219757.2, Jan. 20, 2003.
Search Report to Application No. GB 0013661.4, Feb. 19, 2003.
Search Report to Application No. GB 0225505.7, Mar. 5, 2003.
Search Report to Application No. GB 0220872.6, Mar. 13, 2003.
Examination Report to Application No. 0004285.3, Mar. 28, 2003.
Examination Report to Application No. GB 0208367.3, Apr. 4, 2003.
Examination Report to Application No. GB 0212443.6, Apr. 10, 2003.
Search and Examination Report to Application No. GB 0308296.3, Jun. 2, 2003.
Search and Examination Report to Application No. GB 0308297.1, Jun. 2, 2003.
Search and Examination Report to Application No. GB 0308295.5, Jun. 2, 2003.
Search and Examination Report to Application No. GB 0308293.0, Jun. 2, 2003.
Search and Examination Report to Application No. GB 0308294.8, Jun. 2, 2003.
Search and Examination Report to Application No. GB 0308303.7, Jun. 2, 2003.
Search and Examination Report to Application No. GB 0308290.6, Jun. 2, 2003.
Search and Examination Report to Application No. GB 0308299.7, Jun. 2, 2003.
Search and Examination Report to Application No. GB 0308302.9, Jun. 2, 2003.
Search and Examination Report to Application No. GB 0004282.0, Jun. 3, 2003.
Search and Examination Report to Application No. GB 0310757.0, Jun. 12, 2003.
Search and Examination Report to Application No. GB 0310836.2, Jun. 12, 2003.
Search and Examination Report to Application No. GB 0310785.1, Jun. 12, 2003.
Search and Examination Report to Application No. GB 0310759.6, Jun. 12, 2003.
Search and Examination Report to Application No. GB 0310801.6, Jun. 12, 2003.
Search and Examination Report to Application No. GB 0310772.9, Jun. 12, 2003.
Search and Examination Report to Application No. GB 0310795.0, Jun. 12, 2003.
Search and Examination Report to Application No. GB 0310833.9, Jun. 12, 2003.
Search and Examination Report to Application No. GB 0310799.2, Jun. 12, 2003.
Search and Examination Report to Application No. GB 0310797.6, Jun. 12, 2003.
Search and Examination Report to Application No. GB 0310770.3, Jun. 12, 2003.
Search and Examination Report to Application No. GB 0310099.7, Jun. 24, 2003.
Search and Examination Report to Application No. GB 0310104.5, Jun. 24, 2003.
Search and Examination Report to Application No. GB 0310101.1, Jun. 24, 2003.
Search and Examination Report to Application No. GB 0310118.5, Jun. 24, 2003.
Search and Examination Report to Application No. GB 0310090.6, Jun. 24, 2003.
Search and Examination Report to Application No. GB 0225505.7, Jul. 1, 2003.
Examination Report to Application No. GB 0310836.2, Aug. 7, 2003.
Search and Examination Report to Application No. GB 0316883.8, Aug. 14, 2003.
Search and Examination Report to Application No. GB 0316886.1, Aug. 14, 2003.
Search and Examination Report to Application No. GB 0316887.9, Aug. 14, 2003.
International Examination Report, Application PCT/US02/24399, Aug. 6, 2004.
Examination Report, Application PCT/US02/25727; Jul. 7, 2004.
Examination Report, Applicaiton PCT/US03/10144; Jul. 7, 2004.
International Search Report, Application PCT/US03/20870; Sep. 30, 2004.
International Examination Report, Application PCT/US03/25676, Aug. 17, 2004.
International Examination Report, Application PCT/US03/25677, Aug. 17, 2004.
Examination Report to Application GB 0220872.6, Oct. 29, 2004.
Examination Report to Application No. GB 0225505.7, Oct. 27, 2004.
Examination Report to Application No. GB 0306046.4, Sep. 10, 2004.
Examination Report to Application No. GB 0400018.8; Oct. 29, 2004.
Examination Report to Application No. GB 0400019.6; Oct. 29, 2004.
Search and Examination Report to Application No. GB 0404833.6, Aug. 19, 2004.
Examination Report to Application No. GB 0404837.7, Jul. 12, 2004.
Examination Report to Application No. GB 0408672.4, Jul. 12, 2004.
Examination Report to Application No. GB 0404830.2, Aug. 17, 2004.
Search and Examination Report to Application No. GB 0411698.4, Jun. 30, 2004.
Search and Examination Report to Application No. GB 0411892.3, Jul. 14, 2004.
Search and Examination Report to Application No. GB 0411893.3, Jul. 14, 2004.
Search and Examination Report to Application No. GB 0411894.9, Jun. 30, 2004.
Search and Examination Report to Application No. GB 0412190.1, Jul. 22, 2004.
Search and Examination Report to Application No. GB 0412191.9, Jul. 22, 2004.
Search and Examination Report to Application No. GB 0412192.7, Jul. 22, 2004.
Search and Examination Report to Application No. GB 0416834.0, Aug. 11, 2004.
Search and Examination Report to Application No. GB 0417810.9, Aug. 25, 2004.
Search and Examination Report to Application No. GB 0417811.7, Aug. 25, 2004.
Search and Examination Report to Application No. GB 0418005.5, Aug. 25, 2004.
Search and Examination Report to Application No. GB 0418425.5, Sep. 10, 2004.
Search and Examination Report to Application No. GB 0418426.3 Sep. 10, 2004.
Search and Examination Report to Application No. GB 0418427.1 Sep. 10, 2004.
Search and Examination Report to Application No. GB 0418429.7 Sep. 10, 2004.
Search and Examination Report to Application No. GB 0418430.5 Sep. 10, 2004.
Search and Examination Report to Application No. GB 0418431.3 Sep. 10, 2004.
Search and Examination Report to Application No. GB 0418432.1 Sep. 10, 2004.
Search and Examination Report to Application No. GB 0418433.9 Sep. 10, 2004.
Search and Examination Report to Application No. GB 0418439.6 Sep. 10, 2004.
Search and Examination Report to Application No. GB 0418442.0 Sep. 10, 2004.
Search and Examination Report to Application No. GB 0423416.7 Nov. 12, 2004.
Search and Examination Report to Application No. GB 0423417.5 Nov. 12, 2004.
Search and Examination Report to Application No. GB 0423418.3 Nov. 12, 2004.

Written Opinion to Application No. PCT/US02/24399; Apr. 28, 2004.
Written Opinion to Application No. PCT/US02/25608 Sep. 13, 2004.
Written Opinion to Application No. PCT/US02/25675 Nov. 24, 2004.
Written Opinion to Application No. PCT/US02/25727; May 17, 2004.
Written Opinion to Application No. PCT/US02/39425; Nov. 22, 2004.
Written Opinion to Application No. PCT/US03/13787 Nov. 9, 2004.
Written Opinion to Application No. PCT/US03/14153 Sep. 9, 2004.
Written Opinion to Application No. PCT/US03/14153 Nov. 9, 2004.
Written Opinion to Application No. PCT/US03/18530 Sep. 13, 2004.
Written Opinion to Application No. PCT/US03/19993 Oct. 15, 2004.
Arbuckle, "Advanced Laser Texturing Tames Tough Tasks," Metal Forming Metal Forming Magazine.
Brizmer et al., "A Laser Surface Textured Parallel Thrust Bearing," *Tribology Transactions*, 46(3):397-403, 2005.
Duphorne, "Letter Re: Enventure Claims of Baker Infringement of Enventure's Expandable Patents," Apr. 1, 2005.
Egge, "Technical Overview Production Enhancement Technology," Baker Hughes, Mar. 10, 2003.
"EIS Expandable Isolation Sleeve" *Expandable Tubular Technology*, Feb. 2003.
Enventure Global Technology, Solid Expandable Tubulars are Enabling Technology, *Drilling Contractor*, Mar.-Apr. 2001.
Etsion, "Improving Tribological Performance of Mechanical Seals by Laser Surface Texturing," *Surface Technologies, LTD*.
Etsion, "A Laser Surface Textured Hydrostatic Mechanical Seal," *Sealing Technology*, Mar. 2003.
"Expandable Sand Screens," *Weatherford Completion Systems*, 2002.
Fontova, "Solid Expandable Tubulars (SET) Provide Value to Operators Worldwide in a Variety of Applications," *EP Journal of Technology*, Apr. 2005.
Fraunhofer IWU, "Research Area: Sheet Metal Forming—Superposition of Vibrations," 2001.
Gilmer et al., "World's First Completion Set Inside Expandable Screen," *High-Tech Wells*, 2003.
Guichelaar et al., "Effect of Micro-Surface Texturing on Breakaway Torque and Blister Formation on Carbon-Graphite Faces in a Mechanical Seal," *Lubrication Engineering*, Aug. 2002.
Haefke et al., "Microtexturing of Functional Surfaces for Improving Their Tribological Performance," *Proceedings of the International Tribology Conference*, 2000.
Halliburton Completion Products, 1996.
Linzell, "Trib-Gel A Chemical Cold Welding Agent," 1999.
Lizotte, "Scratching The Surface," *PT Design*, Jun. 1999.
Power Ultrasonics, "Design and Optimisation of An Ultrasonic Die System For Forming Metal Cans," 1999.
Ratliff, "Changing Safety Paradigms in the Oil and Gas Industry," *Society of Petroleum Engineers*, SPE 90828, 2004.
Ronen et al., "Friction-Reducing Surface-Texturing in Reciprocating Automotive Components," *Tribology Transactions*, 44(3):359-366, 2001.
Rky et al., "Experimental Investigation of Laser Surface Texturing for Reciprocating Automotive Components," *Tribology Transactions*, 45(4):444-449, 2002.
Turcotte et al., "Geodynamics Applications of Continuum Physics to Geological Problems," 1982.
Von Flatern, "From Exotic to Routine—the Offshore Quick-step," *Offshore Engineer*, Apr. 2004.
Von Flatern, "Oilfield Service Trio Target Jules Verne Territory," *Offshore Engineer*, Aug. 2001.
www.JETLUBE.com, "Oilfield Catalog—Jet-Lok Product Application Descriptions," 1998.
www.MATERIALSRESOURCES.com, "Low Temperature Bonding of Dissimilar and Hard-to-Bond Materials and Metals Including," 2004.
www.MITCHMET.com "3d Surface Texture Parameters," 2004.
www.SPURIND.com, "Glavanic Protection, Metallurgical Bonds, Custom Fabrications—Spur Industries," 2000.
International Preliminary Examination Report, Application PCT/US03/11765, Jul. 18, 2005.
International Preliminary Examination Report, Application PCT/US01/11765, Aug. 15, 2005.
International Preliminary Examination Report, Application PCT/US03/20870, Sep. 30, 2004.
International Preliminary Examination Report, Application PCT/US03/25675, Aug. 30, 2005.
International Preliminary Examination Report, Application PCT/US03/25742, Dec. 20, 2004.
International Preliminary Examination Report, Application PCT/US03/38550, May 23, 2005.
International Preliminary Report on Patentability, Application PCT/US04/08171, Sep. 13, 2005.
International Preliminary Report on Patentability, Application PCT/US04/28438, Sep. 20, 2005.
Combined Search Report and Written Opinion to Application No. PCT/US04/11973, Sep. 27, 2005.
Combined Search Report and Written Opinion to Application No. PCT/US04/28423, Jul. 13, 2005.
Search Report to Application No. GB 0415835.8, Dec. 2, 2004.
Search Report to Application No. GB 0415835.8, Mar. 10, 2005.
Examination Report to Application No. GB 0316883.8, Nov. 25, 2003.
Examination Report to Application No. GB 0316886.1, Nov. 25, 2003.
Examination Report to Application No. GB 0316887.9, Nov. 25, 2003.
Examination Report to Application No. GB 0406257.6, Jun. 16, 2005.
Examination Report to Application No. GB 0406257.6, Sep. 2, 2005.
Examination Report to Application No. GB 0406258.4, Jul. 27, 2005
Examination Report to Application No. GB 0408672.4, Mar. 21, 2005.
Examination Report to Application No. GB 0411698.4, Jan. 24, 2005.
Examination Report to Application No. GB 0412533.2, May 20, 2005.
Examination Report to Application No. GB 0416834.0, Nov. 16, 2004.
Examination Report to Application No. GB 0500184.7, Sep. 12, 2005.
Examination Report to Application No. GB 0500600.2, Sep. 6, 2005.
Examination Report to Application No. GB 0507979.3, Jun. 16, 2005.
Search and Examination Report to Application No. GB 0505039.8, Jul. 22, 2005.
Search and Examination Report to Application No. GB 0506700.4, Sep. 20, 2005.
Search and Examination Report to Application No. GB 0509618.5, Sep. 27, 2005.
Search and Examination Report to Application No. GB 0509620.1, Sep. 27, 2005.
Search and Examination Report to Application No. GB 0509626.8, Sep. 27, 2005.
Search and Examination Report to Application No. GB 0509627.6, Sep. 27, 2005.
Search and Examination Report to Application No. GB 0509629.2, Sep. 27, 2005.
Search and Examination Report to Application No. GB 0509630.0, Sep. 27, 2005.
Search and Examination Report to Application No. GB 0509631.8, Sep. 27, 2005.
Search and Examination Report to Application No. GB 0512396.3, Jul. 26, 2005.
Search and Examination Report to Application No. GB 0512398.9, Jul. 27, 2005.
Search Report to Application No. Norway 1999 5593, Aug. 20, 2002.

* cited by examiner

FLOW CONTROL SYSTEM FOR AN APPARATUS FOR RADIALLY EXPANDING TUBULAR MEMBERS

CROSS REFERENCE TO RELATED APPLICATIONS

This application is a division of U.S. patent application Ser. No. 09/512,895, filed on Feb. 24, 2000, (now U.S. Pat. No. 6,568,471) which claimed the benefit of the filing date of (1) U.S. Provisional Patent Application Ser. No. 60/121,841, filed on Feb. 26, 1999 and (2) U.S. Provisional Patent Application Ser. No. 60/154,047, filed on Sep. 16, 1999, the disclosures of which are incorporated herein by reference.

This application is related to the following applications: (1) U.S. patent application Ser. No. 09/440,338, filed on Nov. 15, 1999, which issued as U.S. Pat. No. 6,328,113, which claimed the benefit of the filing date of U.S. Provisional patent Application Ser. No. 60/108,558, filed on Nov. 16, 1998, (2) U.S. Pat. No. 6,497,289 which was filed as U.S. patent application Ser. No. 09/454,139, filed on Dec. 3, 1999, which claimed the benefit of the filing date of U.S. Provisional Patent Application Ser. No. 60/111,293, filed on Dec. 7, 1998, (3) U.S. patent application Ser. No. 09/502,350, filed on Feb. 10, 2000, which claimed the benefit of the filing date of U.S. Provisional Patent Application Ser. No. 60/119,611, filed on Feb. 11, 1999, (4) U.S. patent application Ser. No. 09/510,913, filed on Feb. 23, 2000, which claimed the benefit of the filing date of U.S. Provisional Patent Application Ser. No. 60/121,702, filed on Feb. 25, 1999, (5) U.S. Pat. No. 6,575,240, which was filed as U.S. patent application Ser. No. 09/511,941, filed on Feb. 24, 2000, which claimed the benefit of the filing date of U.S. Provisional Patent Application No. 60/121,907, filed on Feb. 26, 1999, (6) U.S. Pat. No. 6,640,903 which was filed as U.S. patent application Ser. No. 09/523,468, which claimed priority to U.S. Provisional Patent Application Ser. No. 60/124,042, filed on Mar. 11, 1999, (7) U.S. Pat. No. 6,604,763, which was filed as application Ser. No. 09/559,122, filed on Apr. 26, 2000, which claims priority from U.S. Provisional Patent Application Ser. No. 60/131,106, filed on Apr. 26, 1999, (8) U.S. Pat. No. 6,557,640, which was filed as patent application Ser. No. 09/588,946, filed on Jun. 7, 2000, which claims prionty from U.S. Provisional Patent Application Ser. No. 60/137,998, filed on Jun. 7, 1999, (9) U.S. Provisional Patent Application Ser. No. 60/143,039, filed on Jul. 9, 1999, and (10) U.S. patent application Ser. No. 10/030,593, filed on Jan. 8, 2002, which claims priority from U.S. Provisional Patent Application Ser. No. 60/146,203, filed on Jul. 29, 1999.

This application is related to the following applications: (1) U.S. Pat. No. 6,497,289, which was filed as U.S. patent Application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application 60/121,702, filed on Feb. 25, 1999, (3) U.S. patent application Ser. No. 09/502,350, filed on Feb. 10, 2000, which claims priority from provisional application 60/119,611, filed on Feb. 11, 1999, (4) U.S. Pat. No. 6,328,113, which was filed as U.S. patent application Ser. No. 09/440.338, filed on Nov. 15, 1999, which claims priority from provisional application 60/108,558, filed on Nov. 16, 1998, (5) U.S. patent application Ser. No. 10/169,434, filed on Jul. 1, 2002, which claims priority from provisional application 60/183,546, filed on Feb. 18, 2000, (6) U.S. Pat. No. 6,640,903 which was filed as U.S. patent application Ser. No. 09/523,468, filed on Mar. 10, 2000, which claims priority from provisional application 60/124,042, filed on Mar. 11, 1999, (7) U.S. Pat. No. 6,568,471, which was filed as patent application Ser. No. 09/512.895, filed on Feb. 24, 2000, which claims priority from provisional application 60/121,841, filed on Feb. 26, 1999, (8) U.S. Pat. No. 6,575,240, which was filed as patent application Ser. No. 09/511,941, filed on Feb. 24, 2000, which claims priority from provisional application 60/121,907, filed on Feb. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. patent application Ser. No. 09/981,916, filed on Oct. 18, 2001 as a continuation-in-part application of U.S. Pat. No. 6,328,113, which was filed as U.S. patent application Ser. No. 09/440,338, filed on Nov. 15, 1999, which claims Priority from provisional application 60/108,558, filed on Nov. 16, 1998, (11) U.S. Pat. No. 6,604,763, which was filed as application Ser. No. 09/559,122, filed on Apr. 26, 2000, which claims priority from provisional application 60/131,106, filed on Apr. 26, 1999, (12) U.S. patent application Ser. No. 10/030,593, filed on Jan. 8, 2002, which claims priority from provisional application 60/146,203, filed on Jul. 29, 1999, (13) U.S. provisional Patent application Ser. No. 60/143,039, filed on Jul. 9, 1999, (14) U.S. patent application Ser. No. 10/111,982, filed on Apr. 30, 2002, which claims priority from provisional patent application Ser. No. 60/162,671, filed on Nov. 1, 1999, (15) U.S. provisional patent application Ser. No. 60/154,047, filed on Sep. 16, 1999, (16) U.S. provisional patent application Ser. No. 60/438,828, filed on Jan. 9, 2003, (17) U.S. Pat. No. 6,564,875, which was filed as application Ser. No. 09/679,907, on Oct. 5, 2000, which claims priority from provisional patent application Ser. No. 60/159,082, filed on Oct. 12, 1999, (18) U.S. patent application Ser. No. 10/089,419, filed on Mar. 27, 2002, which claims priority from provisional patent application Ser. No. 60/159,039, filed on Oct. 12, 1999, (19) U.S. patent application Ser. No. 09/679,906, filed on Oct. 5, 2000, which claims priority from provisional patent application Ser. No. 60/159,033, filed on Oct. 12, 1999, (20) U.S. patent application Ser. No. 10/303,992, filed on Nov. 22, 2002, which claims priority from provisional patent application Ser. No. 60/212,359, filed on Jun. 19, 2000, (21) U.S. provisional patent application Ser. No. 60/165,228, filed on Nov. 12, 1999, (22) U.S. provisional patent application Ser. No. 60/455,051, filed on Mar. 14, 2003, (23) PCT application US02/2477, filed on Jun. 26, 2002, which claims priority from U.S. provisional patent application Ser. No. 60/303,711, filed on Jul. 6, 2001, (24) U.S. patent application Ser. No. 10/311,412, filed on Dec. 12, 2002, which claims priority from provisional patent application Ser. No. 60/221,443, filed on Jul. 28, 2000, (25) U.S. patent application Ser. No. 10/322,947, filed on Dec. 18, 2002, which claims priority from provisional patent application Ser. No. 60/221,645, filed on Jul. 28, 2000, (26) U.S. patent application Ser. No. 10/322,947, filed on Jan. 22, 2003, which claims priority from provisional patent application Ser. No. 60/233,638, filed on Sep. 18, 2000, (27) U.S. patent application Ser. No. 10/406,648, filed on Mar. 31, 2003, which claims priority from provisional patent application Ser. No. 60/237,334, filed on Oct. 2, 2000, (28) PCT application US02/04353, filed on Feb. 14, 2002, which claims priority from U.S. provisional patent application Ser. No. 60/270,007, filed on Feb. 20, 2001, (29) U.S. patent application Ser. No. 10/465,835, filed on Jun. 13, 2003, which claims priority from provisional patent application Ser. No. 60/262,434, filed on Jan. 17, 2001, (30) U.S. patent application Ser. No. 10/465,831, filed on Jun. 13, 2003, which claims pnority from U.S. provisional patent application Ser. No. 60/259,486, filed on Jan. 3, 2001, (31) U.S. provisional patent application Ser. No. 60/452,303, filed on Mar. 5, 2003, (32) U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (33) U.S. Pat. No. 6,561,227, which was filed as patent application Ser. No. 09/852,026, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (34) U.S. patent application Ser. No. 09/852,027, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (35) PCT Application US02/25608, filed on Aug. 13, 2002, which claims priority from provisional application 60/318,021, filed on Sep. 7, 2001, (36) PCT Application US02/24399, filed on Aug. 1, 2002, which claims priority from U.S. provisional patent application Ser. No. 60/313,453, filed on Aug. 20, 2001, (37) PCT Application US02/29856, filed on Sep. 19, 2002, which claims priority from U.S. provisional patent application Ser. No. 60/326,886, filed on Oct. 3, 2001, (38) PCT Application US02/20256, filed on Jun. 26, 2002, which claims priority from U.S. provisional patent application Ser. No. 60/303,740, filed on Jul. 6, 2001, (39) U.S. patent application Ser. No. 09/962,469, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (40) U.S. patent application Ser. No. 09/962,470, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (41) U.S. patent application Ser. No. 09/962,471, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims Priority from provisional application 60/124,042, filed on Mar. 11, 1999, (42) U.S. patent application Ser. No. 09/962,467, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (43) U.S. patent application Ser. No. 09/962,468, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (44) PCT application US 02/25727, filed on Aug. 14, 2002, which claims Priority from U.S. provisional patent application Ser. No. 60/317,985, filed on Sep. 6, 2001, and U.S. provisional patent application Ser. No. 60/318,386, filed on Sep. 10, 2001, (45) PCT application US 02/39425, filed on Dec. 10, 2002, which claims priority from U.S. provisional patent application Ser. No. 60/343,674, filed on Dec. 27, 2001, (46) U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (47) U.S. utility patent application Ser. No. 10/516,467, filed on Dec. 10, 2001, which is a continuation application of U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (48) PCT application US 03/00609, filed on Jan. 9, 2003, which claims priority from U.S. provisional patent application Ser. No. 60/357,372, filed on Feb. 15, 2002, (49) U.S. patent application Ser. No. 10/074,703, filed on Feb. 12, 2002, which is a divisional of U.S. Pat. No. 6,568,471, which was filed as patent application Ser. No. 09/512,895, filed on Feb. 24, 2000, which claims Priority from provisional application 60/121,841, filed on Feb. 26, 1999, (50) U.S. patent application Ser. No. 10/074,244, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (52) U.S. patent application Ser. No. 10/076,661, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (53) U.S. patent application Ser. No. 10/076,659, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (54) U.S. patent application Ser. No. 10/078,928, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (55) U.S. patent application Ser. No. 10/078,922, filed on Feb. 20, 2002, which is a divisional of U.S. Pat. No. 6,568,471, which was filed as patent application Ser. No. 09/512,895, filed on Feb. 24, 2000, which claims Priority from provisional application 60/121,841, filed on Feb. 26, 1999, (56) U.S. patent application Ser. No. 10/078,921, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (57) U.S. patent application Ser. No. 10/261,928, filed on Oct. 1, 2002, which is a divisional of U.S. Pat. No. 6,557,640, which was filed as patent application Ser. No. 09/588,946, filed on Jun. 7, 2000, which claims prionty from provisional application 60/137,998, filed on Jun. 7, 1999, (58) U.S. patent application Ser. No. 10/079,276, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (59) U.S. patent application Ser. No. 10/262,009, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (60) U.S. patent application Ser. No. 10/092,481, filed on Mar. 7, 2002, which is a divisional of U.S. Pat. No. 6,568,471, which was filed as patent application Ser. No. 09/512,895, filed on Feb. 24, 2000, which claims prionty from provisional application 60/121,841, filed on Feb. 26, 1999, (61) U.S. patent application Ser. No. 10/261,926, filed on Oct. 1, 2002, which is a divisional of U.S. Pat. No. 6,557,640, which was filed as patent application Ser. No. 09/588,946, filed on Jun. 7, 2000, which claims Priority from provisional application 60/137,998, filed on Jun. 7, 1999, (62) PCT application US 02/36157, filed on Nov. 12, 2002, which claims priority from U.S. provisional patent application Ser. No. 60/338,996, filed on Nov. 12, 2001, (63) PCT application US 02/36267, filed on Nov. 12, 2002, which claims priority from U.S. provisional patent application Ser. No. 60/339,013, filed on Nov. 12, 2001, (64) PCT application US 03/11765, filed on Apr. 16, 2003, which claims Priority from U.S. provisional patent application Ser. No. 60/383,917, filed on May 29, 2002, (65) PCT application US 03/15020, filed on May 12, 2003, which claims priority from U.S. provisional patent application Ser. No. 60/391,703, filed on Jun. 26, 2002, (66) PCT application US 02/39418, filed on Dec. 10, 2002, which claims priority from U.S. provisional patent application Ser. No. 60/346,309, filed on Jan. 7, 2002, (67) PCT application US 03/06544, filed on Mar. 4, 2003, which claims priority from U.S. provisional patent application Ser. No. 60/372,048, filed on Apr. 12, 2002, (68) U.S. patent application Ser. No. 10/331,718, filed on Dec. 30, 2002, which is a divisional U.S. patent application Ser. No. 09/679,906, filed on Oct. 5, 2000, which claims priority from provisional patent application Ser. No. 60/159,033, filed on Oct. 12, 1999, (69) PCT application US 03/04837, filed on Feb. 29, 2003, which claims priority from U.S. provisional patent application Ser. No. 60/363,829, filed on Mar. 13, 2002, (70) U.S. patent application Ser. No. 10/261,927, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (71) U.S. patent application Ser. No. 10/262,008, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (72) U.S. patent application Ser. No. 10/261,925, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (73) U.S. patent application Ser. No. 10/199,524, filed on Jul. 19, 2002, which is a continuation of U.S. Pat. No. 6,497,289, which was filed as U.S. patent application Ser. No. 09/454,139, filed on Dec. 3, 1999, which claims priority from provisional application 60/111,293, filed on Dec. 7, 1998, (74) PCT application US 03/10144, filed on Mar. 28, 2003, which claims priority from U.S. provisional patent application Ser. No. 60/372,632, filed on Apr. 15, 2002, (75) U.S. provisional patent application Ser. No. 60/412,542, filed on Sep. 20, 2002, (76) PCT application US 03/14153, filed on May 6, 2003, which claims priority from U.S. provisional patent application Ser. No. 60/380,147, filed on May 6, 2002, (77) PCT application US 03/19993, filed on Jun. 24, 2003, which claims priority from U.S. provisional patent application Ser. No. 60/397,284, filed on Jul. 19, 2002, (78) PCT application US 03/13787, filed on May 5, 2003, which claims priority from U.S. provisional patent application Ser. No. 60/387,486, filed on Jun. 10, 2002, (79) PCT application US 03/18530, filed on Jun. 11, 2003, which claims priority from U.S. provisional patent application Ser. No. 60/387,961, filed on Jun. 12, 2002, (80) PCT application US 03/20694, filed on Jul. 1, 2003, which claims priority from U.S. provisional patent application Ser. No. 60/398,061, filed on Jul. 24, 2002, (81) PCT application US 03/20870, filed on Jul. 2, 2003, which claims priority from U.S. provisional patent application Ser. No. 60/399,240, filed on Jul. 29, 2002, (82) U.S. provisional patent application Ser. No. 60/412,487, filed on Sep. 20, 2002, (83) U.S. provisional patent application Ser. No. 60/412,488, filed on Sep. 20, 2002, (84) U.S. patent application Ser. No. 10/280,356, filed on Oct. 25, 2002, which is a continuation of U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. No. 60/405,610, filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application US 03/24779, filed on Aug. 8, 2003, which claims priority from U.S. provisional patent application Ser. No. 60/407,442, filed on Aug. 30, 2002, (91) U.S. provisional patent application Ser. No. 60/423,363, filed on Dec. 10, 2002, (92) U.S. provisional patent application Ser. No. 60/412,196, filed on Sep. 20, 2002, (93) U.S. provisional patent application Ser. No. 60/412,187, filed on Sep. 20, 2002, (94) U.S. provisional patent application Ser. No. 60/412,371, filed on Sep. 20, 2002, (95) U.S. patent application Ser. No. 10/382,325, filed on Mar. 5, 2003, which is a continuation of U.S. Pat. No. 6,557,640, which was filed as patent application Ser. No. 09/588,946, filed on Jun. 7, 2000, which claims priority from provisional application 60/137,998, filed on Jun. 7, 1999, (96) U.S. patent application Ser. No. 10/624,842, filed on Jul. 22, 2003, which is a divisional of U.S. patent application Ser. No. 09/502,350, filed on Feb. 10, 2000, which claims priority from provisional application 60/119,611, filed on Feb. 11, 1999, (97) U.S. provisional patent application Ser. No. 60/431,184, filed on Dec. 5, 2002, (98) U.S. provisional patent application Ser. No. 60/448,526, filed on Feb. 18, 2003, (99) U.S. provisional patent application Ser. No. 60/461,539, filed on Apr. 9, 2003, (100) U.S. provisional patent application Ser. No. 60/462,750, filed on Apr. 14, 2003, (101) U.S. provisional patent application Ser. No. 60/436,106, filed on Dec. 23, 2002, (102) U.S. provisional patent application Ser. No. 60/442,942, filed on Jan. 27, 2003, (103) U.S. provisional patent application Ser. No. 60/442,938, filed on Jan. 27, 2003, (104) U.S. provisional patent application Ser. No. 60/418,687, filed on Apr. 18, 2003, (105) U.S. provisional patent application Ser. No. 60/454,896, filed on Mar. 14, 2003, (106) U.S. provisional patent application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 11, 2003, (110) U.S. patent application Ser. No. 10/421,682, filed on Apr. 23, 2003, which is a continuation of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (111) U.S. provisional patent application Ser. No. 60/457,965, filed on Mar. 27, 2003, (112) U.S. provisional patent application Ser. No. 60/455,718, filed on Mar. 18, 2003, (113) U.S. Pat. No. 6,550,821, which was filed as patent application Ser. No. 09/811,734, filed on Mar. 19, 2001, (114) U.S. patent application Ser. No. 10/436,467, filed on May 12, 2003, which is a continuation of U.S. Pat. No. 6,604,763, which was filed as application Ser. No. 09/559,122, filed on Apr. 26, 2000, which claims priority from provisional application 60/131,106, filed on Apr. 26, 1999, (115) U.S. provisional patent application Ser. No. 60/459,776, filed on Apr. 2, 2003, (116) U.S. provisional patent application Ser. No. 60/461,094, filed on Apr. 8, 2003, (117) U.S. provisional patent application Ser. No. 60/461,038, filed on Apr. 7, 2003, (118) U.S. provisional patent application Ser. No. 60/463,586, filed on Apr. 17, 2003, (119) U.S. provisional patent application Ser. No. 60/472,240, filed on May 20, 2003, (120) U.S. patent application Ser. No. 10/619,285, filed on Jul. 14, 2003, which is a continuation-in-part of U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (121) U.S. utility patent application Ser. No. 10/418,688, which was filed on Apr. 18, 2003, as a division of U.S. utility patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999; (122) PCT patent application serial number PCT/US2004/06246, filed on Feb. 26, 2004; (123) PCT patent application serial number PCT/US2004/08170, filed on Mar. 15, 2004; (124) PCT patent application serial number PCT/US2004/08171, filed on Mar. 15, 2004; (125) PCT patent application serial number PCT/US2004/08073, filed on Mar. 18, 2004; (126) PCT patent application serial number PCT/US2004/07711, filed on Mar. 11, 2004; (127) PCT patent application serial number PCT/US2004/029025, filed on Mar. 26, 2004; (128) PCT patent application serial number PCT/US2004/010317, filed on Apr. 2, 2004; (129) PCT patent application serial number PCT/US2004/010712, filed on Apr. 6, 2004; (130) PCT patent application serial number PCT/US2004/010762, filed on Apr. 6, 2004; (131) PCT patent application serial number PCT/US2004/011973, filed on Apr. 15, 2004; (132) U.S. provisional patent application Ser. No. 60/495,056, filed on Aug. 14, 2003; (133) U.S. provisional patent application Ser. No. 60/600,679, filed on Aug. 11, 2004; (134) PCT patent application serial number PCT/US2005/027318, filed on Jul. 29, 2005; (135) PCT patent application serial number PCT/US2005/028936, filed on Aug. 12, 2005; (136) PCT patent application serial number PCT/US2005/028669, filed on Aug. 11, 2005; (137) PCT patent application serial number PCT/US2005/028453, filed on Aug. 11, 2005; (138) PCT patent application serial number PCT/US2005/028641, filed on Aug. 11, 2005; (139) PCT patent application serial number PCT/US2005/028819, filed on Aug. 11, 2005; (140) PCT patent application serial number PCT/US2005/028446, filed on Aug. 11, 2005; (141) PCT patent application serial number PCT/US2005/028642, filed on Aug. 11, 2005; (142) PCT patent application serial number PCT/US2005/028451, filed on Aug. 11, 2005, and (143). PCT patent application serial number PCT/US2005/028473, filed on Aug. 11, 2005, (144) U.S. utility patent application Ser. No. 10/546,082, filed on Aug. 16, 2005, (145) U.S. utility patent application Ser. No. 10/546,076, filed on Aug. 16, 2005, (146) U.S. utility patent application Ser. No. 10/545,936, filed on Aug. 16, 2005, (147) U.S. utility patent application Ser. No. 10/546,079, filed on Aug. 16, 2005 (148) U.S. utility patent application Ser. No. 10/545,941, filed on Aug. 16, 2005, (149) U.S. utility patent application Ser. No. 546078, filed on Aug. 16, 2005, filed on Aug. 11, 2005, (150) U.S. utility patent application Ser. No. 10/545,941, filed on Aug. 16, 2005, (151) U.S. utility patent application Ser. No. 11/249,967, filed on Oct. 13, 2005, (152) U.S. provisional patent application Ser. No. 60/734,302, filed on Nov. 7, 2005, (153) U.S. provisional patent application Ser. No. 60/725,181, filed on Oct. 11, 2005, (154) PCT patent application serial number PCT/US2005/023391, filed Jun. 29, 2005 which claims priority from U.S. provisional patent application Ser. No. 60/585,370, filed on Jul. 2, 2004, (155) U.S. provisional patent application Ser. No. 60/721,579, filed on Sep. 28, 2005, (156) U.S. provisional patent application Ser. No. 60/717,391, filed on Sep. 15, 2005, (157) U.S. provisional patent application Ser. No. 60/702,935, filed on Jul. 27, 2005, (158) U.S. provisional patent application Ser. No. 60/663,913, filed on Mar. 21, 2005, (159) U.S. provisional patent application Ser. No. 60/652,564, filed on Feb. 14, 2005, (160) U.S. provisionai patent application Ser. No. 60/645,840, filed on Jan. 21, 2005, (161) PCT patent application serial number PCT/US2005/043122, filed on Nov. 29, 2005 which claims priority from U.S. provisional patent application Ser. No. 60/631,703, filed on Nov. 30, 2004, (162) U.S. provisional patent application Ser. No. 60/752,787, filed on Dec. 22, 2005, (163) U.S. National Stage application Ser. No. 10/548,934, filed on Sep. 12, 2005; (164) U.S. National Stage application Ser. No. 10/549,410, filed on Sep. 13, 2005; (165) U.S. Provisional Patent Application No. 60/717,391, filed on Sep. 15, 2005; (166) U.S. National Stage application Ser. No. 10/550,906, filed on Sep. 27, 2005; (167) U.S. National Stage application Ser. No. 10,551,880, filed on Sep 30, 2005; (168) U.S. National Stage application Ser. No. 10/552,253, filed on Oct. 4, 2005; (169) U.S. National Staae application Ser. No. 10/552,790, filed on Oct. 11, 2005; (170) U.S. Provisional Patent Application No. 60/725,181, filed on Oct. 11, 2005; (171) U.S. National Stage application Ser. No. 10/553,094, filed on Oct. 13, 2005; (172) U.S. National Staoe application Ser. No. 10/553,566, filed on Oct. 17, 2005; (173) PCT Patent Application No. PCT/US2006/002449, filed on Jan. 20, 2006, and (174) PCT Patent Application No. PCT/US2006/004809, filed on Feb. 9, 2006; (175) U.S. Utility patent application Ser. No. 11,356,899, filed on Feb. 17, 2006, (176) U.S. National Stage application Ser. No. 10/568,200, filed on Feb. 13, 2006, (177) U.S. National Stage application Ser. No. 10/568,719, filed on Feb. 16, 2006, (178) U.S. National Stage application Ser. No. 10/569,323, (179) U.S. National State patent application Ser. No. 10/571,041, filed on Mar. 3, 2006; (180) U.S. National State patent application Ser. No. 10/571,017, filed on Mar. 3, 2006; (181) U.S. National State patent application Ser. No. 10/571,086, filed on Mar. 6, 2006; and (182) U.S. National State patent application Ser. No. 10/571,085, filed on Mar. 6, 2006, (183) U.S. utility patent application Ser. No. 10/938,788, filed on Sep. 10, 2004, (184) U.S. utility patent application Ser. No. 10/938,225, filed on Sep. 10, 2004, (185) U.S. utility patent application Ser. No. 10/952,288, filed on Sep. 28, 2004, (186) U.S. utility patent application Ser. No. 10/952,416, filed on Sep. 28, 2004, (187) U.S. utility patent application Ser. No. 10/950,749, filed on Sep. 27, 2004, and (188) U.S. utility patent application Ser. No. 10/950,869, filed on Sep. 27, 2004.

BACKGROUND OF THE INVENTION

This invention relates generally to wellbore casings, and in particular to wellbore casings that are formed using expandable tubing.

Conventionally, when a wellbore is created, a number of casings are installed in the borehole to prevent collapse of the borehole wall and to prevent undesired outflow of drilling fluid into the formation or inflow of fluid from the formation into the borehole. The borehole is drilled in intervals whereby a casing which is to be installed in a lower borehole interval is lowered through a previously installed casing of an upper borehole interval. As a consequence of this procedure the casing of the lower interval is of smaller diameter than the casing of the upper interval. Thus, the casings are in a nested arrangement with casing diameters decreasing in downward direction. Cement annuli are provided between the outer surfaces of the casings and the borehole wall to seal the casings from the borehole wall. As a consequence of this nested arrangement a relatively large borehole diameter is required at the upper part of the wellbore. Such a large borehole diameter involves increased costs due to heavy casing handling equipment, large drill bits and increased volumes of drilling fluid and drill cuttings. Moreover, increased drilling rig time is involved due to required cement pumping, cement hardening, required equipment changes due to large variations in hole diameters drilled in the course of the well, and the large volume of cuttings drilled and removed.

Conventionally, at the surface end of the wellbore, a wellhead is formed that typically includes a surface casing, a number of production and/or drilling spools, valving, and a Christmas tree. Typically the wellhead further includes a concentric arrangement of casings including a production casing and one or more intermediate casings. The casings are typically supported using load bearing slips positioned above the ground. The conventional design and construction of wellheads is expensive and complex.

The present invention is directed to overcoming one or more of the limitations of the existing procedures for forming wellbores and wellheads.

SUMMARY OF THE INVENTION

According to one aspect of the present invention, a method of controlling the flow of fluidic materials within a tubular housing that defines an inlet passage and one or more outlet passages is provided that includes injecting fluidic materials into the inlet passage, blocking the inlet passage, and opening the outlet passages.

DETAILED DESCRIPTION OF THE ILLUSTRATIVE EMBODIMENTS

An apparatus and method for forming a wellbore casing within a subterranean formation is provided. The apparatus and method permits a wellbore casing to be formed in a subterranean formation by placing a tubular member and a mandrel in a new section of a wellbore, and then extruding the tubular member off of the mandrel by pressurizing an interior portion of the tubular member. The apparatus and method further permits adjacent tubular members in the wellbore to be joined using an overlapping joint that prevents fluid and or gas passage. The apparatus and method further permits a new tubular member to be supported by an existing tubular member by expanding the new tubular member into engagement with the existing tubular member. The apparatus and method further minimizes the reduction in the hole size of the wellbore casing necessitated by the addition of new sections of wellbore casing.

A crossover valve apparatus and method for controlling the radial expansion of a tubular member is also provided. The crossover valve assembly permits the initiation of the radial expansion of a tubular member to be precisely initiated and controlled.

A force multiplier apparatus and method for applying an axial force to an expansion cone is also provided. The force multiplier assembly permits the amount of axial driving force applied to the expansion cone to be increased. In this manner, the radial expansion process is improved.

A radial expansion apparatus and method for radially expanding a tubular member is also provided. The radial expansion apparatus preferably includes a mandrel, an expansion cone, a centralizer, and a lubrication assembly for lubricating the interface between the expansion cone and the tubular member. The radial expansion apparatus improves the efficiency of the radial expansion process.

A preload assembly for applying a predetermined axial force to an expansion cone is also provided. The preload assembly preferably includes a compressed spring and a spacer for controlling the amount of compression of the spring. The compressed spring in turn is used to apply an axial force to the expansion cone. The preload assembly improves the radial expansion process by presetting the position of the expansion cone using a predetermined axial force.

A coupling assembly for controllably removably coupling an expandable tubular member to a support member is also provided. The coupling assembly preferably includes an emergency release in order to permit the coupling assembly to be decoupled in an emergency.

In several alternative embodiments, the apparatus and methods are used to form and/or repair wellbore casings, pipelines, and/or structural supports.

Figure 1A:
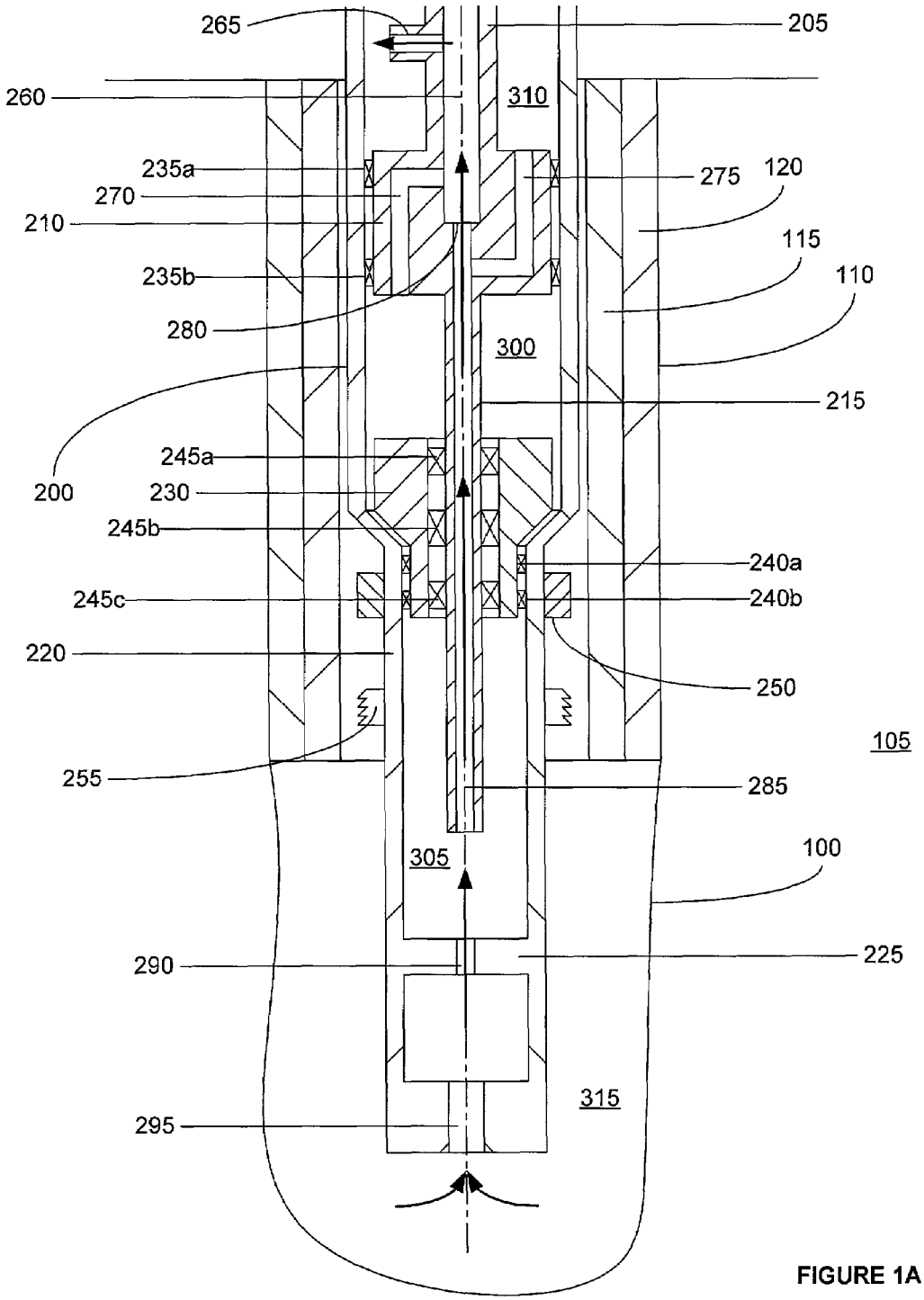
FIG. 1A is a cross-sectional view illustrating the placement of an embodiment of an apparatus for creating a casing within a well borehole.

Referring initially to FIGS. 1A-1F, an embodiment of an apparatus and method for forming a wellbore casing within a subterranean formation will now be described. As illustrated in FIG. 1A, a wellbore 100 is positioned in a subterranean formation 105. The wellbore 100 includes an existing cased section 110 having a tubular casing 115 and an annular outer layer of cement 120.

As illustrated in FIG. 1A, an apparatus 200 for forming a wellbore casing in a subterranean formation is then positioned in the wellbore 100. The apparatus 200 preferably includes a first support member 205, a manifold 210, a second support member 215, a tubular member 220, a shoe 225, an expansion cone 230, first sealing members 235, second sealing members 240, third sealing members 245, fourth sealing members 250, an anchor 255, a first passage 260, a second passage 265, a third passage 270, a fourth passage 275, a throat 280, a fifth passage 285, a sixth passage 290, a seventh passage 295, an annular chamber 300, a chamber 305, and a chamber 310. In a preferred embodiment, the apparatus 200 is used to radially expand the tubular member 220 into intimate contact with the tubular casing 115. In this manner, the tubular member 220 is coupled to the tubular casing 115. In this manner, the apparatus 200 is preferably used to form or repair a wellbore casing, a pipeline, or a structural support. In a particularly preferred embodiment, the apparatus is used to repair or form a wellbore casing.

The first support member 205 is coupled to a conventional surface support and the manifold 210. The first support member 205 may be fabricated from any number of conventional commercially available tubular support members. In a preferred embodiment, the first support member 205 is fabricated from alloy steel having a minimum yield strength of about 75,000 to 140,000 psi in order to provide high strength and resistance to abrasion and fluid erosion. In a preferred embodiment, the first support member 205 further includes the first passage 260 and the second passage 265.

The manifold 210 is coupled to the first support member 205, the second support member 215, the sealing members 235*a* and 235*b*, and the tubular member 200. The manifold 210 preferably includes the first passage 260, the third passage 270, the fourth passage 275, the throat 280 and the fifth passage 285. The manifold 210 may be fabricated from any number of conventional tubular members.

The second support member 215 is coupled to the manifold 210, the sealing members 245*a*, 245*b*, and 245*c*, and the expansion cone 230. The second support member 215 may be fabricated from any number of conventional commercially available tubular support members. In a preferred embodiment, the second support member 215 is fabricated from alloy steel having a minimum yield strength of about 75,000 to 140,000 psi in order to provide high strength and resistance to abrasion and fluid erosion. In a preferred embodiment, the second support member 215 further includes the fifth passage 285.

The tubular member 220 is coupled to the sealing members 235*a* and 235*b* and the shoe 225. The tubular member 220 is further movably coupled to the expansion cone 230 and the sealing members 240*a* and 240*b*. The first support member 205 may comprise any number of conventional tubular members. The tubular member 220 may be fabricated from any number of conventional commercially available tubular members. In a preferred embodiment, the tubular member 220 is further provided substantially as described in one or more of the following: (1) U.S. patent application Ser. No.

09/440,338, filed on Nov. 15, 1999, which issued as U.S. Pat. No. 6,328,113, which claimed benefit of the filing date of U.S. Provisional Patent Application Ser. No. 60/108,558, filed on Nov. 16, 1998, (2) U.S. patent application Ser. No. 09/454,139, filed on Dec. 3, 1999, which claimed benefit of the filing date of U.S. Provisional Patent Application Ser. No. 60/111,293, filed on Dec. 7, 1998, (3) U.S. patent application Ser. No. 09/502,350, filed on Feb. 10, 2000, which claimed the benefit of the filing date of U.S. Provisional Patent Application Ser. No. 60/119,611, filed Feb. 11, 1999, (4) U.S. patent application Ser. No. 09/510,913, filed on Feb. 23, 2000, which claimed the benefit of the filing date of U.S. Provisional Patent Application Ser. No. 60/121,702, filed on Feb. 25, 1999, (5) U.S. patent application Ser. No. 09/511,941, filed on Feb. 24, 2000, which claimed the benefit of the filing date of U.S. Provisional Patent Application No. 60/121,907, filed Feb. 26, 1999, (6) U.S. Provisional Patent Application Ser. No. 60/124,042, filed on Mar. 11, 1999, (7) U.S. Provisional Patent Application Ser. No. 60/131,106, filed on Apr. 26, 1999, (8) U.S. Provisional Patent Application Ser. No. 60/137,998, filed on Jun. 7, 1999, (9) U.S. Provisional Patent Application Ser. No. 60/143,039, filed on Jul. 9, 1999, and (10) U.S. Provisional Patent Application Ser. No. 60/146,203, filed on Jul. 29, 1999, the disclosures of which are incorporated by reference.

The shoe 225 is coupled to the tubular member 220. The shoe 225 preferably includes the sixth passage 290 and the seventh passage 295. The shoe 225 preferably is fabricated from a tubular member. In a preferred embodiment, the shoe 225 is further provided substantially as described in one or more of the following: (1) U.S. patent application Ser. No. 09/440,338, filed on Nov. 15, 1999, which claimed benefit of the filing date of U.S. Provisional Patent Application Ser. No. 60/108,558, filed on Nov. 16, 1998, (2) U.S. patent application Ser. No. 09/454,139, filed on Dec. 3, 1999, which claimed benefit of the filing date of U.S. Provisional Patent Application Ser. No. 60/111,293, filed on Dec. 7, 1998, (3) U.S. patent application Ser. No. 09/502,350, filed on Feb. 10, 2000, which claimed the benefit of the filing date of U.S. Provisional Patent Application Ser. No. 60/119,611, filed Feb. 11, 1999, (4) U.S. patent application Ser. No. 09/510,913, filed on Feb. 23, 2000, which claimed the benefit of the filing date of U.S. Provisional Patent Application Ser. No. 60/121,702, filed on Feb. 25, 1999, (5) U.S. patent application Ser. No. 09/511,941, filed on Feb. 24, 2000, which claimed the benefit of the filing date of U.S. Provisional Patent Application No. 60/121,907, filed Feb. 26, 1999, (6) U.S. Provisional Patent Application Ser. No. 60/124,042, filed on Mar. 11, 1999, (7) U.S. Provisional Patent Application Ser. No. 60/131,106, filed on Apr. 26, 1999, (8) U.S. Provisional Patent Application Ser. No. 60/137,998, filed on Jun. 7, 1999, (9) U.S. Provisional Patent Application Ser. No. 60/143,039, filed on Jul. 9, 1999, and (10) U.S. Provisional Patent Application Ser. No. 60/146,203, filed on Jul. 29, 1999, the disclosures of which are incorporated by reference.

The expansion cone 230 is coupled to the sealing members 240*a* and 240*b* and the sealing members 245*a*, 245*b*, and 245*c*. The expansion cone 230 is movably coupled to the second support member 215 and the tubular member 220. The expansion cone 230 preferably includes an annular member having one or more outer conical surfaces for engaging the inside diameter of the tubular member 220. In this manner, axial movement of the expansion cone 230 radially expands the tubular member 220. In a preferred embodiment, the expansion cone 230 is further provided substantially as described in one or more of the following: (1) U.S. patent application Ser. No. 09/440,338, filed on Nov. 15, 1999, which issued as U.S. Pat. No. 6,328,113, which claimed benefit of the filing date of U.S. Provisional Patent Application Ser. No. 60/108,558, filed on Nov. 16, 1998, (2) U.S. patent application Ser. No. 09/454,139, filed on Dec. 3, 1999, which claimed benefit of the filing date of U.S. Provisional Patent Application Ser. No. 60/111,293, filed on Dec. 7, 1998, (3) U.S. patent application Ser. No. 09/502,350, filed on Feb. 10, 2000, which claimed the benefit of the filing date of U.S. Provisional Patent Application Ser. No. 60/119,611, filed Feb. 11, 1999, (4) U.S. patent application Ser. No. 09/510,913, filed on Feb. 23, 2000, which claimed the benefit of the filing date of U.S. Provisional Patent Application Ser. No. 60/121,702, filed on Feb. 25, 1999, (5) U.S. patent application Ser. No. 09/511,941, filed on Feb. 24, 2000, which claimed the benefit of the filing date of U.S. Provisional Patent Application No. 60/121,907, filed Feb. 26, 1999, (6) U.S. Provisional Patent Application Ser. No. 60/124,042, filed on Mar. 11, 1999, (7) U.S. Provisional Patent Application Ser. No. 60/131,106, filed on Apr. 26, 1999, (8) U.S. Provisional Patent Application Ser. No. 60/137,998, filed on Jun. 7, 1999, (9) U.S. Provisional Patent Application Ser. No. 60/143,039, filed on Jul. 9, 1999, and (10) U.S. Provisional Patent Application Ser. No. 60/146,203, filed on Jul. 29, 1999, the disclosures of which are incorporated by reference.

The first sealing members 235*a* and 235*b* are coupled to the manifold 210 and the tubular member 220. The first sealing members 235*a* and 235*b* preferably fluidicly isolate the annular chamber 300 from the chamber 310. In this manner, annular chamber 300 is optimally pressurized during operation of the apparatus 200. The first sealing members 235*a* and 235*b* may comprise any number of conventional commercially available sealing members. In a preferred embodiment, the first sealing members 235*a* and 235*b* include O-rings with seal backups available from Parker Seals in order to provide a fluidic seal between the tubular member 200 and the expansion cone 230 during axial movement of the expansion cone 230.

In a preferred embodiment, the first sealing member 235*a* and 235*b* further include conventional controllable latching members for removably coupling the manifold 210 to the tubular member 200. In this manner, the tubular member 200 is optimally supported by the manifold 210. Alternatively, the tubular member 200 is preferably removably supported by the first support member 205 using conventional controllable latching members.

The second sealing members 240*a* and 240*b* are coupled to the expansion cone 230. The second sealing members 240*a* and 240*b* are movably coupled to the tubular member 220. The second sealing members 240*a* and 240*b* preferably fludicly isolate the annular chamber 300 from the chamber 305 during axial movement of the expansion cone 230. In this manner, the annular chamber 300 is optimally pressurized. The second sealing members 240*a* and 240*b* may comprise any number of conventional commercially available sealing members.

In a preferred embodiment, the second sealing members 240*a* and 240*b* further include a conventional centralizer and/or bearings for supporting and positioning the expansion cone 230 within the tubular member 200 during axial movement of the expansion cone 230. In this manner, the position and orientation of the expansion cone 230 is optimally controlled during axial movement of the expansion cone 230.

The third sealing members 245*a*, 245*b*, and 245*c* are coupled to the expansion cone 230. The third sealing members 245*a*, 245*b*, and 245*c* are movably coupled to the second support member 215. The third sealing members 245*a*, 245*b*, and 245*c* preferably fludicly isolate the annular chamber 300 from the chamber 305 during axial movement of the expansion cone 230. In this manner, the annular chamber 300 is optimally pressurized. The third sealing members 245*a*, 245*b* and 240*c* may comprise any number of conventional commercially available sealing members. In a preferred embodiment, the third sealing members 245*a*, 245*b*, and 245*c* include O-rings with seal backups available from Parker Seals in order to provide a fluidic seal between the expansion cone 230 and the second support member 215 during axial movement of the expansion cone 230.

In a preferred embodiment, the third sealing members 245*a*, 245*b* and 240*c* further include a conventional centralizer and/or bearings for supporting and positioning the expansion cone 230 around the second support member 215 during axial movement of the expansion cone 230. In this manner, the position and orientation of the expansion cone 230 is optimally controlled during axial movement of the expansion cone 230.

The fourth sealing member 250 is coupled to the tubular member 220. The fourth sealing member 250 preferably fluidicly isolates the chamber 315 after radial expansion of the tubular member 200. In this manner, the chamber 315 outside of the radially expanded tubular member 200 is fluidicly isolated. The fourth sealing member 250 may comprise any number of conventional commercially available sealing members. In a preferred embodiment, the fourth sealing member 250 is a RTTS packer ring available from Halliburton Energy Services in order to optimally provide a fluidic seal.

The anchor 255 is coupled to the tubular member 220. The anchor 255 preferably anchors the tubular member 200 to the casing 115 after radial expansion of the tubular member 200. In this manner, the radially expanded tubular member 200 is optimally supported within the wellbore 100. The anchor 255 may comprise any number of conventional commercially available anchoring devices. In a preferred embodiment, the anchor 255 includes RTTS mechanical slips available from Halliburton Energy Services in order to optimally anchor the tubular member 200 to the casing 115 after the radial expansion of the tubular member 200.

The first passage 260 is fluidicly coupled to a conventional surface pump, the second passage 265, the third passage 270, the fourth passage 275, and the throat 280. The first passage 260 is preferably adapted to convey fluidic materials including drilling mud, cement and/or lubricants at flow rates and pressures ranging from about 0 to 650 gallons/minute and 0 to 10,000 psi, respectively in order to optimally form an annular cement liner and radially expand the tubular member 200.

The second passage 265 is fluidicly coupled to the first passage 260 and the chamber 310. The second passage 265 is preferably adapted to controllably convey fluidic materials from the first passage 260 to the chamber 310. In this manner, surge pressures during placement of the apparatus 200 within the wellbore 100 are optimally minimized. In a preferred embodiment, the second passage 265 further includes a valve for controlling the flow of fluidic materials through the second passage 265.

The third passage 270 is fluidicly coupled to the first passage 260 and the annular chamber 300. The third passage 270 is preferably adapted to convey fluidic materials between the first passage 260 and the annular chamber 300. In this manner, the annular chamber 300 is optimally pressurized.

The fourth passage 275 is fluidicly coupled to the first passage 260, the fifth passage 285, and the chamber 310. The fourth passage 275 is preferably adapted to convey fluidic materials between the fifth passage 285 and the chamber 310. In this manner, during the radial expansion of the tubular member 200, fluidic materials from the chamber 305 are transmitted to the chamber 310. In a preferred embodiment, the fourth passage 275 further includes a pressure compensated valve and/or a pressure compensated orifice in order to optimally control the flow of fluidic materials through the fourth passage 275.

The throat 280 is fluidicly coupled to the first passage 260 and the fifth passage 285. The throat 280 is preferably adapted to receive a conventional fluidic plug or ball. In this manner, the first passage 260 is fluidicly isolated from the fifth passage 285.

The fifth passage 285 is fluidicly coupled to the throat 280, the fourth passage 275, and the chamber 305. The fifth passage 285 is preferably adapted to convey fluidic materials to and from the first passage 260, the fourth passage 275, and the chamber 305.

The sixth passage 290 is fluidicly coupled to the chamber 305 and the seventh passage 295. The sixth passage is preferably adapted to convey fluidic materials to and from the chamber 305. The sixth passage 290 is further preferably adapted to receive a conventional plug or dart. In this manner, the chamber 305 is optimally fluidicly isolated from the chamber 315.

The seventh passage 295 is fluidicly coupled to the sixth passage 290 and the chamber 315. The seventh passage 295 is preferably adapted to convey fluidic materials between the sixth passage 290 and the chamber 315.

The annular chamber 300 is fluidicly coupled to the third passage 270. Pressurization of the annular chamber 300 preferably causes the expansion cone 230 to be displaced in the axial direction. In this manner, the tubular member 200 is radially expanded by the expansion cone 230. During operation of the apparatus 200, the annular chamber 300 is preferably adapted to be pressurized to operating pressures ranging from about 1000 to 10000 psi in order to optimally radially expand the tubular member 200.

The chamber 305 is fluidicly coupled to the fifth passage 285 and the sixth passage 290. During operation of the apparatus 200, the chamber 305 is preferably fluidicly isolated from the annular chamber 300 and the chamber 315 and fluidicly coupled to the chamber 310.

The chamber 310 is fluidicly coupled to the fourth passage 275. During operation of the apparatus 200, the chamber 310 is preferably fluidicly isolated from the annular chamber 300 and fluidicly coupled to the chamber 305.

During operation, as illustrated in FIG. 1A, the apparatus 200 is preferably placed within the wellbore 100 in a predetermined overlapping relationship with the preexisting casing 115. During placement of the apparatus 200 within the wellbore 100, fluidic materials within the chamber 315 are preferably conveyed to the chamber 310 using the second, first, fifth, sixth and seventh fluid passages 265, 260, 285, 290 and 295, respectively. In this manner, surge pressures within the wellbore 100 during placement of the apparatus 200 are minimized. Once the apparatus 200 has been placed at the predetermined location within the wellbore 100, the second passage 265 is preferably closed using a conventional valve member.

Figure 1B:
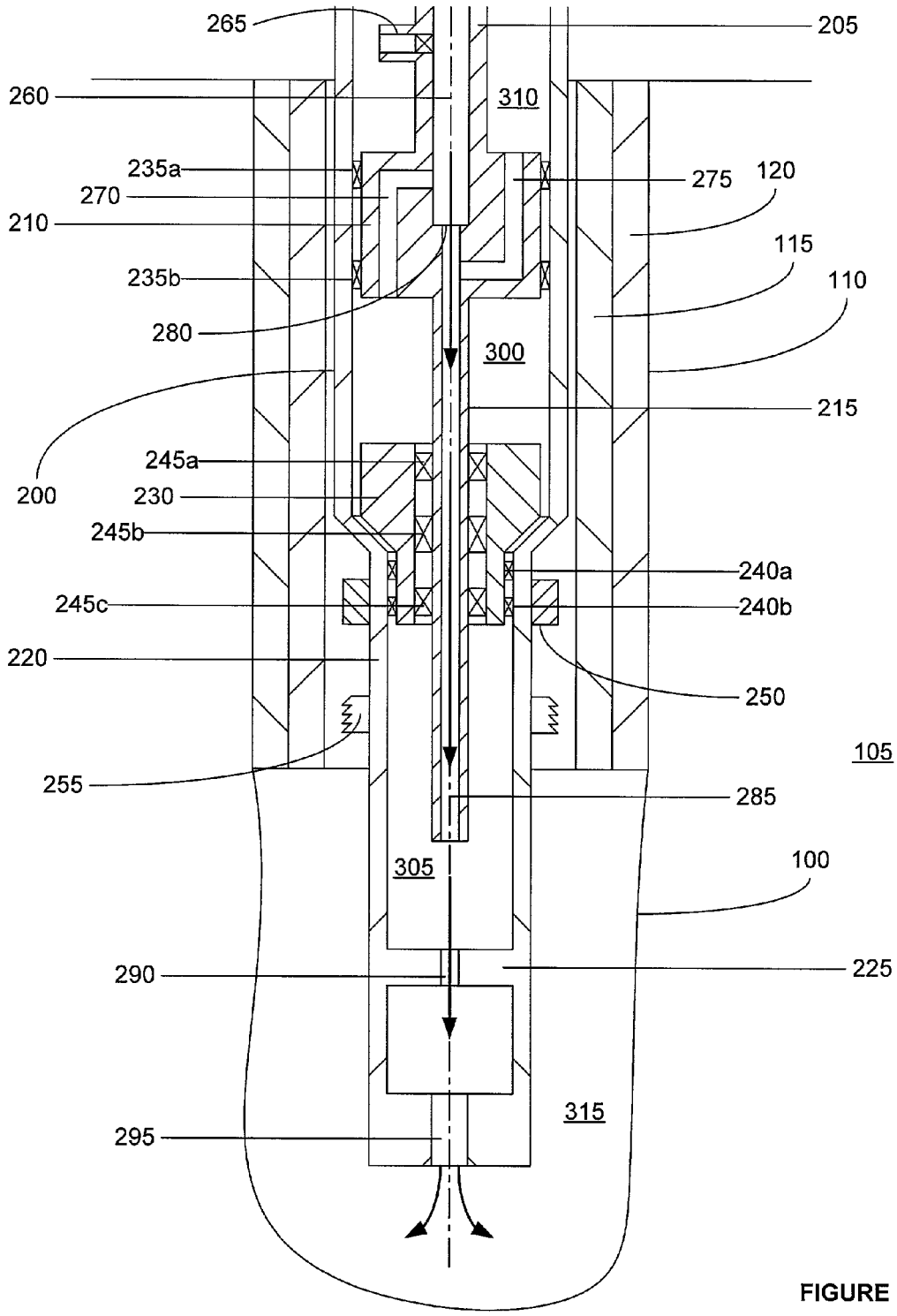
FIG. 1B is a cross-sectional view illustrating the injection of a fluidic material into the well borehole of FIG. 1A.

As illustrated in FIG. 1B, one or more volumes of a non-hardenable fluidic material are then injected into the chamber 315 using the first, fifth, sixth and seventh passages, 260, 285, 290 and 295 in order to ensure that all of the passages are clear. A quantity of a hardenable fluidic sealing material such as, for example, cement, is then preferably injected into the chamber 315 using the first, fifth, sixth and seventh passages 260, 285, 290 and 295. In this manner, an annular outer sealing layer is preferably formed around the radially expanded tubular member 200.

Figure 1C:
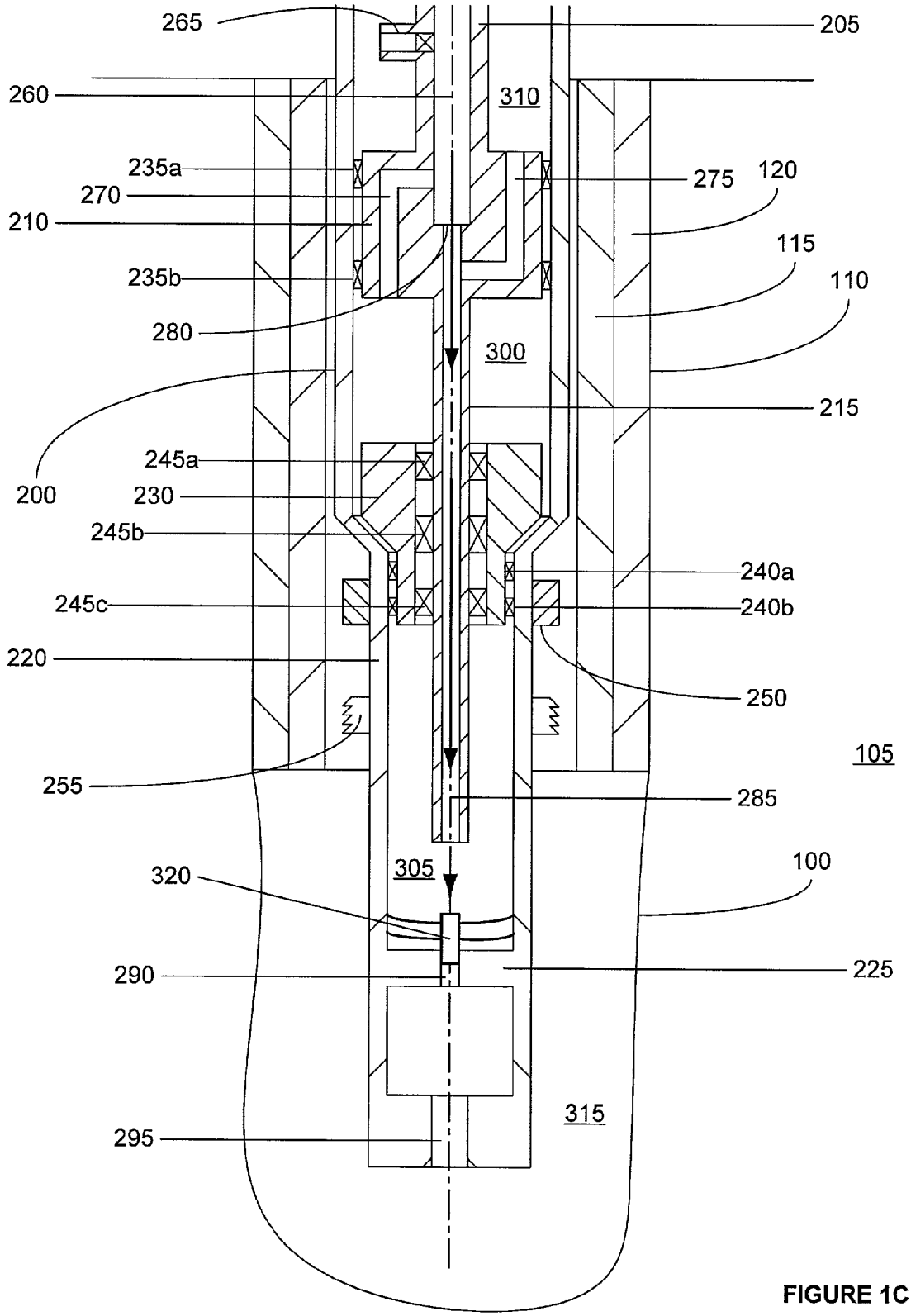
FIG. 1C is a cross-sectional view illustrating the injection of a wiper plug into the apparatus of FIG. 1B.

As illustrated in FIG. 1C, a conventional wiper plug 320 is then preferably injected into the first passage 260 using a non-hardenable fluidic material. The wiper plug 320 preferably passes through the first and fifth passages, 260 and 285, and into the chamber 305. Inside the chamber 305, the wiper plug 320 preferably forces substantially all of the hardenable fluidic material out of the chamber 305 through the sixth passage 290. The wiper plug 320 then preferably lodges in and fluidicly seals off the sixth passage 290. In this manner, the chamber 305 is optimally fluidicly isolated from the chamber 315. Furthermore, the amount of hardenable sealing material within the chamber 305 is minimized.

Figure 1D:
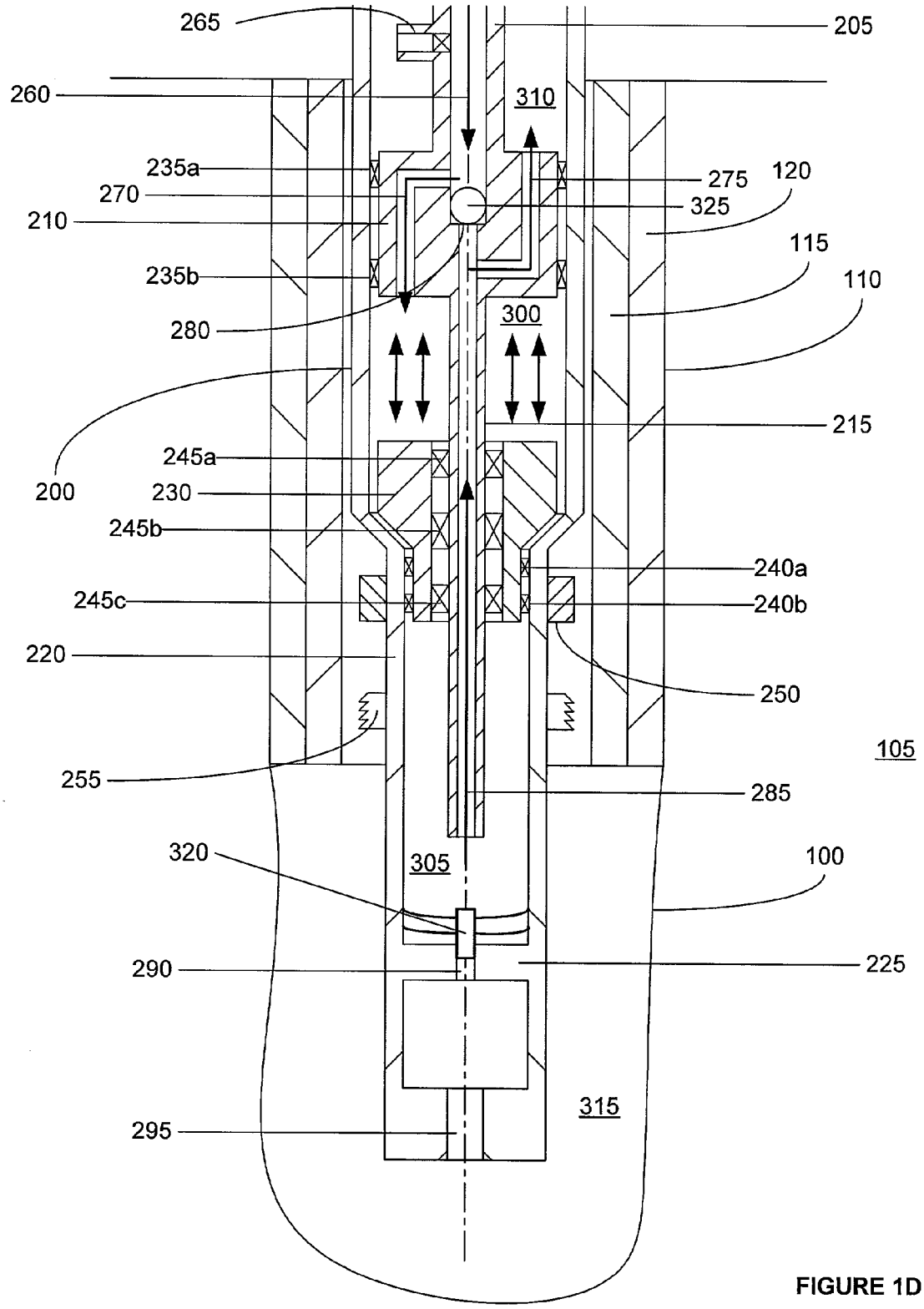
FIG. 1D is a fragmentary cross-sectional view illustrating the injection of a ball plug and a fluidic material into the apparatus of FIG. 1C.

As illustrated in FIG. 1D, a conventional sealing ball or plug 325 is then preferably injected into the first passage 260 using a non-hardenable fluidic material. The sealing ball 325 preferably lodges in and fluidicly seals off the throat 280. In this manner, the first passage 260 is fluidicly isolated from the fifth fluid passage 285. Consequently, the injected non-hardenable fluidic sealing material passes from the first passage 260 into the third passage 270 and into the annular chamber 300. In this manner, the annular chamber 300 is pressurized.

Figure 1E:
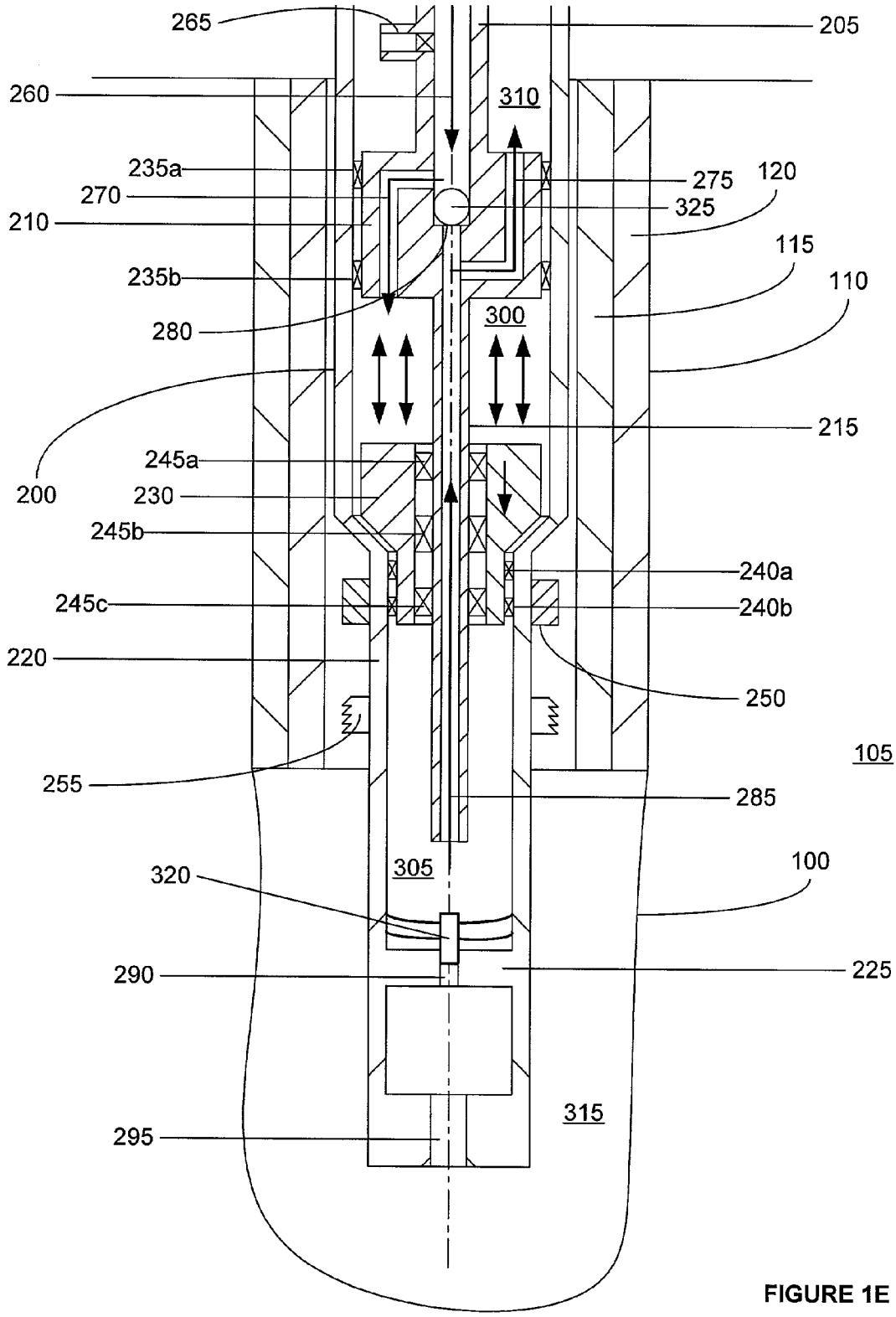
FIG. 1E is a fragmentary cross-sectional view illustrating the continued injection of fluidic material into the apparatus of FIG. 1D in order to radially expand a tubular member.

As illustrated in FIG. 1E, continued injection of a non-hardenable fluidic material into the annular chamber 300 preferably increases the operating pressure within the annular chamber 300, and thereby causes the expansion cone 230 to move in the axial direction. In a preferred embodiment, the axial movement of the expansion cone 230 radially expands the tubular member 200. In a preferred embodiment, the annular chamber 300 is pressurized to operating pressures ranging from about 1000 to 10000 psi. during the radial expansion process. In a preferred embodiment, the pressure differential between the first passage 260 and the fifth passage 285 is maintained at least about 1000 to 10000 psi. during the radial expansion process in order to optimally fluidicly seal the throat 280 using the sealing ball 325.

In a preferred embodiment, during the axial movement of the expansion cone 230, at least a portion of the interface between the expansion cone 230 and the tubular member 200 is fluidicly sealed by the sealing members 240*a* and 240*b*. In a preferred embodiment, during the axial movement of the expansion cone 230, at least a portion of the interface between the expansion cone 230 and the second support member 215 is fluidicly sealed by the sealing members 245*a*, 245*b* and 240*c*. In this manner, the annular chamber 300 is optimally fluidicly isolated from the chamber 305 during the radial expansion process.

During the radial expansion process, the volumetric size of the annular chamber 300 preferably increases while the volumetric size of the chamber 305 preferably decreases during the radial expansion process. In a preferred embodiment, during the radial expansion process, fluidic materials within the decreasing chamber 305 are transmitted to the chamber 310 using the fourth and fifth passages, 275 and 285. In this manner, the rate and amount of axial movement of the expansion cone 230 is optimally controlled by the flow rate of fluidic materials conveyed from the chamber 300 to the chamber 310. In a preferred embodiment, the fourth passage 275 further includes a conventional pressure compensated valve in order to optimally control the initiation of the radial expansion process. In a preferred embodiment, the fourth passage 275 further includes a conventional pressure compensated orifice in order to optimally control the rate of the radial expansion process.

In a preferred embodiment, continued radial expansion of the tubular member 200 by the expansion cone 230 causes the sealing members 250 to contact the inside surface of the existing casing 115. In this manner, the interface between the radially expanded tubular member 200 and the preexisting casing 115 is optimally fluidicly sealed. Furthermore, in a preferred embodiment, continued radial expansion of the tubular member 200 by the expansion cone 230 causes the anchor 255 to contact and at least partially penetrate the inside surface of the preexisting casing 115. In this manner, the radially expanded tubular member 200 is optimally coupled to the preexisting casing 115.

Figure 1F:
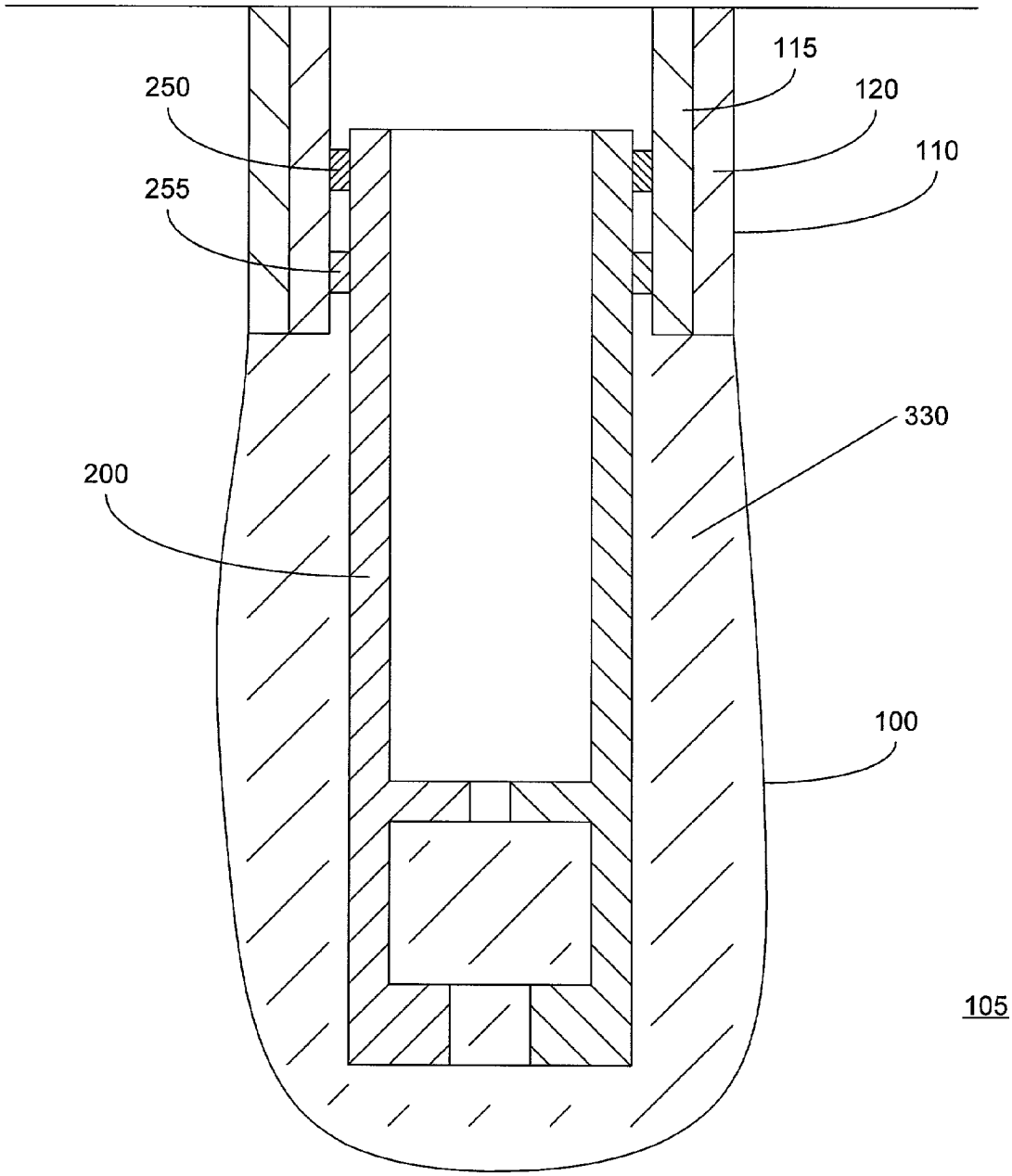
FIG. 1F is a cross-sectional view of the completed wellbore casing.
Figure 2A:
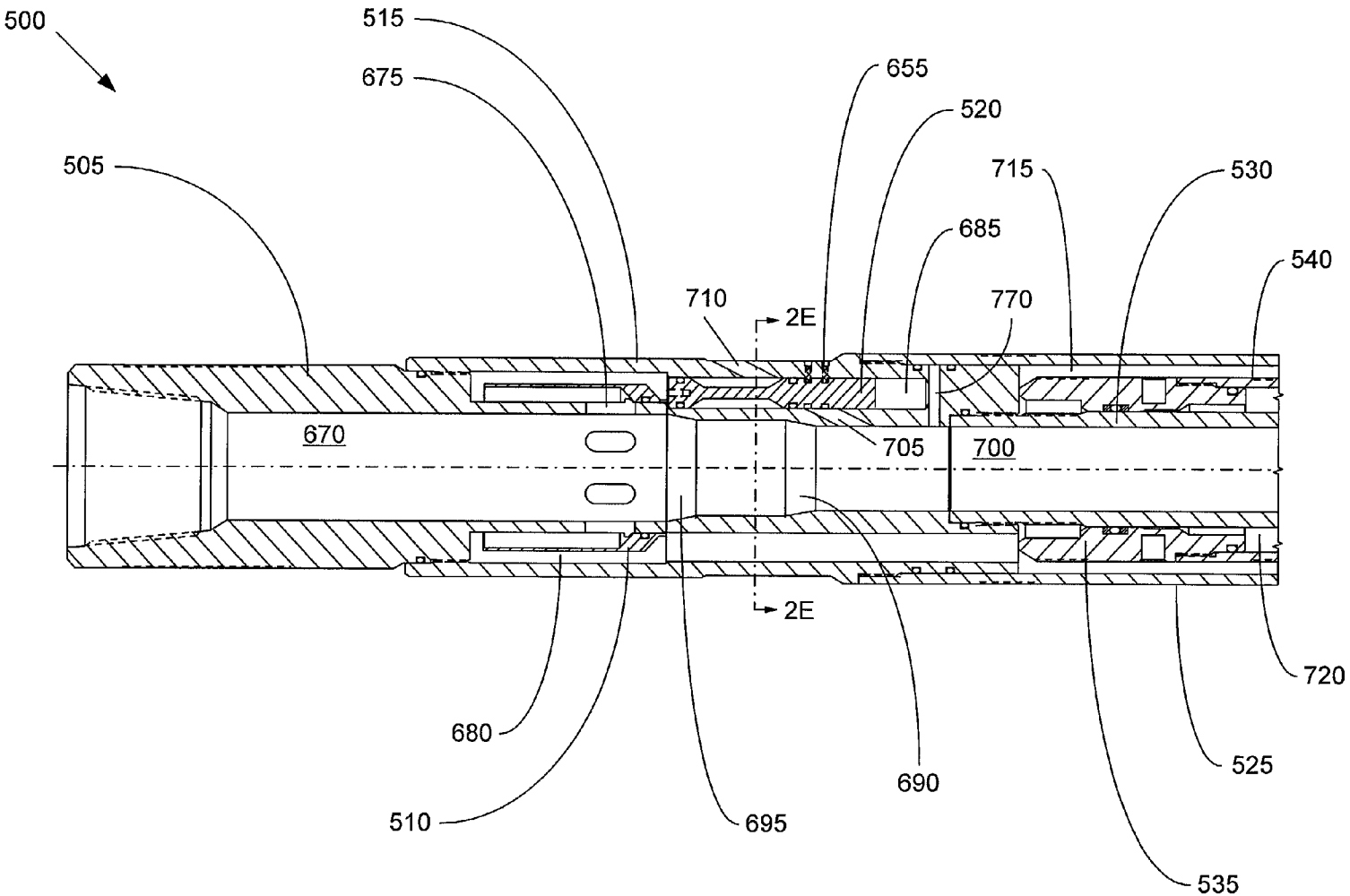
FIG. 2A is a cross-sectional illustration of a portion of an embodiment of an apparatus for forming and/or repairing a wellbore, pipeline or structural support.
Figure 2B:
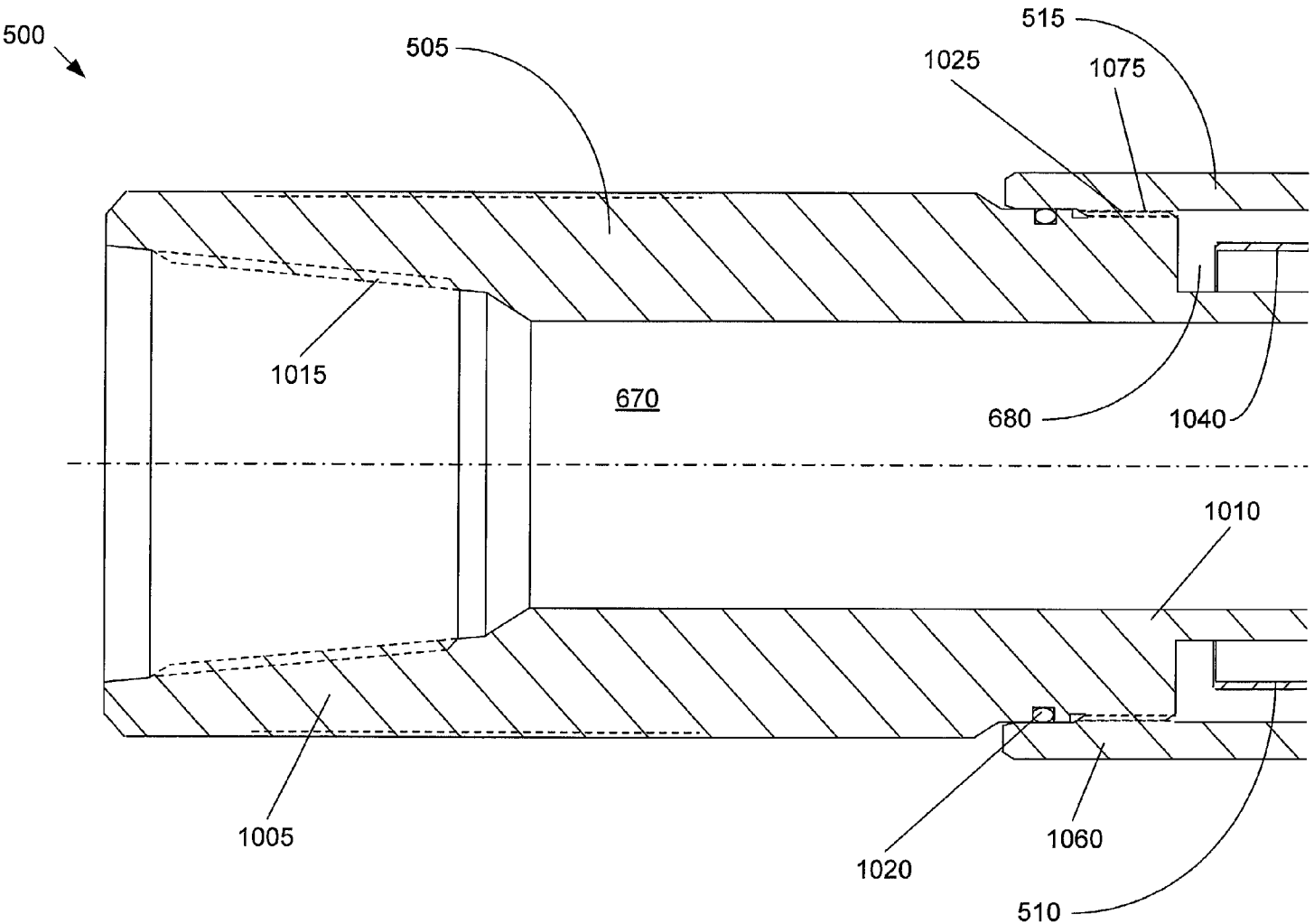
FIG. 2B is an enlarged illustration of a portion of the apparatus of FIG. 2A.
Figure 2C:
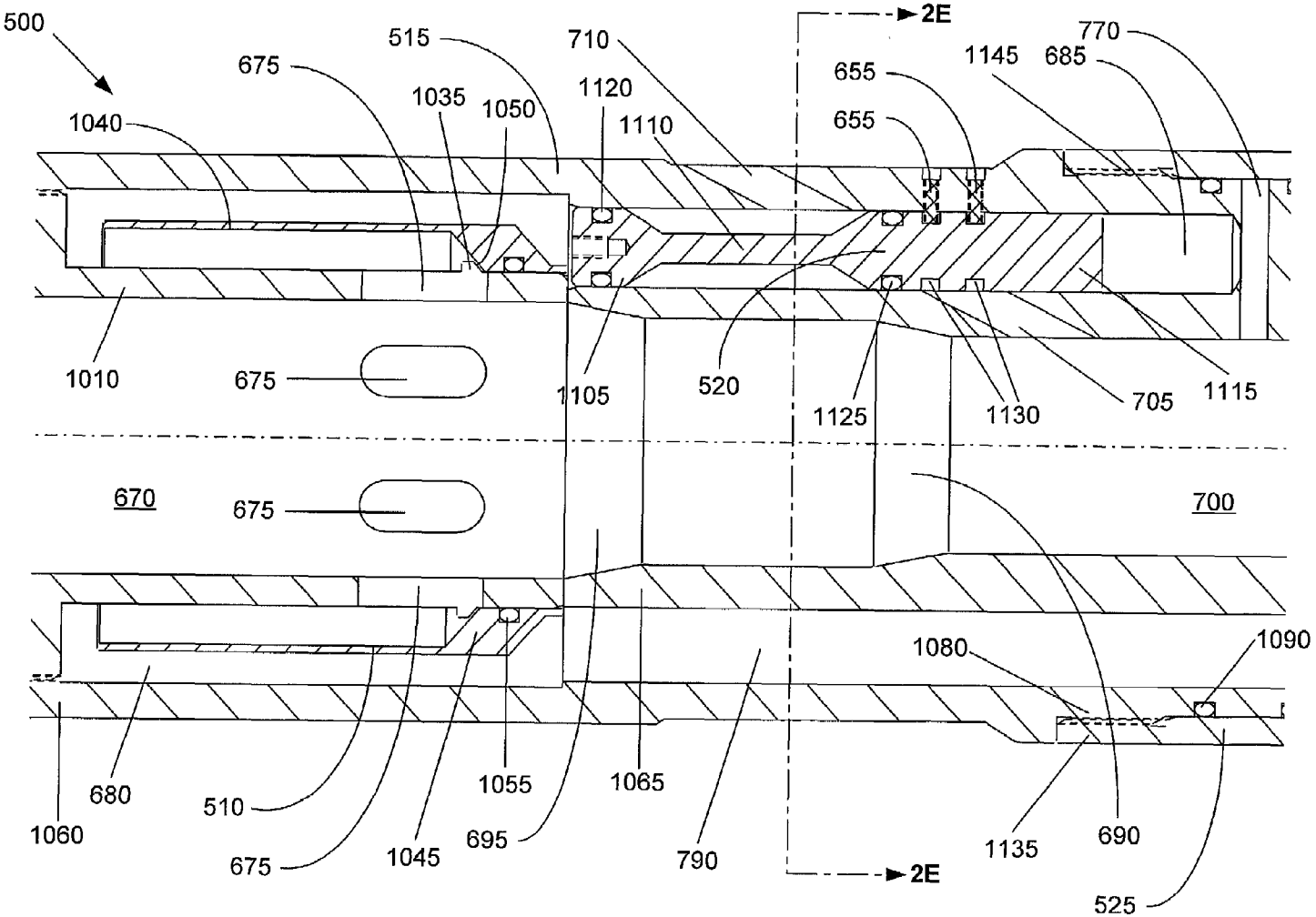
FIG. 2C is an enlarged illustration of a portion of the apparatus of FIG. 2A.
Figure 2D:
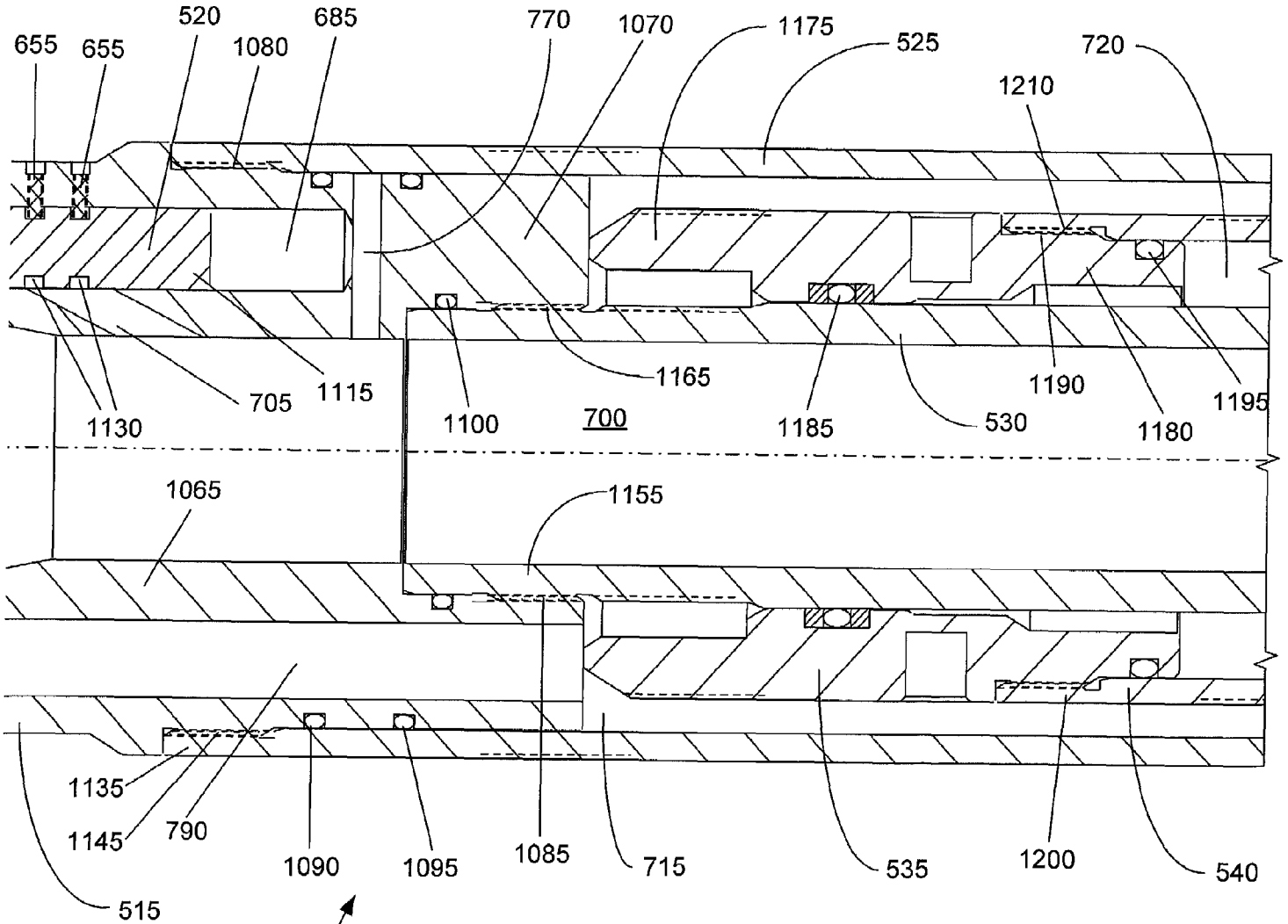
FIG. 2D is an enlarged illustration of a portion of the apparatus of FIG. 2A.
Figure 2E:
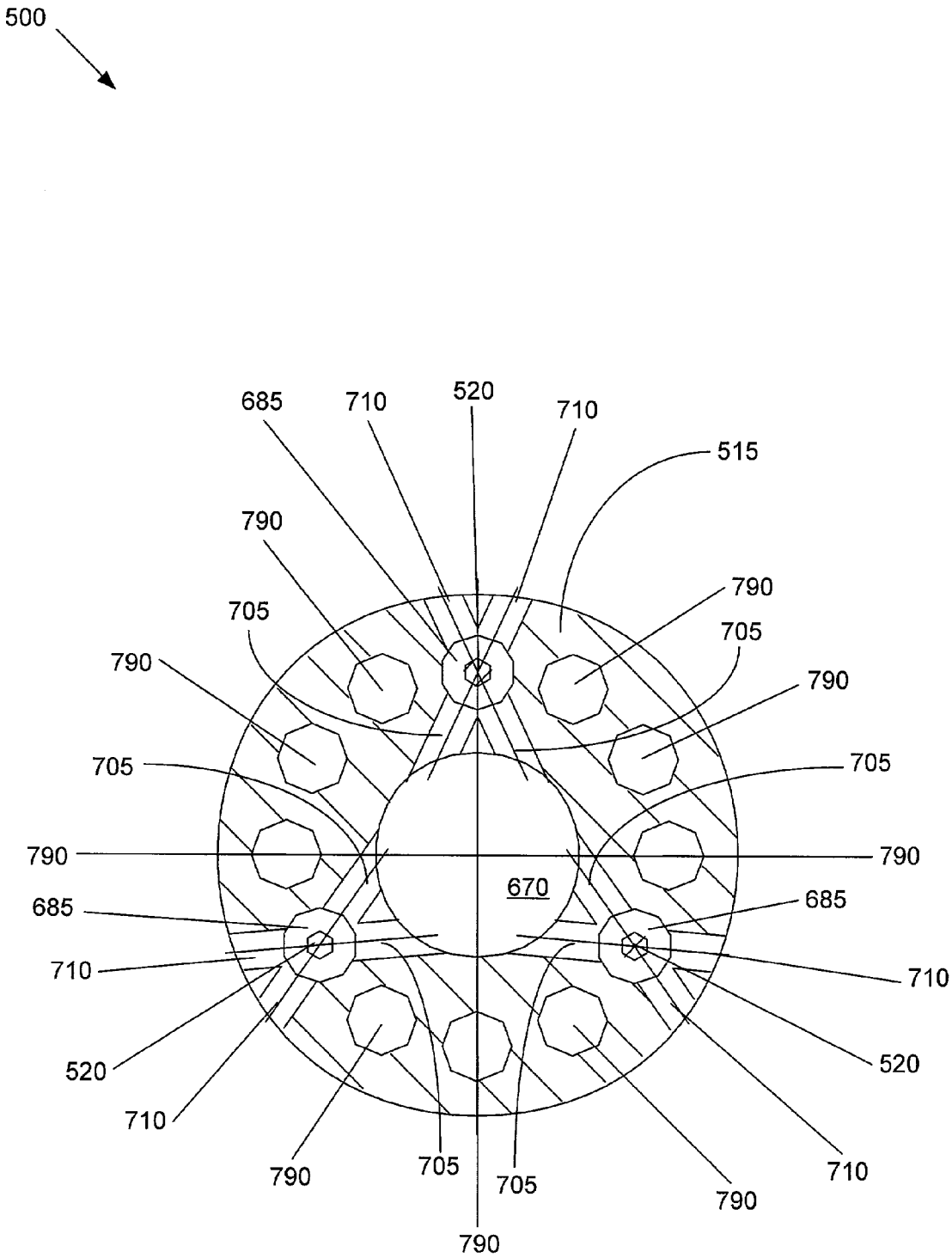
FIG. 2E is a cross-sectional illustration of the apparatus of FIG. 2A.
Figure 2F:
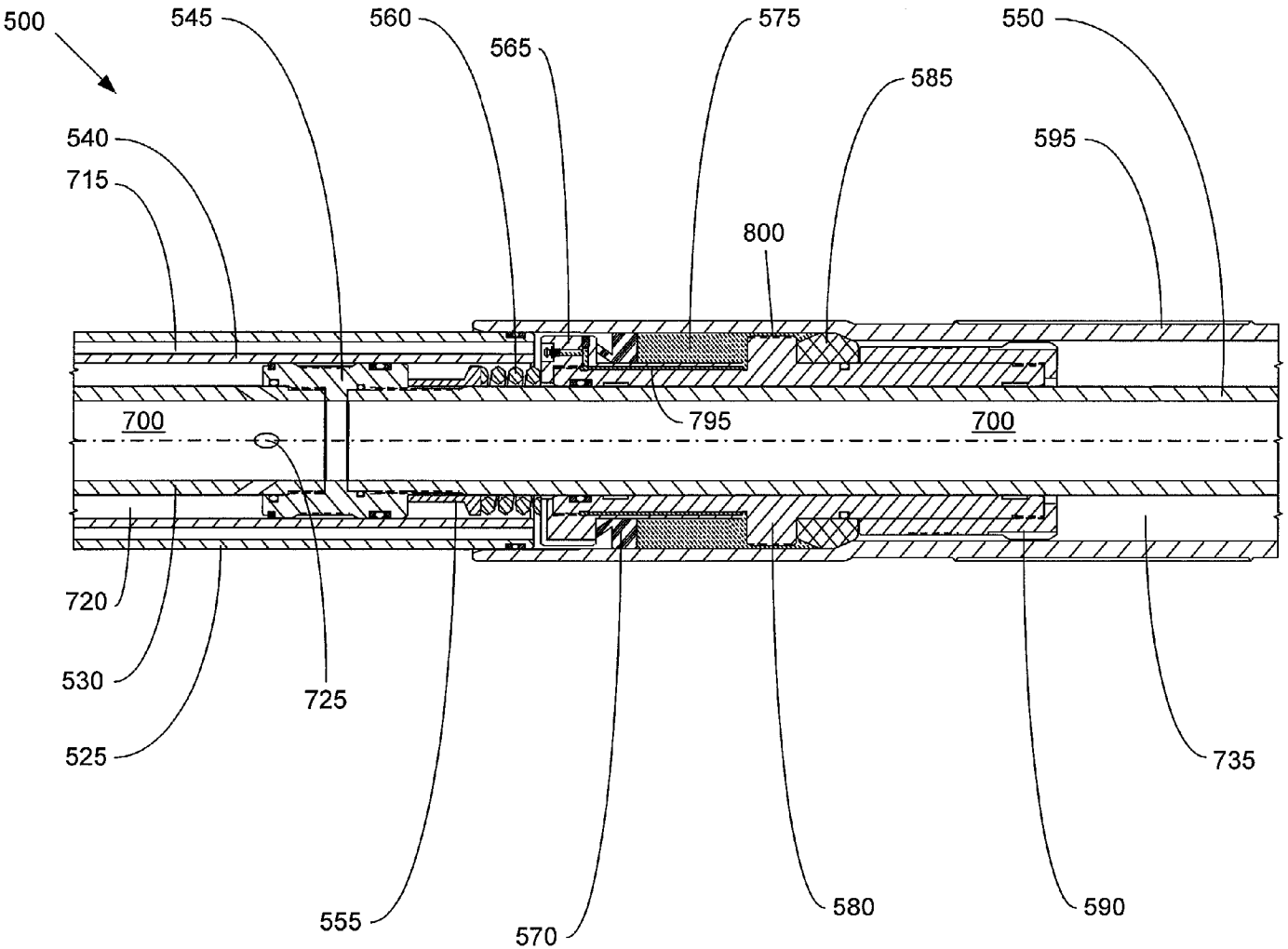
FIG. 2F is a cross-sectional illustration of another portion of the apparatus of FIG. 2A.
Figure 2G:
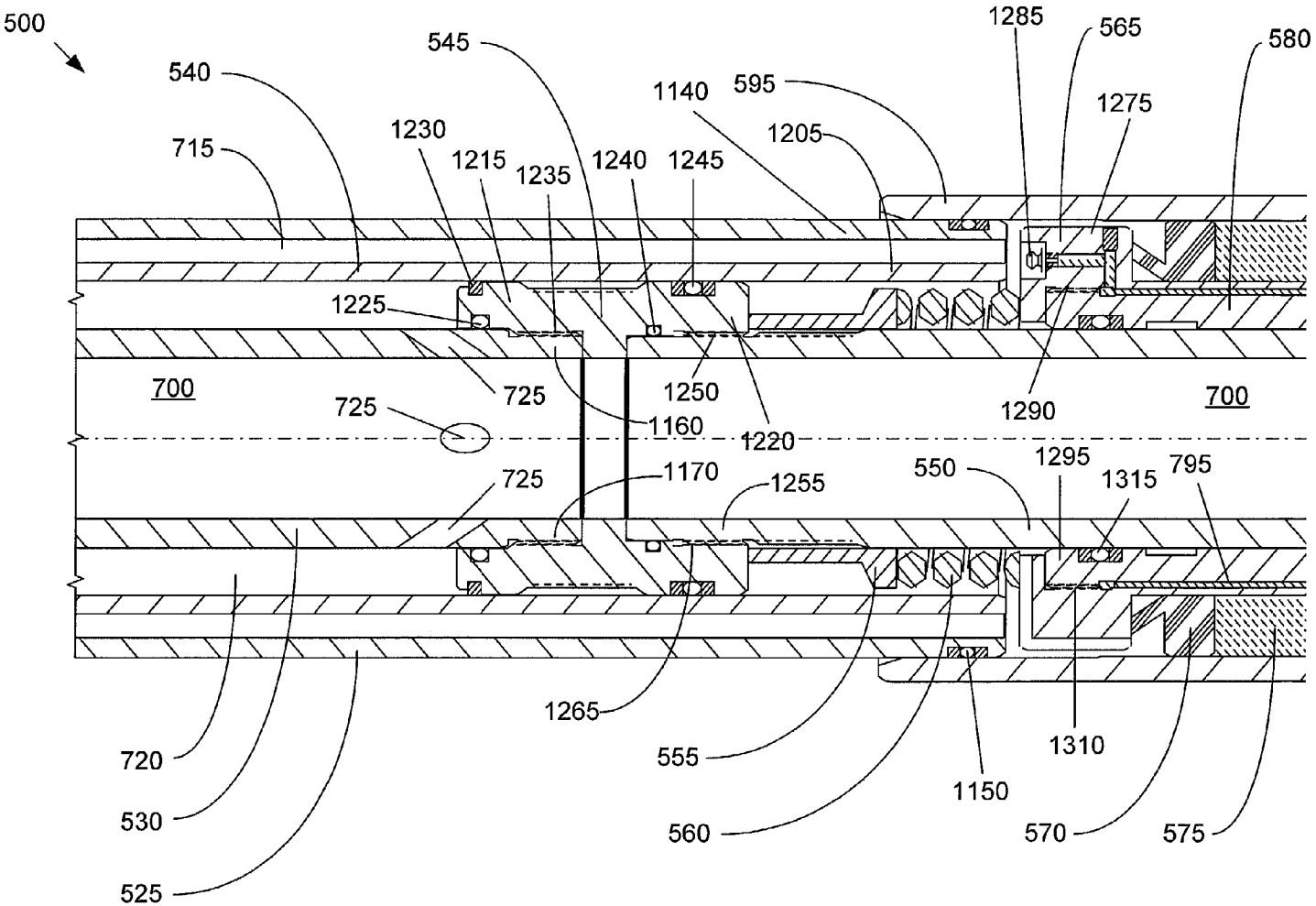
FIG. 2G is an enlarged illustration of a portion of the apparatus of FIG. 2F.
Figure 2H:
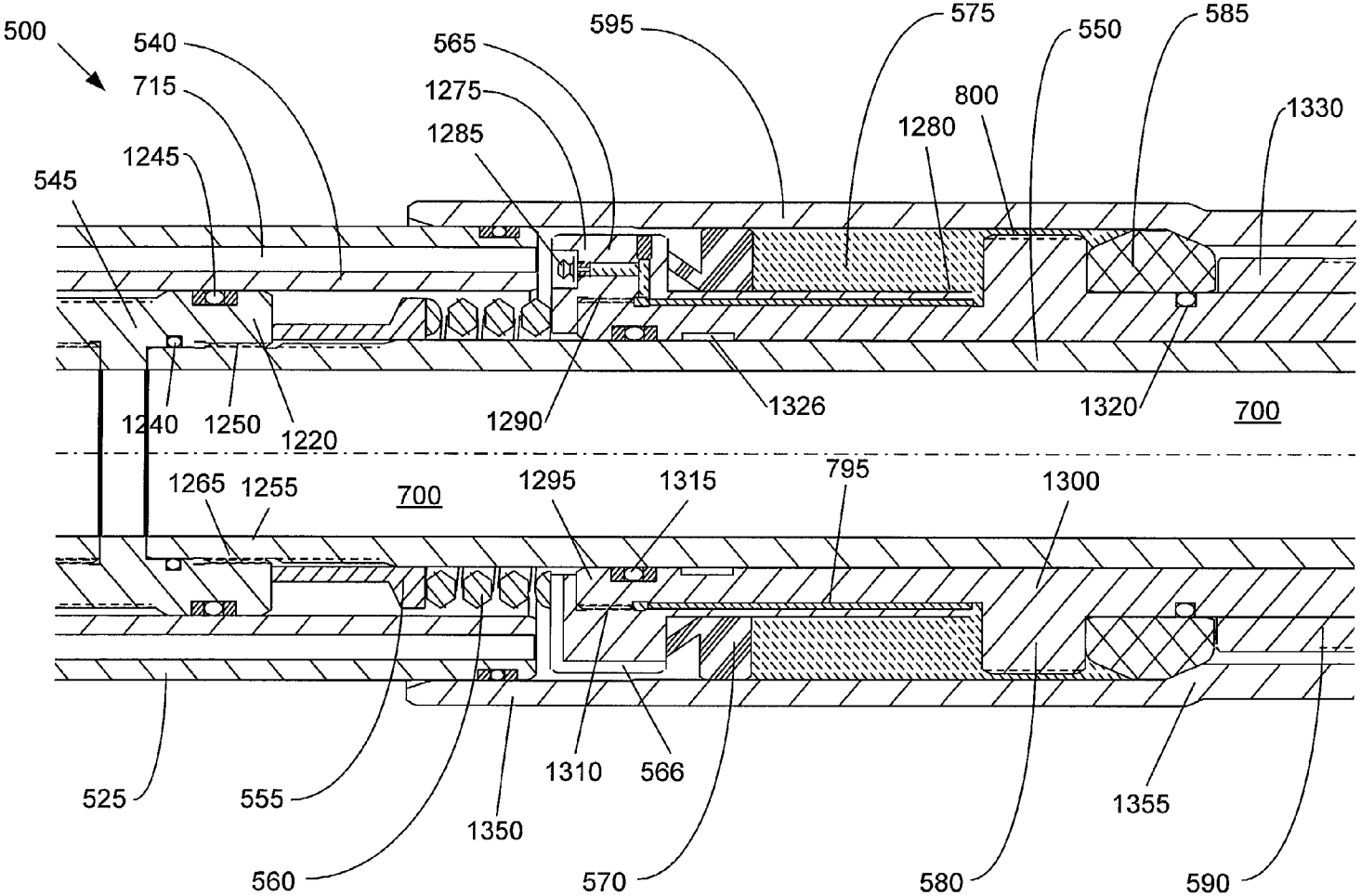
FIG. 2H is an enlarged illustration of a portion of the apparatus of FIG. 2F.
Figure 2I:
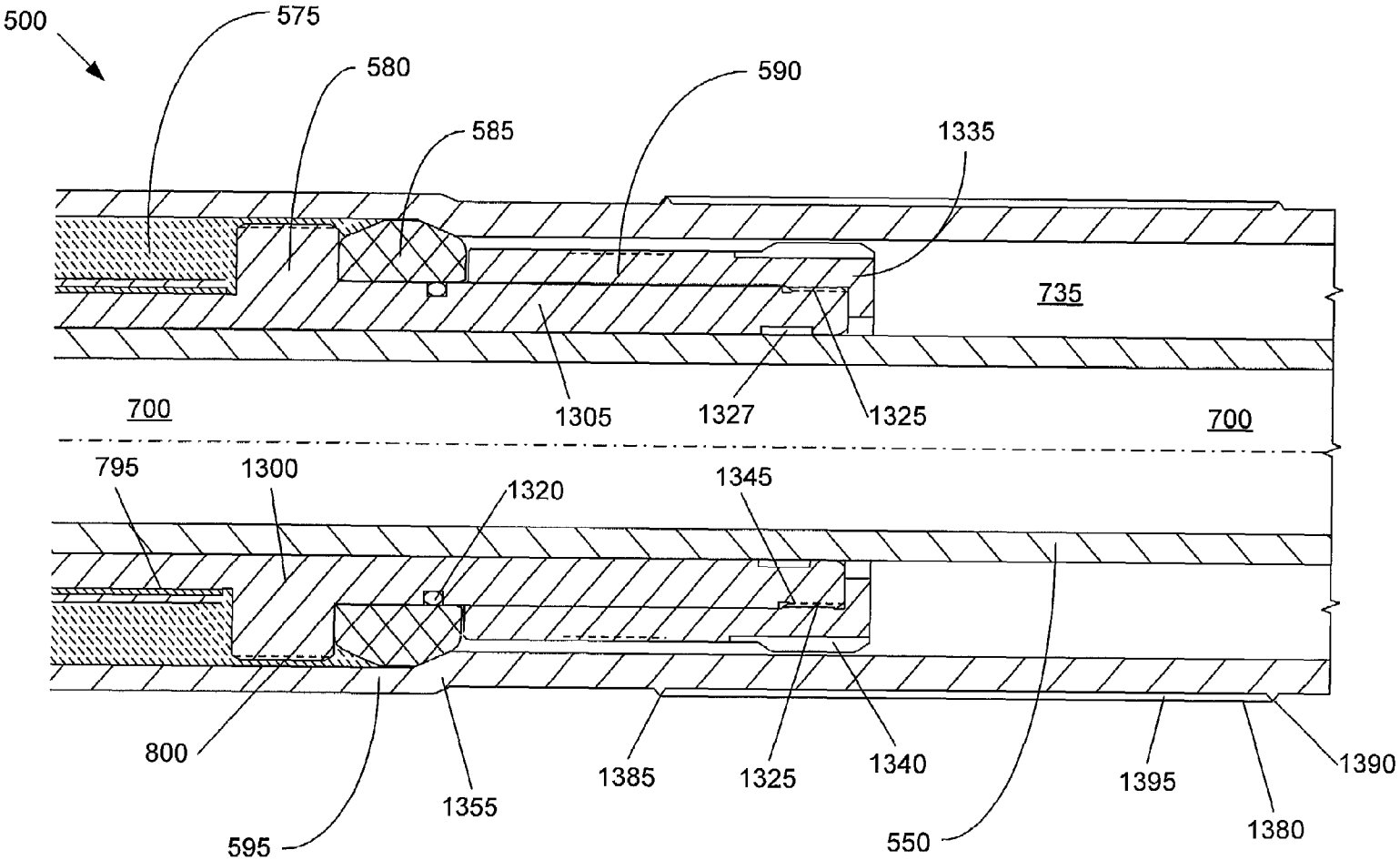
FIG. 2I is an enlarged illustration of a portion of the apparatus of FIG. 2F.
Figure 2J:
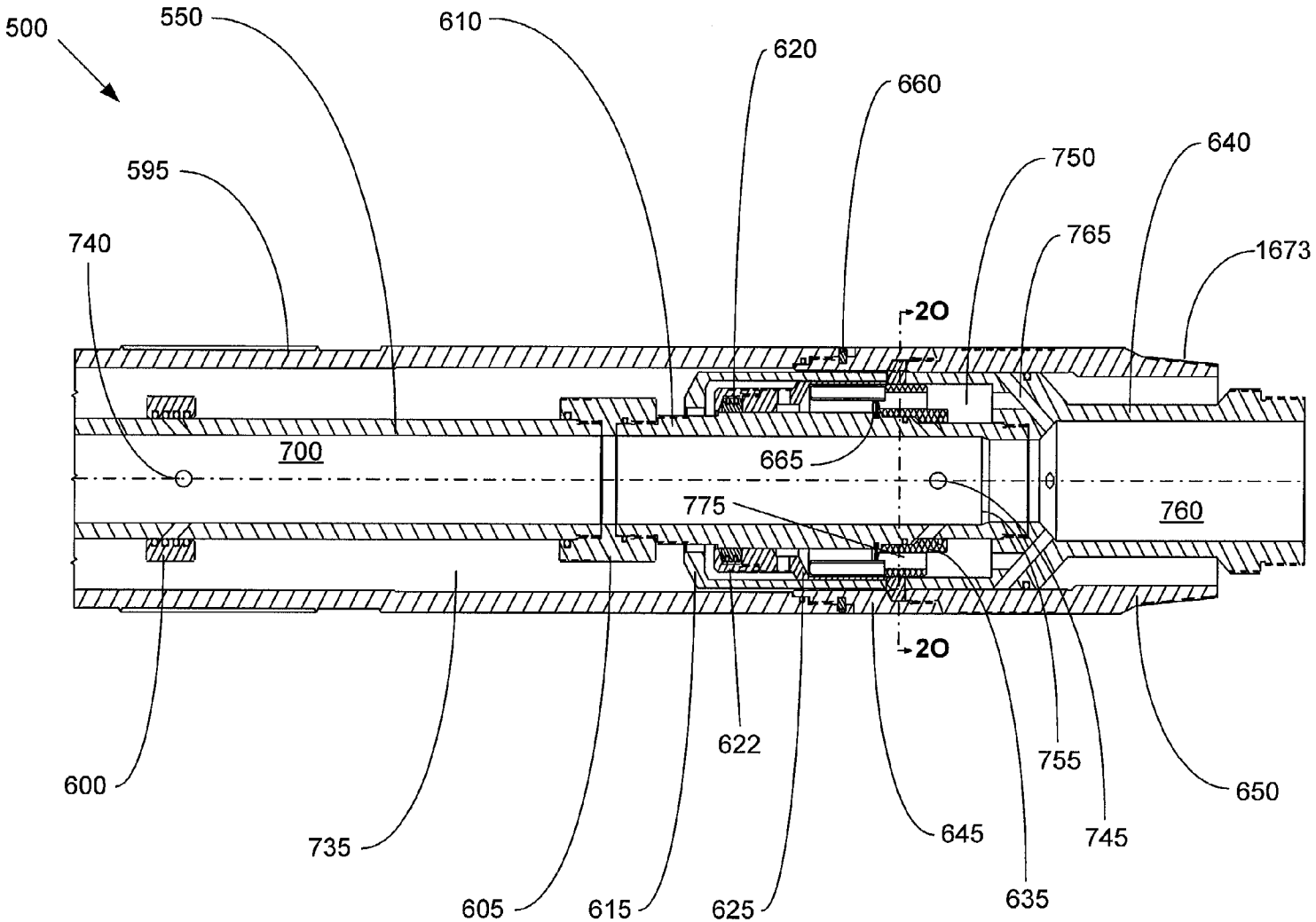
FIG. 2J is a cross-sectional illustration of another portion of the apparatus of FIG. 2A.
Figure 2K:
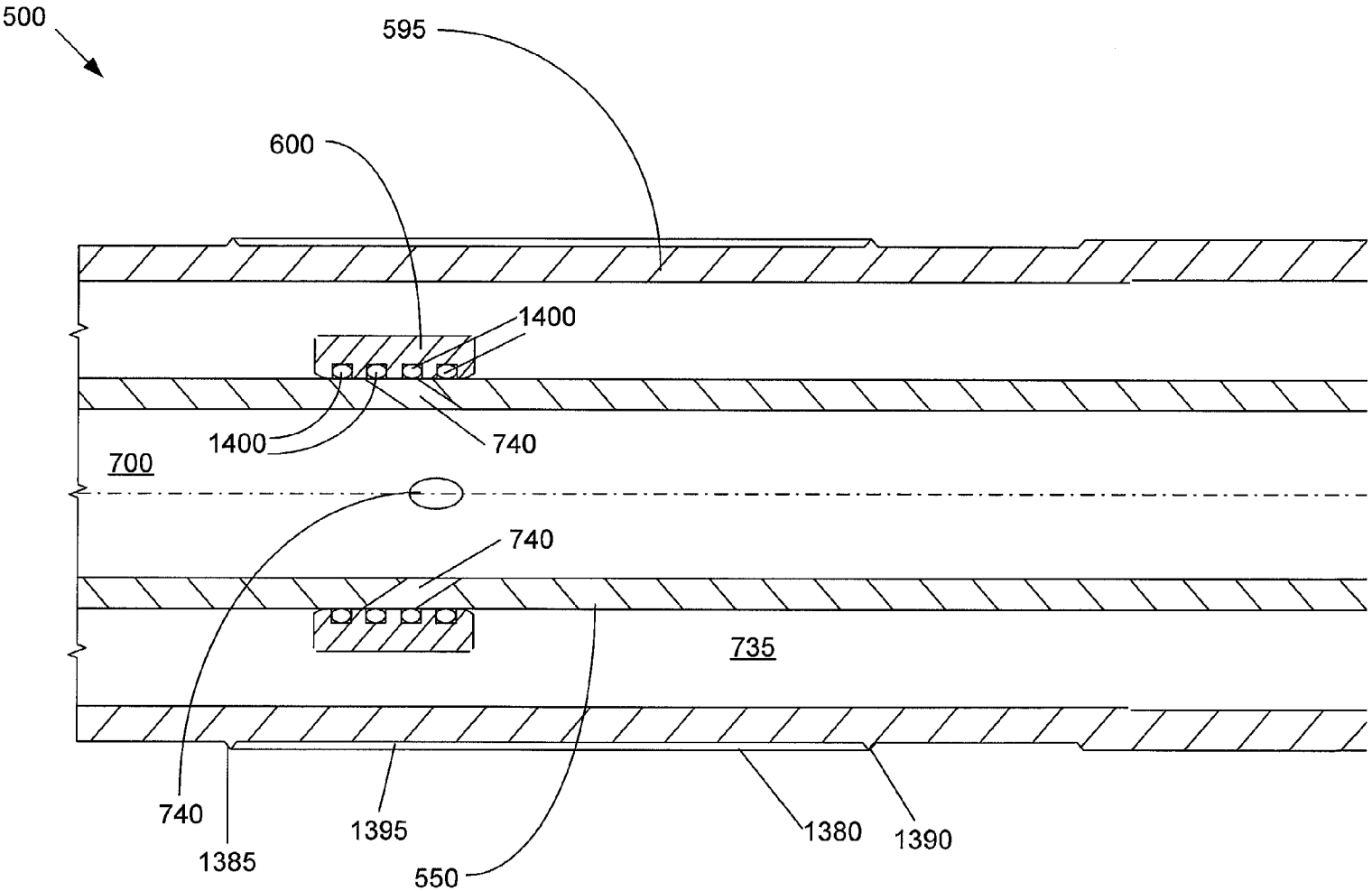
FIG. 2K is an enlarged illustration of a portion of the apparatus of FIG. 2J.
Figure 2L:
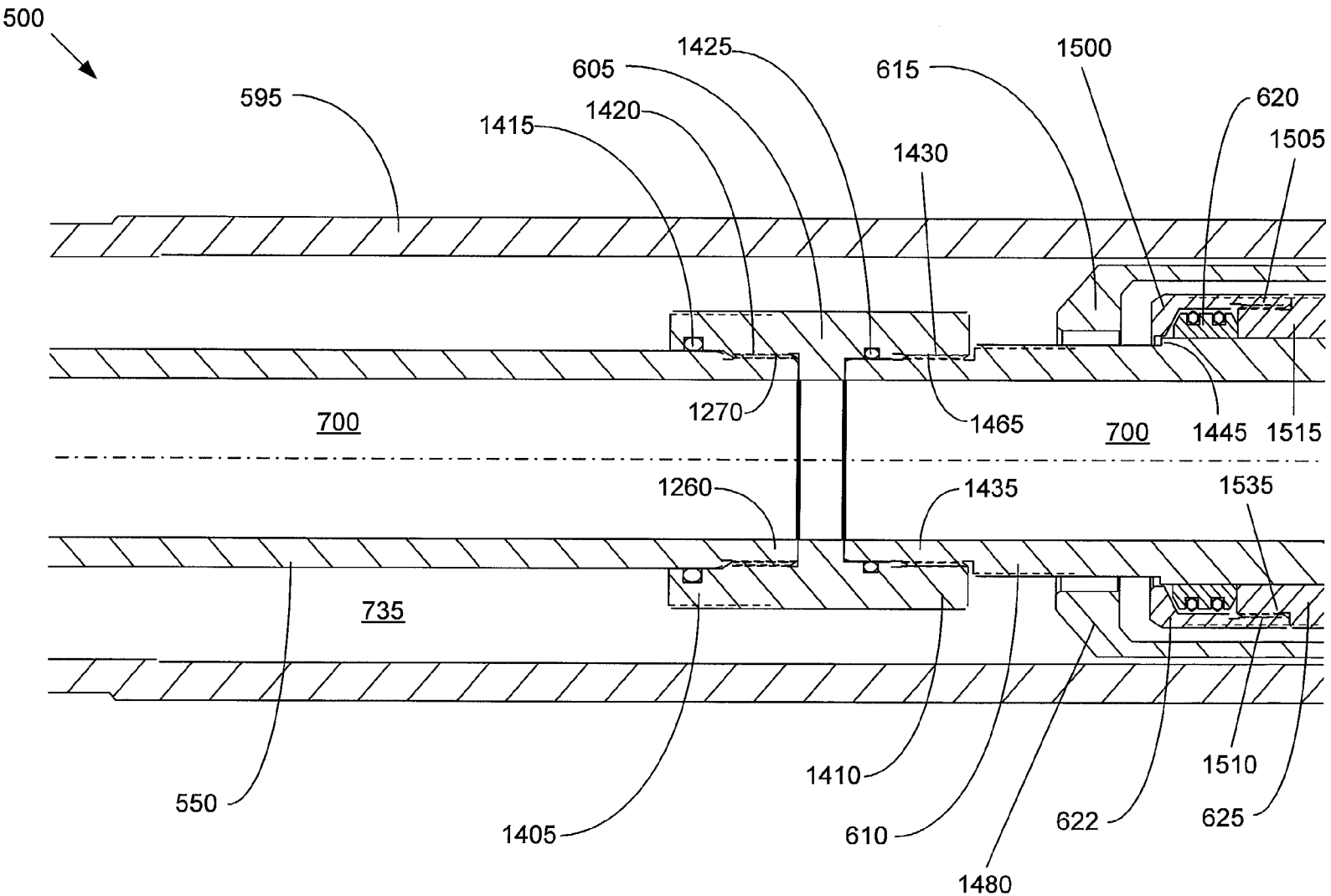
FIG. 2L is an enlarged illustration of a portion of the apparatus of FIG. 2J.
Figure 2M:
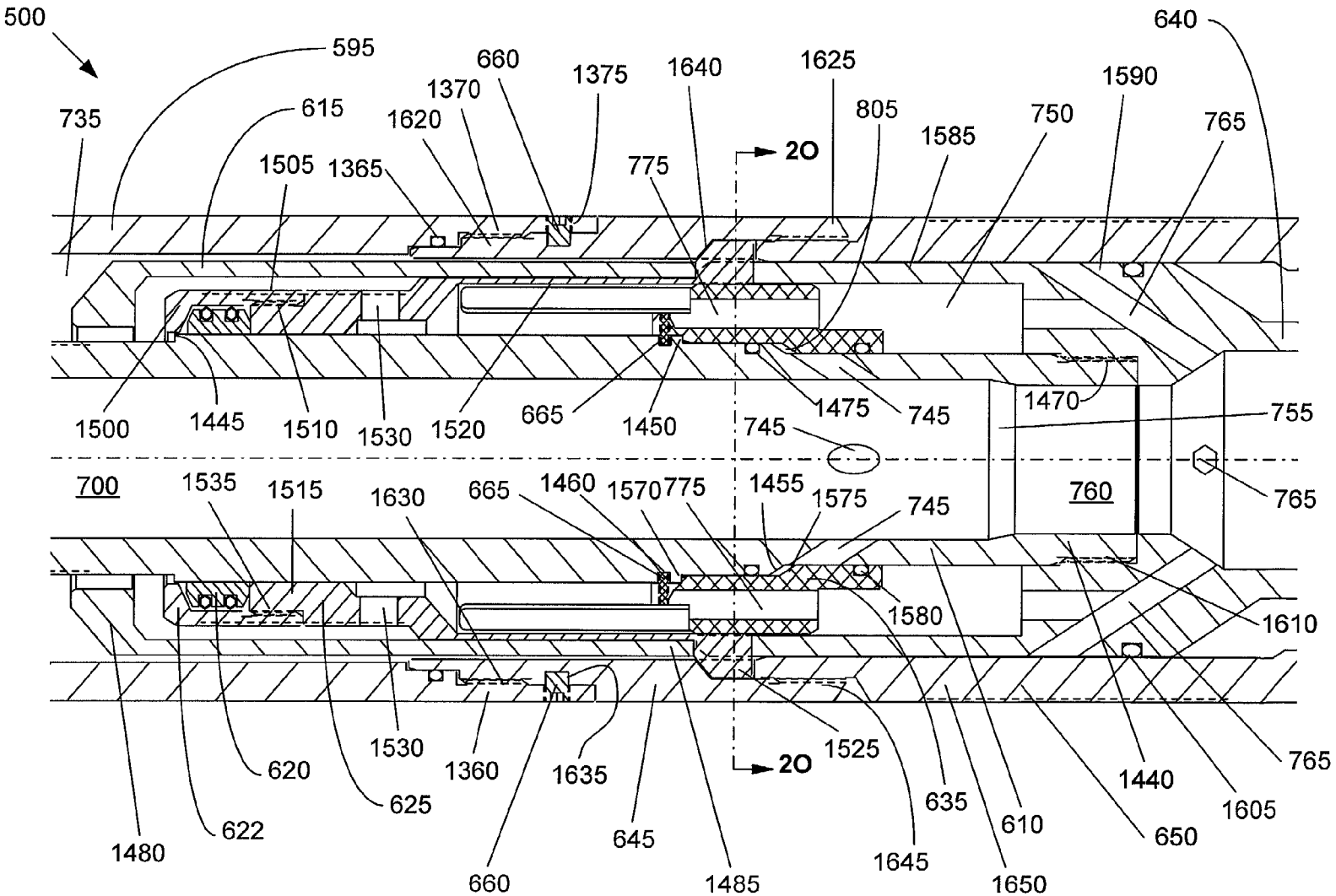
FIG. 2M is an enlarged illustration of a portion of the apparatus of FIG. 2J.
Figure 2N:
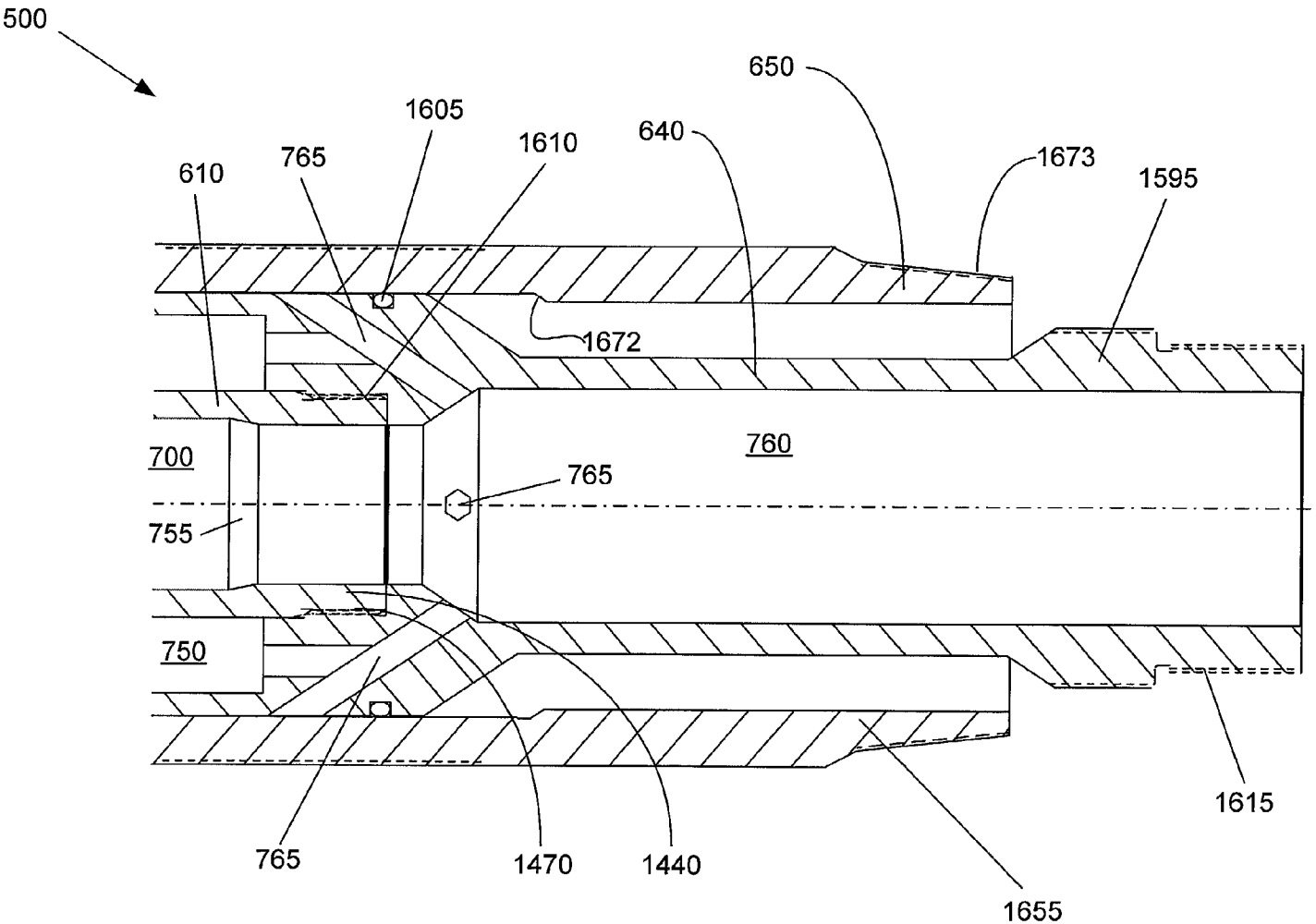
FIG. 2N is an enlarged illustration of a portion of the apparatus of FIG. 2J.
Figure 2O:
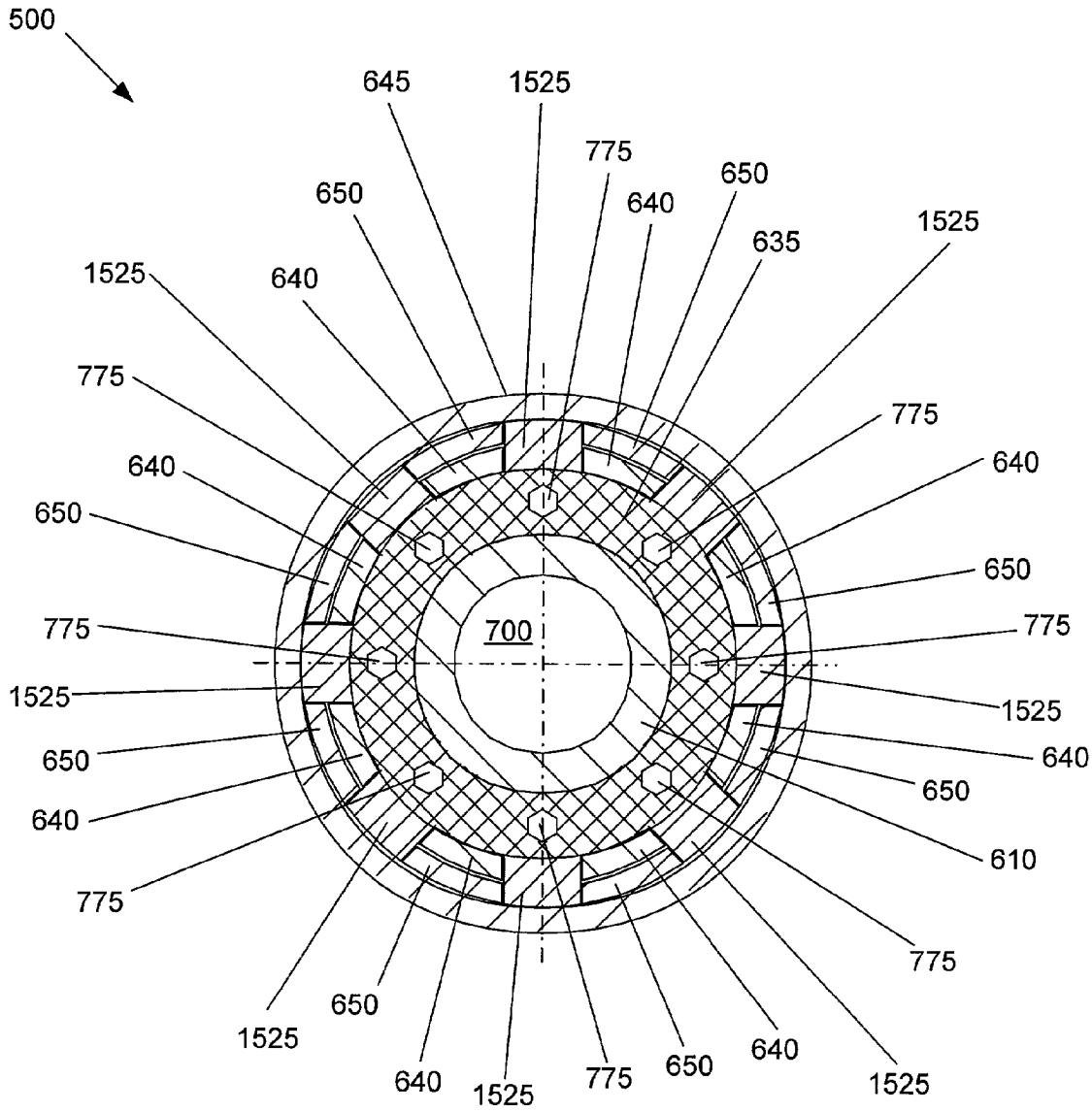
FIG. 2O is a cross-sectional illustration of the apparatus of FIG. 2J.
Figure 3A:
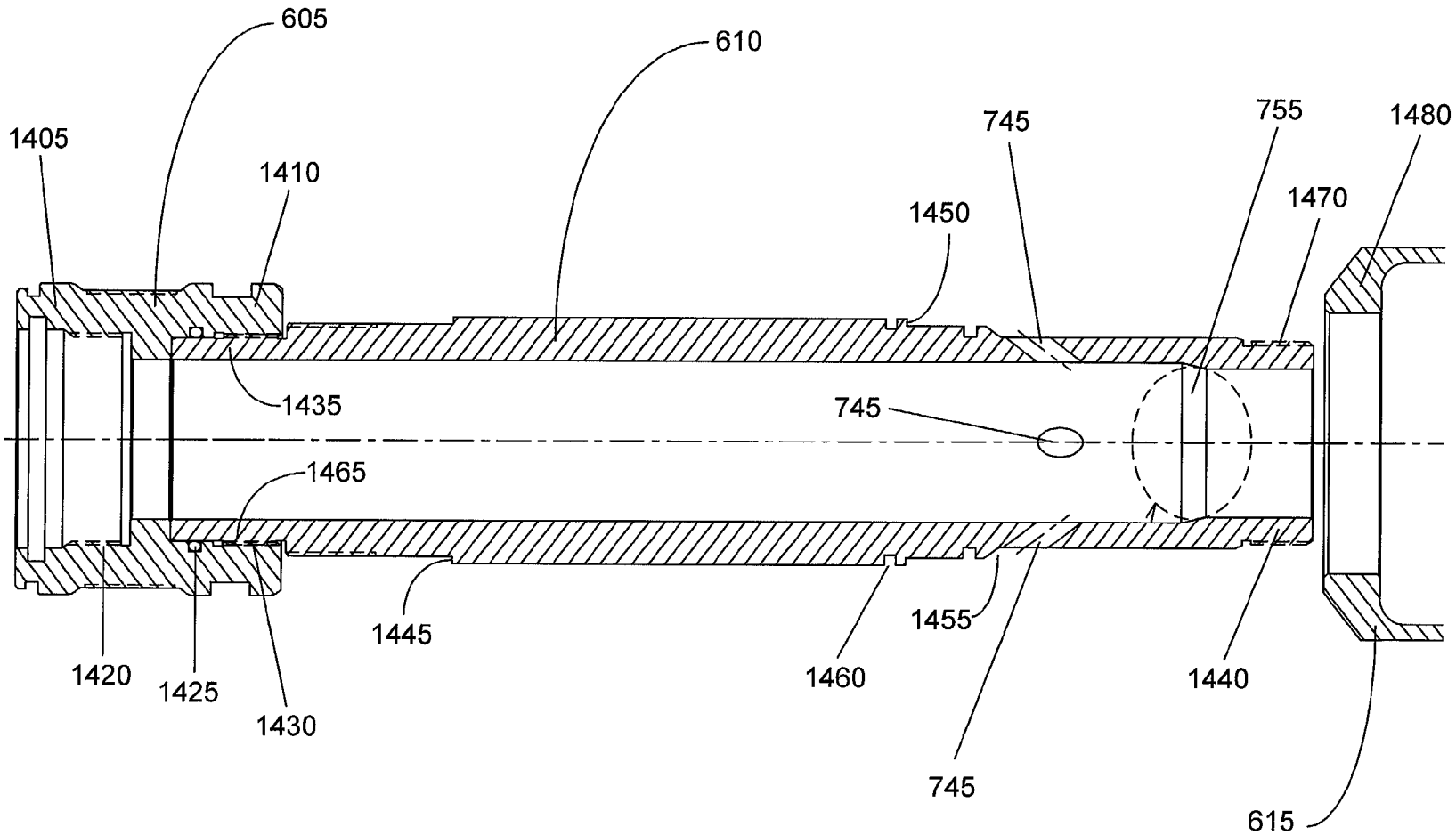
FIGS. 3A to 3D are exploded views of a portion of the apparatus of FIGS. 2A to 2O.
Figure 3B:
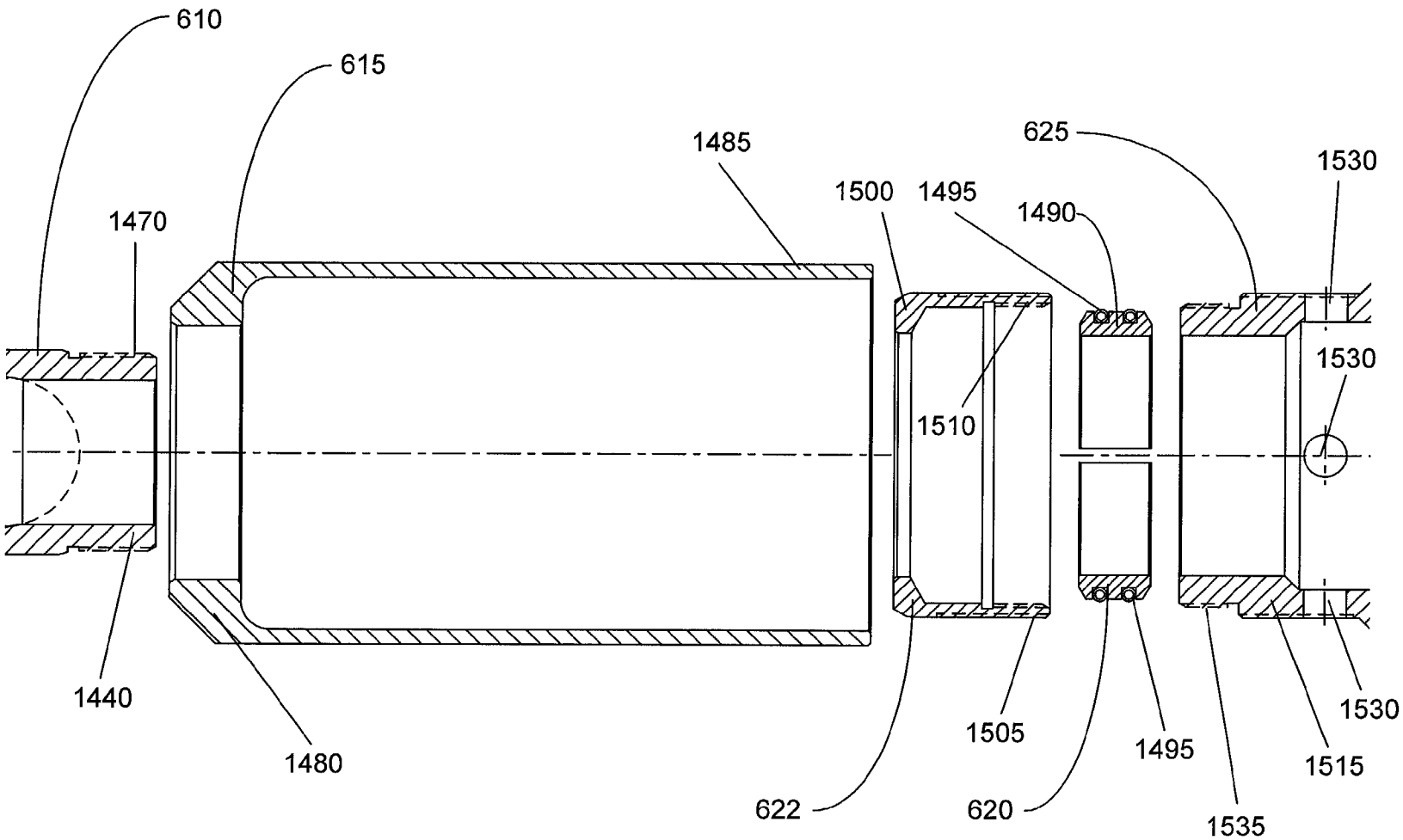
Figure 3C:
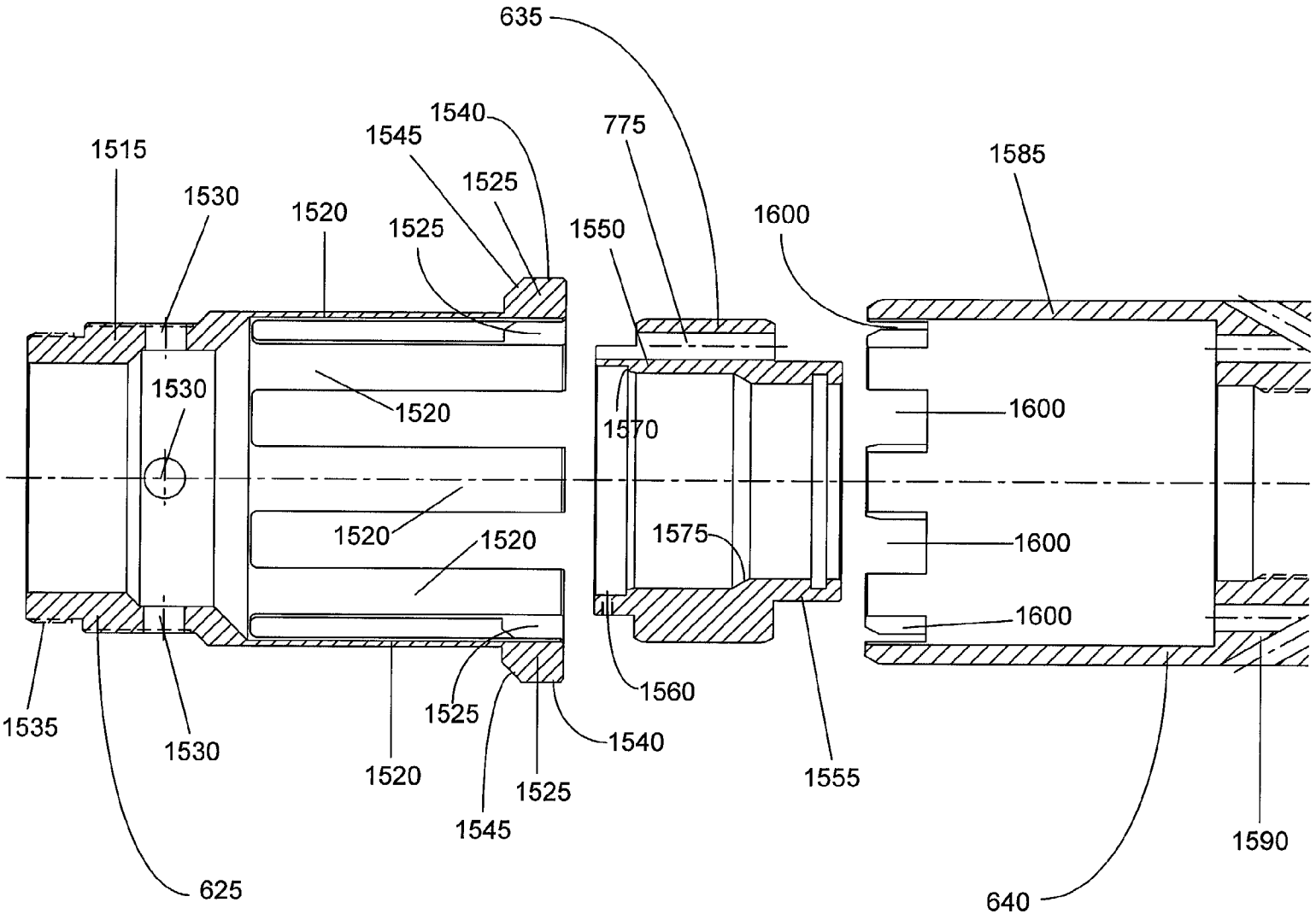
Figure 3D:
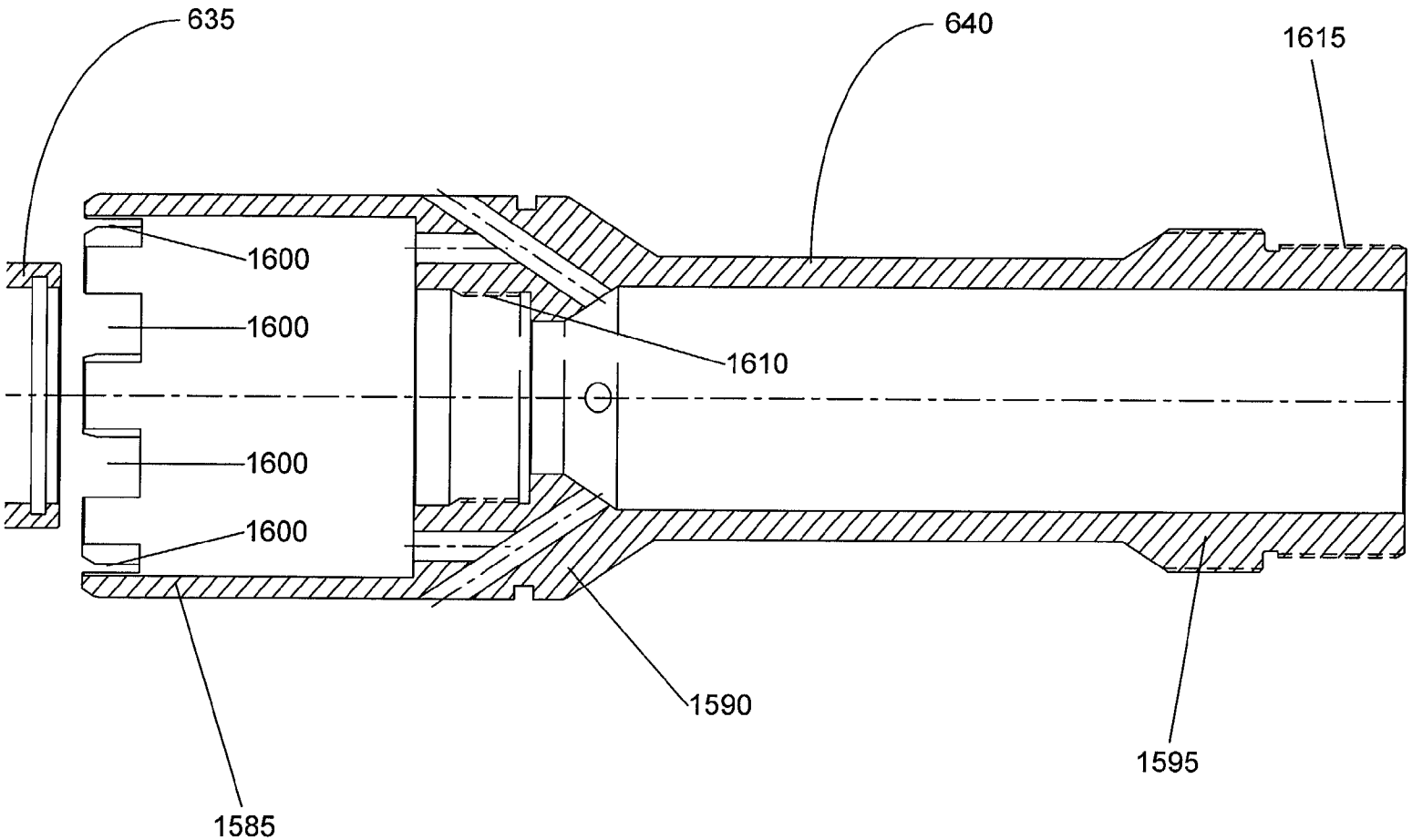
Figure 3E:
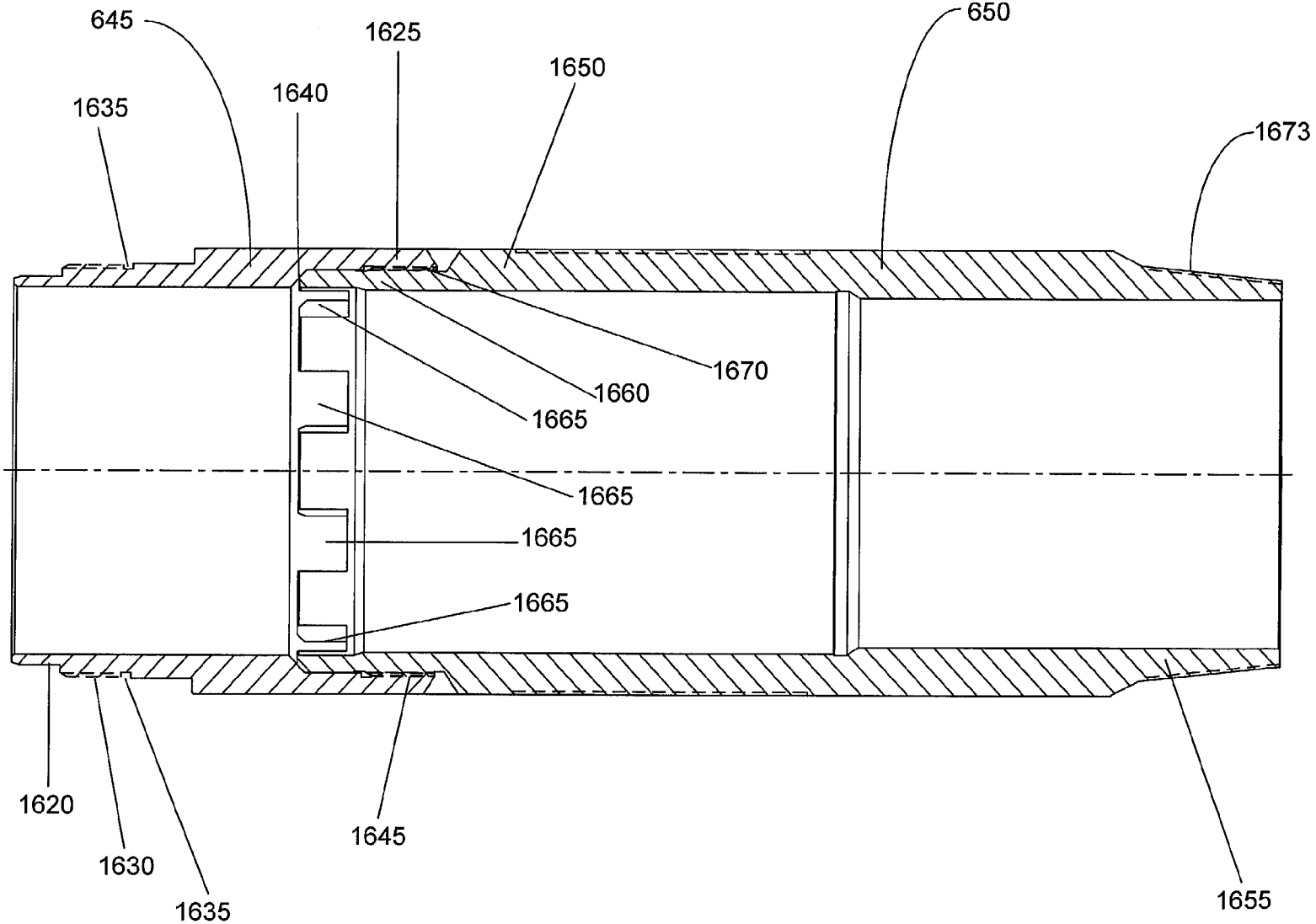
FIG. 3E is a cross-sectional illustration of the outer collet support member and the liner hanger setting sleeve of the apparatus of FIGS. 2A to 2O.
Figure 3G:
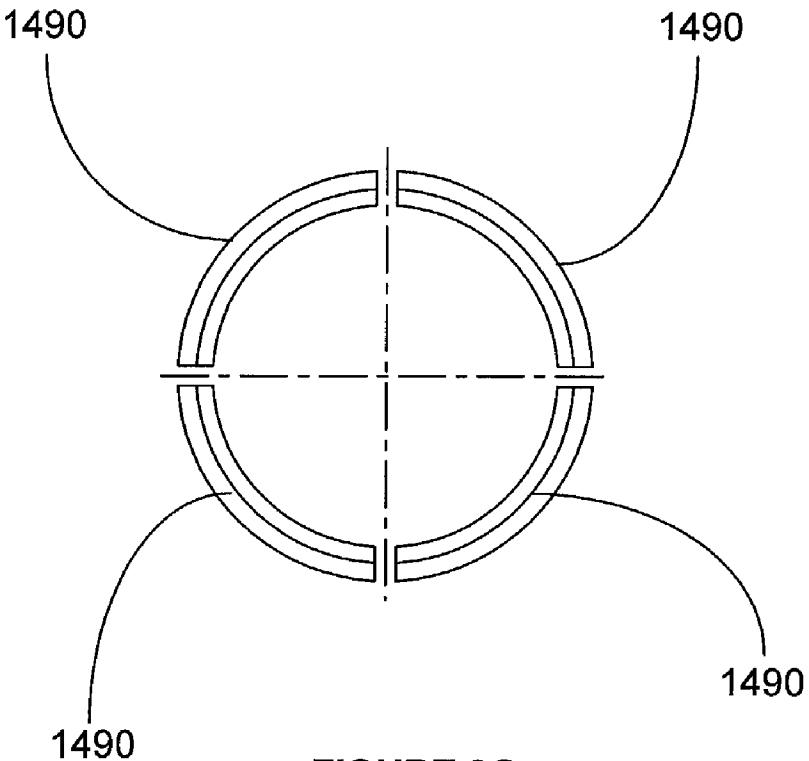
FIG. 3G is a front view of the locking dogs of the apparatus of FIGS. 2A to 2O.
Figure 3F:
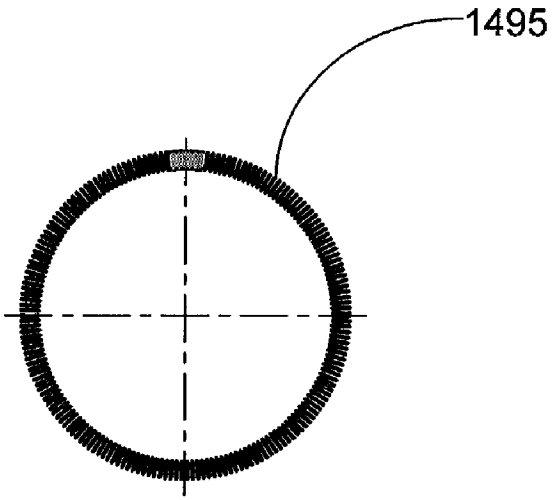
FIG. 3F is a front view of the locking dog spring of the apparatus of FIGS. 2A to 2O.
Figure 3H:
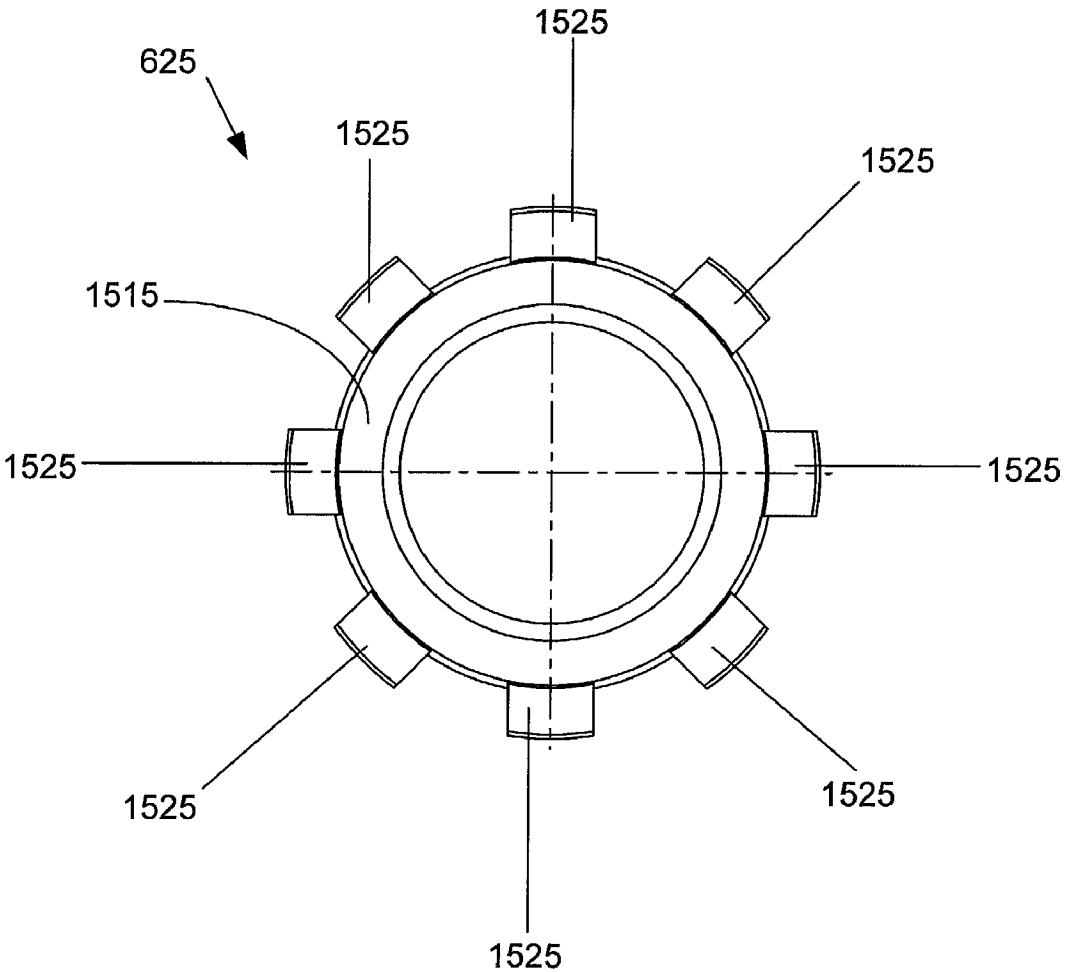
FIG. 3H is a front view of the collet assembly of the apparatus of FIGS. 2A to 2O.
Figure 3I:
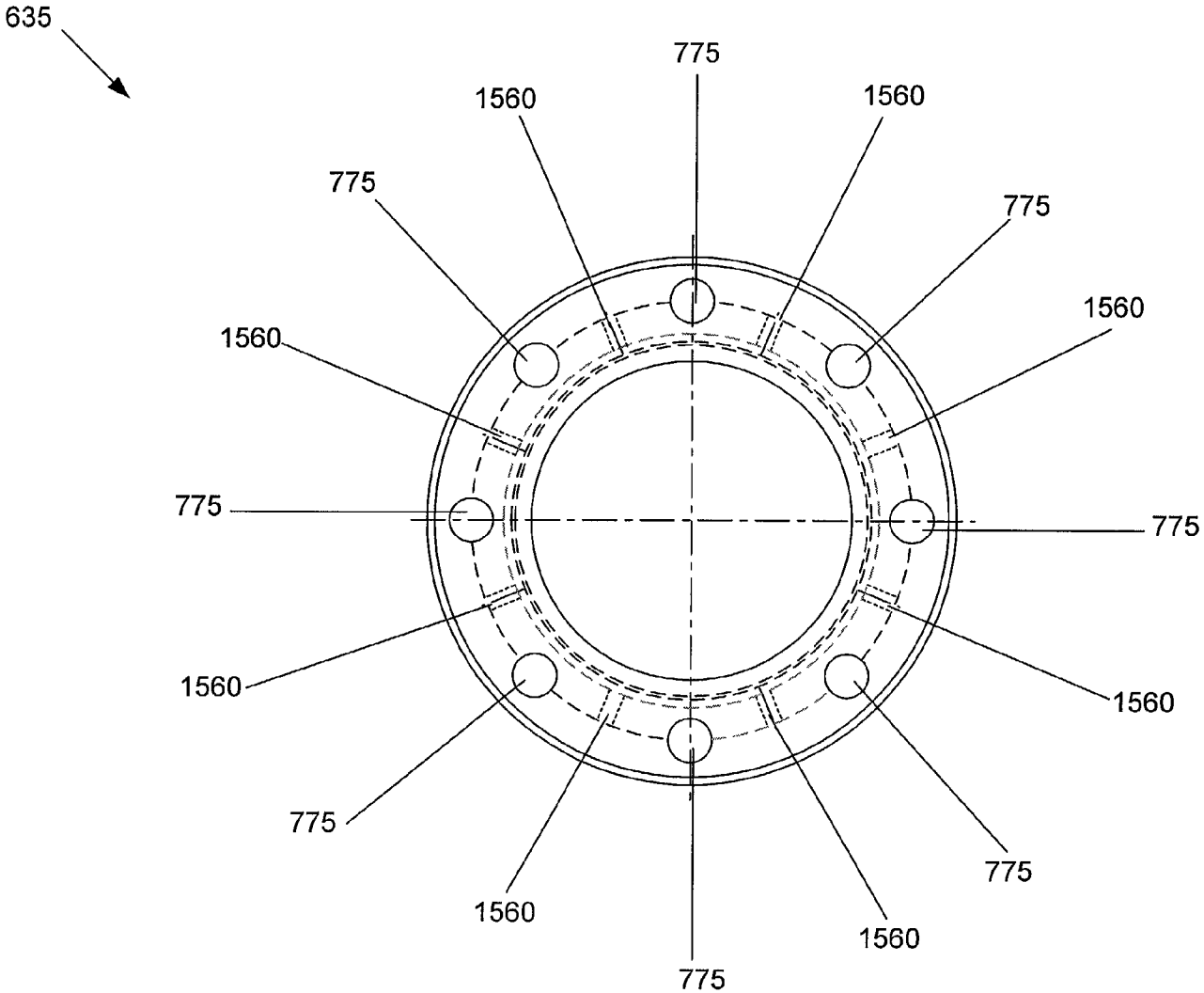
FIG. 3I is a front view of the collet retaining sleeve of the apparatus of FIGS. 2A to 2O.
Figure 3J:
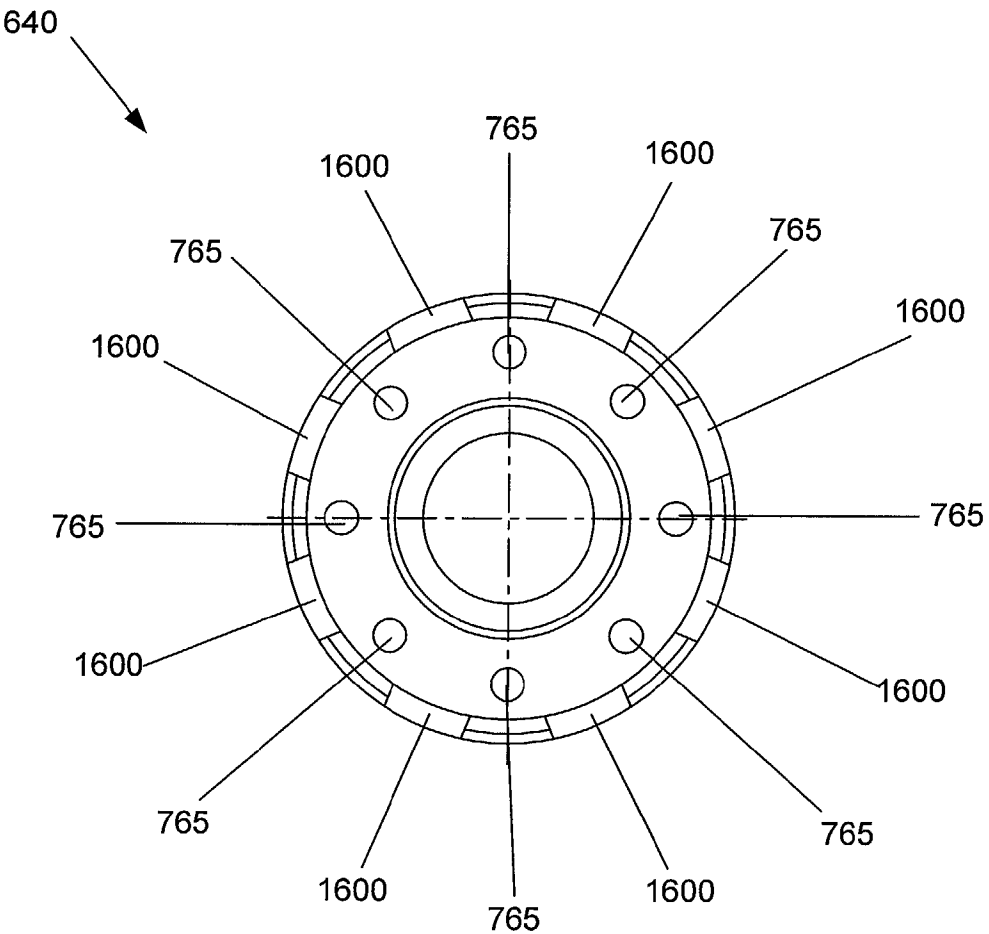
FIG. 3J is a front view of the collet retaining adaptor of the of apparatus of FIGS. 2A to 2O.
Figure 4A:
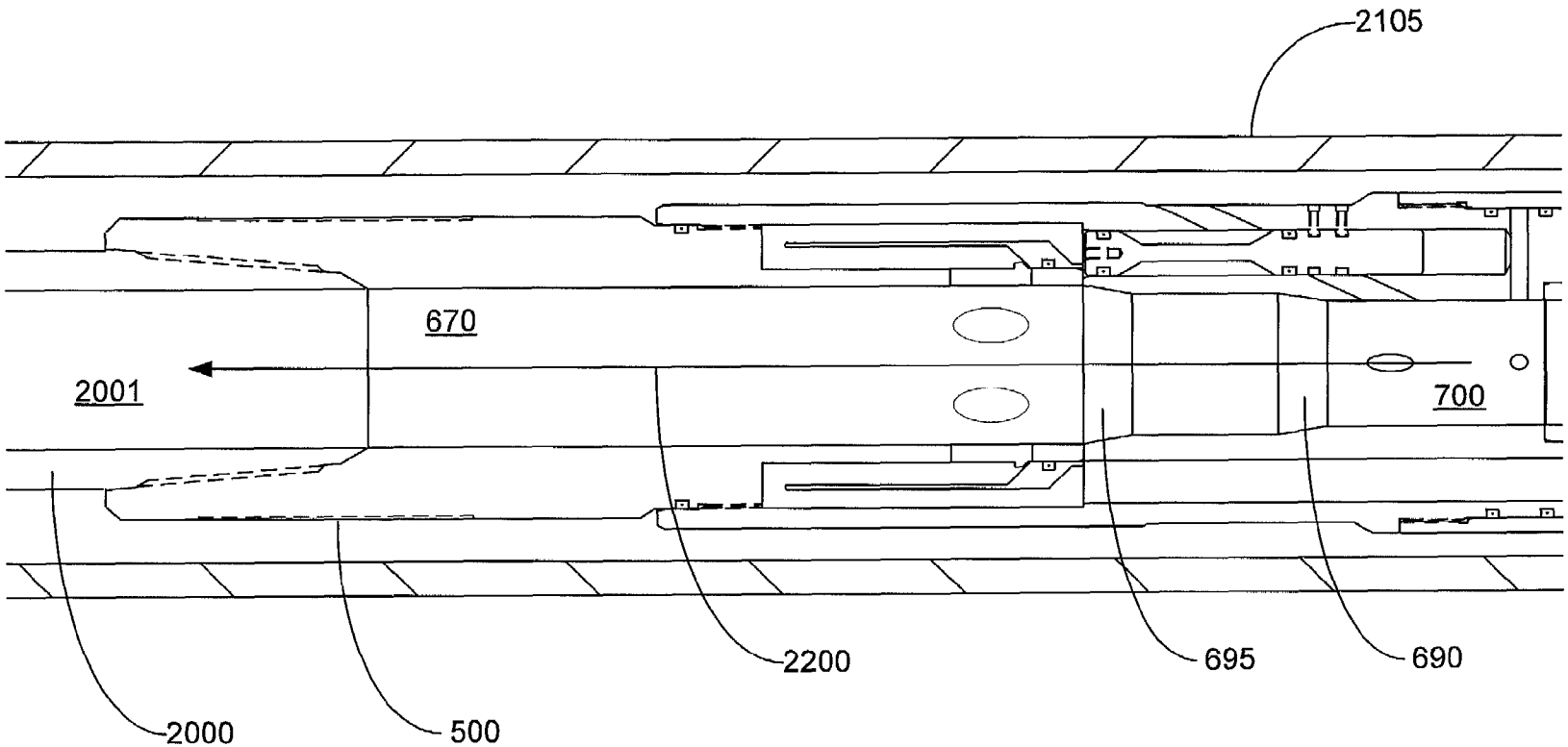
FIGS. 4A to 4G are fragmentary cross-sectional illustrations of an embodiment of a method for placing the apparatus of FIGS. 2A-2O within a wellbore.
Figure 4B:
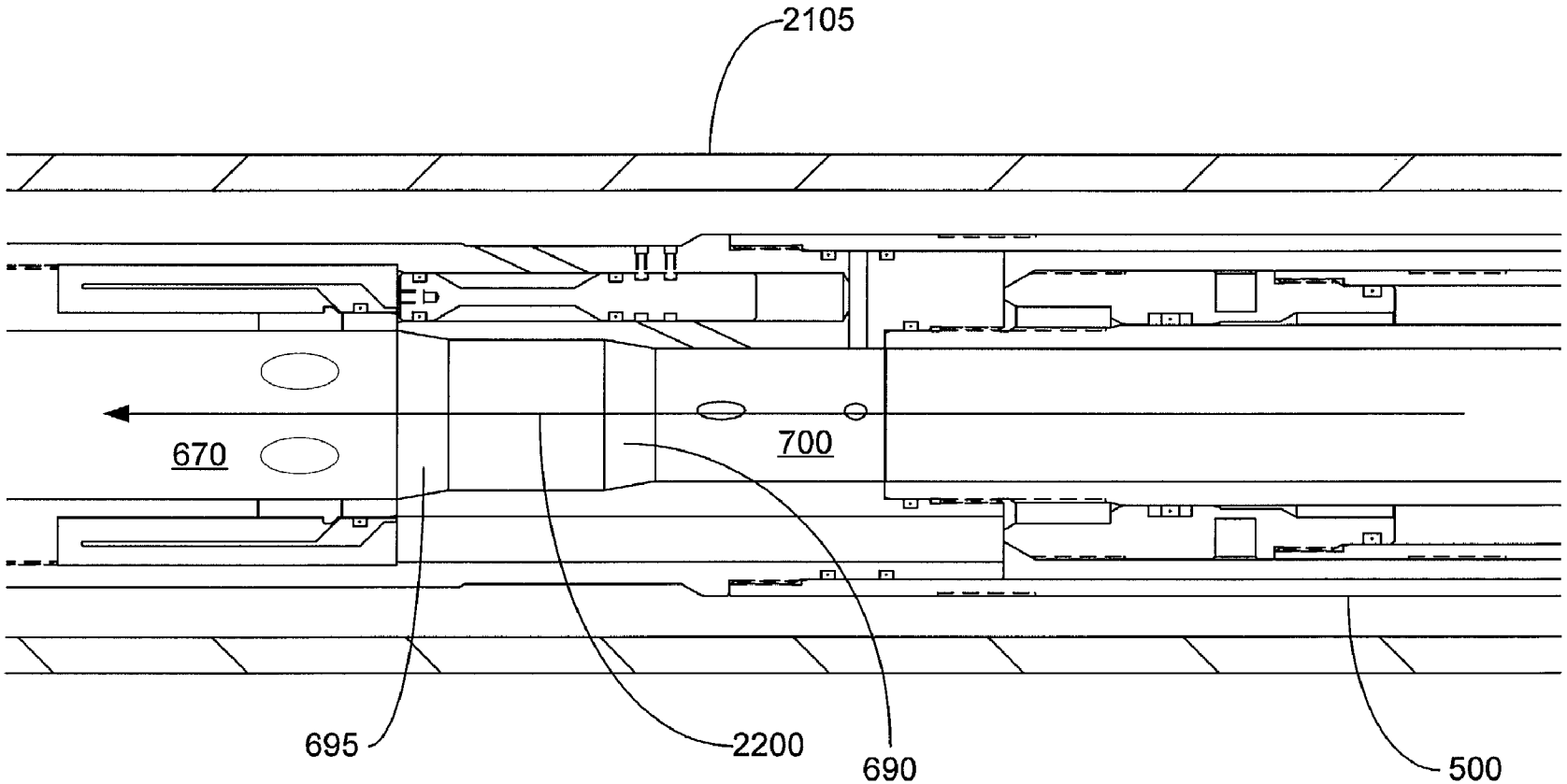
Figure 4C:
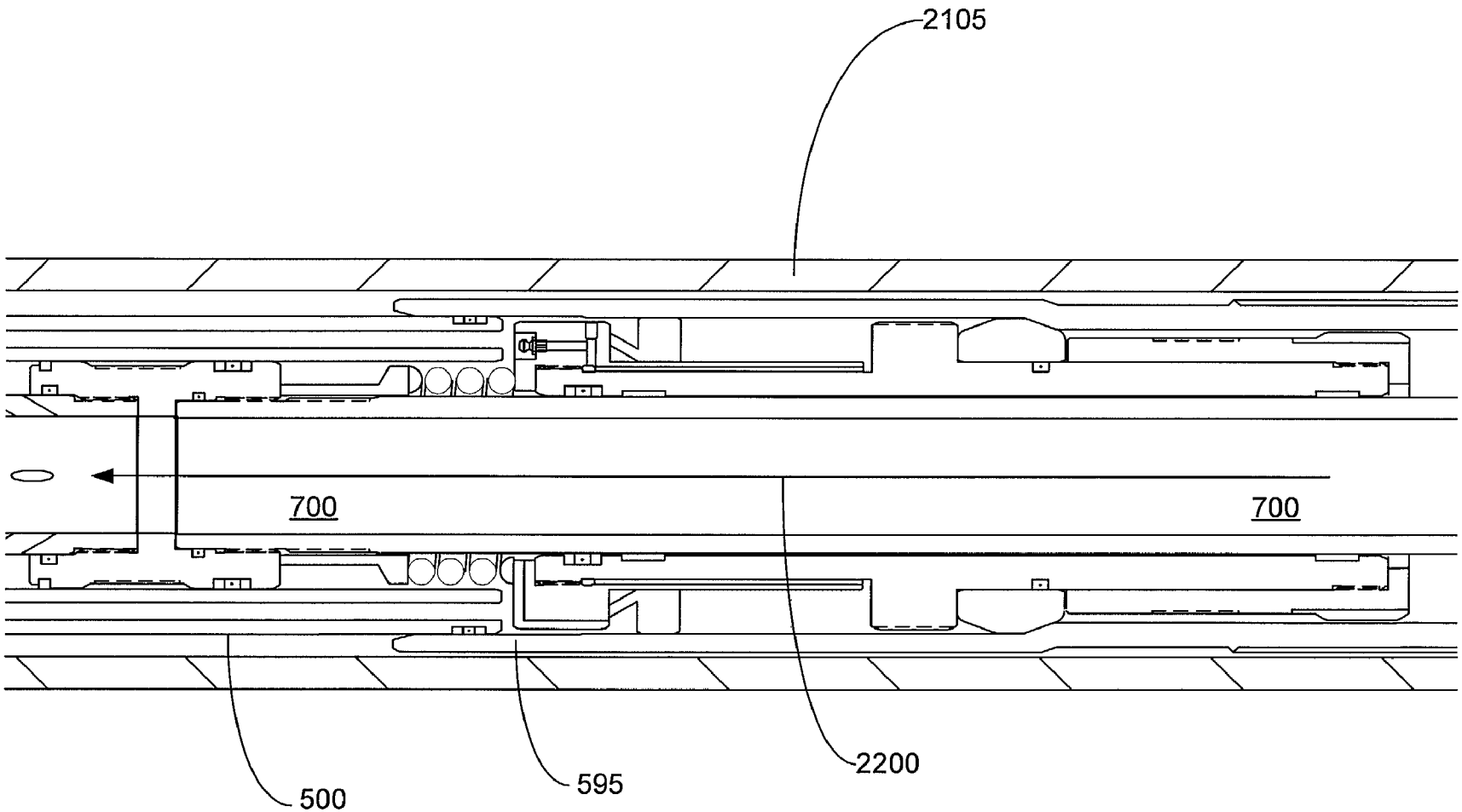
Figure 4D:
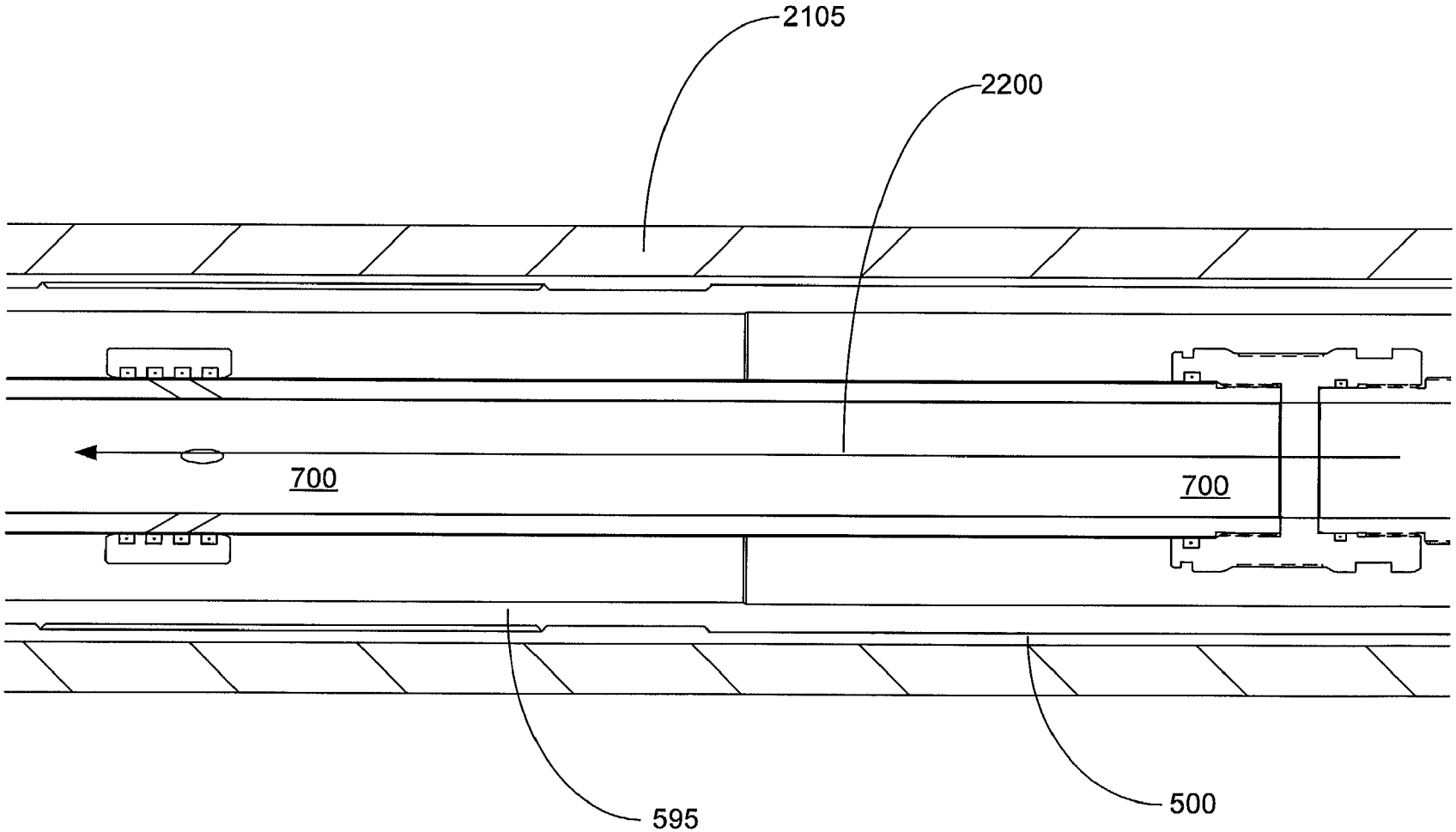
Figure 4E:
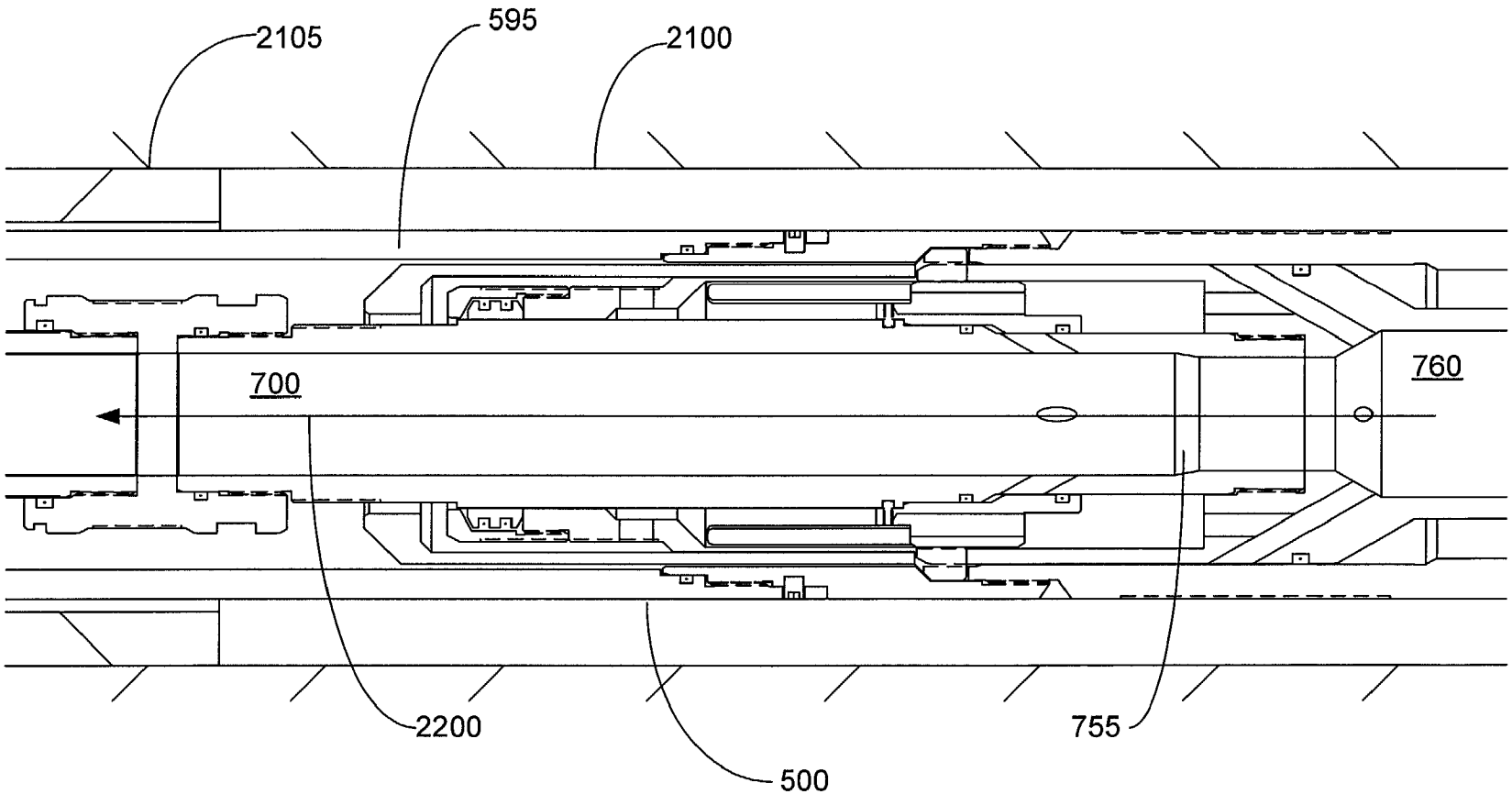
Figure 4F:
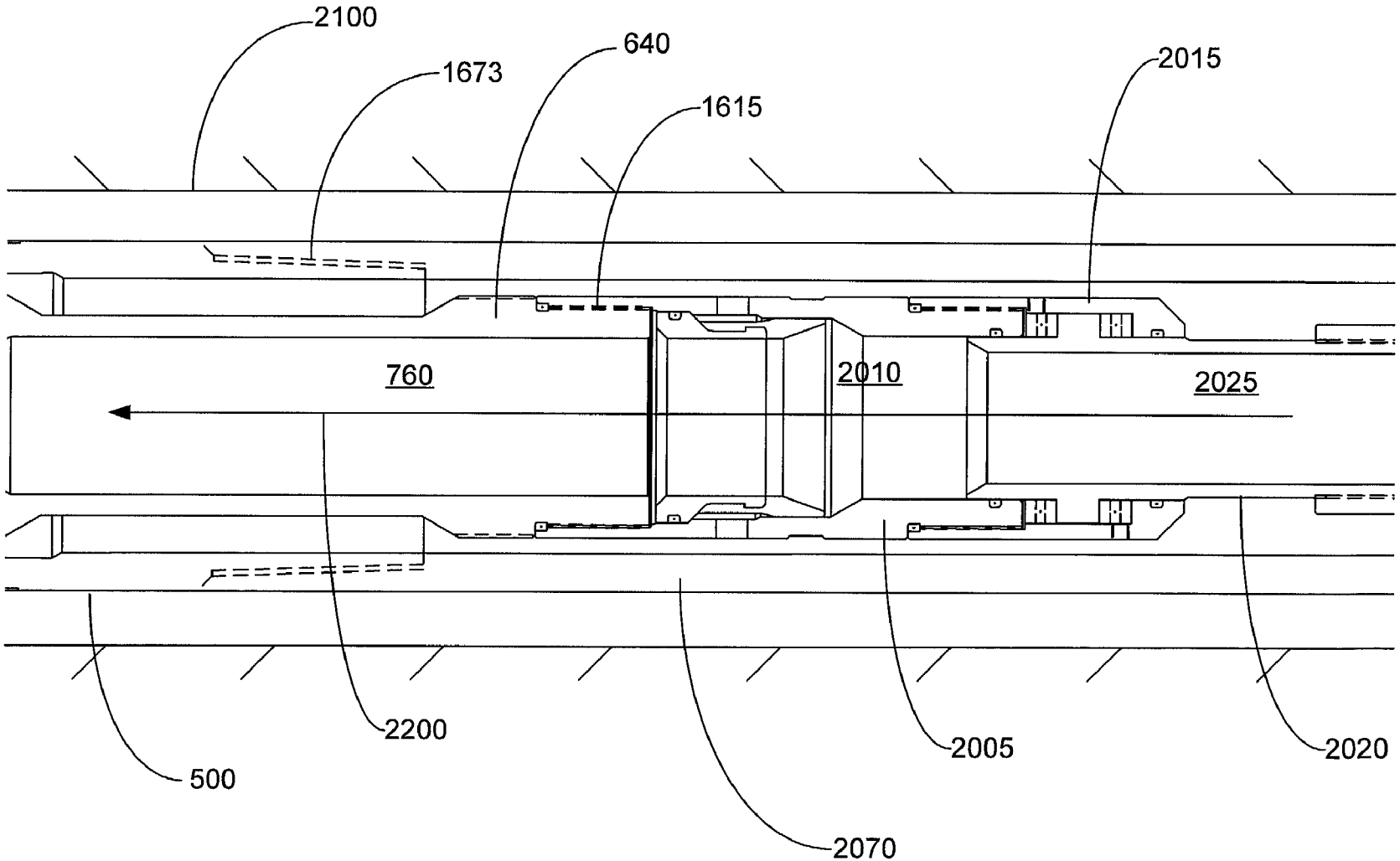
Figure 4G:
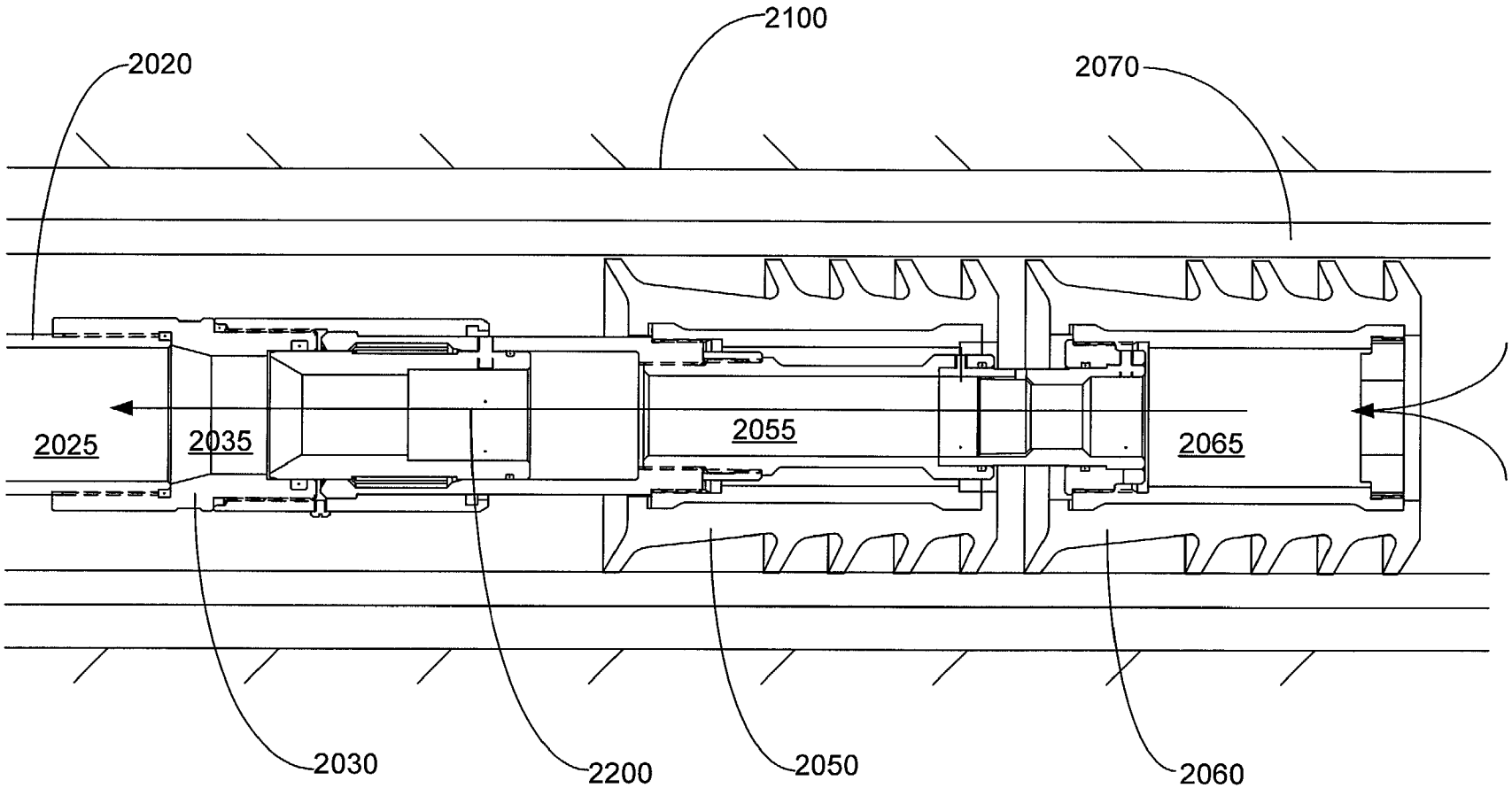

As illustrated in FIG. 1F, upon the completion of the radial expansion process using the apparatus 200 and the curing of the hardenable fluidic sealing material, a new section of wellbore casing is generated that preferably includes the radially expanded tubular member 200 and an outer annular fluidic sealing member 330. In this manner, a new section of wellbore casing is generated by radially expanding a tubular member into contact with a preexisting section of wellbore casing. In several alternative preferred embodiments, the apparatus 200 is used to form or repair a wellbore casing, a pipeline, or a structural support.

Referring now to FIGS. 2A-2O, and 3A-3J, a preferred embodiment of an apparatus 500 for forming or repairing a wellbore casing, pipeline or structural support will be described. The apparatus 500 preferably includes a first support member 505, a debris shield 510, a second support member 515, one or more crossover valve members 520, a force multiplier outer support member 525, a force multiplier inner support member 530, a force multiplier piston 535, a force multiplier sleeve 540, a first coupling 545, a third support member 550, a spring spacer 555, a preload spring 560, a lubrication fitting 565, a lubrication packer sleeve 570, a body of lubricant 575, a mandrel 580, an expansion cone 585, a centralizer 590, a liner hanger 595, a travel port sealing sleeve 600, a second coupling 605, a collet mandrel 610, a load transfer sleeve 615, one or more locking dogs 620, a locking dog retainer 622, a collet assembly 625, a collet retaining sleeve 635, a collet retaining adapter 640, an outer collet support member 645, a liner hanger setting sleeve 650, one or more crossover valve shear pins 655, one or more set screws 660, one or more collet retaining sleeve shear pins 665, a first passage 670, one or more second passages 675, a third passage 680, one or more crossover valve chambers 685, a primary throat passage 690, a secondary throat passage 695, a fourth passage 700, one or more inner crossover ports 705, one or more outer crossover ports 710, a force multiplier piston chamber 715, a force multiplier exhaust chamber 720, one or more force multiplier exhaust passages 725, a second annular chamber 735, one or more expansion cone travel indicator ports 740, one or more collet release ports 745, a third annular chamber 750, a collet release throat passage 755, a fifth passage 760, one or more sixth passages 765, one or more seventh passages 770, one or more collet sleeve passages 775, one or more force multiplier supply passages 790, a first lubrication supply passage 795, a second lubrication supply passage 800, and a collet sleeve release chamber 805.

The first support member 505 is coupled to the debris shield 510 and the second support member 515. The first support member 505 includes the first passage 670 and the second passages 675 for conveying fluidic materials. The first support member 505 preferably has a substantially annular cross section. The first support member 505 may be fabricated from any number of conventional commercially available materials. In a preferred embodiment, the first support member 505 is fabricated from alloy steel having a minimum yield strength ranging from about 75,000 to 140,000 psi in order to optimally provide high strength and resistance to abrasion and fluid erosion. The first support member 505 preferably further includes a first end 1005, a second end 1010, a first threaded portion 1015, a sealing member 1020, a second threaded portion 1025, and a collar 1035.

The first end 1005 of the first support member 505 preferably includes the first threaded portion 1015 and the first passage 670. The first threaded portion 1015 is preferably adapted to be removably coupled to a conventional support member. The first threaded portion 1015 may include any number of conventional commercially available threads. In a preferred embodiment, the first threaded portion 1015 is a 4½" API IF box threaded portion in order to optimally provide high tensile strength.

The second end 1010 of the first support member 505 is preferably adapted to extend within both the debris shield 510 and the second support member 515. The second end 1010 of the first support member 505 preferably includes the sealing member 1020, the second threaded portion 1025, the first passage 670, and the second passages 675. The sealing member 1020 is preferably adapted to fluidicly seal the interface between first support member 505 and the second support member 515. The sealing member 1020 may comprise any number of conventional commercially available sealing members. In a preferred embodiment, the sealing member 1020 is an O-ring sealing member available from Parker Seals in order to optimally provide a fluidic seal. The second threaded portion 1025 is preferably adapted to be removably coupled to the second support member 515. The second threaded portion 1025 may comprise any number of conventional commercially available threaded portions. In a preferred embodiment, the second threaded portion 1025 is a stub acme thread available from Halliburton Energy Services in order to optimally provide high tensile strength. In a preferred embodiment, the second end 1010 of the first support member 505 includes a plurality of the passages 675 in order to optimally provide a large flow cross sectional area. The collar 1035 preferably extends from the second end 1010 of the first support member 505 in an outward radial direction. In this manner, the collar 1035 provides a mounting support for the debris shield 510.

The debris shield 510 is coupled to the first support member 505. The debris shield 510 preferably prevents foreign debris from entering the passage 680. In this manner, the operation of the apparatus 200 is optimized. The debris shield 510 preferably has a substantially annular cross section. The debris shield 510 may be fabricated from any number of conventional commercially available materials. In a preferred embodiment, the debris shield 510 is fabricated from alloy steel having a minimum yield strength ranging from about 75,000 to 140,000 psi in order to optimally provide resistance to erosion. The debris shield 510 further preferably includes a first end 1040, a second end 1045, a channel 1050, and a sealing member 1055.

The first end 1040 of the debris shield 510 is preferably positioned above both the outer surface of the second end 1010 of the first support member 505 and the second passages 675 and below the inner surface of the second support member 515. In this manner, fluidic materials from the passages 675 flow from the passages 675 to the passage 680. Furthermore, the first end 1040 of the debris shield 510 also preferably prevents the entry of foreign materials into the passage 680.

The second end 1045 of the debris shield 510 preferably includes the channel 1050 and the sealing member 1055. The channel 1050 of the second end 1045 of the debris shield 510 is preferably adapted to mate with and couple to the collar 1035 of the second end 1010 of the first support member 505. The sealing member 1055 is preferably adapted to seal the interface between the second end 1010 of the first support member 505 and the second end 1045 of the debris shield 510. The sealing member 1055 may comprise any number of conventional commercially available sealing members. In a preferred embodiment, the sealing member 1055 is an O-ring sealing member available from Parker Seals in order to optimally provide a fluidic seal.

The second support member 515 is coupled to the first support member 505, the force multiplier outer support member 525, the force multiplier inner support member 530, and the crossover valve shear pins 655. The second support member 515 is movably coupled to the crossover valve members 520. The second support member 515 preferably has a substantially annular cross section. The second support member 515 may be fabricated from any number of conventional commercially available materials. In a preferred embodiment, the second support member 515 is fabricated from alloy steel having a minimum yield strength ranging from about 75,000 to 140,000 psi in order to optimally provide high strength and resistance to abrasion and fluid erosion. The second support member 515 preferably further includes a first end 1060, an intermediate portion 1065, a second end 1070, a first threaded portion 1075, a second threaded portion 1080, a third threaded portion 1085, a first sealing member 1090, a second sealing member 1095, and a third sealing member 1100.

The first end 1060 of the second support member 515 is preferably adapted to contain the second end 1010 of the first support member 505 and the debris shield 510. The first end 1060 of the second support member 515 preferably includes the third passage 680 and the first threaded portion 1075. The first threaded portion 1075 of the first end 1060 of the second support member 515 is preferably adapted to be removably coupled to the second threaded portion 1025 of the second end 1010 of the first support member 505. The first threaded portion 1075 may include any number of conventional commercially available threaded portions. In a preferred embodiment, the first threaded portion 1075 is a stub acme thread available from Halliburton Energy Services in order to optimally provide high tensile strength.

The intermediate portion 1065 of the second support member 515 preferably includes the crossover valve members 520, the crossover valve shear pins 655, the crossover valve chambers 685, the primary throat passage 690, the secondary throat passage 695, the fourth passage 700, the seventh passages 770, the force multiplier supply passages 790, the second threaded portion 1080, the first sealing member 1090, and the second sealing member 1095. The second threaded portion 1080 is preferably adapted to be removably coupled to the force multiplier outer support member 525. The second threaded portion 1080 may include any number of conventional commercially available threaded portions. In a preferred embodiment, the second threaded portion 1080 is a stub acme thread available from Halliburton Energy Services in order to optimally provide high tensile strength. The first and second sealing members, 1090 and 1095, are preferably adapted to fluidicly seal the interface between the intermediate portion 1065 of the second support member 515 and the force multiplier outer support member 525.

The second end 1070 of the second support member 515 preferably includes the fourth passage 700, the third threaded portion 1085, and the third sealing member 1100. The third threaded portion 1085 of the second end 1070 of the second support member 515 is preferably adapted to be removably coupled to the force multiplier inner support member 530. The third threaded portion 1085 may include any number of conventional commercially available threaded portions. In a preferred embodiment, the third threaded portion 1085 is a stub acme thread available from Halliburton Energy Services in order to optimally provide high tensile strength. The third sealing member 1100 is preferably adapted to fluidicly seal the interface between the second end 1070 of the second support member 515 and the force multiplier inner support member 530. The third sealing member 1100 may comprise any number of conventional commercially available sealing members. In a preferred embodiment, the third sealing member 1100 is an O-ring sealing member available from Parker Seals in order to optimally provide a fluidic seal.

Each crossover valve member 520 is coupled to corresponding crossover valve shear pins 655. Each crossover valve member 520 is also movably coupled to the second support member 515 and contained within a corresponding crossover valve chamber 685. Each crossover valve member 520 preferably has a substantially circular cross-section. The crossover valve members 520 may be fabricated from any number of conventional commercially available materials. In a preferred embodiment, the crossover valve members 520 are fabricated from alloy steel having a minimum yield strength ranging from about 75,000 to 140,000 psi in order to optimally provide high strength and resistance to abrasion and fluid erosion. In a preferred embodiment, each crossover valve member 520 includes a first end 1105, an intermediate portion 1110, a second end 1115, a first sealing member 1120, a second sealing member 1125, and recesses 1130.

The first end 1105 of the crossover valve member 520 preferably includes the first sealing member 1120. The outside diameter of the first end 1105 of the crossover valve member 520 is preferably less than the inside diameter of the corresponding crossover valve chamber 685 in order to provide a sliding fit. In a preferred embodiment, the outside diameter of the first end 1105 of the crossover valve member 520 is preferably about 0.005 to 0.010 inches less than the inside diameter of the corresponding crossover valve chamber 685 in order to provide an optimal sliding fit. The first sealing member 1120 is preferably adapted to fluidicly seal the dynamic interface between the first end 1105 of the crossover valve member 520 and the corresponding crossover valve chamber 685. The first sealing member 1120 may include any number of conventional commercially available sealing members. In a preferred embodiment, the first sealing member 1120 is an O-ring sealing member available from Parker Seals in order to optimally provide a dynamic fluidic seal.

The intermediate end 1110 of the crossover valve member 520 preferably has an outside diameter that is less than the outside diameters of the first and second ends, 1105 and 1115, of the crossover valve member 520. In this manner, fluidic materials are optimally conveyed from the corresponding inner crossover port 705 to the corresponding outer crossover ports 710 during operation of the apparatus 200.

The second end 1115 of the crossover valve member 520 preferably includes the second sealing member 1125 and the recesses 1130. The outside diameter of the second end 1115 of the crossover valve member 520 is preferably less than the inside diameter of the corresponding crossover valve chamber 685 in order to provide a sliding fit. In a preferred embodiment, the outside diameter of the second end 1115 of the crossover valve member 520 is preferably about 0.005 to 0.010 inches less than the inside diameter of the corresponding crossover valve chamber 685 in order to provide an optimal sliding fit. The second sealing member 1125 is preferably adapted to fluidicly seal the dynamic interface between the second end 1115 of the crossover valve member 520 and the corresponding crossover valve chamber 685. The second sealing member 1125 may include any number of conventional commercially available sealing members. In a preferred embodiment, the second sealing member 1125 is an O-ring sealing member available from Parker Seals in order to optimally provide a dynamic fluidic seal. The recesses 1130 are preferably adapted to receive the corresponding crossover valve shear pins 655. In this manner, the crossover valve member 520 is maintained in a substantially stationary position.

The force multiplier outer support member 525 is coupled to the second support member 515 and the liner hanger 595. The force multiplier outer support member 525 preferably has a substantially annular cross section. The force multiplier outer support member 525 may be fabricated from any number of conventional commercially available materials. In a preferred embodiment, the force multiplier outer support member 525 is fabricated from alloy steel having a minimum yield strength ranging from about 75,000 to 140,000 psi in order to optimally provide high strength and resistance to abrasion and fluid erosion. The force multiplier outer support member 525 preferably further includes a first end 1135, a second end 1140, a first threaded portion 1145, and a sealing member 1150.

The first end 1135 of the force multiplier outer support member 525 preferably includes the first threaded portion 1145 and the force multiplier piston chamber 715. The first threaded portion 1145 is preferably adapted to be removably coupled to the second threaded portion 1080 of the intermediate portion 1065 of the second support member 515. The first threaded portion 1145 may include any number of conventional commercially available threads. In a preferred embodiment, the first threaded portion 1145 is a stub acme thread in order to optimally provide high tensile strength.

The second end 1140 of the force multiplier outer support member 525 is preferably adapted to extend within at least a portion of the liner hanger 595. The second end 1140 of the force multiplier outer support member 525 preferably includes the sealing member 1150 and the force multiplier piston chamber 715. The sealing member 1150 is preferably adapted to fluidicly seal the interface between the second end 1140 of the force multiplier outer support member 525 and the liner hanger 595. The sealing member 1150 may comprise any number of conventional commercially available sealing members. In a preferred embodiment, the sealing member 1150 is an O-ring with seal backups available from Parker Seals in order to optimally provide a fluidic seal.

The force multiplier inner support member 530 is coupled to the second support member 515 and the first coupling 545. The force multiplier inner support member 530 is movably coupled to the force multiplier piston 535. The force multiplier inner support member 530 preferably has a substantially annular cross-section. The force multiplier inner support member 530 may be fabricated from any number of conventional commercially available materials. In a preferred embodiment, the force multiplier inner support member 530 is fabricated from alloy steel having a minimum yield strength ranging from about 75,000 to 140,000 psi in order to optimally provide high strength and resistance to abrasion and fluid erosion. In a preferred embodiment, the outer surface of the force multiplier inner support member 530 includes a nickel plating in order to provide an optimal dynamic seal with the force multiplier piston 535. In a preferred embodiment, the force multiplier inner support member 530 further includes a first end 1155, a second end 1160, a first threaded portion 1165, and a second threaded portion 1170.

The first end 1155 of the force multiplier inner support member 530 preferably includes the first threaded portion 1165 and the fourth passage 700. The first threaded portion 1165 of the first end 1155 of the force multiplier inner support member 530 is preferably adapted to be removably coupled to the third threaded portion 1085 of the second end 1070 of the second support member 515. The first threaded portion 1165 may comprise any number of conventional commercially available threaded portions. In a preferred embodiment, the first threaded portion 1165 is a stub acme thread available from Halliburton Energy Services in order to optimally provide high tensile strength.

The second end 1160 of the force multiplier inner support member 530 preferably includes the second threaded portion 1170, the fourth passage 700, and the force multiplier exhaust passages 725. The second threaded portion 1170 of the second end 1160 of the force multiplier inner support member 530 is preferably adapted to be removably coupled to the first coupling 545. The second threaded portion 1170 may comprise any number of conventional commercially available threaded portions. In a preferred embodiment, the second threaded portion 1170 is a stub acme thread available from Halliburton Energy Services in order to optimally provide high tensile strength.

The force multiplier piston 535 is coupled to the force multiplier sleeve 540. The force multiplier piston 535 is movably coupled to the force multiplier inner support member 530. The force multiplier piston 535 preferably has a substantially annular cross-section. The force multiplier piston 535 may be fabricated from any number of conventional commercially available materials. In a preferred embodiment, the force multiplier piston 535 is fabricated from alloy steel having a minimum yield strength ranging from about 75,000 to 140,000 psi in order to optimally provide high strength and resistance to abrasion and fluid erosion. In a preferred embodiment, the force multiplier piston 535 further includes a first end 1175, a second end 1180, a first sealing member 1185, a first threaded portion 1190, and a second sealing member 1195.

The first end 1175 of the force multiplier piston 535 preferably includes the first sealing member 1185. The first sealing member 1185 is preferably adapted to fluidicly seal the dynamic interface between the inside surface of the force multiplier piston 535 and the outside surface of the inner force multiplier support member 530. The first sealing member 1185 may include any number of conventional commercially available sealing members. In a preferred embodiment, the first sealing member 1185 is an O-ring with seal backups available from Parker Seals in order to optimally provide a dynamic seal.

The second end 1180 of the force multiplier piston 535 preferably includes the first threaded portion 1190 and the second sealing member 1195. The first threaded portion 1190 is preferably adapted to be removably coupled to the force multiplier sleeve 540. The first threaded portion 1190 may include any number of conventional commercially available threaded portions. In a preferred embodiment, the first threaded portion 1190 is a stub acme thread available from Halliburton Energy Services in order to optimally provide high tensile strength. The second sealing member 1195 is preferably adapted to fluidicly seal the interface between the second end 1180 of the force multiplier piston 535 and the force multiplier sleeve 540. The second sealing member 1195 may include any number of conventional commercially available sealing members. In a preferred embodiment, the second sealing member 1195 is an O-ring sealing member available from Parker Seals in order to optimally provide a fluidic seal.

The force multiplier sleeve 540 is coupled to the force multiplier piston 535. The force multiplier sleeve 540 is movably coupled to the first coupling 545. The force multiplier sleeve 540 preferably has a substantially annular cross-section. The force multiplier sleeve 540 may be fabricated from any number of conventional commercially available materials. In a preferred embodiment, the force multiplier sleeve 540 is fabricated from alloy steel having a minimum yield strength ranging from about 75,000 to 140,000 psi in order to optimally provide high strength and resistance to abrasion and fluid erosion. In a preferred embodiment, the inner surface of the force multiplier sleeve 540 includes a nickel plating in order to provide an optimal dynamic seal with the outside surface of the first coupling 545. In a preferred embodiment, the force multiplier sleeve 540 further includes a first end 1200, a second end 1205, and a first threaded portion 1210.

The first end 1200 of the force multiplier sleeve 540 preferably includes the first threaded portion 1210. The first threaded portion 1210 of the first end 1200 of the force multiplier sleeve 540 is preferably adapted to be removably coupled to the first threaded portion 1190 of the second end 1180 of the force multiplier piston 535. The first threaded portion 1210 may comprise any number of conventional commercially available threaded portions. In a preferred embodiment, the first threaded portion 1210 is a stub acme thread available from Halliburton Energy Services in order to optimally provide high tensile strength.

The first coupling 545 is coupled to the force multiplier inner support member 530 and the third support member 550. The first coupling 545 is movably coupled to the force multiplier sleeve 540. The first coupling 545 preferably has a substantially annular cross-section. The first coupling 545 may be fabricated from any number of conventional commercially available materials. In a preferred embodiment, the first coupling 545 is fabricated from alloy steel having a minimum yield strength ranging from about 75,000 to 140,000 psi in order to optimally provide high strength and resistance to abrasion and fluid erosion. In a preferred embodiment, the first coupling 545 further includes the fourth passage 700, a first end 1215, a second end 1220, a first inner sealing member 1225, a first outer sealing member 1230, a first threaded portion 1235, a second inner sealing member 1240, a second outer sealing member 1245, and a second threaded portion 1250.

The first end 1215 of the first coupling 545 preferably includes the first inner sealing member 1225, the first outer sealing member 1230, and the first threaded portion 1235. The first inner sealing member 1225 is preferably adapted to fluidicly seal the interface between the first end 1215 of the first coupling 545 and the second end 1160 of the force multiplier inner support member 530. The first inner sealing member 1225 may include any number of conventional commercially available sealing members. In a preferred embodiment, the first inner sealing member 1225 is an O-ring seal available from Parker Seals in order to optimally provide a fluidic seal. The first outer sealing member 1230 is preferably adapted to prevent foreign materials from entering the interface between the first end 1215 of the first coupling 545 and the second end 1205 of the force multiplier sleeve 540. The first outer sealing member 1230 is further preferably adapted to fluidicly seal the interface between the first end 1215 of the first coupling 545 and the second end 1205 of the force multiplier sleeve 540. The first outer sealing member 1230 may include any number of conventional commercially available sealing members. In a preferred embodiment, the first outer sealing member 1230 is a seal backup available from Parker Seals in order to optimally provide a barrier to foreign materials. The first threaded portion 1235 of the first end 1215 of the first coupling 545 is preferably adapted to be removably coupled to the second threaded portion 1170 of the second end 1160 of the force multiplier inner support member 530. The first threaded portion 1235 may comprise any number of conventional commercially available threaded portions. In a preferred embodiment, the first threaded portion 1235 is a stub acme thread available from Halliburton Energy Services in order to optimally provide high tensile strength.

The second end 1220 of the first coupling 545 preferably includes the second inner sealing member 1240, the second outer sealing member 1245, and the second threaded portion 1250. The second inner sealing member 1240 is preferably adapted to fluidicly seal the interface between the second end 1220 of the first coupling 545 and the third support member 550. The second inner sealing member 1240 may include any number of conventional commercially available sealing members. In a preferred embodiment, the second inner sealing member 1240 is an O-ring available from Parker Seals in order to optimally provide a fluidic seal. The second outer sealing member 1245 is preferably adapted to fluidicly seal the dynamic interface between the second end 1220 of the first coupling 545 and the second end 1205 of the force multiplier sleeve 540. The second outer sealing member 1245 may include any number of conventional commercially available sealing members. In a preferred embodiment, the second outer sealing member 1245 is an O-ring with seal backups available from Parker Seals in order to optimally provide a fluidic seal. The second threaded portion 1250 of the second end 1220 of the first coupling 545 is preferably adapted to be removably coupled to the third support member 550. The second threaded portion 1250 may comprise any number of conventional commercially available threaded portions. In a preferred embodiment, the second threaded portion 1250 is a stub acme thread available from Halliburton Energy Services in order to optimally provide high tensile strength.

The third support member 550 is coupled to the first coupling 545 and the second coupling 605. The third support member 550 is movably coupled to the spring spacer 555, the preload spring 560, the mandrel 580, and the travel port sealing sleeve 600. The third support member 550 preferably has a substantially annular cross-section. The third support member 550 may be fabricated from any number of conventional commercially available materials. In a preferred embodiment, the third support member 550 is fabricated from alloy steel having a minimum yield strength ranging from about 75,000 to 140,000 psi in order to optimally provide high strength and resistance to abrasion and fluid erosion. In a preferred embodiment, the outer surface of the third support member 550 includes a nickel plating in order to provide an optimal dynamic seal with the inside surfaces of the mandrel 580 and the travel port sealing sleeve 600. In a preferred embodiment, the third support member 550 further includes a first end 1255, a second end 1260, a first threaded portion 1265, and a second threaded portion 1270.

The first end 1255 of the third support member 550 preferably includes the first threaded portion 1265 and the fourth passage 700. The first threaded portion 1265 of the first end 1255 of the third support member 550 is preferably adapted to be removably coupled to the second threaded portion 1250 of the second end 1220 of the first coupling 545. The first threaded portion 1265 may comprise any number of conventional commercially available threaded portions. In a preferred embodiment, the first threaded portion 1265 is a stub acme thread available from Halliburton Energy Services in order to optimally provide high tensile strength.

The second end 1260 of the third support member 550 preferably includes the second threaded portion 1270 and the fourth passage 700, and the expansion cone travel indicator ports 740. The second threaded portion 1270 of the second end 1260 of the third support member 550 is preferably adapted to be removably coupled to the second coupling 605. The second threaded portion 1270 may comprise any number of conventional commercially available threaded portions. In a preferred embodiment, the second threaded portion 1270 is a stub acme thread available from Halliburton Energy Services in order to optimally provide high tensile strength.

The spring spacer 555 is coupled to the preload spring 560. The spring spacer is movably coupled to the third support member 550. The spring spacer 555 preferably has a substantially annular cross-section. The spring spacer 555 may be fabricated from any number of conventional commercially available materials. In a preferred embodiment, the spring spacer 555 is fabricated from alloy steel having a minimum yield strength ranging from about 75,000 to 140,000 psi in order to optimally provide high strength and resistance to abrasion and fluid erosion.

The preload spring 560 is coupled to the spring spacer 555. The preload spring 560 is movably coupled to the third support member 550. The preload spring 560 may be fabricated from any number of conventional commercially available materials. In a preferred embodiment, the preload spring 560 is fabricated from alloys of chromium-vanadium or chromium-silicon in order to optimally provide a high preload force for sealing the interface between the expansion cone 585 and the liner hanger 595. In a preferred embodiment, the preload spring 560 has a spring rate ranging from about 500 to 2000 lbf/in in order to optimally provide a preload force.

The lubrication fitting 565 is coupled to the lubrication packer sleeve 570, the body of lubricant 575 and the mandrel 580. The lubrication fitting 565 preferably has a substantially annular cross-section. The lubrication fitting 565 may be fabricated from any number of conventional commercially available materials. In a preferred embodiment, the lubrication fitting 565 is fabricated from alloy steel having a minimum yield strength ranging from about 75,000 to 140,000 psi in order to optimally provide high strength and resistance to abrasion and fluid erosion. The lubrication fitting 565 preferably includes a first end 1275, a second end 1280, a lubrication injection fitting 1285, a first threaded portion 1290, and the first lubrication supply passage 795.

The first end 1275 of the lubrication fitting 565 preferably includes the lubrication injection fitting 1285, the first threaded portion 1290 and the first lubrication supply passage 795. The lubrication injection fitting 1285 is preferably adapted to permit lubricants to be injected into the first lubrication supply passage 795. The lubrication injection fitting 1285 may comprise any number of conventional commercially available injection fittings. In a preferred embodiment, the lubrication injection fitting 1285 is a model 1641-B grease fitting available from Alemite Corp. in order to optimally provide a connection for injecting lubricants. The first threaded portion 1290 of the first end 1275 of the lubrication fitting 565 is preferably adapted to be removably coupled to the mandrel 580. The first threaded portion 1290 may comprise any number of conventional commercially available threaded portions. In a preferred embodiment, the first threaded portion 1290 is a stub acme thread available from Halliburton Energy Services. The second end 1280 of the lubrication fitting 565 is preferably spaced above the outside surface of the mandrel 580 in order to define a portion of the first lubrication supply passage 795.

The lubrication packer sleeve 570 is coupled to the lubrication fitting 565 and the body of lubricant 575. The lubrication packer sleeve 570 is movably coupled to the liner hanger 595. The lubrication packer sleeve 570 is preferably adapted to fluidicly seal the radial gap between the outside surface of the second end 1280 of the lubrication fitting 565 and the inside surface of the liner hanger 595. The lubrication packer sleeve 570 is further preferably adapted to compress the body of lubricant 575. In this manner, the lubricants within the body of lubricant 575 are optimally pumped to outer surface of the expansion cone 585.

The lubrication packer sleeve 570 may comprise any number of conventional commercially available packer sleeves. In a preferred embodiment, the lubrication packer sleeve 570 is a 70 durometer packer available from Halliburton Energy Services in order to optimally provide a low pressure fluidic seal.

The body of lubricant 575 is fluidicly coupled to the first lubrication supply passage 795 and the second lubrication supply passage 800. The body of lubricant 575 is movably coupled to the lubrication fitting 565, the lubrication packer sleeve 570, the mandrel 580, the expansion cone 585 and the liner hanger 595. The body of lubricant 575 preferably provides a supply of lubricant for lubricating the dynamic interface between the outside surface of the expansion cone 585 and the inside surface of the liner hanger 595. The body of lubricant 575 may include any number of conventional commercially available lubricants. In a preferred embodiment, the body of lubricant 575 includes anti-seize 1500 available from Climax Lubricants and Equipment Co. in order to optimally provide high pressure lubrication.

In a preferred embodiment, during operation of the apparatus 500, the body of lubricant 575 lubricates the interface between the interior surface of the expanded portion of the liner hanger 595 and the exterior surface of the expansion cone 585. In this manner, when the expansion cone 585 is removed from the interior of the radially expanded liner hanger 595, the body of lubricant 575 lubricates the dynamic interfaces between the interior surface of the expanded portion of the liner hanger 595 and the exterior surface of the expansion cone 585. Thus, the body of lubricant 575 optimally reduces the force required to remove the expansion cone 585 from the radially expanded liner hanger 595.

The mandrel 580 is coupled to the lubrication fitting 565, the expansion cone 585, and the centralizer 590. The mandrel 580 is movably coupled to the third support member 550, the body of lubricant 575, and the liner hanger 595. The mandrel 580 preferably has a substantially annular cross-section. The mandrel 580 may be fabricated from any number of conventional commercially available materials. In a preferred embodiment, the mandrel 580 is fabricated from alloy steel having a minimum yield strength ranging from about 75,000 to 140,000 psi in order to optimally provide high strength and resistance to abrasion and fluid erosion. In a preferred embodiment, the mandrel 580 further includes a first end 1295, an intermediate portion 1300, second end 1305, a first threaded portion 1310, a first sealing member 1315, a second sealing member 1320, and a second threaded portion 1325, a first wear ring 1326, and a second wear ring 1327.

The first end 1295 of the mandrel 580 preferably includes the first threaded portion 1310, the first sealing member 1315, and the first wear ring 1326. The first threaded portion 1310 is preferably adapted to be removably coupled to the first threaded portion 1290 of the first end 1275 of the lubrication fitting 565. The first threaded portion 1310 may comprise any number of conventional commercially available threaded portions. In a preferred embodiment, the first threaded portion 1310 is a stub acme thread available from Halliburton Energy Services in order to optimally provide high tensile strength. The first sealing member 1315 is preferably adapted to fluidicly seal the dynamic interface between the inside surface of the first end 1295 of the mandrel 580 and the outside surface of the third support member 550. The first sealing member 1315 may comprise any number of conventional commercially available sealing members. In a preferred embodiment, the first sealing member 1315 is an O-ring with seal backups available from Parker Seals in order to optimally provide a dynamic fluidic seal. The first wear ring 1326 is preferably positioned within an interior groove formed in the first end 1295 of the mandrel 580. The first wear ring 1326 is preferably adapted to maintain concentricity between and among the mandrel 580 and the third support member 550 during axial displacement of the mandrel 580, reduce frictional forces, and support side loads. In a preferred embodiment, the first wear ring 1326 is a model GR2C wear ring available from Busak & Shamban.

The outside diameter of the intermediate portion 1300 of the mandrel 580 is preferably about 0.05 to 0.25 inches less than the inside diameter of the line hanger 595. In this manner, the second lubrication supply passage 800 is defined by the radial gap between the intermediate portion 1300 of the mandrel 580 and the liner hanger 595.

The second end 1305 of the mandrel 580 preferably includes the second sealing member 1320, the second threaded portion 1325, and the second wear ring 1327. The second sealing member 1320 is preferably adapted to fluidicly seal the interface between the inside surface of the expansion cone 585 and the outside surface of the mandrel 580. The second sealing member 1320 may comprise any number of conventional commercially available sealing members. In a preferred embodiment, the second sealing member 1320 is an O-ring sealing member available from Parker Seals in order to optimally provide a fluidic seal. The second threaded portion 1325 is preferably adapted to be removably coupled to the centralizer 590. The second threaded portion 1325 may comprise any number of conventional commercially available threaded portions. In a preferred embodiment, the second threaded portion 1325 is a stub acme thread available from Halliburton Energy Services in order to optimally provide high tensile strength. The second wear ring 1327 is preferably positioned within an interior groove formed in the second end 1305 of the mandrel 580. The second wear ring 1327 is preferably adapted to maintain concentricity between and among the mandrel 580 and the third support member 550 during axial displacement of the mandrel 580, reduce frictional forces, and support side loads. In a preferred embodiment, the second wear ring 1327 is a model GR2C wear ring available from Busak & Shamban.

The expansion cone 585 is coupled to the mandrel 580 and the centralizer 590. The expansion cone 585 is fluidicly coupled to the second lubrication supply passage 800. The expansion cone 585 is movably coupled to the body of lubricant 575 and the liner hanger 595. The expansion cone 585 preferably includes a substantially annular cross-section. The expansion cone 585 may be fabricated from any number of conventional commercially available materials. In a preferred embodiment, the expansion cone 585 is fabricated from cold worked tool steel in order to optimally provide high strength and wear resistance.

In a preferred embodiment, the expansion cone 585 is further provided substantially as described in one or more of the following: (1) U.S. patent application Ser. No. 09/440,338, filed on Nov. 15, 1999, which issued as U.S. Pat. No. 6,328,113, which claimed benefit of the filing date of U.S.

Provisional Patent Application Ser. No. 60/108,558, filed on Nov. 16, 1998, (2) U.S. patent application Ser. No. 09/454,139, filed on Dec. 3, 1999, which claimed benefit of the filing date of U.S. Provisional Patent Application Ser. No. 60/111,293, filed on Dec. 7, 1998, (3) U.S. patent application Ser. No. 09/502,350, filed on Feb. 10, 2000, which claimed the benefit of the filing date of U.S. Provisional Patent Application Ser. No. 60/119,611, filed Feb. 11, 1999, (4) U.S. patent application Ser. No. 09/510,913, filed on Feb. 23, 2000, which claimed the benefit of the filing date of U.S. Provisional Patent Application Ser. No. 60/121,702, filed on Feb. 25, 1999, (5) U.S. patent application Ser. No. 09/511,941, filed on Feb. 24, 2000, which claimed the benefit of the filing date of U.S. Provisional Patent Application No. 60/121,907, filed Feb. 26, 1999, (6) U.S. Provisional Patent Application Ser. No. 60/124,042, filed on Mar. 11, 1999, (7) U.S. Provisional Patent Application Ser. No. 60/131,106, filed on Apr. 26, 1999, (8) U.S. Provisional Patent Application Ser. No. 60/137,998, filed on Jun. 7, 1999, (9) U.S. Provisional Patent Application Ser. No. 60/143,039, filed on Jul. 9, 1999, and (10) U.S. Provisional Patent Application Ser. No. 60/146,203, filed on Jul. 29, 1999, the disclosures of which are incorporated by reference.

The centralizer 590 is coupled to the mandrel 580 and the expansion cone 585. The centralizer 590 is movably coupled to the liner hanger 595. The centralizer 590 preferably includes a substantially annular cross-section. The centralizer 590 may be fabricated from any number of conventional commercially available materials. In a preferred embodiment, the centralizer 590 is fabricated from alloy steel having a minimum yield strength ranging from about 75,000 to 140,000 in order to optimally provide high strength and resistance to abrasion and fluid erosion. The centralizer 590 preferably includes a first end 1330, a second end 1335, a plurality of centralizer fins 1340, and a threaded portion 1345.

The second end 1335 of the centralizer 590 preferably includes the centralizer fins 1340 and the threaded portion 1345. The centralizer fins 1340 preferably extend from the second end 1335 of the centralizer 590 in a substantially radial direction. In a preferred embodiment, the radial gap between the centralizer fins 1340 and the inside surface of the liner hanger 595 is less than about 0.06 inches in order to optimally provide centralization of the expansion cone 585. The threaded portion 1345 is preferably adapted to be removably coupled to the second threaded portion 1325 of the second end 1305 of the mandrel 580. The threaded portion 1345 may comprise any number of conventional commercially available threaded portions. In a preferred embodiment, the threaded portion 1345 is a stub acme thread in order to optimally provide high tensile strength.

The liner hanger 595 is coupled to the outer collet support member 645 and the set screws 660. The liner hanger 595 is movably coupled to the lubrication packer sleeve 570, the body of lubricant 575, the expansion cone 585, and the centralizer 590. The liner hanger 595 preferably has a substantially annular cross-section. The liner hanger 595 preferably includes a plurality of tubular members coupled end to end. The axial length of the liner hanger 595 preferably ranges from about 5 to 12 feet. The liner hanger 595 may be fabricated from any number of conventional commercially available materials. In a preferred embodiment, the liner hanger 595 is fabricated from alloy steel having a minimum yield strength ranging from about 40,000 to 125,000 psi in order to optimally provide high strength and ductility. The liner hanger 595 preferably includes a first end 1350, an intermediate portion 1355, a second end 1360, a sealing member 1365, a threaded portion 1370, one or more set screw mounting holes 1375, and one or more outside sealing portions 1380.

The outside diameter of the first end 1350 of the liner hanger 595 is preferably selected to permit the liner hanger 595 and apparatus 500 to be inserted into another opening or tubular member. In a preferred embodiment, the outside diameter of the first end 1350 of the liner hanger 595 is selected to be about 0.12 to 2 inches less than the inside diameter of the opening or tubular member that the liner hanger 595 will be inserted into. In a preferred embodiment, the axial length of the first end 1350 of the liner hanger 595 ranges from about 8 to 20 inches.

The outside diameter of the intermediate portion 1355 of the liner hanger 595 preferably provides a transition from the first end 1350 to the second end 1360 of the liner hanger. In a preferred embodiment, the axial length of the intermediate portion 1355 of the liner hanger 595 ranges from about 0.25 to 2 inches in order to optimally provide reduced radial expansion pressures.

The second end 1360 of the liner hanger 595 includes the sealing member 1365, the threaded portion 1370, the set screw mounting holes 1375 and the outside sealing portions 1380. The outside diameter of the second end 1360 of the liner hanger 595 is preferably about 0.10 to 2.00 inches less than the outside diameter of the first end 1350 of the liner hanger 595 in order to optimally provide reduced radial expansion pressures. The sealing member 1365 is preferably adapted to fluidicly seal the interface between the second end 1360 of the liner hanger and the outer collet support member 645. The sealing member 1365 may comprise any number of conventional commercially available sealing members. In a preferred embodiment, the sealing member 1365 is an O-ring seal available from Parker Seals in order to optimally provide a fluidic seal. The threaded portion 1370 is preferably adapted to be removably coupled to the outer collet support member 645. The threaded portion 1370 may comprise any number of conventional commercially available threaded portions. In a preferred embodiment, the threaded portion 1370 is a stub acme thread available from Halliburton Energy Services in order to optimally provide high tensile strength. The set screw mounting holes 1375 are preferably adapted to receive the set screws 660. Each outside sealing portion 1380 preferably includes a top ring 1385, an intermediate sealing member 1395, and a lower ring 1390. The top and bottom rings, 1385 and 1390, are preferably adapted to penetrate the inside surface of a wellbore casing. The top and bottom rings, 1385 and 1390, preferably extend from the outside surface of the second end 1360 of the liner hanger 595. In a preferred embodiment, the outside diameter of the top and bottom rings, 1385 and 1390, are less than or equal to the outside diameter of the first end 1350 of the liner hanger 595 in order to optimally provide protection from abrasion when placing the apparatus 500 within a wellbore casing or other tubular member. In a preferred embodiment, the top and bottom rings, 1385 and 1390 are fabricated from alloy steel having a minimum yield strength of about 40,000 to 125,000 psi in order to optimally provide high strength and ductility. In a preferred embodiment, the top and bottom rings, 1385 and 1390, are integrally formed with the liner hanger 595. The intermediate sealing member 1395 is preferably adapted to seal the interface between the outside surface of the second end 1360 of the liner hanger 595 and the inside surface of a wellbore casing. The intermediate sealing member 1395 may comprise any number of conventional sealing members. In a preferred embodiment, the intermediate sealing member 1395 is a 50 to 90 durometer nitrile elastomeric sealing member available from Eutsler Technical Products in order to optimally provide a fluidic seal and shear strength.

The liner hanger 595 is further preferably provided substantially as described in one or more of the following: (1) U.S. patent application Ser. No. 09/440,338, filed on Nov. 15, 1999, which issued as U.S. Pat. No. 6,328,113, which claimed benefit of the filing date of U.S. Provisional Patent Application Ser. No. 60/108,558, filed on Nov. 16, 1998, (2) U.S. patent application Ser. No. 09/454,139, filed on Dec. 3, 1999, which claimed benefit of the filing date of U.S. Provisional Patent Application Ser. No. 60/111,293, filed on Dec. 7, 1998, (3) U.S. patent application Ser. No. 09/502,350, filed on Feb. 10, 2000, which claimed the benefit of the filing date of U.S. Provisional Patent Application Ser. No. 60/119,611, filed Feb. 11, 1999, (4) U.S. patent application Ser. No. 09/510,913, filed on Feb. 23, 2000, which claimed the benefit of the filing date of U.S. Provisional Patent Application Ser. No. 60/121,702, filed on Feb. 25, 1999, (5) U.S. patent application Ser. No. 09/511,941, filed on Feb. 24, 2000, which claimed the benefit of the filing date of U.S. Provisional Patent Application No. 60/121,907, filed Feb. 26, 1999, (6) U.S. Provisional Patent Application Ser. No. 60/124,042, filed on Mar. 11, 1999, (7) U.S. Provisional Patent Application Ser. No. 60/131,106, filed on Apr. 26, 1999, (8) U.S. Provisional Patent Application Ser. No. 60/137,998, filed on Jun. 7, 1999, (9) U.S. Provisional Patent Application Ser. No. 60/143,039, filed on Jul. 9, 1999, and (10) U.S. Provisional Patent Application Ser. No. 60/146,203, filed on Jul. 29, 1999, the disclosures of which are incorporated by reference.

The travel port sealing sleeve 600 is movably coupled to the third support member 550. The travel port sealing sleeve 600 is further initially positioned over the expansion cone travel indicator ports 740. The travel port sealing sleeve 600 preferably has a substantially annular cross-section. The travel port sealing sleeve 600 may be fabricated from any number of conventional commercially available materials. In a preferred embodiment, the travel port sealing sleeve 600 is fabricated from alloy steel having a minimum yield strength of about 75,000 to 140,000 psi in order to optimally provide high strength and resistance to abrasion and fluid erosion. The travel port sealing sleeve preferably includes a plurality of inner sealing members 1400. The inner sealing members 1400 are preferably adapted to seal the dynamic interface between the inside surface of the travel port sealing sleeve 600 and the outside surface of the third support member 550. The inner sealing members 1400 may comprise any number of conventional commercially available sealing members. In a preferred embodiment, the inner sealing members 1400 are o-rings available from Parker Seals in order to optimally provide a fluidic seal. In a preferred embodiment, the inner sealing members 1400 further provide sufficient frictional force to prevent inadvertent movement of the travel port sealing sleeve 600. In an alternative embodiment, the travel port sealing sleeve 600 is removably coupled to the third support member 550 by one or more shear pins. In this manner, accidental movement of the travel port sealing sleeve 600 is prevented.

The second coupling 605 is coupled to the third support member 550 and the collet mandrel 610. The second coupling 605 preferably has a substantially annular cross-section. The second coupling 605 may be fabricated from any number of conventional commercially available materials. In a preferred embodiment, the second coupling 605 is fabricated from alloy steel having a minimum yield strength of about 75,000 to 140,000 psi in order to optimally provide high strength and resistance to abrasion and fluid erosion. In a preferred embodiment, the second coupling 605 further includes the fourth passage 700, a first end 1405, a second end 1410, a first inner sealing member 1415, a first threaded portion 1420, a second inner sealing member 1425, and a second threaded portion 1430.

The first end 1405 of the second coupling 605 preferably includes the first inner sealing member 1415 and the first threaded portion 1420. The first inner sealing member 1415 is preferably adapted to fluidicly seal the interface between the first end 1405 of the second coupling 605 and the second end 1260 of the third support member 550. The first inner sealing member 1415 may include any number of conventional commercially available sealing members. In a preferred embodiment, the first inner sealing member 1415 is an O-ring available from Parker Seals in order to optimally provide a fluidic seal. The first threaded portion 1420 of the first end 1415 of the second coupling 605 is preferably adapted to be removably coupled to the second threaded portion 1270 of the second end 1260 of the third support member 550. The first threaded portion 1420 may comprise any number of conventional commercially available threaded portions. In a preferred embodiment, the first threaded portion 1420 is a stub acme thread available from Halliburton Energy Services in order to optimally provide high tensile strength.

The second end 1410 of the second coupling 605 preferably includes the second inner sealing member 1425 and the second threaded portion 1430. The second inner sealing member 1425 is preferably adapted to fluidicly seal the interface between the second end 1410 of the second coupling 605 and the collet mandrel 610. The second inner sealing member 1425 may include any number of conventional commercially available sealing members. In a preferred embodiment, the second inner sealing member 1425 is an O-ring available from Parker Seals in order to optimally provide a fluidic seal. The second threaded portion 1430 of the second end 1410 of the second coupling 605 is preferably adapted to be removably coupled to the collet mandrel 610. The second threaded portion 1430 may comprise any number of conventional commercially available threaded portions. In a preferred embodiment, the second threaded portion 1430 is a stub acme thread available from Halliburton Energy Services in order to optimally provide high tensile strength.

The collet mandrel 610 is coupled to the second coupling 605, the collet retaining adapter 640, and the collet retaining sleeve shear pins 665. The collet mandrel 610 is releasably coupled to the locking dogs 620, the collet assembly 625, and the collet retaining sleeve 635. The collet mandrel 610 preferably has a substantially annular cross-section. The collet mandrel 610 may be fabricated from any number of conventional commercially available materials. In a preferred embodiment, the collet mandrel 610 is fabricated from alloy steel having a minimum yield strength of about 75,000 to 140,000 psi in order to optimally provide high strength and resistance to abrasion and fluid erosion. In a preferred embodiment, the collet mandrel 610 further includes the fourth passage 700, the collet release ports 745, the collet release throat passage 755, the fifth passage 760, a first end 1435, a second end 1440, a first shoulder 1445, a second shoulder 1450, a recess 1455, a shear pin mounting hole 1460, a first threaded portion 1465, a second threaded portion 1470, and a sealing member 1475.

The first end 1435 of the collet mandrel 610 preferably includes the fourth passage 700, the first shoulder 1445, and the first threaded portion 1465. The first threaded portion 1465 is preferably adapted to be removably coupled to the second threaded portion 1430 of the second end 1410 of the second coupling 605. The first threaded portion 1465 may include any number of conventional threaded portions. In a preferred embodiment, the first threaded portion 1465 is a stub acme thread available from Halliburton Energy Services in order to optimally provide high tensile strength.

The second end 1440 of the collet mandrel 610 preferably includes the fourth passage 700, the collet release ports 745, the collet release throat passage 755, the fifth passage 760, the second shoulder 1450, the recess 1455, the shear pin mounting hole 1460, the second threaded portion 1470, and the sealing member 1475. The second shoulder 1450 is preferably adapted to mate with and provide a reference position for the collet retaining sleeve 635. The recess 1455 is preferably adapted to define a portion of the collet sleeve release chamber 805. The shear pin mounting hole 1460 is preferably adapted to receive the collet retaining sleeve shear pins 665. The second threaded portion 1470 is preferably adapted to be removably coupled to the collet retaining adapter 640. The second threaded portion 1470 may include any number of conventional commercially available threaded portions. In a preferred embodiment, the second threaded portions 1470 is a stub acme thread available from Halliburton Energy Services in order to optimally provide high tensile strength. The sealing member 1475 is preferably adapted to seal the dynamic interface between the outside surface of the collet mandrel 610 and the inside surface of the collet retaining sleeve 635. The sealing member 1475 may include any number of conventional commercially available sealing members. In a preferred embodiment, the sealing member 1475 is an O-ring available from Parker Seals in order to optimally provide a fluidic seal.

The load transfer sleeve 615 is movably coupled to the collet mandrel 610, the collet assembly 625, and the outer collet support member 645. The load transfer sleeve 615 preferably has a substantially annular cross-section. The load transfer sleeve 615 may be fabricated from any number of conventional commercially available materials. In a preferred embodiment, the load transfer sleeve 615 is fabricated from alloy steel having a minimum yield strength of about 75,000 to 140,000 psi in order to optimally provide high strength and resistance to abrasion and fluid erosion. In a preferred embodiment, the load transfer sleeve 615 further a first end 1480 and a second end 1485.

The inside diameter of the first end 1480 of the load transfer sleeve 615 is preferably greater than the outside diameter of the collet mandrel 610 and less than the outside diameters of the second coupling 605 and the locking dog retainer 622. In this manner, during operation of the apparatus 500, the load transfer sleeve 615 optimally permits the flow of fluidic materials from the second annular chamber 735 to the third annular chamber 750. Furthermore, in this manner, during operation of the apparatus 200, the load transfer sleeve 615 optimally limits downward movement of the second coupling 605 relative to the collet assembly 625.

The second end 1485 of the load transfer sleeve 615 is preferably adapted to cooperatively interact with the collet 625. In this manner, during operation of the apparatus 200, the load transfer sleeve 615 optimally limits downward movement of the second coupling 605 relative to the collet assembly 625.

The locking dogs 620 are coupled to the locking dog retainer 622 and the collet assembly 625. The locking dogs 620 are releasably coupled to the collet mandrel 610. The locking dogs 620 are preferably adapted to lock onto the outside surface of the collet mandrel 610 when the collet mandrel 610 is displaced in the downward direction relative to the locking dogs 620. The locking dogs 620 may comprise any number of conventional commercially available locking dogs. In a preferred embodiment, the locking dogs 620 include a plurality of locking dog elements 1490 and a plurality of locking dog springs 1495.

In a preferred embodiment, each of the locking dog elements 1490 include an arcuate segment including a pair of external grooves for receiving the locking dog springs, 1495. In a preferred embodiment, each of the locking dog springs 1495 are garter springs. During operation of the apparatus 500, the locking dog elements 1490 are preferably radially inwardly displaced by the locking dog springs 1495 when the locking dogs 620 are relatively axially displaced past the first shoulder 1445 of the collet mandrel 610. As a result, the locking dogs 620 are then engaged by the first shoulder 1445 of the collet mandrel 610.

The locking dog retainer 622 is coupled to the locking dogs 620 and the collet assembly 625. The locking dog retainer 622 preferably has a substantially annular cross-section. The locking dog retainer 622 may be fabricated from any number of conventional commercially available materials. In a preferred embodiment, the locking dog retainer 622 is fabricated from alloy steel having a minimum yield strength of about 75,000 to 140,000 psi in order to optimally provide high strength and resistance to abrasion and fluid erosion. In a preferred embodiment, the locking dog retainer 622 further includes a first end 1500, a second end 1505, and a threaded portion 1510.

The first end 1500 of the locking dog retainer 622 is preferably adapted to capture the locking dogs 620. In this manner, when the locking dogs 620 latch onto the first shoulder 1445 of the collet mandrel 610, the locking dog retainer 622 transmits the axial force to the collet assembly 625.

The second end 1505 of the locking dog retainer preferably includes the threaded portion 1510. The threaded portion 1510 is preferably adapted to be removably coupled to the collet assembly 625. The threaded portion 1510 may comprise any number of conventional commercially available threaded portions. In a preferred embodiment, the threaded portions 1510 is a stub acme thread available from Halliburton Energy Services in order to optimally provide high tensile strength.

The collet assembly 625 is coupled to the locking dogs 620 and the locking dog retainer 622. The collet assembly 625 is releasably coupled to the collet mandrel 610, the outer collet support member 645, the collet retaining sleeve 635, the load transfer sleeve 615, and the collet retaining adapter 640. The collet assembly 625 preferably has a substantially annular cross-section. The collet assembly 625 may be fabricated from any number of conventional commercially available materials. In a preferred embodiment, the collet assembly 625 is fabricated from alloy steel having a minimum yield strength of about 75,000 to 140,000 psi in order to optimally provide high strength and resistance to abrasion and fluid erosion. In a preferred embodiment, the collet assembly 625 includes a collet body 1515, a plurality of collet arms 1520, a plurality of collet upsets 1525, flow passages 1530, and a threaded portion 1535.

The collet body 1515 preferably includes the flow passages 1530 and the threaded portion 1535. The flow passages 1530 are preferably adapted to convey fluidic materials between the second annular chamber 735 and the third annular chamber 750. The threaded portion 1535 is preferably adapted to be removably coupled to the threaded portion 1510 of the second end 1505 of the locking dog retainer 622. The threaded portion 1535 may include any number of conventional commercially available threaded portions. In a preferred embodiment, the threaded portion 1535 is a stub acme thread available from Halliburton Energy Services in order to optimally provide high tensile strength.

The collet arms 1520 extend from the collet body 1515 in a substantially axial direction. The collet upsets 1525 extend from the ends of corresponding collet arms 1520 in a substantially radial direction. The collet upsets 1525 are preferably adapted to mate with and cooperatively interact with corresponding slots provided in the collet retaining adapter 640 and the liner hanger setting sleeve 650. In this manner, the collet upsets 1525 preferably controllably couple the collet retaining adapter 640 to the outer collet support member 645 and the liner hanger setting sleeve 650. In this manner, axial and radial forces are optimally coupled between the collet retaining adapter 640, the outer collet support member 645 and the liner hanger setting sleeve 650. The collet upsets 1525 preferably include a flat outer surface 1540 and an angled outer surface 1545. In this manner, the collet upsets 1525 are optimally adapted to be removably coupled to the slots provided in the collet retaining adapter 640 and the liner hanger setting sleeve 650.

The collet retaining sleeve 635 is coupled to the collet retaining sleeve shear pins 665. The collet retaining sleeve 635 is movably coupled to the collet mandrel 610 and the collet assembly 625. The collet retaining sleeve 635 preferably has a substantially annular cross-section. The collet retaining sleeve 635 may be fabricated from any number of conventional commercially available materials. In a preferred embodiment, the collet retaining sleeve 635 is fabricated from alloy steel having a minimum yield strength of about 75,000 to 140,000 psi in order to optimally provide high strength and resistance to abrasion and fluid erosion. In a preferred embodiment, the collet retaining sleeve 635 includes the collet sleeve passages 775, a first end 1550, a second end 1555, one or more shear pin mounting holes 1560, a first shoulder 1570, a second shoulder 1575, and a sealing member 1580.

The first end 1550 of the collet retaining sleeve 635 preferably includes the collet sleeve passages 775, the shear pin mounting holes 1560, and the first shoulder 1570. The collet sleeve passages 775 are preferably adapted to convey fluidic materials between the second annular chamber 735 and the third annular chamber 750. The shear pin mounting holes 1560 are preferable adapted to receive corresponding shear pins 665. The first shoulder 1570 is preferably adapted to mate with the second shoulder 1450 of the collet mandrel 610.

The second end 1555 of the collet retaining sleeve 635 preferably includes the collet sleeve passages 775, the second shoulder 1575, and the sealing member 1580. The collet sleeve passages 775 are preferably adapted to convey fluidic materials between the second annular chamber 735 and the third annular chamber 750. The second shoulder 1575 of the second end 1555 of the collet retaining sleeve 635 and the recess 1455 of the second end 1440 of the collet mandrel 610 are preferably adapted to define the collet sleeve release chamber 805. The sealing member 1580 is preferably adapted to seal the dynamic interface between the outer surface of the collet mandrel 610 and the inside surface of the collet retaining sleeve 635. The sealing member 1580 may include any number of conventional commercially available sealing members. In a preferred embodiment, the sealing member 1580 is an O-ring available from Parker Seals in order to optimally provide a fluidic seal.

The collet retaining adapter 640 is coupled to the collet mandrel 610. The collet retaining adapter 640 is movably coupled to the liner hanger setting sleeve 650, the collet retaining sleeve 635, and the collet assembly 625. The collet retaining adapter 640 preferably has a substantially annular cross-section. The collet retaining adapter 640 may be fabricated from any number of conventional commercially available materials. In a preferred embodiment, the collet retaining adapter 640 is fabricated from alloy steel having a minimum yield strength of about 75,000 to 140,000 psi in order to optimally provide high strength and resistance to abrasion and fluid erosion. In a preferred embodiment, the collet retaining adapter 640 includes the fifth passage 760, the sixth passages 765, a first end 1585, an intermediate portion 1590, a second end 1595, a plurality of collet slots 1600, a sealing member 1605, a first threaded portion 1610, and a second threaded portion 1615.

The first end 1585 of the collet retaining adapter 640 preferably includes the collet slots 1600. The collet slots 1600 are preferably adapted to cooperatively interact with and mate with the collet upsets 1525. The collet slots 1600 are further preferably adapted to be substantially aligned with corresponding collet slots provided in the liner hanger setting sleeve 650. In this manner, the slots provided in the collet retaining adapter 640 and the liner hanger setting sleeve 650 are removably coupled to the collet upsets 1525.

The intermediate portion 1590 of the collet retaining adapter 640 preferably includes the sixth passages 765, the sealing member 1605, and the first threaded portion 1610. The sealing member 1605 is preferably adapted to fluidicly seal the interface between the outside surface of the collet retaining adapter 640 and the inside surface of the liner hanger setting sleeve 650. The sealing member 1605 may include any number of conventional commercially available sealing members. In a preferred embodiment, the sealing member 1605 is an O-ring available from Parker Seals in order to optimally provide a fluidic seal. The first threaded portion 1610 is preferably adapted to be removably coupled to the second threaded portion 1470 of the second end 1440 of the collet mandrel 610. The first threaded portion 1610 may include any number of conventional commercially available threaded portions. In a preferred embodiment, the first threaded portion 1610 is a stub acme thread available from Halliburton Energy Services in order to optimally provide high tensile strength.

The second end 1595 of the collet retaining adapter 640 preferably includes the fifth passage 760 and the second threaded portion 1615. The second threaded portion 1615 is preferably adapted to be removably coupled to a conventional SSR plug set, or other similar device.

The outer collet support member 645 is coupled to the liner hanger 595, the set screws 660, and the liner hanger setting sleeve 650. The outer collet support member 645 is releasably coupled to the collet assembly 625. The outer collet support member 645 is movably coupled to the load transfer sleeve 615. The outer collet support member 645 preferably has a substantially annular cross-section. The outer collet support member 645 may be fabricated from any number of conventional commercially available materials. In a preferred embodiment, the outer collet support member 645 is fabricated from alloy steel having a minimum yield strength of about 75,000 to 140,000 psi in order to optimally provide high strength and resistance to abrasion and fluid erosion. In a preferred embodiment, the outer collet support member 645 includes a first end 1620, a second end 1625, a first threaded portion 1630, set screw mounting holes 1635, a recess 1640, and a second threaded portion 1645.

The first end 1620 of the outer collet support member 645 preferably includes the first threaded portion 1630 and the set screw mounting holes 1635. The first threaded portion 1630 is preferably adapted to be removably coupled to the threaded portion 1370 of the second end 1360 of the liner hanger 595. The first threaded portion 1630 may include any number of conventional commercially available threaded portions. In a preferred embodiment, the first threaded portion 1630 is a stub acme thread available from Halliburton Energy Services in order to optimally provide high tensile strength. The set screw mounting holes 1635 are preferably adapted to receive corresponding set screws 660.

The second end 1625 of the outer collet support member 645 preferably includes the recess 1640 and the second threaded portion 1645. The recess 1640 is preferably adapted to receive a portion of the end of the liner hanger setting sleeve 650. In this manner, the second end 1625 of the outer collet support member 645 overlaps with a portion of the end of the liner hanger setting sleeve 650. The second threaded portion 1645 is preferably adapted to be removably coupled to the liner hanger setting sleeve 650. The second threaded portion 1645 may include any number of conventional commercially available threaded portions. In a preferred embodiment, the second threaded portion 1645 is a stub acme thread available from Halliburton Energy Services in order to optimally provide high tensile strength.

The liner hanger setting sleeve 650 is coupled to the outer collet support member 645. The liner hanger setting sleeve 650 is releasably coupled to the collet assembly 625. The liner hanger setting sleeve 650 is movably coupled to the collet retaining adapter 640. The liner hanger setting sleeve 650 preferably has a substantially annular cross-section. The liner hanger setting sleeve 650 may be fabricated from any number of conventional commercially available materials. In a preferred embodiment, the liner hanger setting sleeve 650 is fabricated from alloy steel having a minimum yield strength of about 75,000 to 140,000 psi in order to optimally provide high strength and resistance to abrasion and fluid erosion. In a preferred embodiment, the liner hanger setting sleeve 650 includes a first end 1650, a second end 1655, a recessed portion 1660, a plurality of collet slots 1665, a threaded portion 1670, an interior shoulder 1672, and a threaded portion 1673.

The first end 1650 of the liner hanger setting sleeve 650 preferably includes the recessed portion 1660, the plurality of collet slots 1665 and the threaded portion 1670. The recessed portion 1660 of the first end 1650 of the liner hanger setting sleeve 650 is preferably adapted to mate with the recessed portion 1640 of the second end 1625 of the outer collet support member 645. In this manner, the first end 1650 of the liner hanger setting sleeve 650 overlaps and mates with the second end 1625 of the outer collet support member 645. The recessed portion 1660 of the first end 1650 of the liner hanger setting sleeve 650 further includes the plurality of collet slots 1665. The collet slots 1665 are preferably adapted to mate with and cooperatively interact with the collet upsets 1525. The collet slots 1665 are further preferably adapted to be aligned with the collet slots 1600 of the collet retaining adapted 640. In this manner, the collet retaining adapter 640 and the liner hanger setting sleeve 650 preferably cooperatively interact with and mate with the collet upsets 1525. The threaded portion 1670 is preferably adapted to be removably coupled to the second threaded portion 1645 of the second end 1625 of the outer collet support member 645. The threaded portion 1670 may include any number of conventional threaded portions. In a preferred embodiment, the threaded portion 1670 is a stub acme thread available from Halliburton Energy Services in order to optimally provide high tensile strength.

The second end 1655 of the liner hanger setting sleeve 650 preferably includes the interior shoulder 1672 and the threaded portion 1673. In a preferred embodiment, the threaded portion 1673 is adapted to be coupled to conventional tubular members. In this manner tubular members are hung from the second end 1655 of the liner hanger setting sleeve 650. The threaded portion 1673 may be any number of conventional commercially available threaded portions. In a preferred embodiment, the threaded portion 1673 is a stub acme thread available from Halliburton Energy Services in order to provide high tensile strength.

The crossover valve shear pins 655 are coupled to the second support member 515. The crossover valve shear pins 655 are releasably coupled to corresponding ones of the crossover valve members 520. The crossover valve shear pins 655 may include any number of conventional commercially available shear pins. In a preferred embodiment, the crossover valve shear pins 655 are ASTM B16 Brass H02 condition shear pins available from Halliburton Energy Services in order to optimally provide consistency.

The set screws 660 coupled to the liner hanger 595 and the outer collet support member 645. The set screws 660 may include any number of conventional commercially available set screws.

The collet retaining sleeve shear pins 665 are coupled to the collet mandrel 610. The collet retaining shear pins 665 are releasably coupled to the collet retaining sleeve 635. The collet retaining sleeve shear pins 665 may include any number of conventional commercially available shear pins. In a preferred embodiment, the collet retaining sleeve shear pins 665 are ASTM B16 Brass H02 condition shear pins available from Halliburton Energy Services in order to optimally provide consistent shear force values.

The first passage 670 is fluidicly coupled to the second passages 675 and the secondary throat passage 695. The first passage 670 is preferably defined by the interior of the first support member 505. The first passage 670 is preferably adapted to convey fluidic materials such as, for example, drilling mud, cement, and/or lubricants. In a preferred embodiment, the first passage 670 is adapted to convey fluidic materials at operating pressures and flow rates ranging from about 0 to 10,000 psi and 0 to 650 gallons/minute.

The second passages 675 are fluidicly coupled to the first passage 670, the third passage 680, and the crossover valve chambers 685. The second passages 675 are preferably defined by a plurality of radial openings provided in the second end 1010 of the first support member 505. The second passages 675 are preferably adapted to convey fluidic materials such as, for example, drilling mud, cement and/or lubricants. In a preferred embodiment, the second passages 675 are adapted to convey fluidic materials at operating pressures and flow rates ranging from about 0 to 10,000 psi and 0 to 650 gallons/minute.

The third passage 680 is fluidicly coupled to the second passages 675 and the force multiplier supply passages 790. The third passage 680 is preferably defined by the radial gap between the second end 1010 of the first support member 505 and the first end 1060 of the second support member 515. The third passage 680 is preferably adapted to convey fluidic materials such as, for example, drilling mud, cement, and/or lubricants. In a preferred embodiment, the third passage 680 is adapted to convey fluidic materials at operating pressures and flow rates ranging from about 0 to 10,000 psi and 0 to 200 gallons/minute.

The crossover valve chambers 685 are fluidicly coupled to the third passage 680, the corresponding inner crossover ports 705, the corresponding outer crossover ports 710, and the corresponding seventh passages 770. The crossover valve chambers 685 are preferably defined by axial passages provided in the second support member 515. The crossover valve chambers 685 are movably coupled to corresponding crossover valve members 520. The crossover valve chambers 685 preferably have a substantially constant circular cross-section.

In a preferred embodiment, during operation of the apparatus 500, one end of one or more of the crossover valve chambers 685 is pressurized by fluidic materials injected into the third passage 680. In this manner, the crossover valve shear pins 655 are sheared and the crossover valve members 520 are displaced. The displacement of the crossover valve members 520 causes the corresponding inner and outer crossover ports, 705 and 710, to be fluidicly coupled. In a particularly preferred embodiment, the crossover valve chambers 685 are pressurized by closing the primary and/or the secondary throat passages, 690 and 695, using conventional plugs or balls, and then injecting fluidic materials into the first, second and third passages 670, 675 and 680.

The primary throat passage 690 is fluidicly coupled to the secondary throat passage 695 and the fourth passage 700. The primary throat passage 690 is preferably defined by a transitionary section of the interior of the second support member 515 in which the inside diameter transitions from a first inside diameter to a second, and smaller, inside diameter. The primary throat passage 690 is preferably adapted to receive and mate with a conventional ball or plug. In this manner, the first passage 670 optimally fluidicly isolated from the fourth passage 700.

The secondary throat passage 695 is fluidicly coupled to the first passage 670 and the primary throat passage 695. The secondary throat passage 695 is preferably defined by another transitionary section of the interior of the second support member 515 in which the inside diameter transitions from a first inside diameter to a second, and smaller, inside diameter. The secondary throat passage 695 is preferably adapted to receive and mate with a conventional ball or plug. In this manner, the first passage 670 optimally fluidicly isolated from the fourth passage 700.

In a preferred embodiment, the inside diameter of the primary throat passage 690 is less than or equal to the inside diameter of the secondary throat passage 695. In this manner, if required, a primary plug or ball can be placed in the primary throat passage 690, and then a larger secondary plug or ball can be placed in the secondary throat passage 695. In this manner, the first passage 670 is optimally fluidicly isolated from the fourth passage 700.

The fourth passage 700 is fludicly coupled to the primary throat passage 690, the seventh passage 770, the force multiplier exhaust passages 725, the collet release ports 745, and the collet release throat passage 755. The fourth passage 700 is preferably defined by the interiors of the second support member 515, the force multiplier inner support member 530, the first coupling 545, the third support member 550, the second coupling 605, and the collet mandrel 610. The fourth passage 700 is preferably adapted to convey fluidic materials such as, for example, drilling mud, cement, and/or lubricants. In a preferred embodiment, the fourth passage 700 is adapted to convey fluidic materials at operating pressures and flow rates ranging from about 0 to 10,000 psi and 0 to 650 gallons/minute.

The inner crossover ports 705 are fludicly coupled to the fourth passage 700 and the corresponding crossover valve chambers 685. The inner crossover ports 705 are preferably defined by substantially radial openings provided in an interior wall of the second support member 515. The inner crossover ports 705 are preferably adapted to convey fluidic materials such as, for example, drilling mud, cement, and lubricants. In a preferred embodiment, the inner crossover ports 705 are adapted to convey fluidic materials at operating pressures and flow rates ranging from about 0 to 10,000 psi and 0 to 50 gallons/minute.

In a preferred embodiment, during operation of the apparatus 500, the inner crossover ports 705 are controllably fluidicly coupled to the corresponding crossover valve chambers 685 and outer crossover ports 710 by displacement of the corresponding crossover valve members 520. In this manner, fluidic materials within the fourth passage 700 are exhausted to the exterior of the apparatus 500.

The outer crossover ports 710 are fludicly coupled to corresponding crossover valve chambers 685 and the exterior of the apparatus 500. The outer crossover ports 710 are preferably defined by substantially radial openings provided in an exterior wall of the second support member 515. The outer crossover ports 710 are preferably adapted to convey fluidic materials such as, for example, drilling mud, cement, and lubricants. In a preferred embodiment, the outer crossover ports 710 are adapted to convey fluidic materials at operating pressures and flow rates ranging from about 0 to 10,000 psi and 0 to 50 gallons/minute.

In a preferred embodiment, during operation of the apparatus 500, the outer crossover ports 710 are controllably fluidicly coupled to the corresponding crossover valve chambers 685 and inner crossover ports 705 by displacement of the corresponding crossover valve members 520. In this manner, fluidic materials within the fourth passage 700 are exhausted to the exterior of the apparatus 500.

The force multiplier piston chamber 715 is fluidicly coupled to the third passage 680. The force multiplier piston chamber 715 is preferably defined by the annular region defined by the radial gap between the force multiplier inner support member 530 and the force multiplier outer support member 525 and the axial gap between the end of the second support member 515 and the end of the lubrication fitting 565.

In a preferred embodiment, during operation of the apparatus, the force multiplier piston chamber 715 is pressurized to operating pressures ranging from about 0 to 10,000 psi. The pressurization of the force multiplier piston chamber 715 preferably displaces the force multiplier piston 535 and the force multiplier sleeve 540. The displacement of the force multiplier piston 535 and the force multiplier sleeve 540 in turn preferably displaces the mandrel 580 and expansion cone 585. In this manner, the liner hanger 595 is radially expanded. In a preferred embodiment, the pressurization of the force multiplier piston chamber 715 directly displaces the mandrel 580 and the expansion cone 585. In this manner, the force multiplier piston 535 and the force multiplier sleeve 540 may be omitted. In a preferred embodiment, the lubrication fitting 565 further includes one or more slots 566 for facilitating the passage of pressurized fluids to act directly upon the mandrel 580 and expansion cone 585.

The force multiplier exhaust chamber 720 is fluidicly coupled to the force multiplier exhaust passages 725. The force multiplier exhaust chamber 720 is preferably defined by the annular region defined by the radial gap between the force multiplier inner support member 530 and the force multiplier sleeve 540 and the axial gap between the force multiplier piston 535 and the first coupling 545. In a preferred embodiment, during operation of the apparatus 500, fluidic materials within the force multiplier exhaust chamber 720 are exhausted into the fourth passage 700 using the force multiplier exhaust passages 725. In this manner, during operation of the apparatus 500, the pressure differential across the force multiplier piston 535 is substantially equal to the difference in operating pressures between the force multiplier piston chamber 715 and the fourth passage 700.

The force multiplier exhaust passages 725 are fluidicly coupled to the force multiplier exhaust chamber 720 and the fourth passage 700. The force multiplier exhaust passages 725 are preferably defined by substantially radial openings provided in the second end 1160 of the force multiplier inner support member 530.

The second annular chamber 735 is fluidicly coupled to the third annular chamber 750. The second annular chamber 735 is preferably defined by the annular region defined by the radial gap between the third support member 550 and the liner hanger 595 and the axial gap between the centralizer 590 and the collet assembly 625. In a preferred embodiment, during operation of the apparatus 500, fluidic materials displaced by movement of the mandrel 580 and expansion cone 585 are conveyed from the second annular chamber 735 to the third annular chamber 750, the sixth passages 765, and the sixth passage 760. In this manner, the operation of the apparatus 500 is optimized.

The expansion cone travel indicator ports 740 are fluidicly coupled to the fourth passage 700. The expansion cone travel indicator ports 740 are controllably fluidicly coupled to the second annular chamber 735. The expansion cone travel indicator ports 740 are preferably defined by radial openings in the third support member 550. In a preferred embodiment, during operation of the apparatus 500, the expansion cone travel indicator ports 740 are further controllably fluidicly coupled to the force multiplier piston chamber 715 by displacement of the travel port sealing sleeve 600 caused by axial displacement of the mandrel 580 and expansion cone 585. In this manner, the completion of the radial expansion process is indicated by a pressure drop caused by fluidicly coupling the force multiplier piston chamber 715 with the fourth passage 700.

The collet release ports 745 are fluidicly coupled to the fourth passage 700 and the collet sleeve release chamber 805. The collet release ports 745 are controllably fluidicly coupled to the second and third annular chambers, 735 and 750. The collet release ports 745 are defined by radial openings in the collet mandrel 610. In a preferred embodiment, during operation of the apparatus 500, the collet release ports 745 are controllably pressurized by blocking the collet release throat passage 755 using a conventional ball or plug. The pressurization of the collet release throat passage 755 in turn pressurizes the collet sleeve release chamber 805. The pressure differential between the pressurized collet sleeve release chamber 805 and the third annular chamber 750 then preferably shears the collet shear pins 665 and displaces the collet retaining sleeve 635 in the axial direction.

The third annular chamber 750 is fluidicly coupled to the second annular chamber 735 and the sixth passages 765. The third annular chamber 750 is controllably fluidicly coupled to the collet release ports 745. The third annular chamber 750 is preferably defined by the annular region defined by the radial gap between the collet mandrel 610 and the collet assembly 625 and the first end 1585 of the collet retaining adapter and the axial gap between the collet assembly 625 and the intermediate portion 1590 of the collet retaining adapter 640.

The collet release throat passage 755 is fluidicly coupled to the fourth passage 700 and the fifth passage 760. The collet release throat passage 755 is preferably defined by a transitionary section of the interior of the collet mandrel 610 including a first inside diameter that transitions into a second smaller inside diameter. The collet release throat passage 755 is preferably adapted to receive and mate with a conventional sealing plug or ball. In this manner, the fourth passage 700 is optimally fluidicly isolated from the fifth passage 760. In a preferred embodiment, the maximum inside diameter of the collet release throat passage 755 is less than or equal to the minimum inside diameters of the primary and secondary throat passages, 690 and 695.

In a preferred embodiment, during operation of the apparatus 500, a conventional sealing plug or ball is placed in the collet release throat passage 755. The fourth passage 700 and the collet release ports 745 are then pressurized. The pressurization of the collet release throat passage 755 in turn pressurizes the collet sleeve release chamber 805. The pressure differential between the pressurized collet sleeve release chamber 805 and the third annular chamber 750 then preferably shears the collet shear pins 665 and displaces the collet retaining sleeve 635 in the axial direction.

The fifth passage 760 is fluidicly coupled to the collet release throat passage 755 and the sixth passages 765. The fifth passage 760 is preferably defined by the interior of the second end 1595 of the collet retaining adapter 640.

The sixth passages 765 are fluidicly coupled to the fifth passage 760 and the third annular chamber 750. The sixth passages 765 are preferably defined by approximately radial openings provided in the intermediate portion 1590 of the collet retaining adapter 640. In a preferred embodiment, during operation of the apparatus 500, the sixth passages 765 fluidicly couple the third annular passage 750 to the fifth passage 760. In this manner, fluidic materials displaced by axial movement of the mandrel 580 and expansion cone 585 are exhausted to the fifth passage 760.

The seventh passages 770 are fluidicly coupled to corresponding crossover valve chambers 685 and the fourth passage 700. The seventh passages 770 are preferably defined by radial openings in the intermediate portion 1065 of the second support member 515. During operation of the apparatus 700, the seventh passage 770 preferably maintain the rear portions of the corresponding crossover valve chamber 685 at the same operating pressure as the fourth passage 700. In this manner, the pressure differential across the crossover valve members 520 caused by blocking the primary and/or the secondary throat passages, 690 and 695, is optimally maintained.

The collet sleeve passages 775 are fluidicly coupled to the second annular chamber 735 and the third annular chamber 750. The collet sleeve passages 775 are preferably adapted to convey fluidic materials between the second annular chamber 735 and the third annular chamber 750. The collet sleeve passages 735 are preferably defined by axial openings provided in the collet sleeve 635.

The force multiplier supply passages 790 are fluidicly coupled to the third passage 680 and the force multiplier piston chamber 715. The force multiplier supply passages 790 are preferably defined by a plurality of substantially axial openings in the second support member 515. During operation of the apparatus 500, the force multiplier supply passages 790 preferably convey pressurized fluidic materials from the third passage 680 to the force multiplier piston chamber 715.

The first lubrication supply passage 795 is fludicly coupled to the lubrication fitting 1285 and the body of lubricant 575. The first lubrication supply passage 795 is preferably defined by openings provided in the lubrication fitting 565 and the annular region defined by the radial gap between the lubrication fitting 565 and the mandrel 580. During operation of the apparatus 500, the first lubrication passage 795 is preferably adapted to convey lubricants from the lubrication fitting 1285 to the body of lubricant 575.

The second lubrication supply passage 800 is fludicly coupled to the body of lubricant 575 and the expansion cone 585. The second lubrication supply passage 800 is preferably defined by the annular region defined by the radial gap between the expansion mandrel 580 and the liner hanger 595.

During operation of the apparatus 500, the second lubrication passage 800 is preferably adapted to convey lubricants from the body of lubricant 575 to the expansion cone 585. In this manner, the dynamic interface between the expansion cone 585 and the liner hanger 595 is optimally lubricated.

The collet sleeve release chamber 805 is fluidicly coupled to the collet release ports 745. The collet sleeve release chamber 805 is preferably defined by the annular region bounded by the recess 1455 and the second shoulder 1575. During operation of the apparatus 500, the collet sleeve release chamber 805 is preferably controllably pressurized. This manner, the collet release sleeve 635 is axially displaced.

Referring to FIGS. 4A to 4G, in a preferred embodiment, during operation of the apparatus 500, the apparatus 500 is coupled to an annular support member 2000 having an internal passage 2001, a first coupling 2005 having an internal passage 2010, a second coupling 2015, a third coupling 2020 having an internal passage 2025, a fourth coupling 2030 having an internal passage 2035, a tail wiper 2050 having an internal passage 2055, a lead wiper 2060 having an internal passage 2065, and one or more tubular members 2070. The annular support member 2000 may include any number of conventional commercially available annular support members. In a preferred embodiment, the annular support member 2000 further includes a conventional controllable vent passage for venting fluidic materials from the internal passage 2001. In this manner, during placement of the apparatus 500 in the wellbore 2000, fluidic materials in the internal passage 2001 are vented thereby minimizing surge pressures.

The first coupling 2005 is preferably removably coupled to the second threaded portion 1615 of the collet retaining adapter 640 and the second coupling 2015. The first coupling 2005 may comprise any number of conventional commercially available couplings. In a preferred embodiment, the first coupling 2005 is an equalizer case available from Halliburton Energy Services in order to optimally provide containment of the equalizer valve.

The second coupling 2015 is preferably removably coupled to the first coupling 2005 and the third coupling 2020. The second coupling 2015 may comprise any number of conventional commercially available couplings. In a preferred embodiment, the second coupling 2015 is a bearing housing available from Halliburton Energy Services in order to optimally provide containment of the bearings.

The third coupling 2020 is preferably removably coupled to the second coupling 2015 and the fourth coupling 2030. The third coupling 2020 may comprise any number of conventional commercially available couplings. In a preferred embodiment, the third coupling 2020 is an SSR swivel mandrel available from Halliburton Energy Services in order to optimally provide for rotation of tubular members positioned above the SSR plug set.

The fourth coupling 2030 is preferably removably coupled to the third coupling 2020 and the tail wiper 2050. The fourth coupling 2030 may comprise any number of conventional commercially available couplings. In a preferred embodiment, the fourth coupling 2030 is a lower connector available from Halliburton Energy Services in order to optimally provide a connection to a SSR plug set.

The tail wiper 2050 is preferably removably coupled to the fourth coupling 2030 and the lead wiper 2060. The tail wiper 2050 may comprise any number of conventional commercially available tail wipers. In a preferred embodiment, the tail wiper 2050 is an SSR top plug available from Halliburton Energy Services in order to optimally provide separation of cement and drilling mud.

The lead wiper 2060 is preferably removably coupled to the tail wiper 2050. The lead wiper 2060 may comprise any number of conventional commercially available tail wipers. In a preferred embodiment, the lead wiper 2060 is an SSR bottom plug available from Halliburton Energy Services in order to optimally provide separation of mud and cement.

In a preferred embodiment, the first coupling 2005, the second coupling 2015, the third coupling 2020, the fourth coupling 2030, the tail wiper 2050, and the lead wiper 2060 are a conventional SSR wiper assembly available from Halliburton Energy Services in order to optimally provide separation of mud and cement.

The tubular member 2070 are coupled to the threaded portion 1673 of the liner hanger setting sleeve 650. The tubular member 2070 may include one or more tubular members. In a preferred embodiment, the tubular member 2070 includes a plurality of conventional tubular members coupled end to end.

The apparatus 500 is then preferably positioned in a wellbore 2100 having a preexisting section of wellbore casing 2105 using the annular support member 2000. The wellbore 2100 and casing 2105 may be oriented in any direction from the vertical to the horizontal. In a preferred embodiment, the apparatus 500 is positioned within the wellbore 2100 with the liner hanger 595 overlapping with at least a portion of the preexisting wellbore casing 2105. In a preferred embodiment, during placement of the apparatus 500 within the wellbore 2100, fluidic materials 2200 within the wellbore 2100 are conveyed through the internal passage 2065, the internal passage 2055, the internal passage 2035, the internal passage 2025, the internal passage 2010, the fifth passage 760, the collet release throat passage 755, the fourth passage 700, the primary throat passage 690, the secondary throat passage 695, the first passage 670, and the internal passage 2001. In this manner, surge pressures during insertion and placement of the apparatus 500 within the wellbore 2000 are minimized. In a preferred embodiment, the internal passage 2001 further includes a controllable venting passage for conveying fluidic materials out of the internal passage 2001.

Figure 5A:
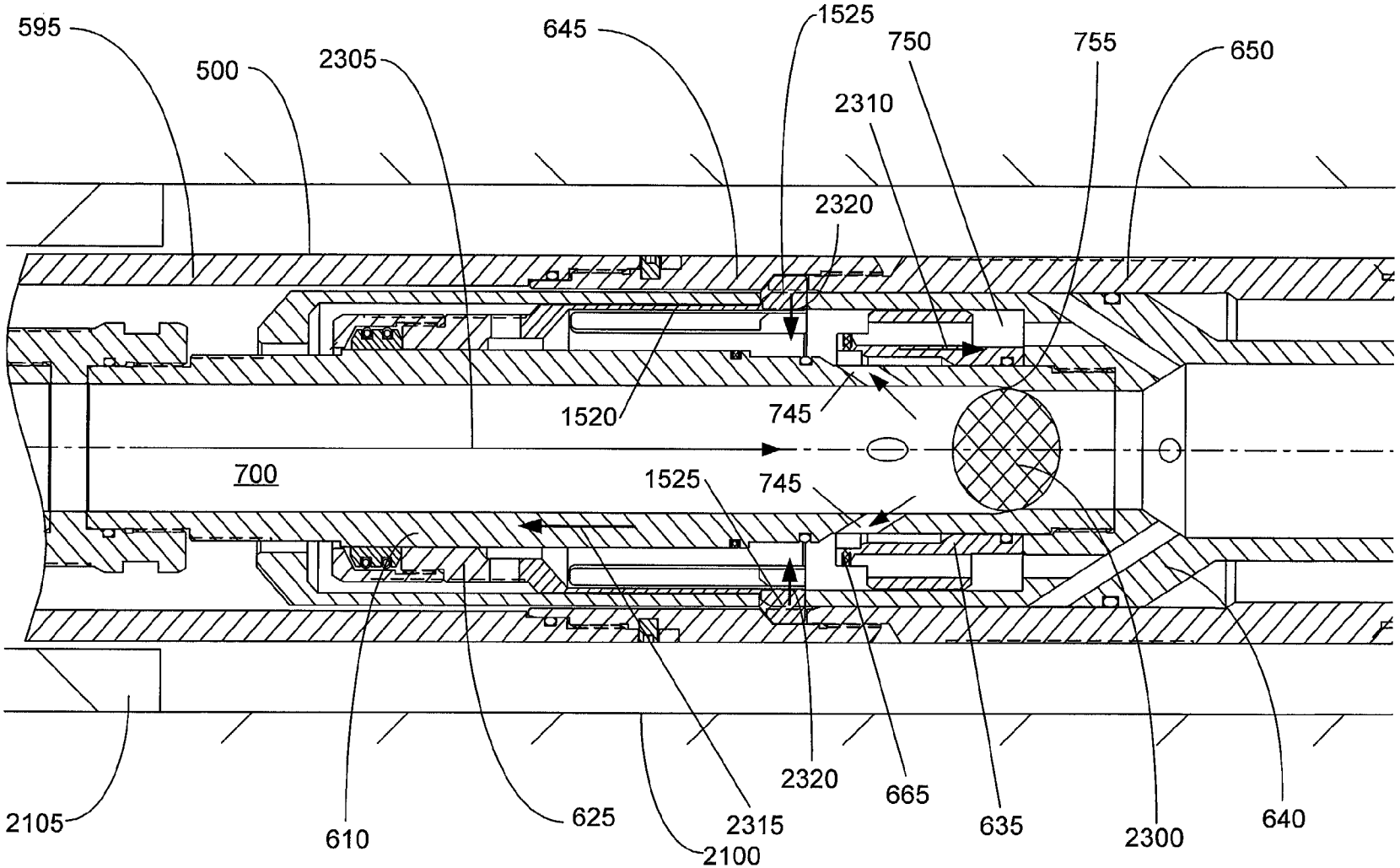
FIGS. 5A to 5C are fragmentary cross-sectional illustrations of an embodiment of a method for decoupling the liner hanger, the outer collet support member, and the liner hanger setting sleeve from the apparatus of FIGS. 4A to 4G.
Figure 5B:
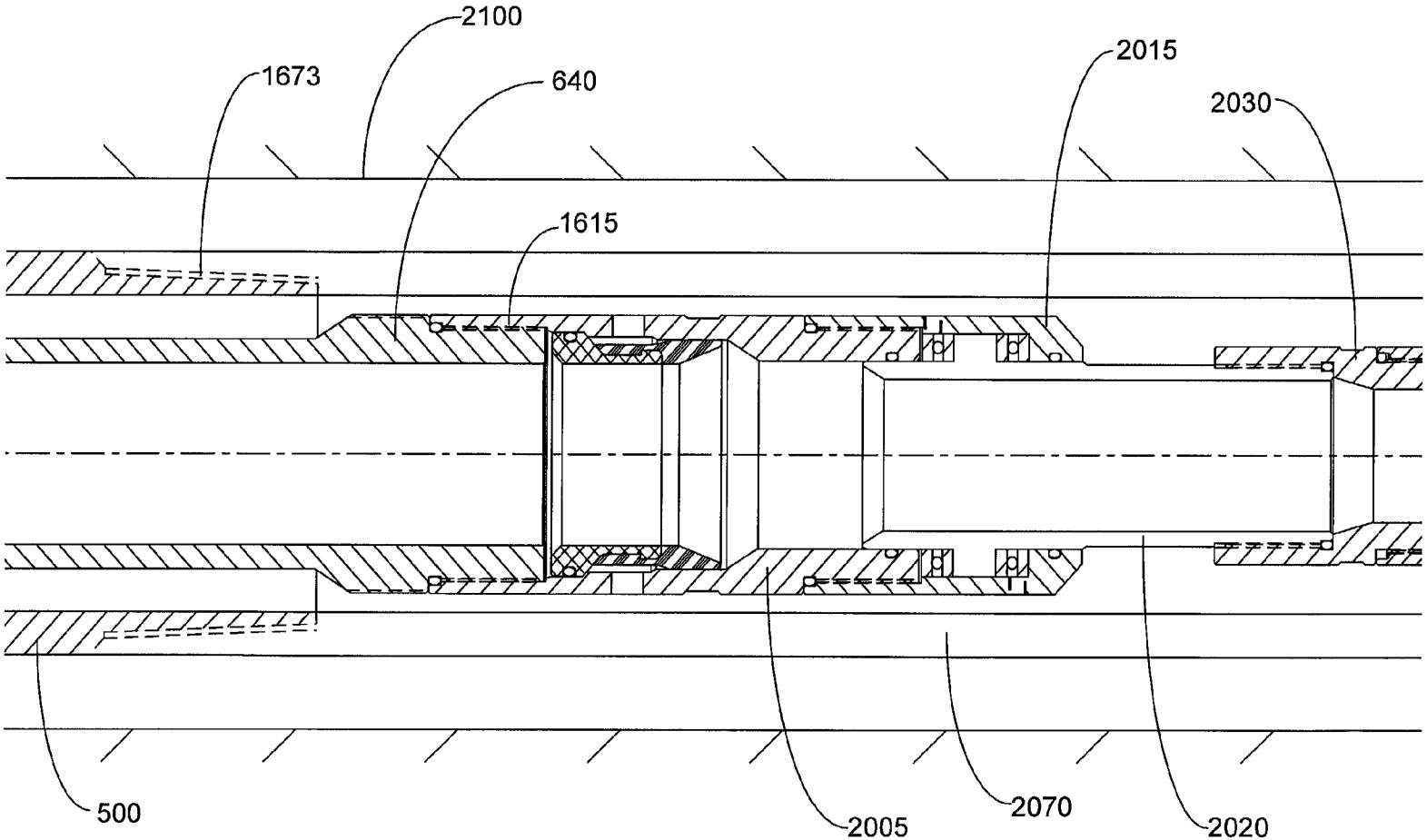
Figure 5C:
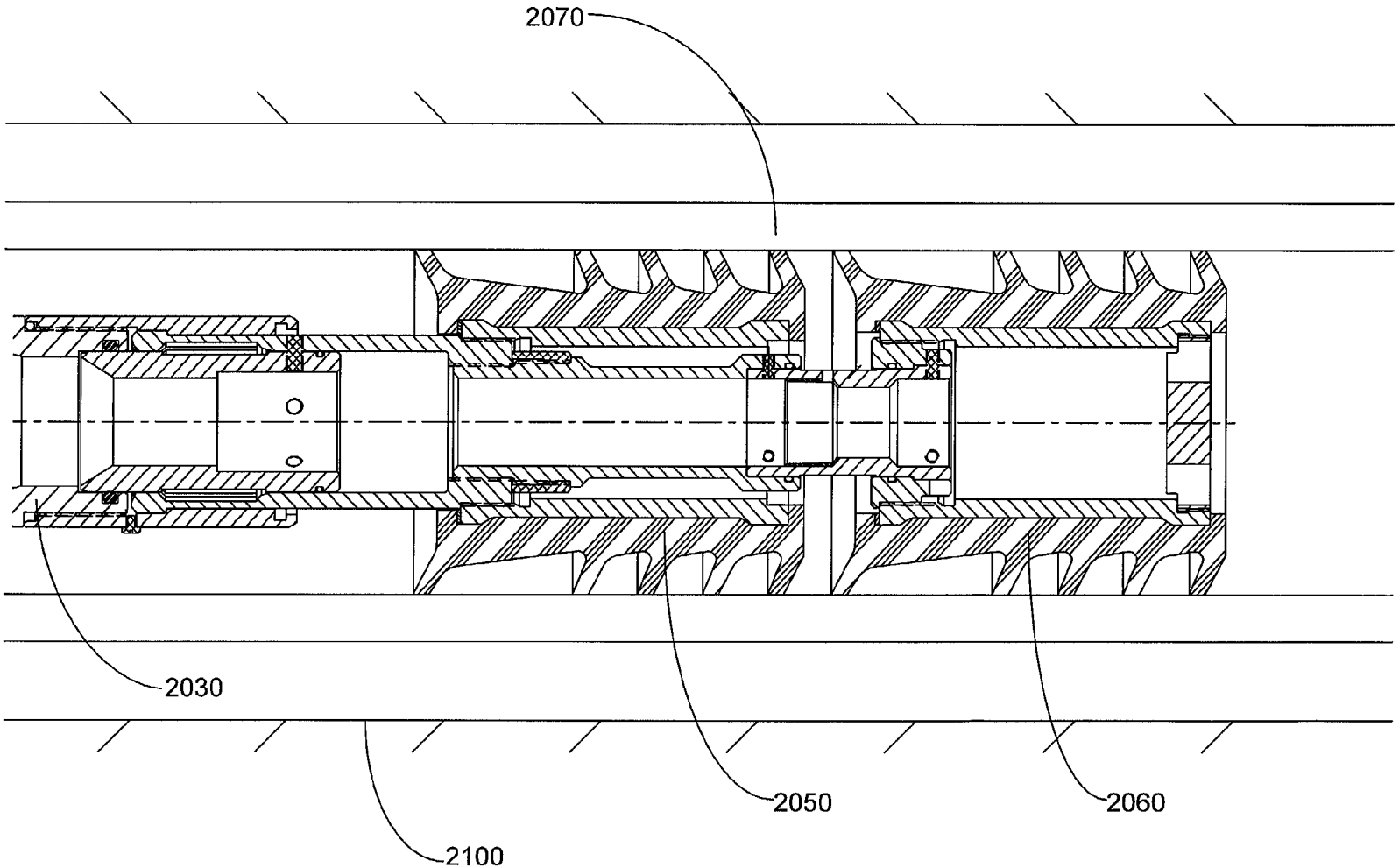

Referring to FIGS. 5A to 5C, in a preferred embodiment, in the event of an emergency after placement of the apparatus 500 within the wellbore 2000, the liner hanger 595, the outer collet support member 645, and the liner hanger setting sleeve 650 are decoupled from the apparatus 500 by first placing a ball 2300 within the collet release throat passage 755. A quantity of a fluidic material 2305 is then injected into the fourth passage 700, the collet release ports 745, and the collet sleeve release chamber 805. In a preferred embodiment, the fluidic material 2305 is a non-hardenable fluidic material such as, for example, drilling mud. Continued injection of the fluidic material 2305 preferably pressurizes the collet sleeve release chamber 805. In a preferred embodiment, the collet sleeve release chamber 805 is pressurized to operating pressures ranging from about 1,000 to 3,000 psi in order to optimally provide a positive indication of the shifting of the collet retaining sleeve 635 as indicated by a sudden pressure drop. The pressurization of the collet sleeve release chamber 805 preferably applies an axial force to the collet retaining sleeve 635. The axial force applied to the collet retaining sleeve 635 preferably shears the collet retaining sleeve shear pins 665. The collet retaining sleeve 635 then preferably is displaced in the axial direction 2310 away from the collet upsets 1525. In a preferred embodiment, the collet retaining sleeve 635 is axially displaced when the operating pressure within the collet sleeve release chamber 805 is greater than about 1650 psi.

In this manner, the collet upsets 1525 are no longer held in place within the collet slots 1600 and 1665 by the collet retaining sleeve 635.

In a preferred embodiment, the collet mandrel 610 is then displaced in the axial direction 2315 causing the collet upsets 1525 to be moved in a radial direction 2320 out of the collet slots 1665. The liner hanger 595, the outer collet support member 645, and the liner hanger setting sleeve 650 are thereby decoupled from the remaining portions of the apparatus 500. The remaining portions of the apparatus 500 are then removed from the wellbore 2100. In this manner, in the event of an emergency during operation of the apparatus, the liner hanger 595, the outer collet support member 645, and the liner hanger setting sleeve 650 are decoupled from the apparatus 500. This provides an reliable and efficient method of recovering from an emergency situation such as, for example, where the liner hanger 595, and/or outer collet support member 645, and/or the liner hanger setting sleeve 650 become lodged within the wellbore 2100 and/or the wellbore casing 2105.

Figure 6A:
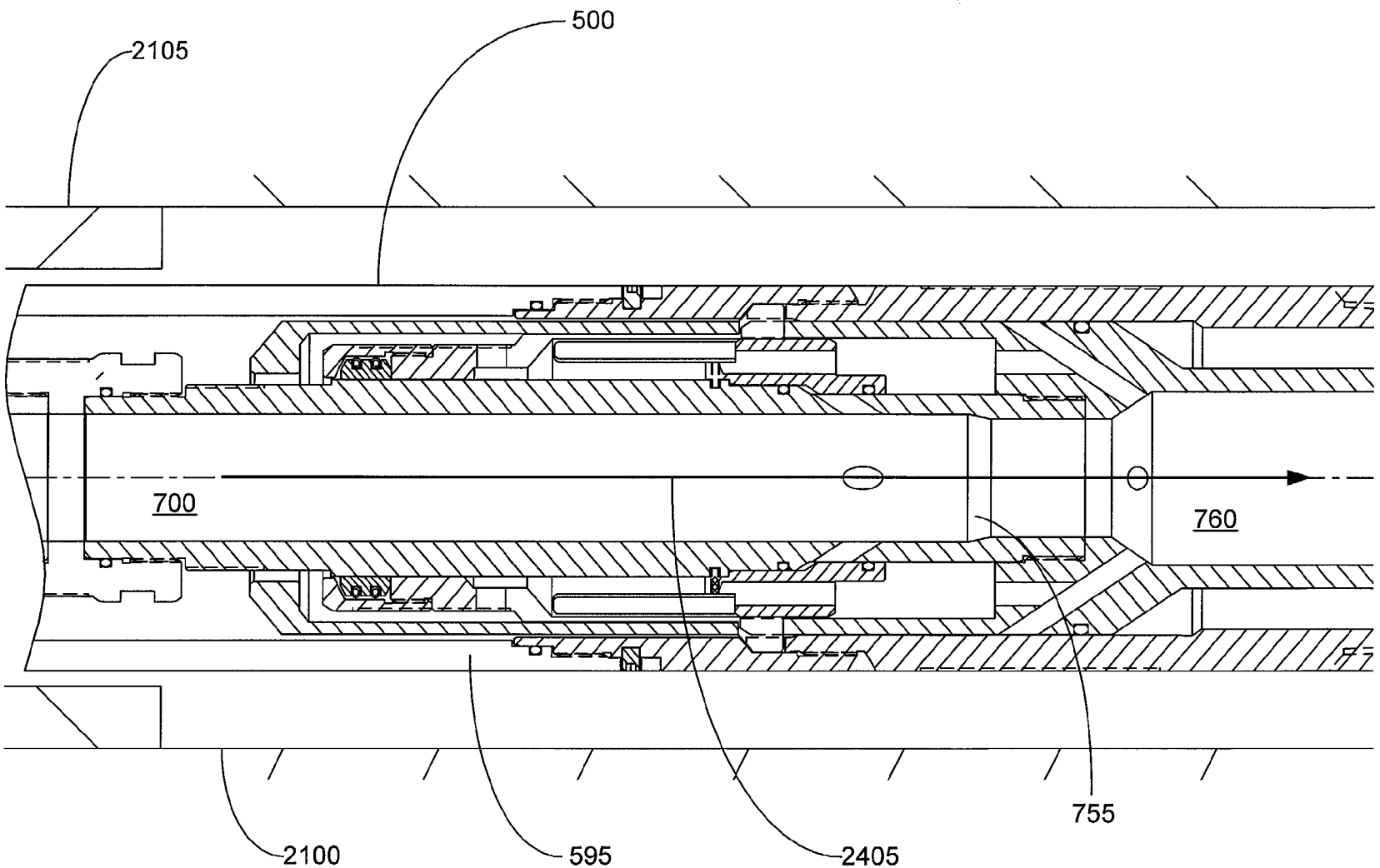
FIGS. 6A to 6C are fragmentary cross-sectional illustrations of an embodiment of a method for releasing the lead wiper from the apparatus of FIGS. 4A to 4G.
Figure 6B:
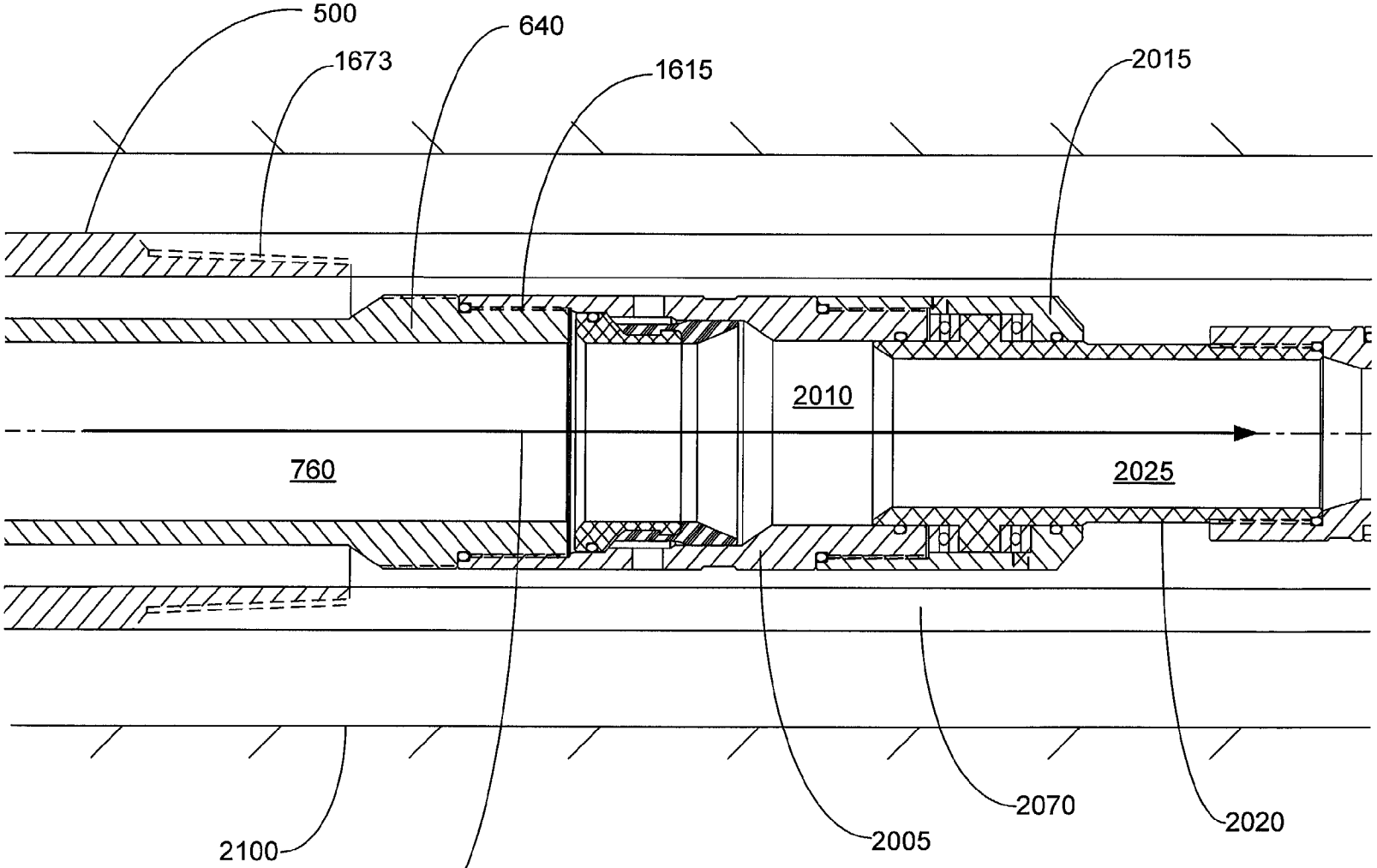
Figure 6C:
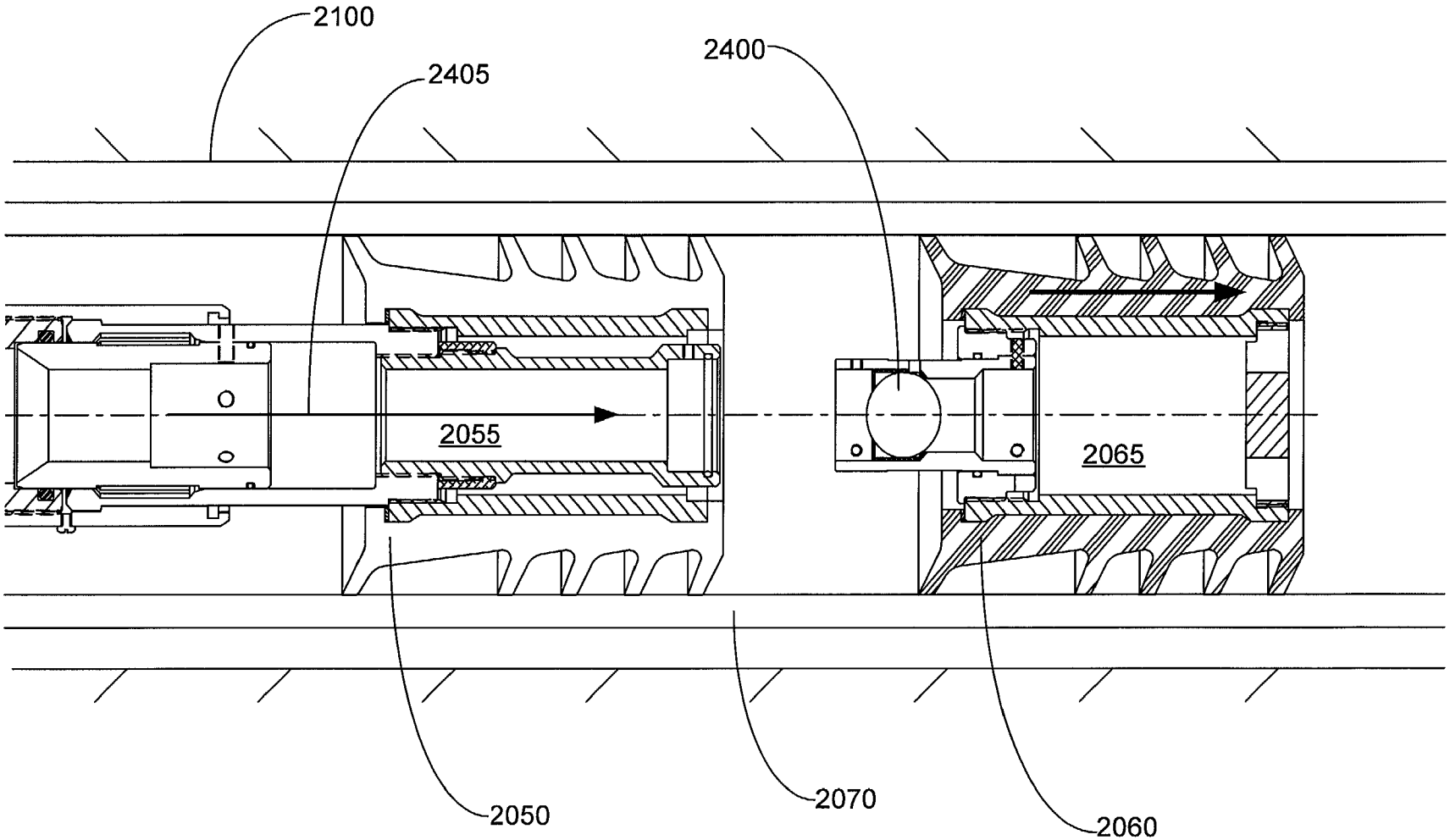

Referring to FIGS. 6A to 6C, in a preferred embodiment, after positioning the apparatus 500 within the wellbore 2100, the lead wiper 2060 is released from the apparatus 500 by injecting a conventional ball 2400 into an end portion of the lead wiper 2060 using a fluidic material 2405. In a preferred embodiment, the fluidic material 2405 is a non-hardenable fluidic material such as, for example, drilling mud.

Referring to FIGS. 7A to 7G, in a preferred embodiment, after releasing the lead wiper 2060 from the apparatus 500, a quantity of a hardenable fluidic sealing material 2500 is injected from the apparatus 500 into the wellbore 2100 using the internal passage 2001, the first passage 670, the secondary throat passage 695, the primary throat passage 690, the fourth passage 700, the collet release throat passage 755, the fifth passage 760, the internal passage 2010, the internal passage 2025, the internal passage 2035, and the internal passage 2055. In a preferred embodiment, the hardenable fluidic sealing material 2500 substantially fills the annular space surrounding the liner hanger 595. The hardenable fluidic sealing material 2500 may include any number of conventional hardenable fluidic sealing materials such as, for example, cement or epoxy resin. In a preferred embodiment, the hardenable fluidic sealing material includes oil well cement available from Halliburton Energy Services in order to provide an optimal seal for the surrounding formations and structural support for the liner hanger 595 and tubular members 2070. In an alternative embodiment, the injection of the hardenable fluidic sealing material 2500 is omitted.

Figure 7A:
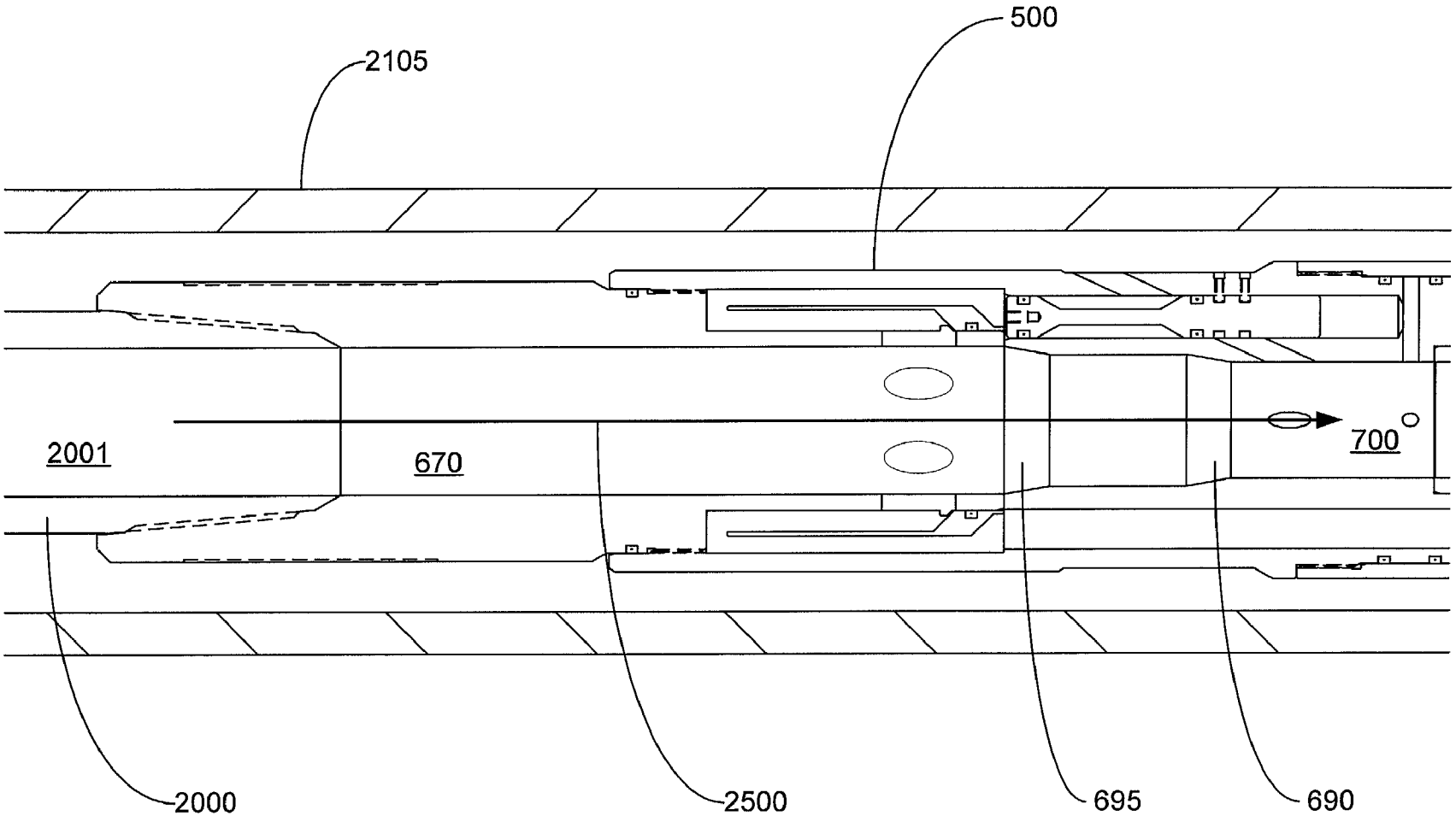
FIGS. 7A to 7G are fragmentary cross-sectional illustration of an embodiment of a method for cementing the region outside of the apparatus of FIGS. 6A to 6C.
Figure 7B:
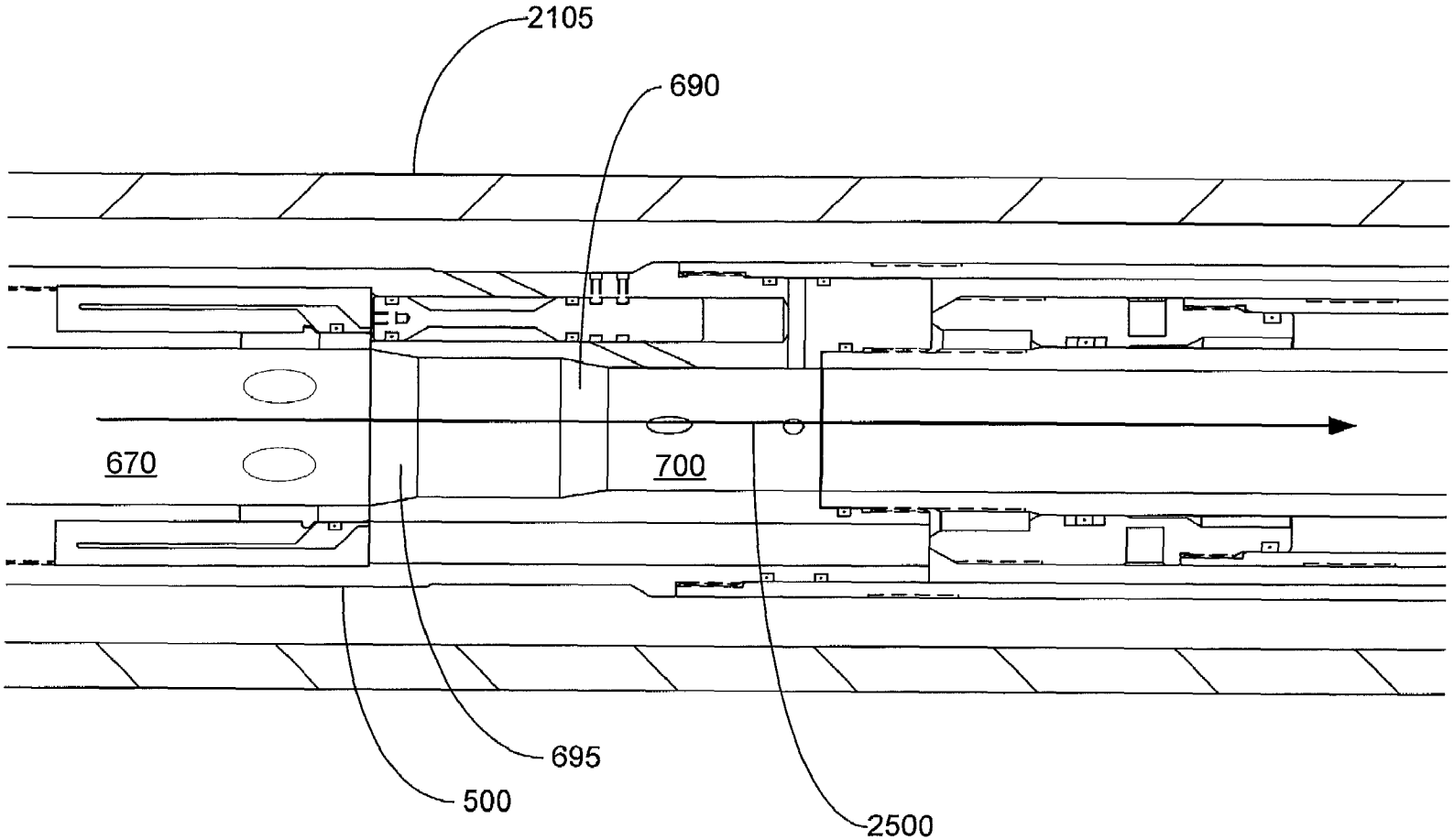
Figure 7C:
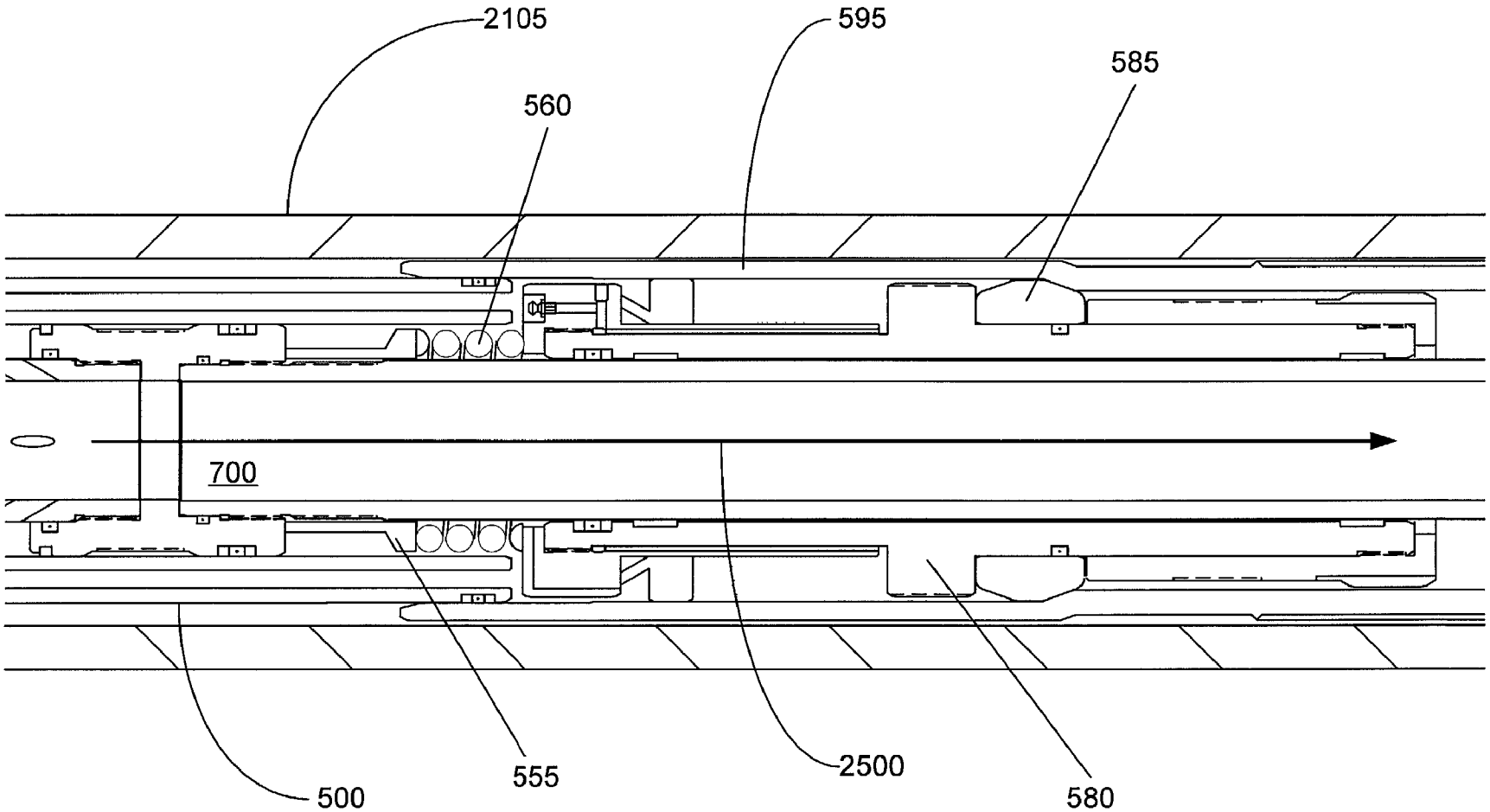
Figure 7D:
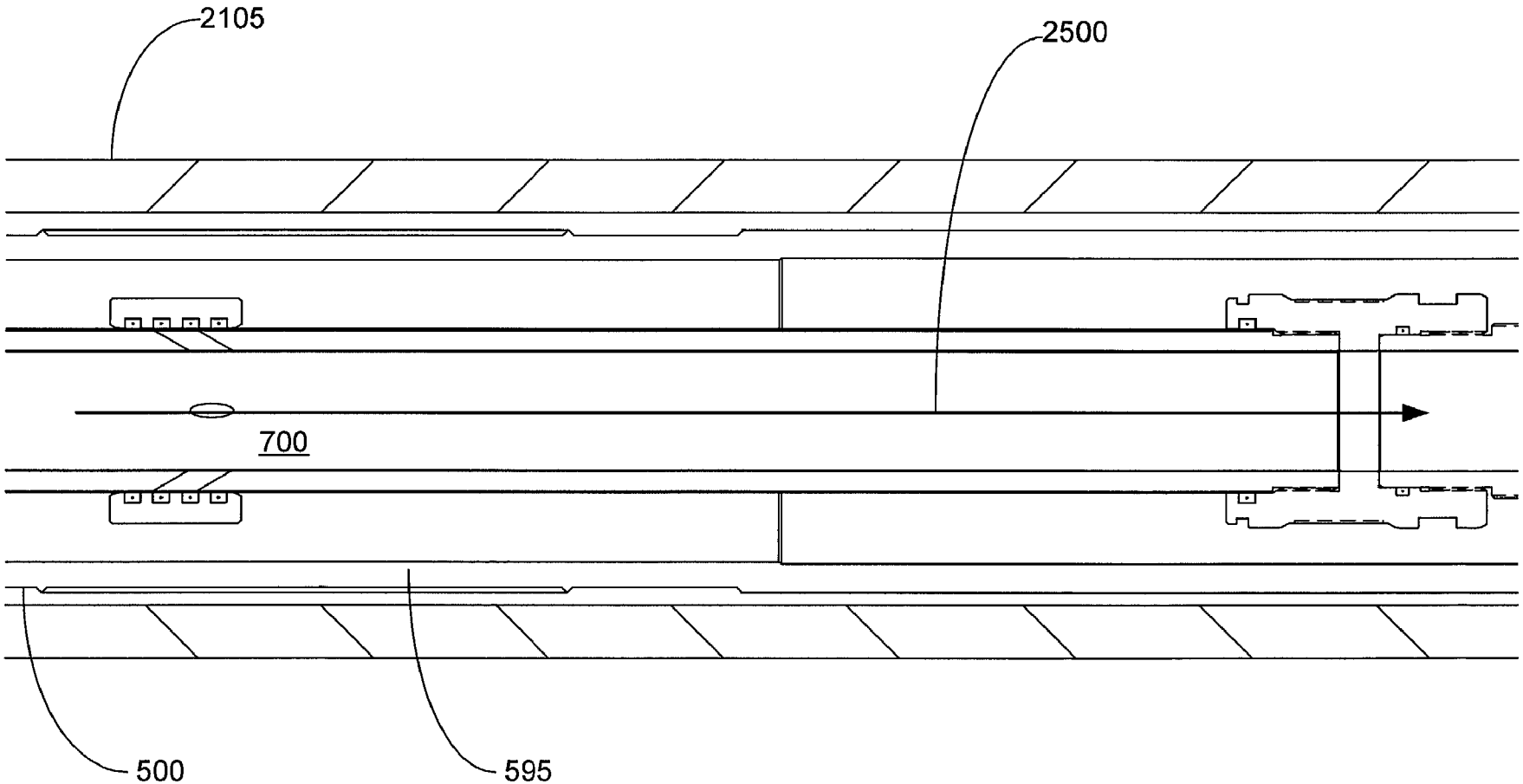
Figure 7E:
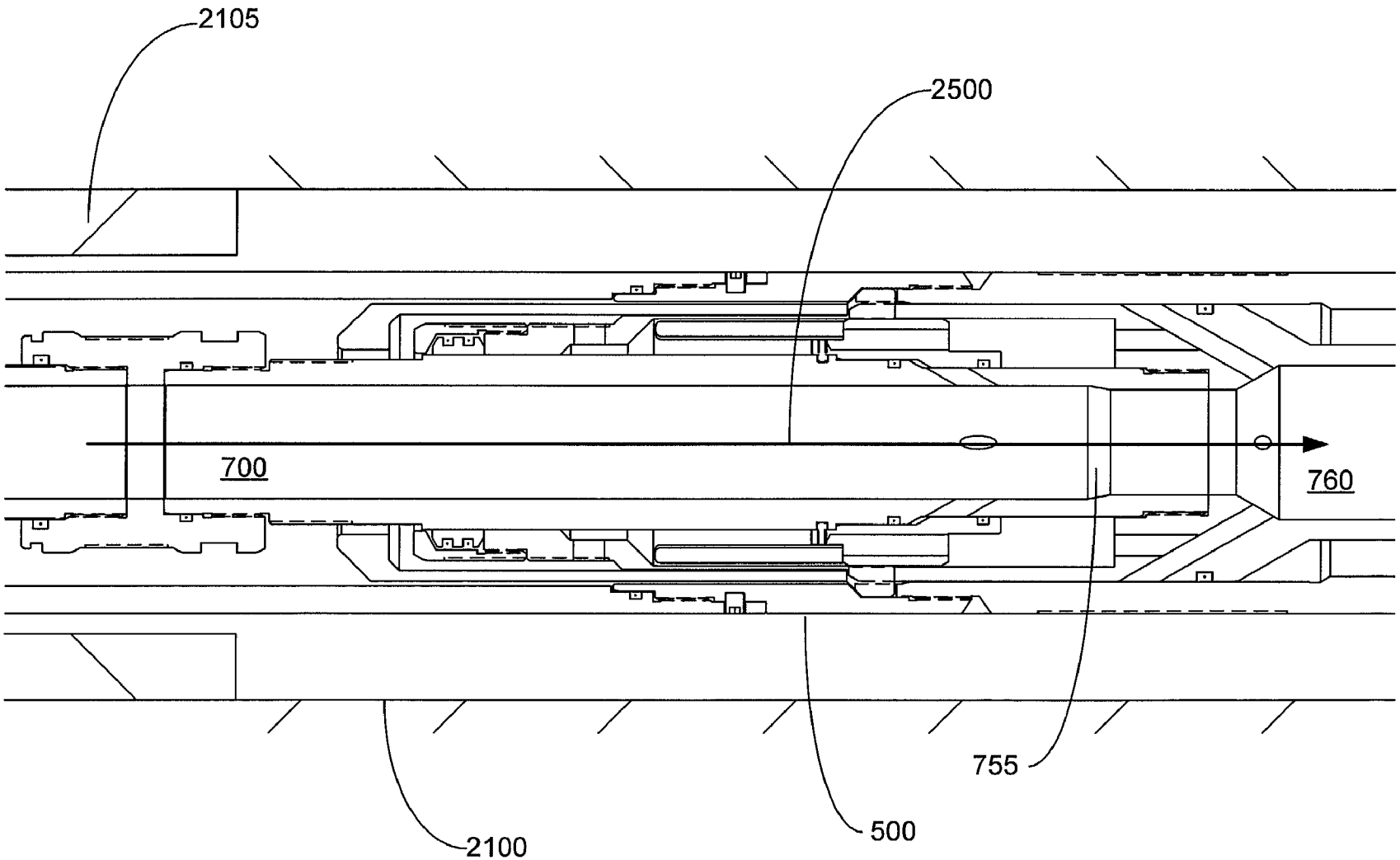
Figure 7F:
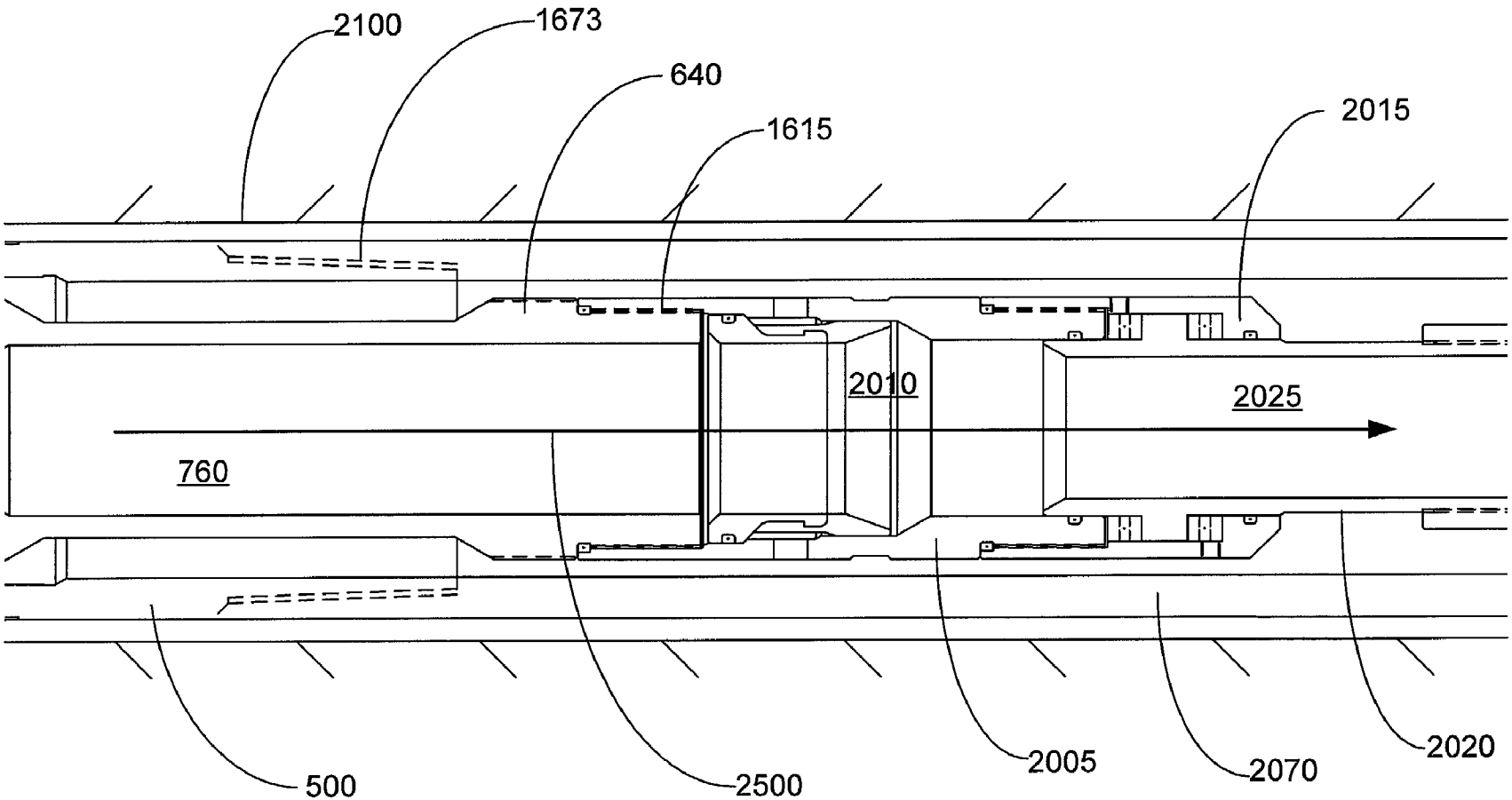
Figure 7G:
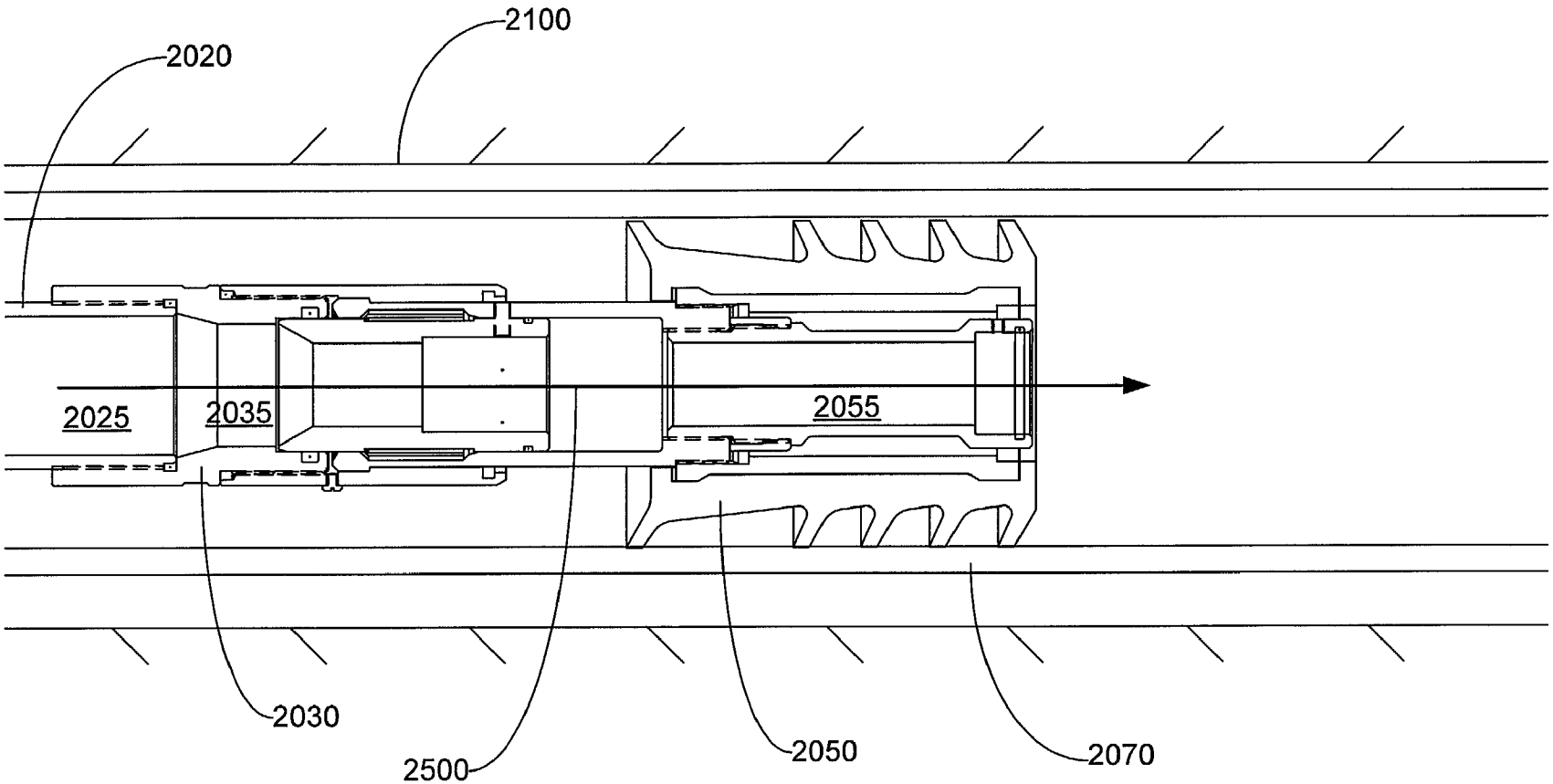

As illustrated in FIG. 7C, in a preferred embodiment, prior to the initiation of the radial expansion process, the preload spring 560 exerts a substantially constant axial force on the mandrel 580 and expansion cone 585. In this manner, the expansion cone 585 is maintained in a substantially stationary position prior to the initiation of the radial expansion process. In a preferred embodiment, the amount of axial force exerted by the preload spring 560 is varied by varying the length of the spring spacer 555. In a preferred embodiment, the axial force exerted by the preload spring 560 on the mandrel 580 and expansion cone 585 ranges from about 500 to 2,000 lbf in order to optimally provide an axial preload force on the expansion cone 585 to ensure metal to metal contact between the outside diameter of the expansion cone 585 and the interior surface of the liner hanger 595.

Figure 8A:
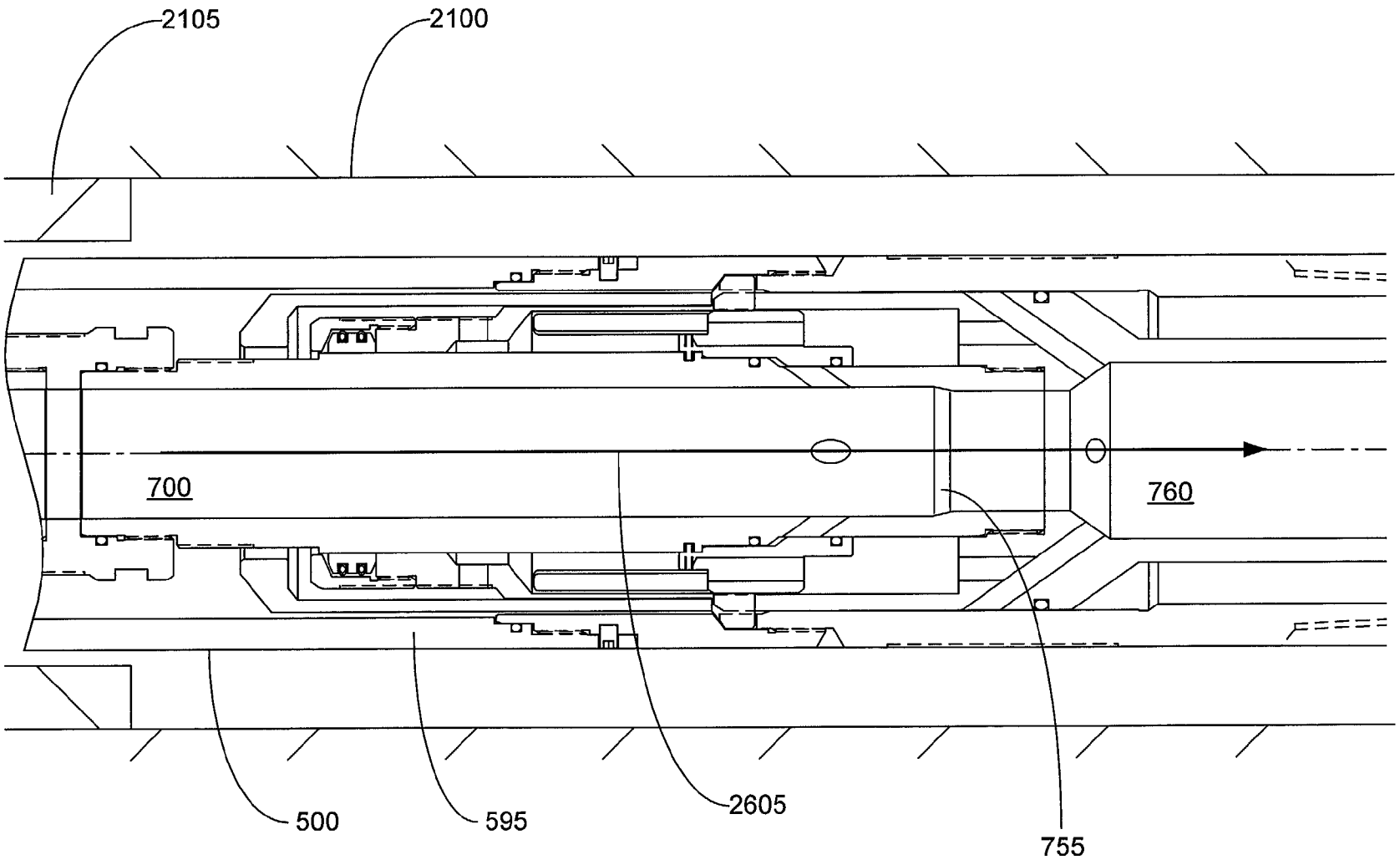
FIGS. 8A to 8C are fragmentary cross-sectional illustrations of an embodiment of a method for releasing the tail wiper from the apparatus of FIGS. 7A to 7G.
Figure 8B:
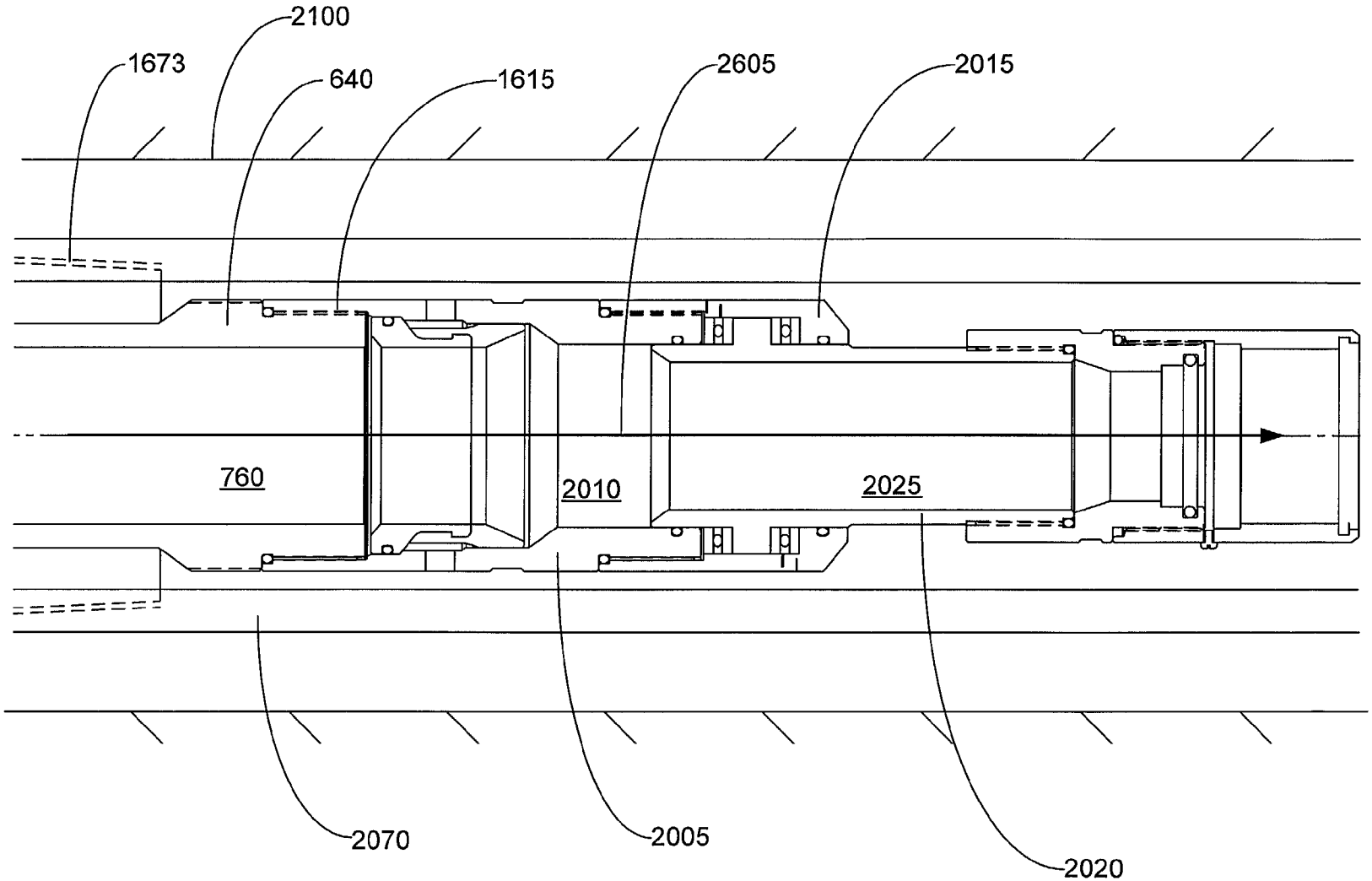
Figure 8C:
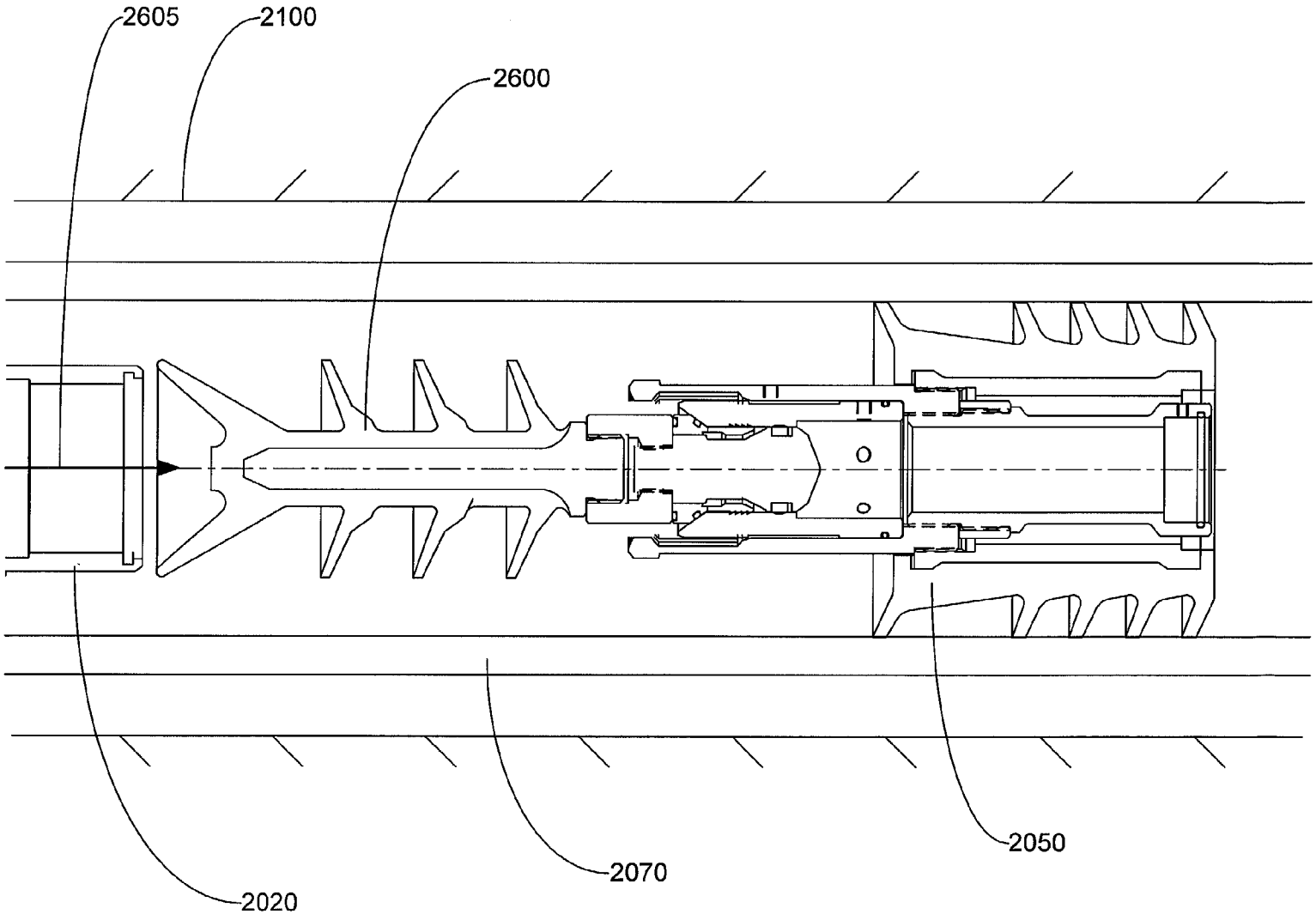
Figure 9A:
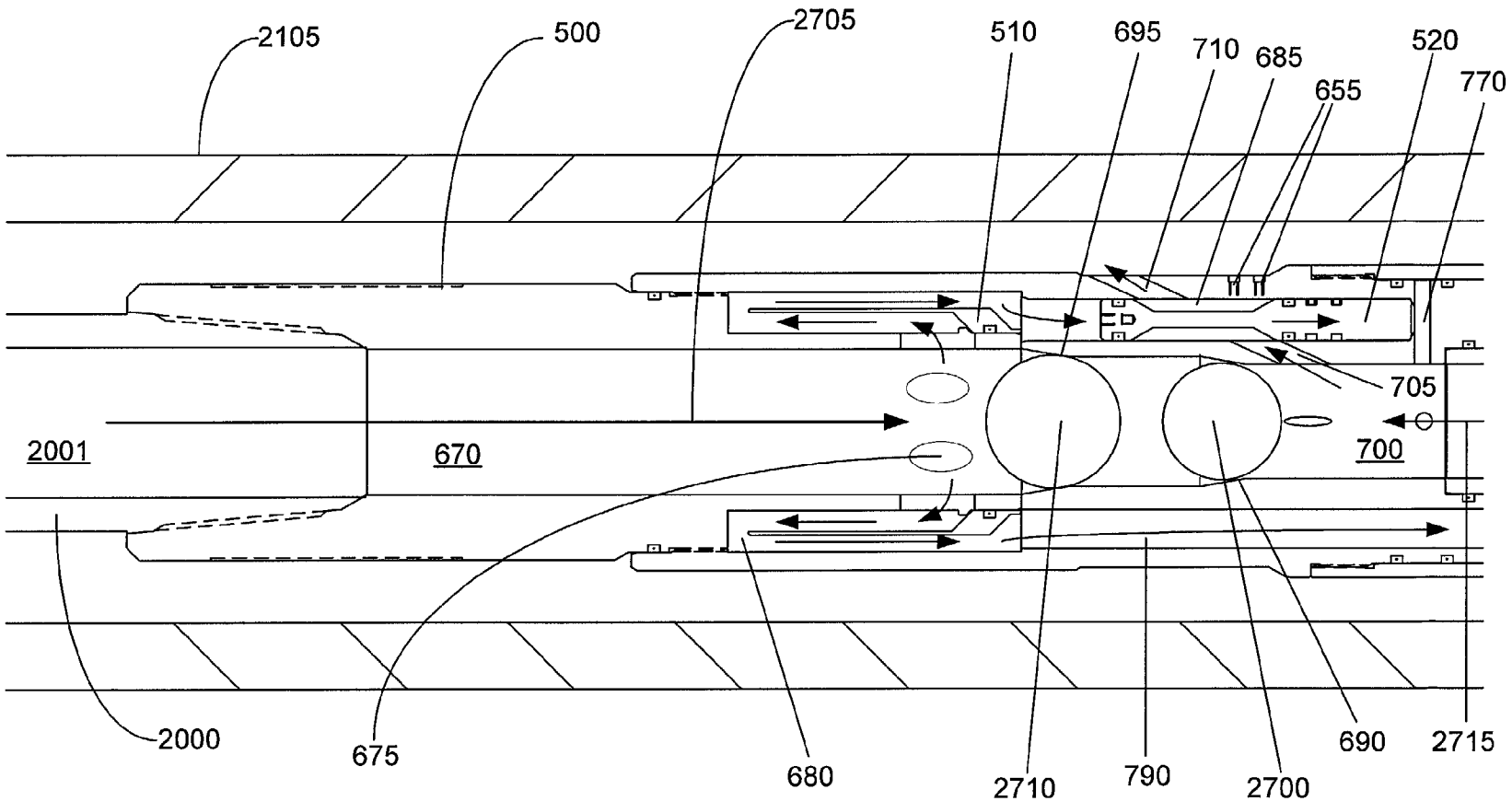
FIGS. 9A to 9H are fragmentary cross-sectional illustrations of an embodiment of a method of radially expanding the liner hanger of the apparatus of FIGS. 8A to 8C.
Figure 9B:
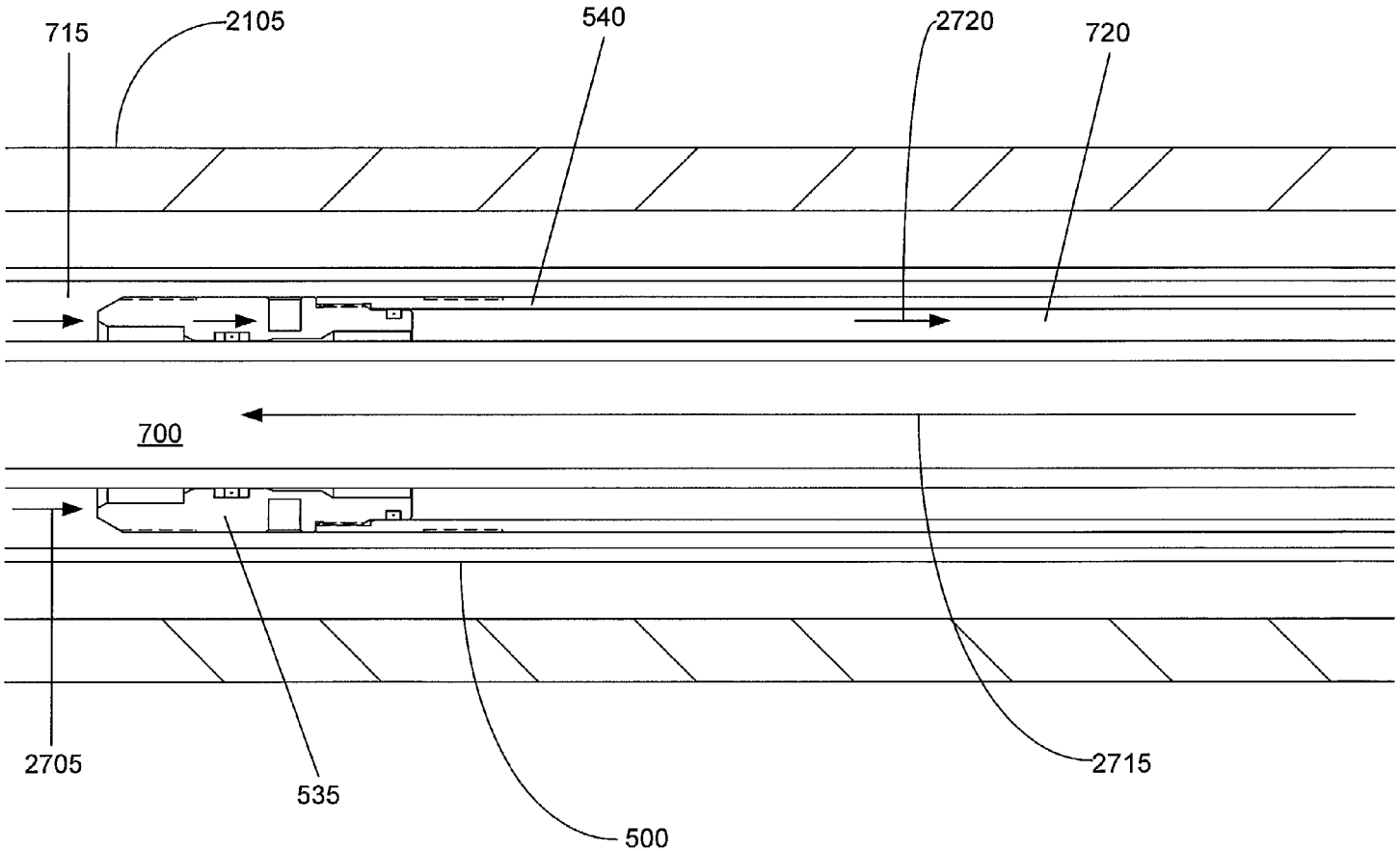
Figure 9C:
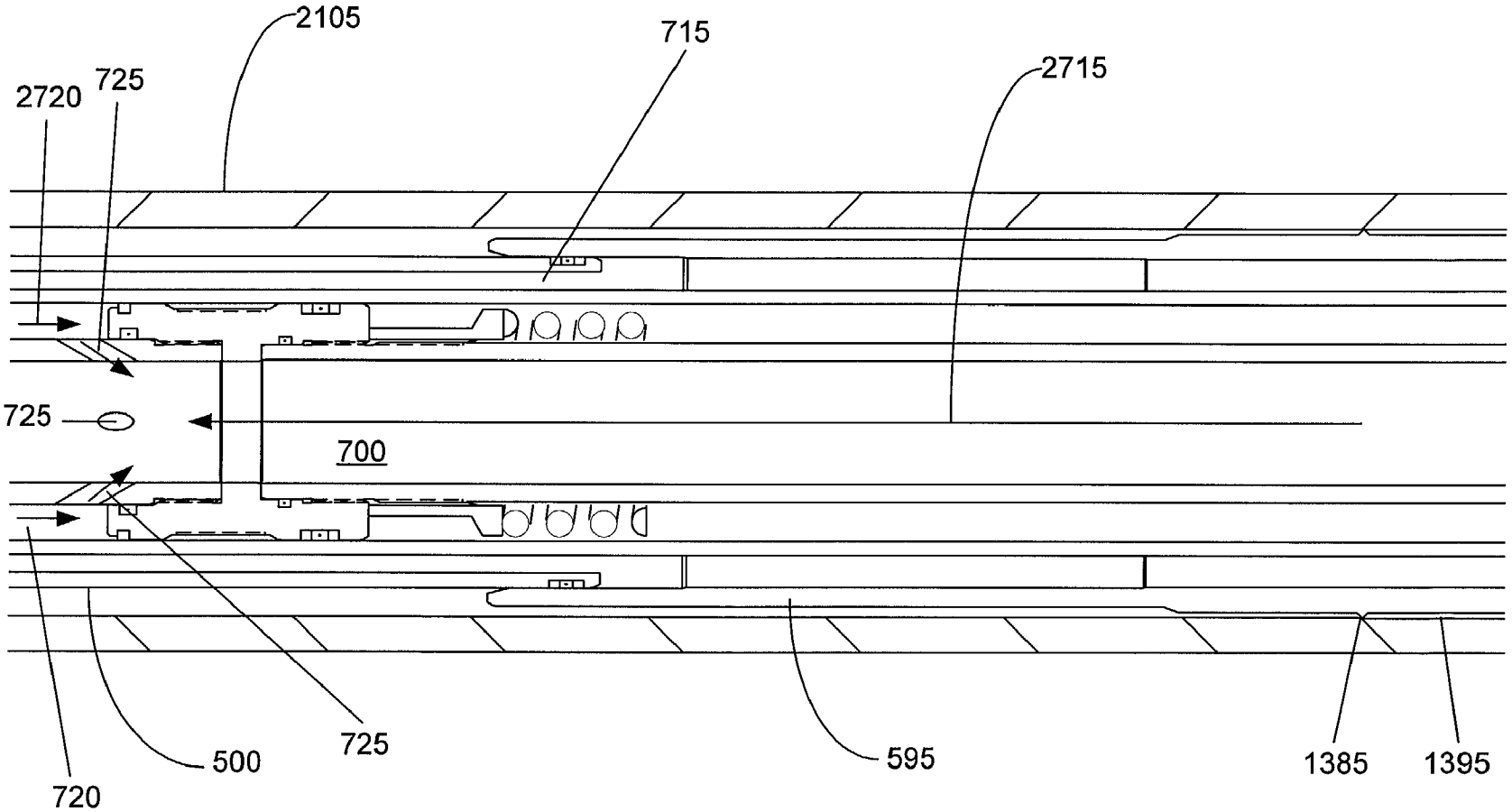
Figure 9D:
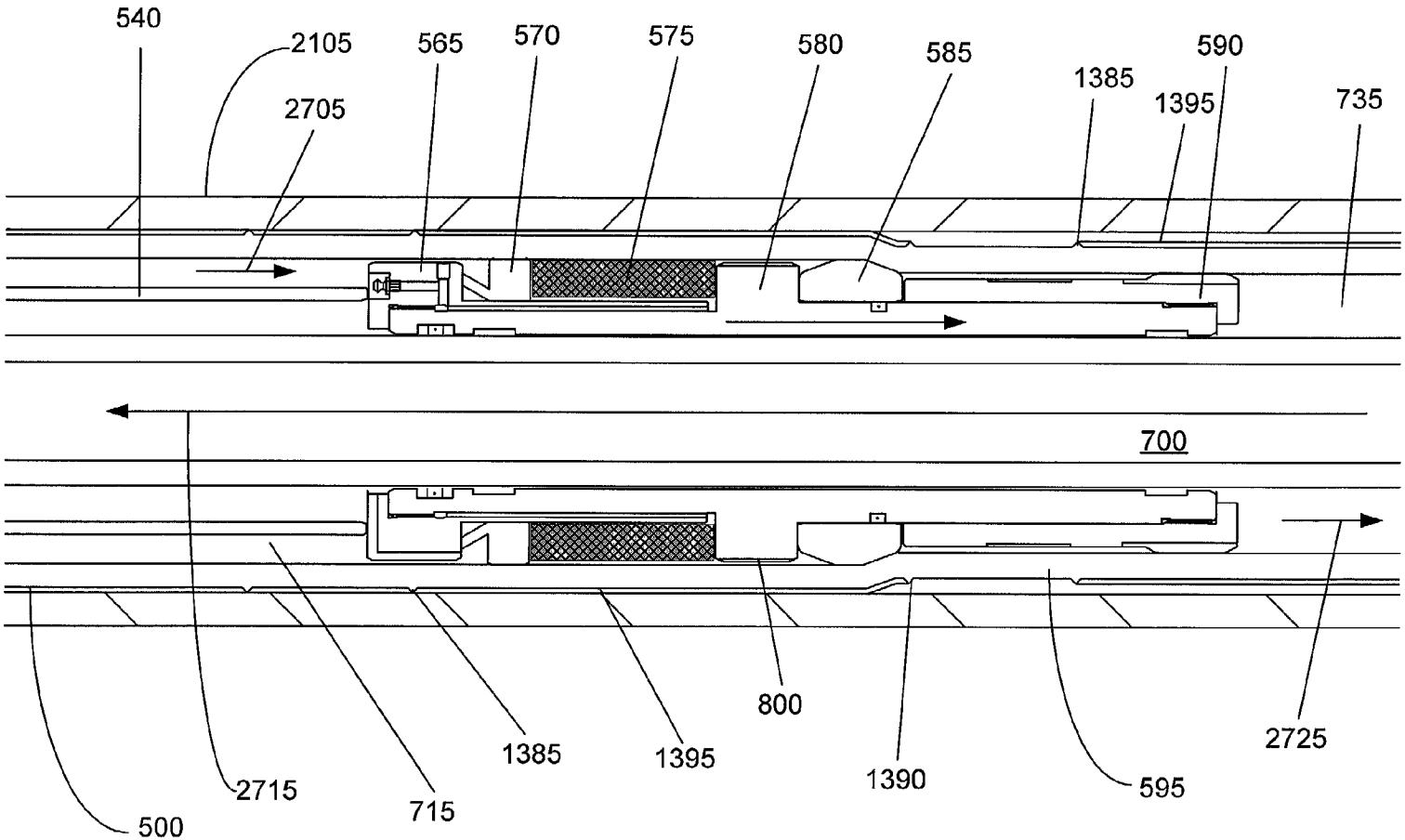
Figure 9E:
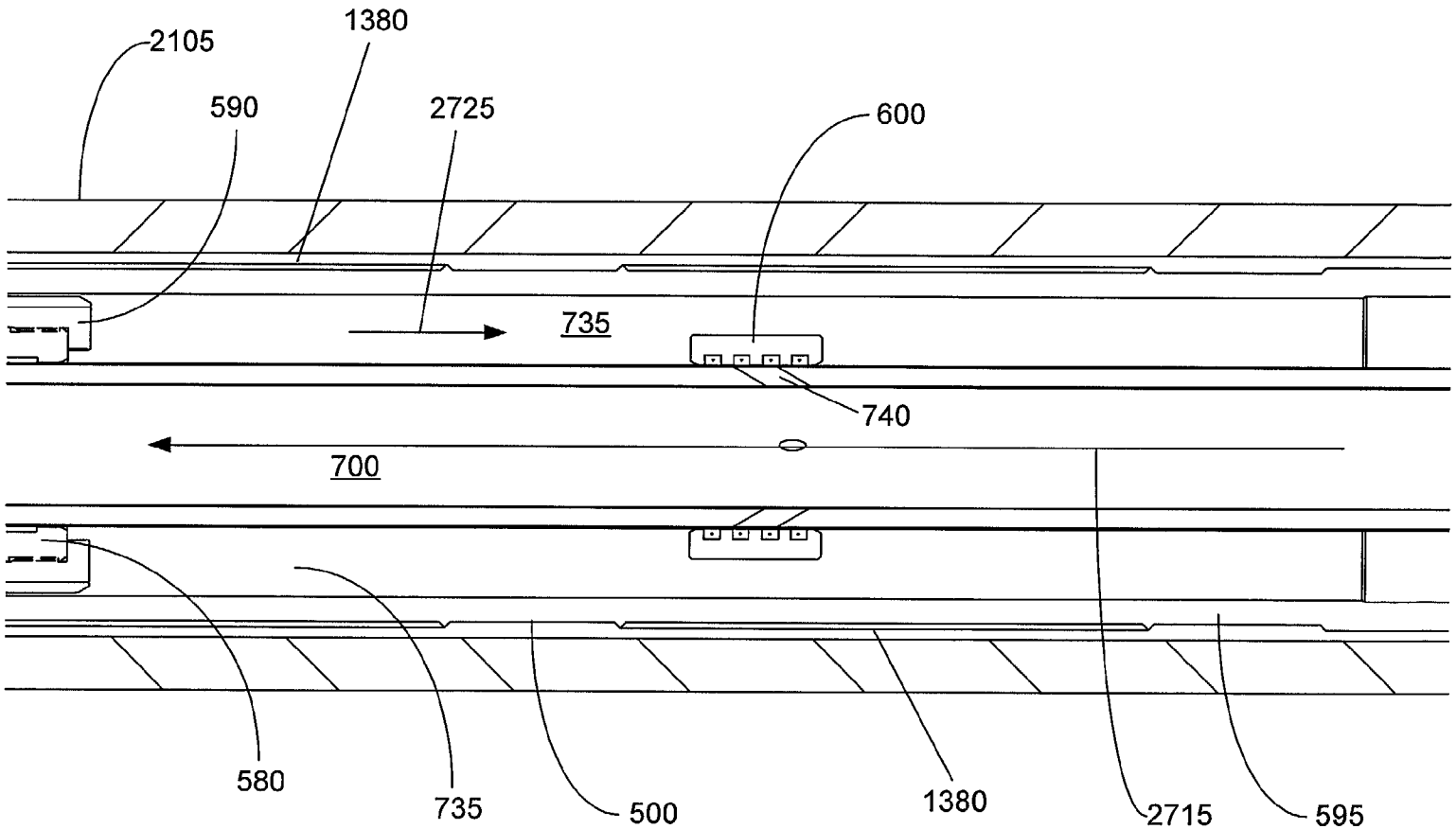
Figure 9F:
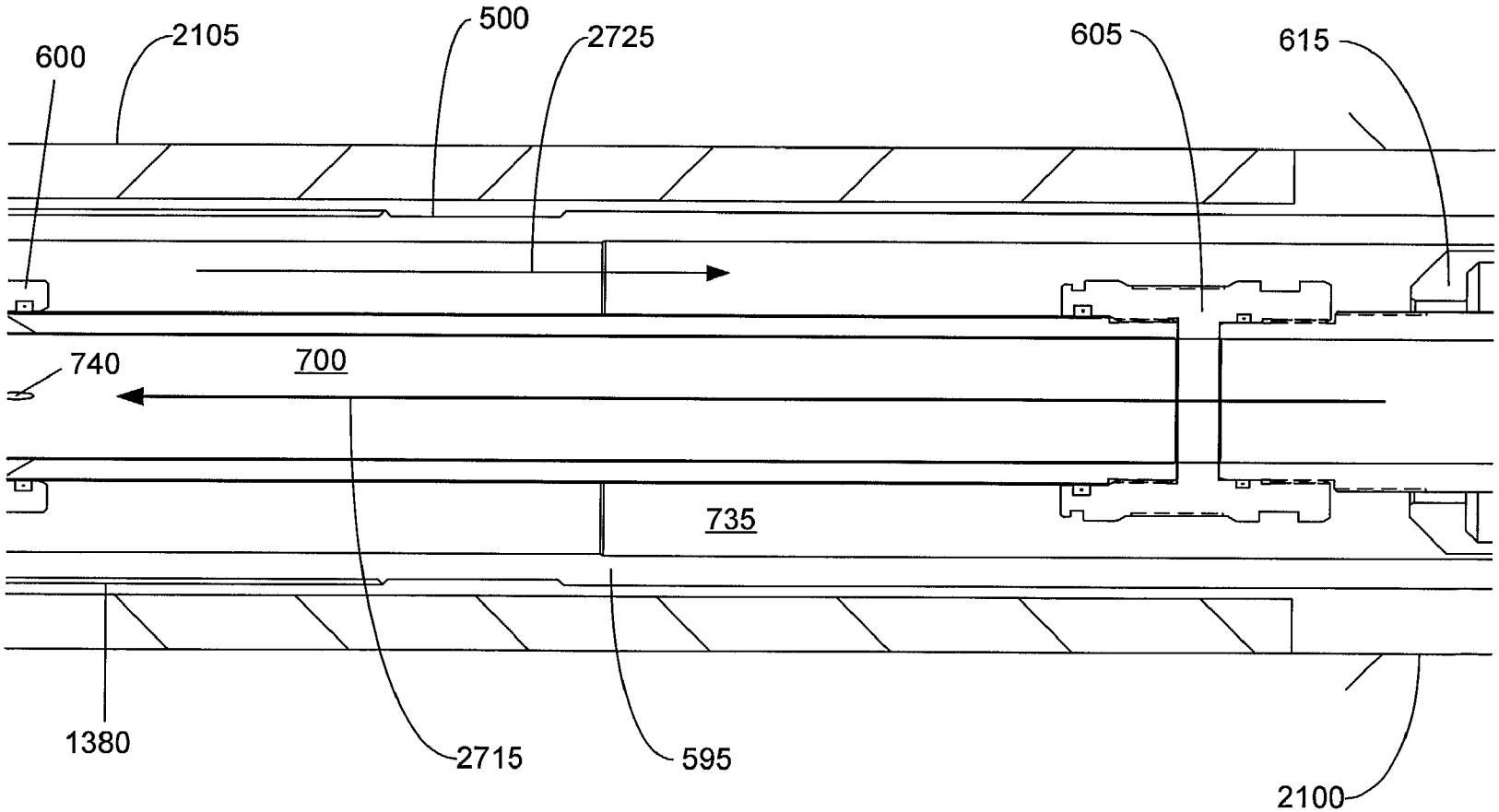
Figure 9G:
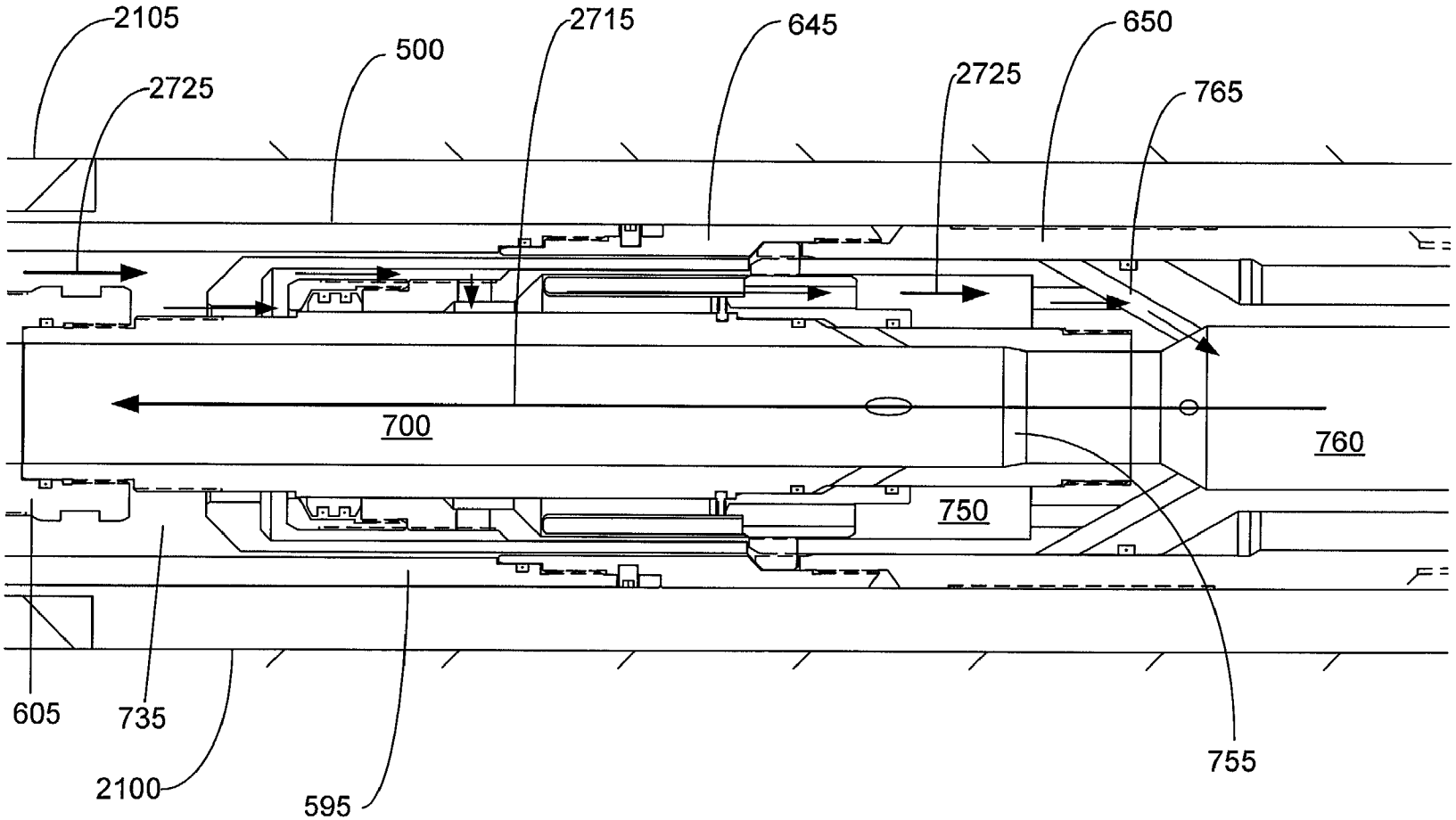
Figure 9H:
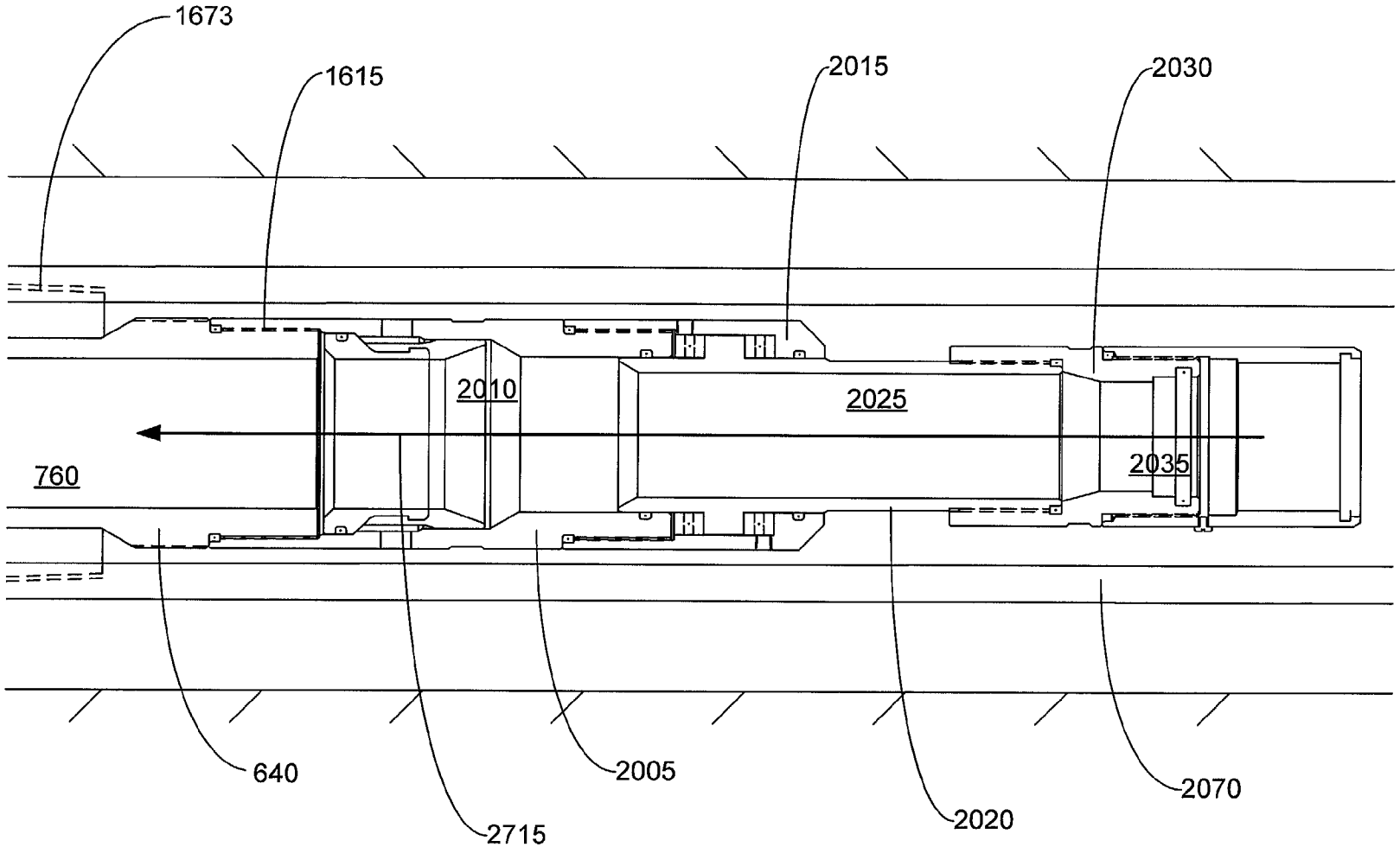
Figure 10A:
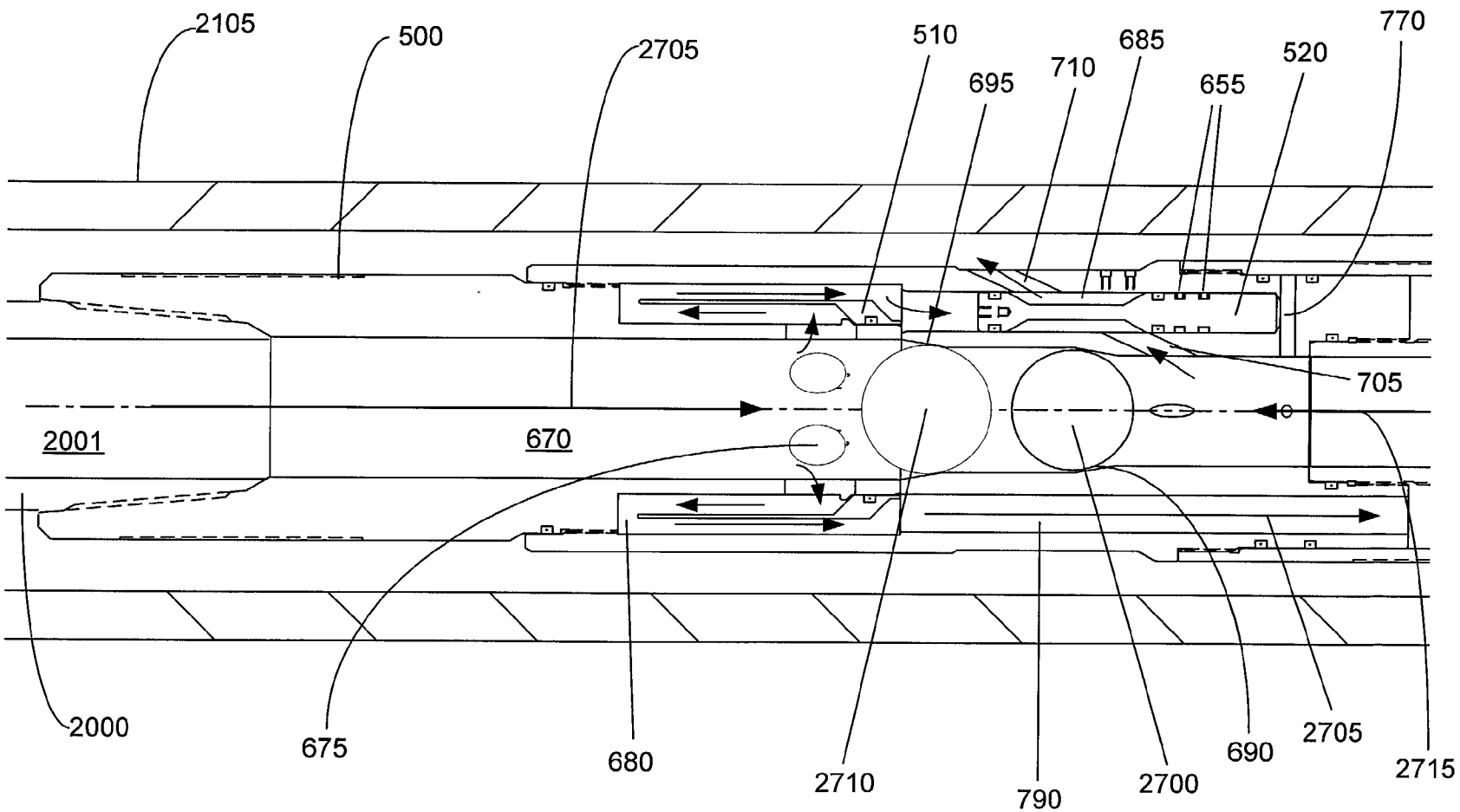
FIGS. 10A to 10E are fragmentary cross-sectional illustrations of the completion of the radial expansion of the liner hanger using the apparatus of FIGS. 9A to 9H.
Figure 10B:
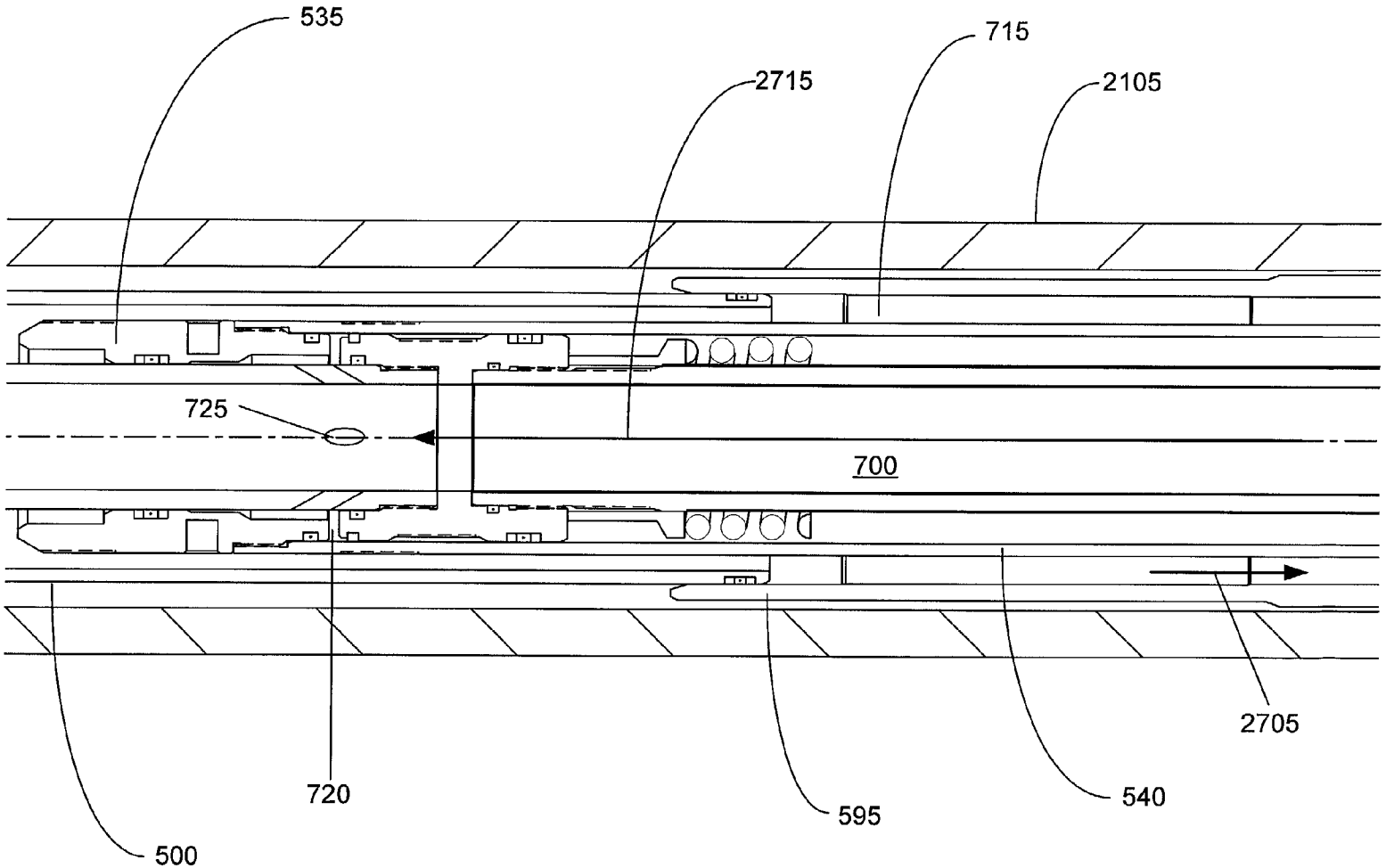
Figure 10C:
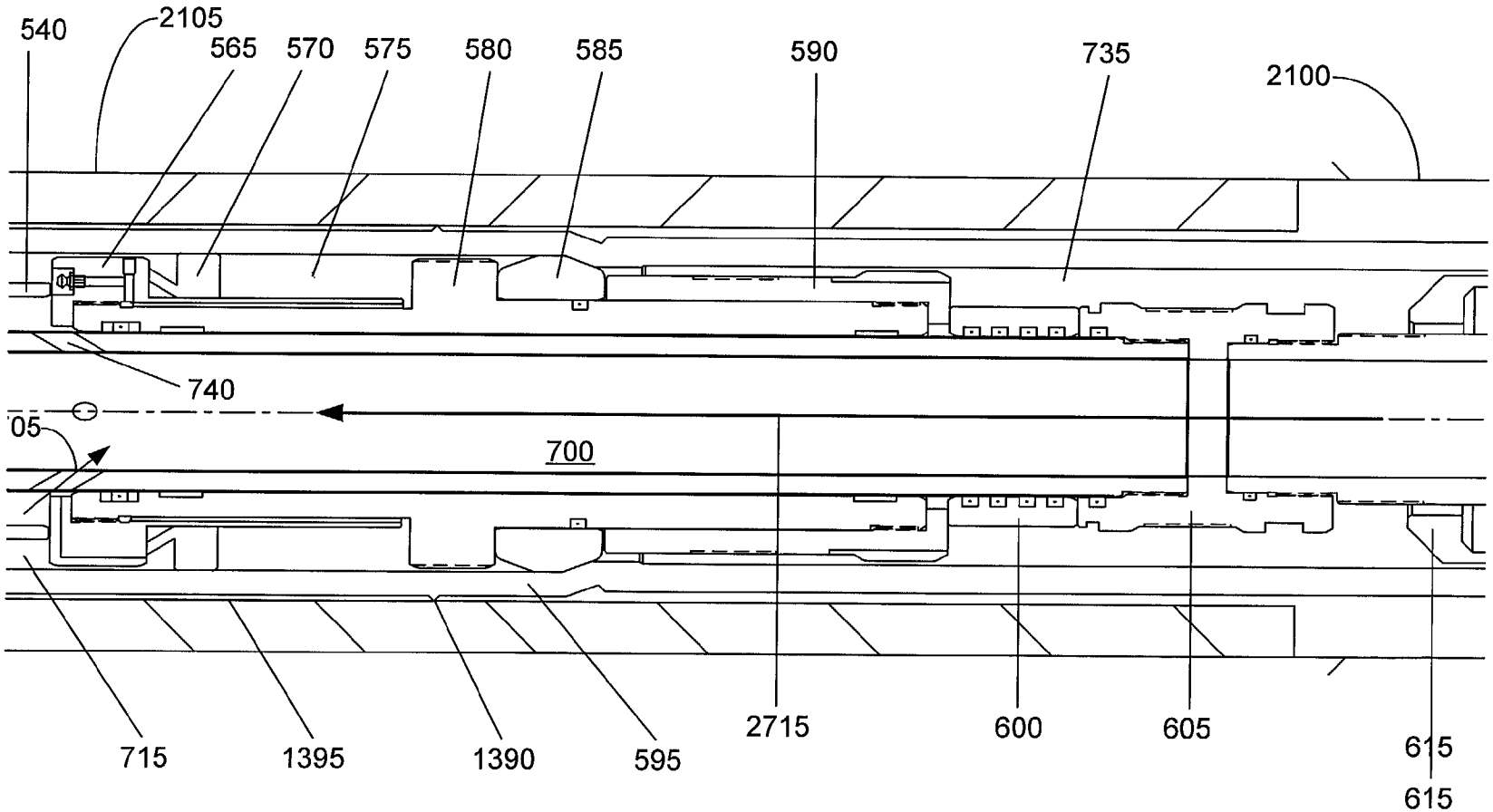
Figure 10D:
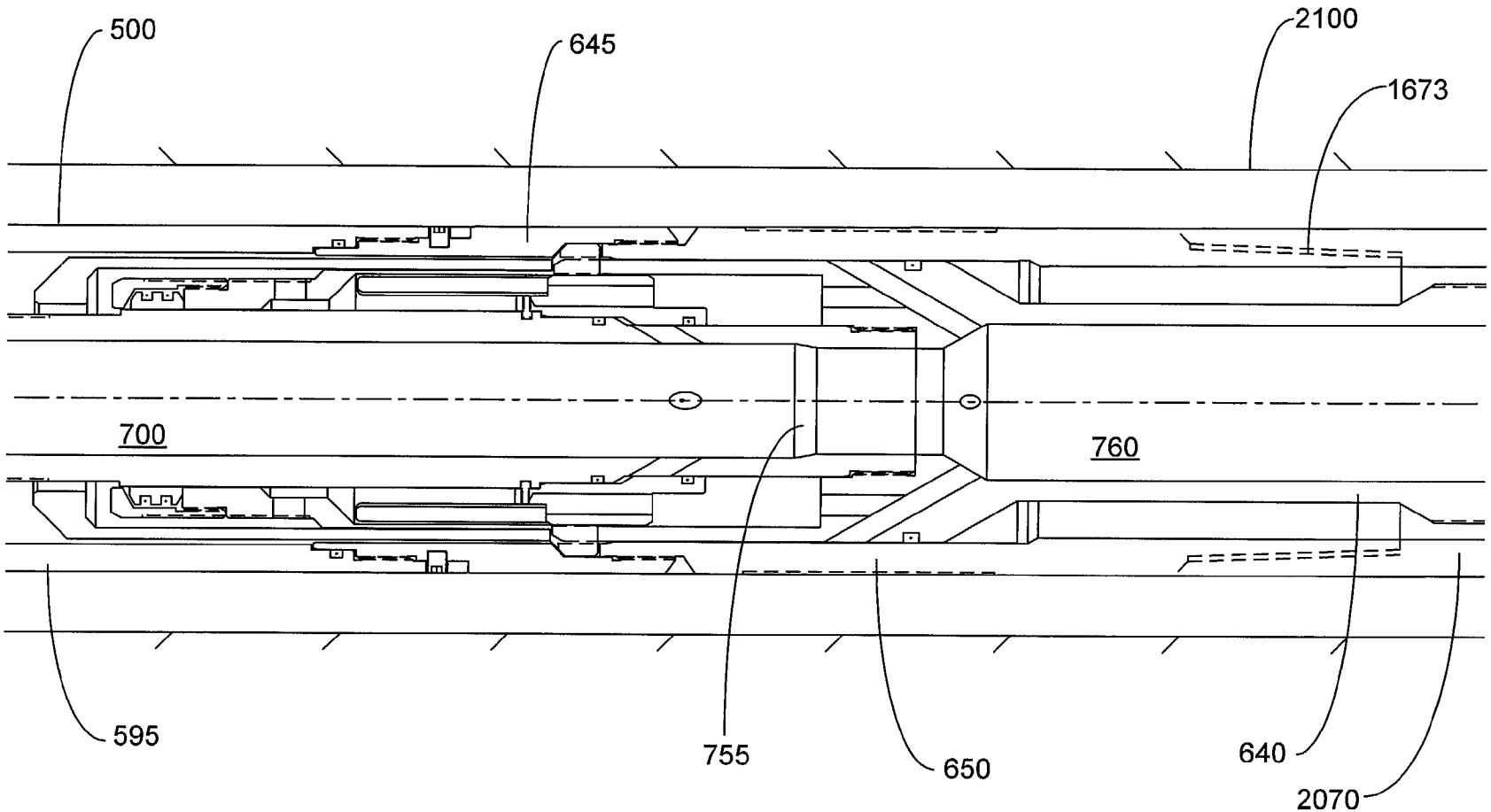
Figure 10E:
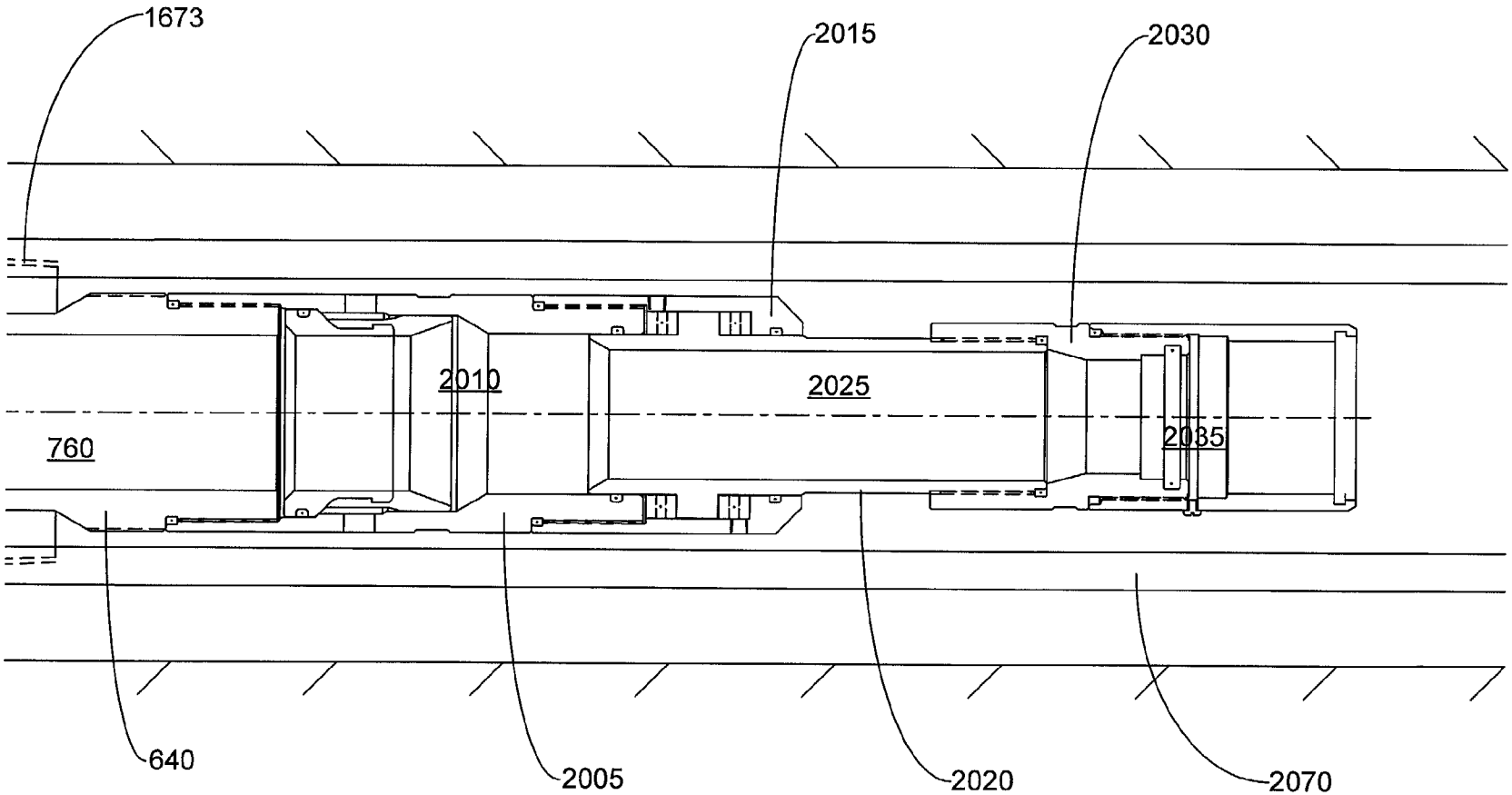

Referring to FIGS. 8A to 8C, in a preferred embodiment, after injecting the hardenable fluidic sealing material 2500 out of the apparatus 500 and into the wellbore 2100, the tail wiper 2050 is preferably released from the apparatus 500 by injecting a conventional wiper dart 2600 into the tail wiper 2050 using a fluidic material 2605. In a preferred embodiment, the fluidic material 2605 is a non-hardenable fluidic material such as, for example, drilling mud.

Referring to FIGS. 9A to 9H, in a preferred embodiment, after releasing the tail wiper 2050 from the apparatus 500, a conventional ball plug 2700 is placed in the primary throat passage 690 by injecting a fluidic material 2705 into the first passage 670. In a preferred embodiment, a conventional ball plug 2710 is also placed in the secondary throat passage 695. In this manner, the first passage 670 is optimally fluidicly isolated from the fourth passage 700. In a preferred embodiment, the differential pressure across the ball plugs 2700 and/or 2710 ranges from about 0 to 10,000 psi in order to optimally fluidicly isolate the first passage 670 from the fourth passage 700. In a preferred embodiment, the fluidic material 2705 is a non-hardenable fluidic material. In a preferred embodiment, the fluidic material 2705 includes one or more of the following: drilling mud, water, oil and lubricants.

The injected fluidic material 2705 preferably is conveyed to the crossover valve chamber 685 through the first passage 670, the second passages 675, and the third passage 680. The injected fluidic material 2705 is also preferably conveyed to the force multiplier piston chamber 715 through the first passage 670, the second passages 675, the third passage 680, and the force multiplier supply passages 790. The fluidic material 2705 injected into the crossover valve chambers 685 preferably applies an axial force on one end of the crossover valve members 520. In a preferred embodiment, the axial force applied to the crossover valve members 520 by the injected fluidic material 2705 shears the crossover valve shear pins 655. In this manner, one or more of the crossover valve members 520 are displaced in the axial direction thereby fluidicly coupling the fourth passage 700, the inner crossover ports 705, the crossover valve chambers 685, the outer crossover ports 710, and the region outside of the apparatus 500. In this manner, fluidic materials 2715 within the apparatus 500 are conveyed outside of the apparatus. In a preferred embodiment, the operating pressure of the fluidic material 2705 is gradually increased after the placement of the sealing ball 2700 and/or the sealing ball 2710 in the primary throat passage 690 and/or the secondary throat passage 695 in order to minimize stress on the apparatus 500. In a preferred embodiment, the operating pressure required to displace the crossover valve members 520 ranges from about 500 to 3,000 psi in order to optimally prevent inadvertent or premature shifting the crossover valve members 520. In a preferred embodiment, the one or more of the crossover valve members 520 are displaced when the operating pressure of the fluidic material 2705 is greater than or equal to about 1860 psi. In a preferred embodiment, the radial expansion of the liner hanger 595 does not begin until one or more of the crossover valve members 520 are displaced in the axial direction. In this manner, the operation of the apparatus 500 is precisely controlled. Furthermore, in a preferred embodiment, the outer crossover ports 710 include controllable variable orifices in order to control the flow rate of the fluidic materials conveyed outside of the apparatus 500. In this manner, the rate of the radial expansion process is optimally controlled.

In a preferred embodiment, after displacing one or more of the crossover valve members 520, the operating pressure of the fluidic material 2705 is gradually increased until the radial expansion process begins. In an exemplary embodiment, the radial expansion process begins when the operating pressure of the fluidic material 2705 within the force multiplier piston chamber 715 is greater than about 3200 psi. The operating pressure within the force multiplier piston chamber 715 preferably causes the force multiplier piston 535 to be displaced in the axial direction. The axial displacement of the force multiplier piston 535 preferably causes the force multiplier sleeve 540 to be displaced in the axial direction. Fluidic materials 2720 within the force multiplier exhaust chamber 720 are then preferably exhausted into the fourth passage 700 through the force multiplier exhaust passages 725. In this manner, the differential pressure across the force multiplier piston 535 is maximized. In an exemplary embodiment, the force multiplier piston 535 includes about 11.65 square inches of surface area in order to optimally increase the rate of radial expansion of the liner hanger 595 by the expansion cone 585. In a preferred embodiment, the operating pressure within the force multiplier piston chamber 715 ranges from about 1,000 to 10,000 psi during the radial expansion process in order to optimally provide radial expansion of the liner hanger 595.

In a preferred embodiment, the axial displacement of the force multiplier sleeve 540 causes the force multiplier sleeve 540 to drive the mandrel 580 and expansion cone 585 in the axial direction. In a preferred embodiment, the axial displacement of the expansion cone 585 radially expands the liner hanger 595 into contact with the preexisting wellbore casing 2105. In a preferred embodiment, the operating pressure within the force multiplier piston chamber 715 also drives the mandrel 580 and expansion cone 585 in the axial direction. In this manner, the axial force for axially displacing the mandrel 580 and expansion cone 585 preferably includes the axial force applied by the force multiplier sleeve 540 and the axial force applied by the operating pressure within the force multiplier piston chamber 715. In an alternative preferred embodiment, the force multiplier piston 535 and the force multiplier sleeve 540 are omitted and the mandrel 580 and expansion cone 585 are driven solely by fluid pressure.

The radial expansion of the liner hanger 595 preferably causes the top rings 1385 and the lower rings 1390 of the liner hanger 595 to penetrate the interior walls of the preexisting wellbore casing 2105. In this manner, the liner hanger 595 is optimally coupled to the wellbore casing 2105. In a preferred embodiment, during the radial expansion of the liner hanger 595, the intermediate sealing members 1395 of the liner hanger 595 fluidicly seal the interface between the radially expanded liner hanger 595 and the interior surface of the wellbore casing 2105.

During the radial expansion process, the dynamic interface between the exterior surface of the expansion cone 585 and the interior surface of the liner hanger 595 is preferably lubricated by lubricants supplied from the body of lubricant 575 through the second lubrication supply passage 800. In this manner, the operational efficiency of the apparatus 500 during the radial expansion process is optimized. In a preferred embodiment, the lubricants supplied by the body of lubricant 575 through the second lubrication passage 800 are injected into the dynamic interface between the exterior surface of the expansion cone 585 and the interior surface of the liner hanger 595 substantially as disclosed in one or more of the following: (1) U.S. patent application Ser. No. 09/440,338, filed on Nov. 15, 1999, which issued as U.S. Pat. No. 6,328,113, which claimed benefit of the filing date of U.S. Provisional Patent Application Ser. No. 60/108,558, filed on Nov. 16, 1998, (2) U.S. patent application Ser. No. 09/454,139, filed on Dec. 3, 1999, which claimed benefit of the filing date of U.S. Provisional Patent Application Ser. No. 60/111,293, filed on Dec. 7, 1998, (3) U.S. patent application Ser. No. 09/502,350, filed on Feb. 10, 2000, which claimed the benefit of the filing date of U.S. Provisional Patent Application Ser. No. 60/119,611, filed Feb. 11, 1999, (4) U.S. patent application Ser. No. 09/510,913, filed on Feb. 23, 2000, which claimed the benefit of the filing date of U.S. Provisional Patent Application Ser. No. 60/121,702, filed on Feb. 25, 1999, (5) U.S. patent application Ser. No. 09/511,941, filed on Feb. 24, 2000, which claimed the benefit of the filing date of U.S. Provisional Patent Application No. 60/121,907, filed Feb. 26, 1999, (6) U.S. Provisional Patent Application Ser. No. 60/124,042, filed on Mar. 11, 1999, (7) U.S. Provisional Patent Application Ser. No. 60/131,106, filed on Apr. 26, 1999, (8) U.S. Provisional Patent Application Ser. No. 60/137,998, filed on Jun. 7, 1999, (9) U.S. Provisional Patent Application Ser. No. 60/143,039, filed on Jul. 9, 1999, and (10) U.S. Provisional Patent Application Ser. No. 60/146,203, filed on Jul. 29, 1999, the disclosures of which are incorporated by reference.

In a preferred embodiment, the expansion cone 585 is reversible. In this manner, if one end of the expansion cone 585 becomes excessively worn, the apparatus 500 can be disassembled and the expansion cone 585 reversed in order to use the un-worn end of the expansion cone 585 to radially expand the liner hanger 595. In a preferred embodiment, the expansion cone 585 further includes one or more surface inserts fabricated from materials such as, for example, tungsten carbide, in order to provide an extremely durable material for contacting the interior surface of the liner hanger 595 during the radial expansion process.

During the radial expansion process, the centralizer 590 preferably centrally positions the mandrel 580 and the expansion cone 585 within the interior of the liner hanger 595. In this manner, the radial expansion process is optimally provided.

During the radial expansion process, fluidic materials 2725 within the second annular chamber 735 are preferably conveyed to the fifth passage 760 through the collet sleeve passages 775, the flow passages 1530, the third annular chamber 750, and the sixth passages 765. In this manner, the axial displacement of the mandrel 580 and the expansion cone 585 are optimized.

Referring to FIGS. 10A to 10E, in a preferred embodiment, the radial expansion of the liner hanger 595 is stopped by fluidicly coupling the force multiplier piston chamber 715 with the fourth passage 700. In particular, during the radial expansion process, the continued axial displacement of the mandrel 580 and the expansion cone 585, caused by the injection of the fluidic material 2705, displaces the travel port sealing sleeve 600 and causes the force multiplier piston chamber 715 to be fluidicly coupled to the fourth passage 700 through the expansion cone travel indicator ports 740. In a preferred embodiment, the travel port sealing sleeve 600 is removably coupled to the third support member 550 by one or more shear pins. In this manner, accidental movement of the travel port sealing sleeve 600 is prevented.

In a preferred embodiment, the fluidic coupling of the force multiplier piston chamber 715 with the fourth passage 700 reduces the operating pressure within the force multiplier piston chamber 715. In a preferred embodiment, the reduction in the operating pressure within the force multiplier piston chamber 715 stops the axial displacement of the mandrel 580 and the expansion cone 585. In this manner, the radial expansion of the liner hanger 595 is optimally stopped. In an alternative preferred embodiment, the drop in the operating pressure within the force multiplier piston chamber 715 is remotely detected and the injection of the fluidic material 2705 is reduced and/or stopped in order to gradually reduce and/or stop the radial expansion process. In this manner, the radial expansion process is optimally controlled by sensing the operating pressure within the force multiplier piston chamber 715.

In a preferred embodiment, after the completion of the radial expansion process, the hardenable fluidic sealing material 2500 is cured. In this manner, a hard annular outer layer of sealing material is formed in the annular region around the liner hanger 595. In an alternative embodiment, the hardenable fluidic sealing material 2500 is omitted.

Referring to FIGS. 11A to 11E, in a preferred embodiment, the liner hanger 595, the outer collet support member 645, and the liner hanger setting sleeve 650 are then decoupled from the apparatus 500. In a preferred embodiment, the liner hanger 595, the collet retaining adapter 640, the outer collet support member 645, and the liner hanger setting sleeve 650 are decoupled from the apparatus 500 by first displacing the annular support member 2000, the first support member 505, the second support member 515, the force multiplier outer support member 525, the force multiplier inner support member 530, the first coupling 545, the third support member 550, the second coupling 605, the collet mandrel 610, and the collet retaining adapter 640 in the axial direction 2800 relative to the liner hanger 595, the outer collet support member 645, and the liner hanger setting sleeve 650.

Figure 11A:
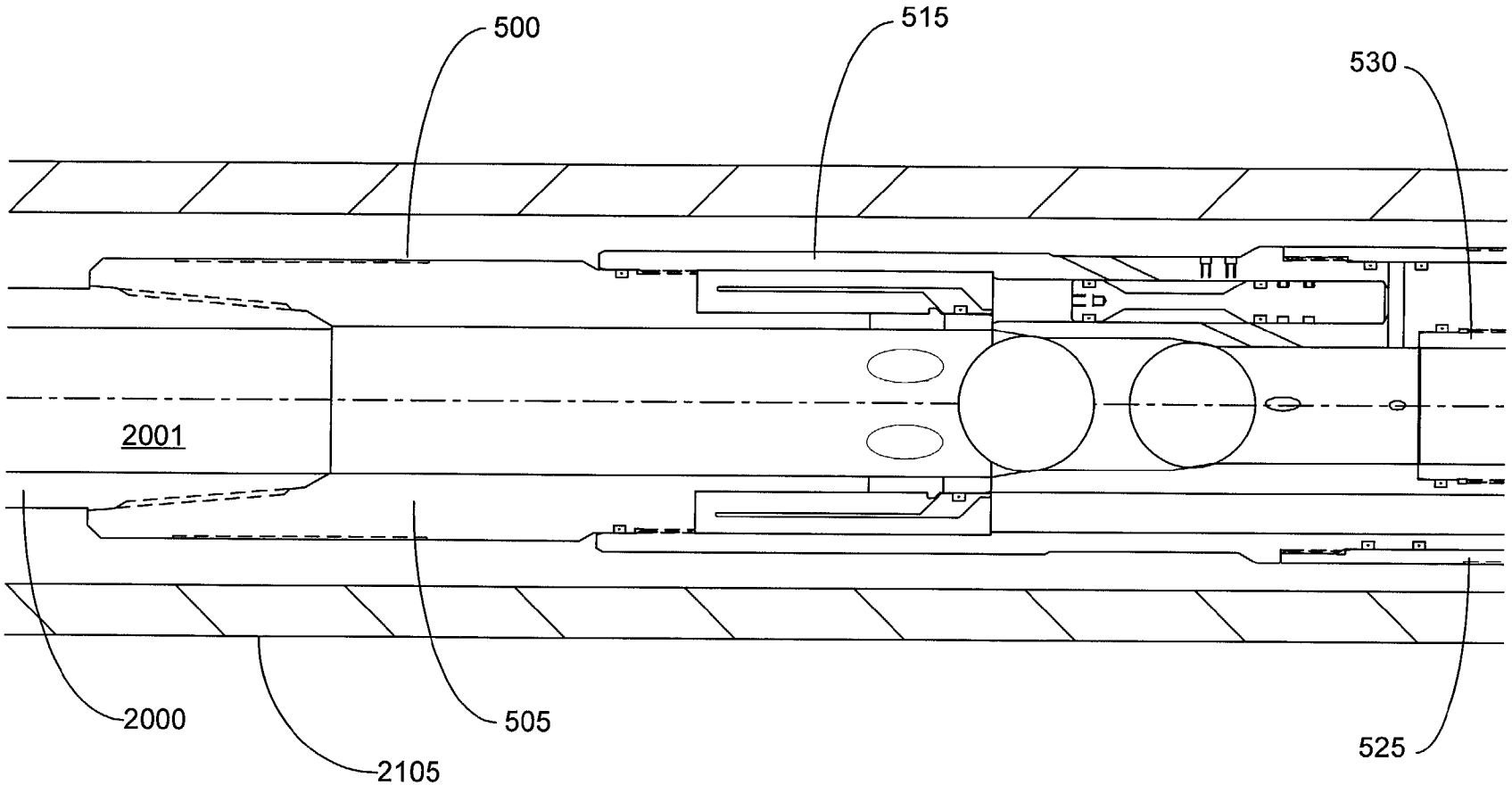
FIGS. 11A to 11E are fragmentary cross-sectional illustrations of the decoupling of the radially expanded liner hanger from the apparatus of FIGS. 10A to 10E.
Figure 11B:
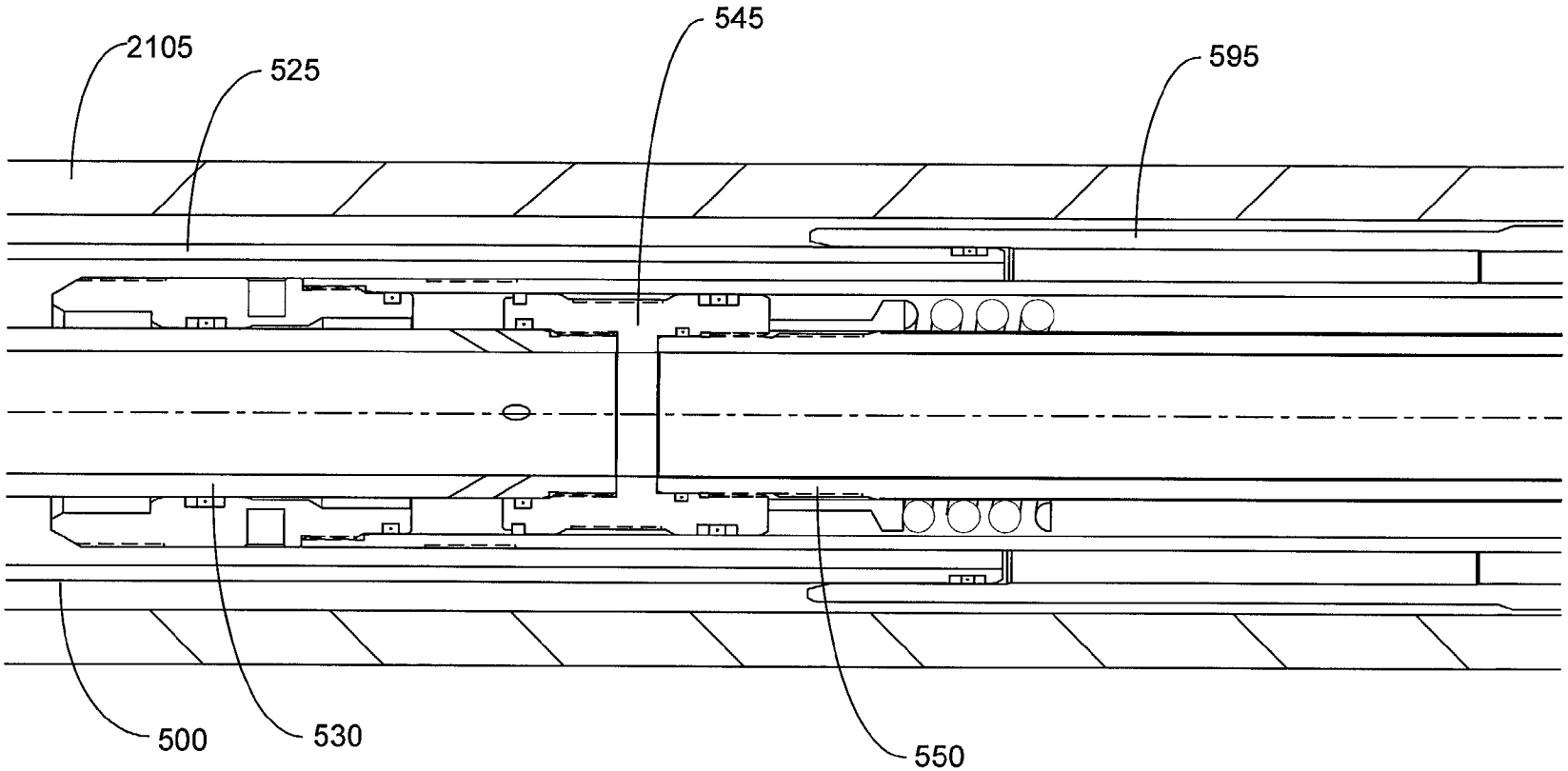
Figure 11C:
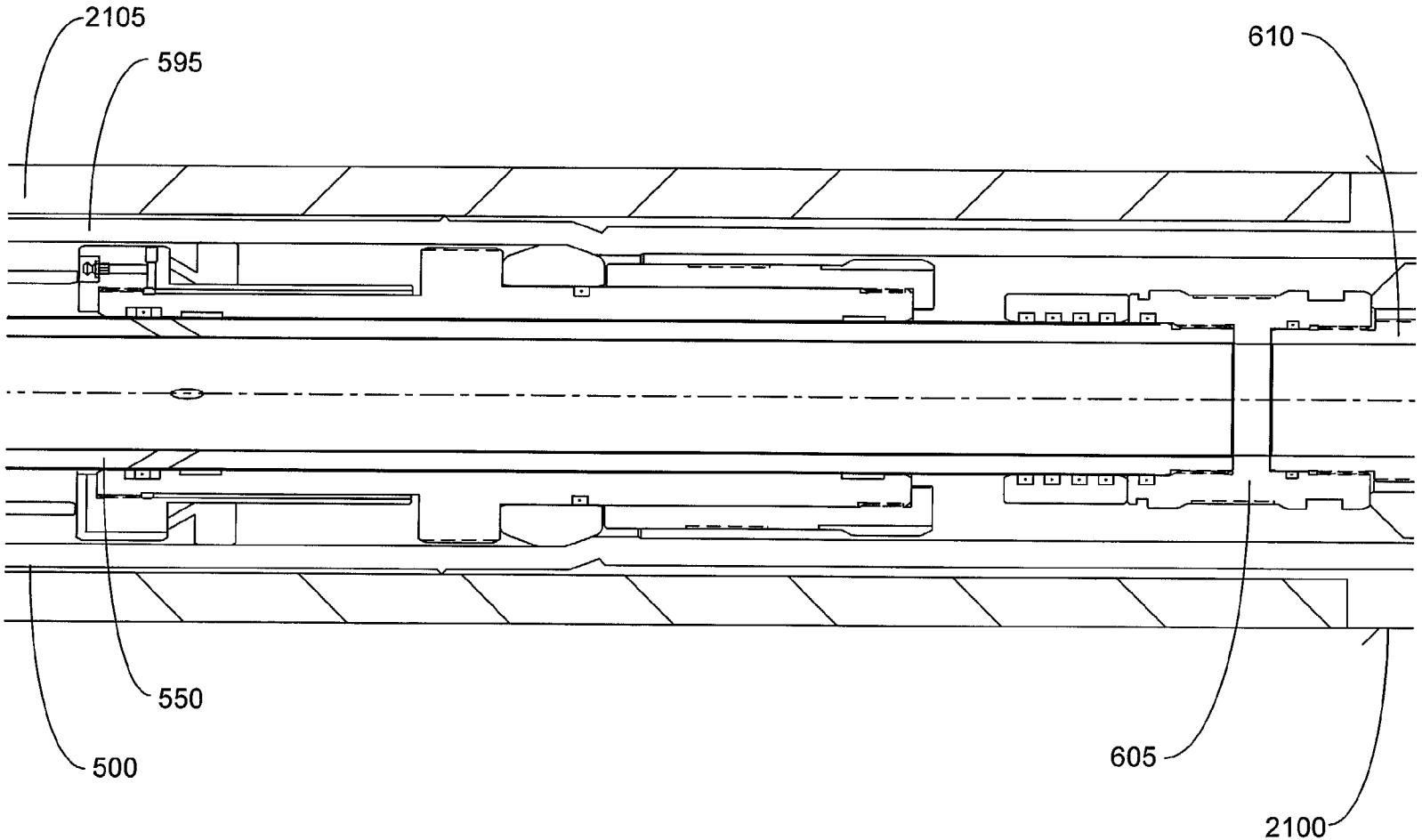
Figure 11D:
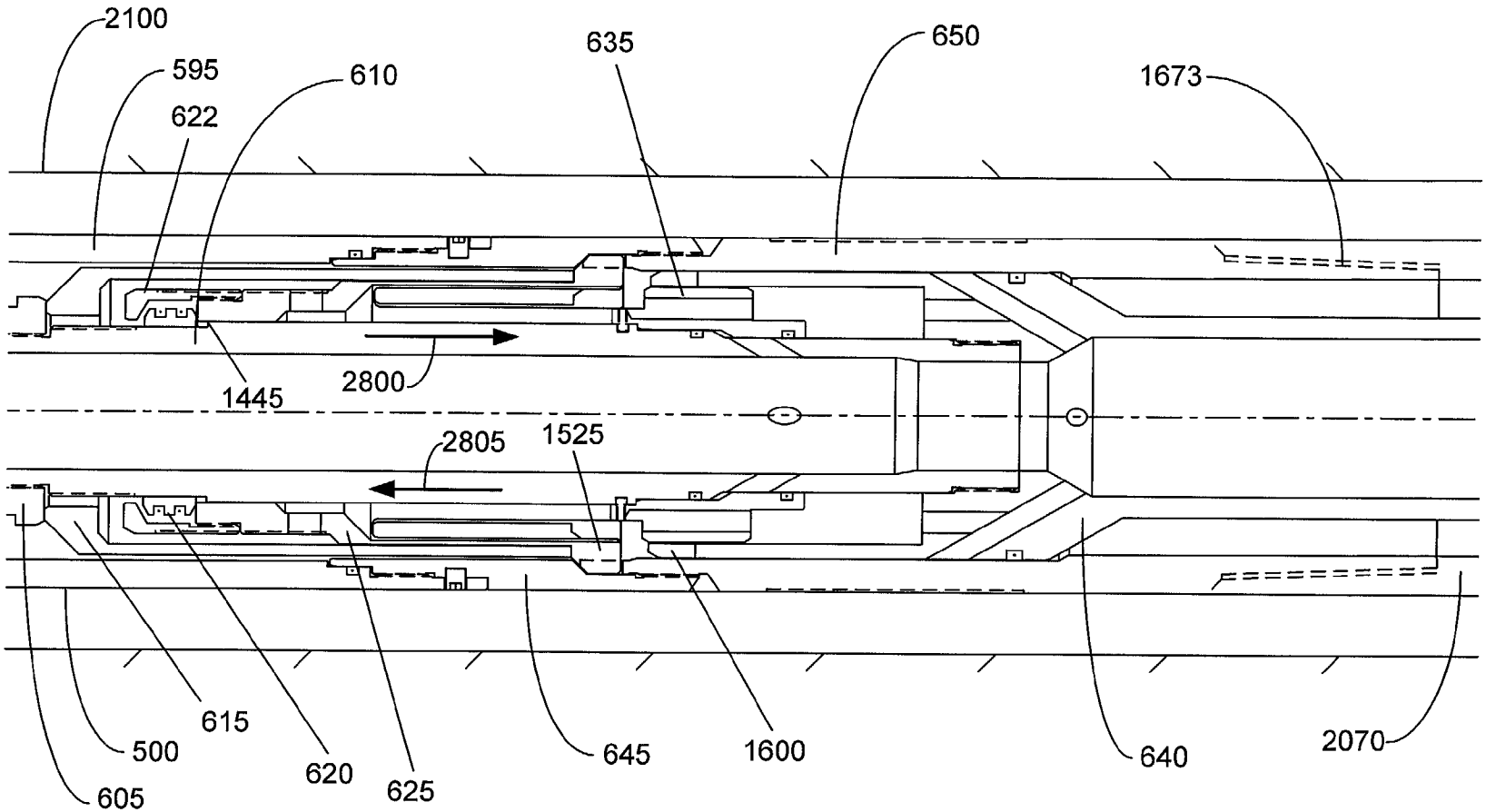
Figure 11E:
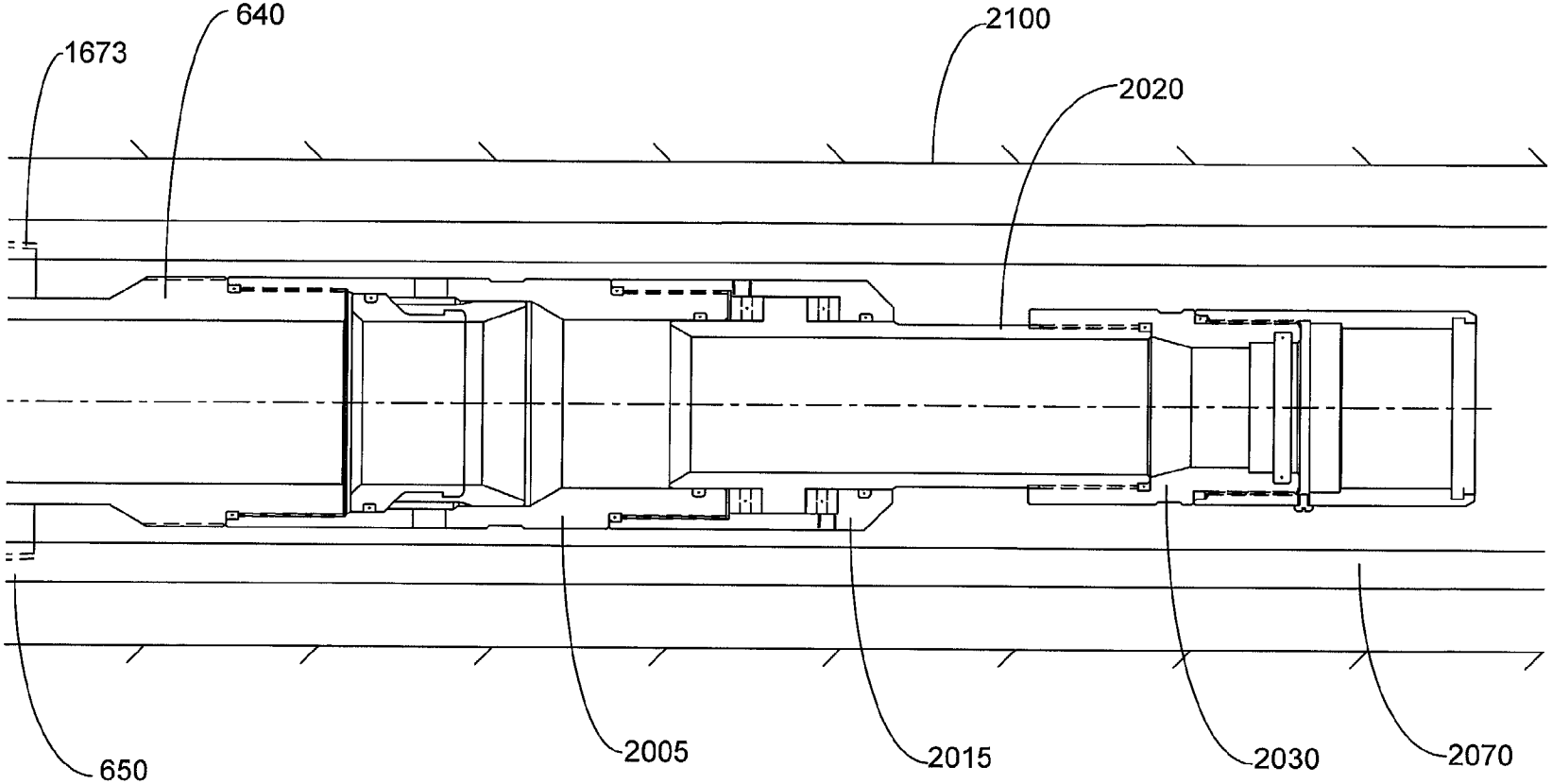

In particular, as illustrated in FIG. 11D, the axial displacement of the collet mandrel 610 in the axial direction 2800 preferably displaces the collet retaining sleeve 635 in the axial direction 2800 relative to the collet upsets 1525. In this manner, the collet upsets 1525 are no longer held in the collet slots 1665 by the collet retaining sleeve 635. Furthermore, in a preferred embodiment, the axial displacement of the collet mandrel 610 in the axial direction 2800 preferably displaces the first shoulder 1445 in the axial direction 2800 relative to the locking dogs 620. In this manner, the locking dogs 620 lock onto the first shoulder 1445 when the collet mandrel 610 is then displaced in the axial direction 2805. In a preferred embodiment, axial displacement of the collet mandrel of about 1.50 inches displaces the collet retaining sleeve 635 out from under the collet upsets 1525 and also locks the locking dogs 620 onto the first shoulder 1445 of the collet mandrel 610. Furthermore, the axial displacement of the collet retaining adapter 640 in the axial direction 2800 also preferably displaces the slots 1600 away from the collet upsets 1525.

In a preferred embodiment, the liner hanger 595, the collet retaining adapter 640, the outer collet support member 645, and the liner hanger setting sleeve 650 are then decoupled from the apparatus 500 by displacing the annular support member 2000, the first support member 505, the second support member 515, the force multiplier outer support member 525, the force multiplier inner support member 530, the first coupling 545, the third support member 550, the second coupling 605, the collet mandrel 610, and the collet retaining adapter 640 in the axial direction 2805 relative to the liner hanger 595, the outer collet support member 645, and the liner hanger setting sleeve 650. In particular, the subsequent axial displacement of the collet mandrel 610 in the axial direction 2805 preferably pulls and decouples the collet upsets 1525 from the collet slots 1665. In a preferred embodiment, the angled outer surfaces 1545 of the collet upsets 1525 facilitate the decoupling process.

In an alternative embodiment, if the locking dogs 620 do not lock onto the first shoulder 1445 of the collet mandrel 610, then the annular support member 2000, the first support member 505, the second support member 515, the force multiplier outer support member 525, the force multiplier inner support member 530, the first coupling 545, the third support member 550, the second coupling 605, the collet mandrel 610, and the collet retaining adapter 640 are then displaced back in the axial direction 2800 and rotated. The rotation of the annular support member 2000, the first support member 505, the second support member 515, the force multiplier outer support member 525, the force multiplier inner support member 530, the first coupling 545, the third support member 550, the second coupling 605, the collet mandrel 610, and the collet retaining adapter 640 preferably misaligns the collet slots 1600 and 1665. In this manner, a subsequent displacement of the in the axial direction 2805 pushes the collet upsets 1525 out of the collet slots 1665 in the liner hanger setting sleeve 650. In a preferred embodiment, the amount of rotation ranges from about 5 to 40 degrees. In this manner, the liner hanger 595, the outer collet support member 645, and the liner hanger setting sleeve 650 are then decoupled from the apparatus 500.

In a preferred embodiment, the removal of the apparatus 500 from the interior of the radially expanded liner hanger 595 is facilitated by the presence of the body of lubricant 575. In particular, the body of lubricant 575 preferably lubricates the interface between the interior surface of the radially expanded liner hanger 595 and the exterior surface of the expansion cone 585. In this manner, the axial force required to remove the apparatus 500 from the interior of the radially expanded liner hanger 595 is minimized.

Figure 12A:
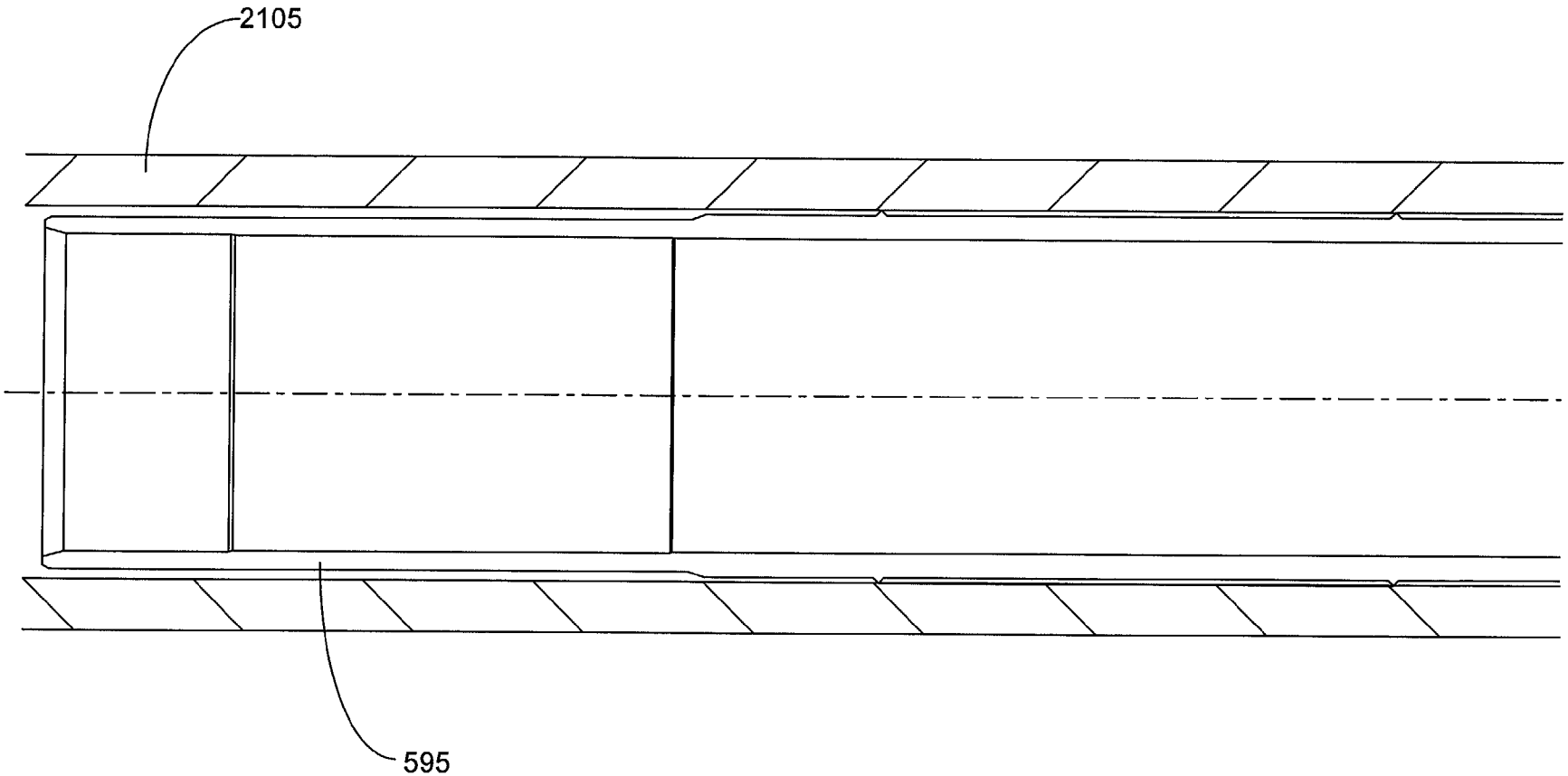
FIGS. 12A to 12C are fragmentary cross-sectional illustrations of the completed wellbore casing.
Figure 12B:
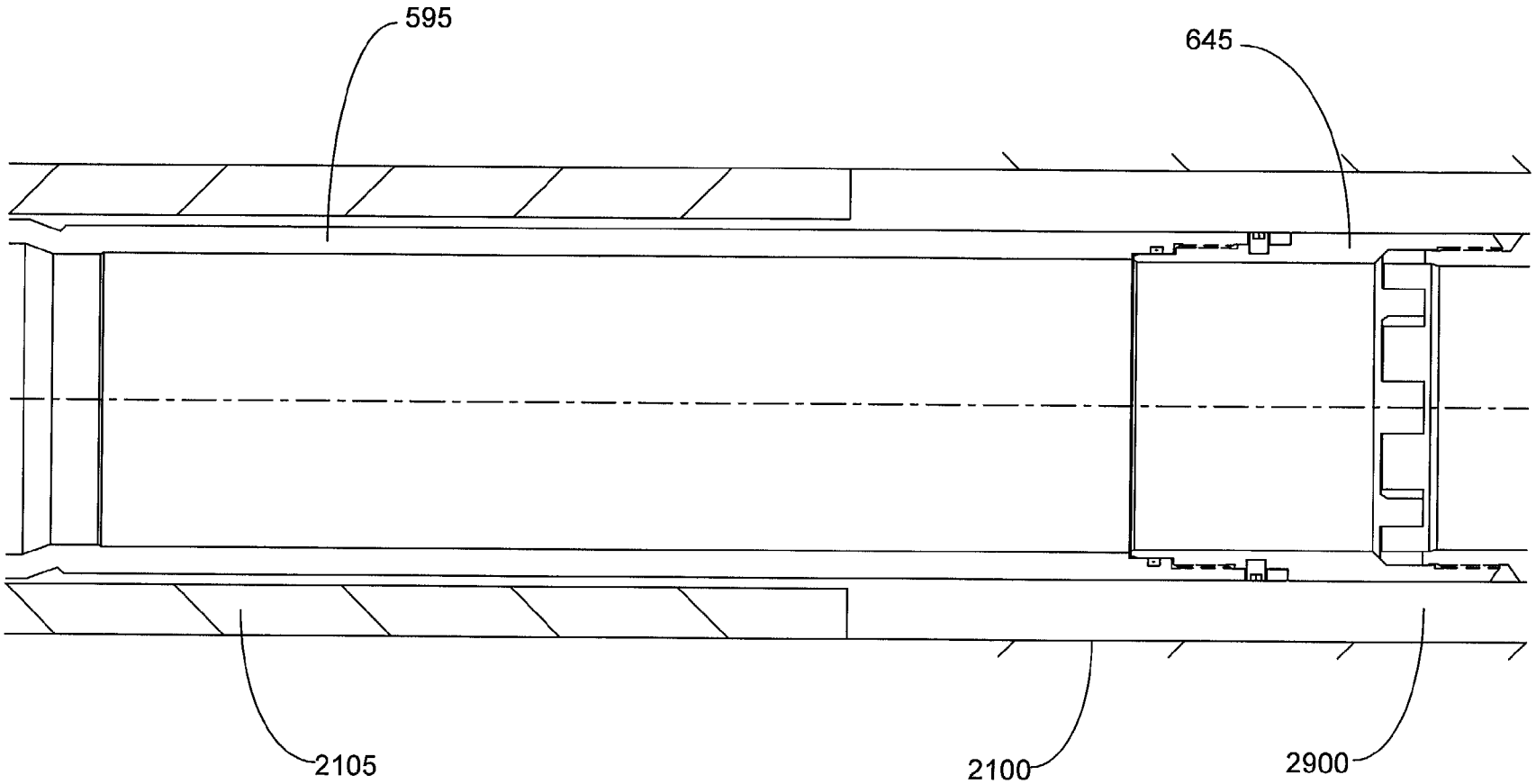
Figure 12C:
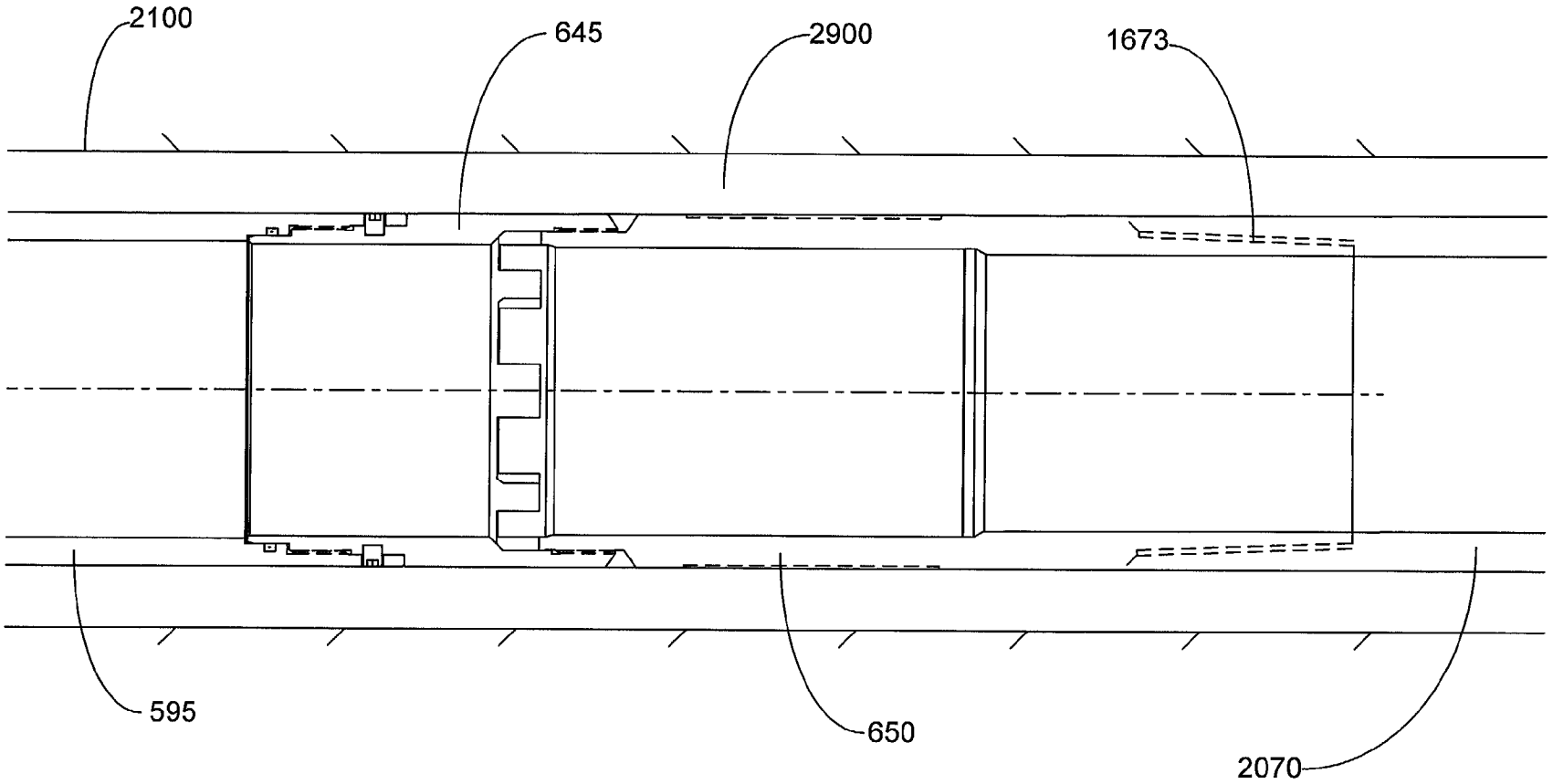

Referring to FIGS. 12A to 12C, after the removal of the remaining portions of the apparatus 500, a new section of wellbore casing is provided that preferably includes the liner hanger 595, the outer collet support member 645, the liner hanger setting sleeve 650, the tubular members 2070 and an outer annular layer of cured material 2900.

In an alternative embodiment, the interior of the radially expanded liner hanger 595 is used as a polished bore receptacle ("PBR"). In an alternative embodiment, the interior of the radially expanded liner hanger 595 is machined and then used as a PBR. In an alternative embodiment, the first end 1350 of the liner hanger 595 is threaded and coupled to a PBR.

In a preferred embodiment, all surfaces of the apparatus 500 that provide a dynamic seal are nickel plated in order to provide optimal wear resistance.

Referring to FIGS. 13A to 13G, an alternative embodiment of an apparatus 3000 for forming or repairing a wellbore casing, pipeline or structural support will be described. The apparatus 3000 preferably includes the first support member 505, the debris shield 510, the second support member 515, the one or more crossover valve members 520, the force multiplier outer support member 525, the force multiplier inner support member 530, the force multiplier piston 535, the force multiplier sleeve 540, the first coupling 545, the third support member 550, the spring spacer 555, the preload spring 560, the lubrication fitting 565, the lubrication packer sleeve 570, the body of lubricant 575, the mandrel 580, the expansion cone 585, the centralizer 590, the liner hanger 595, the travel port sealing sleeve 600, the second coupling 605, the collet mandrel 610, the load transfer sleeve 615, the one or more locking dogs 620, the locking dog retainer 622, the collet assembly 625, the collet retaining sleeve 635, the collet retaining adapter 640, the outer collet support member 645, the liner hanger setting sleeve 650, the one or more crossover valve shear pins 655, the one or more collet retaining sleeve shear pins 665, the first passage 670, the one or more second passages 675, the third passage 680, the one or more crossover valve chambers 685, the primary throat passage 690, the secondary throat passage 695, the fourth passage 700, the one or more inner crossover ports 705, the one or more outer crossover ports 710, the force multiplier piston chamber 715, the force multiplier exhaust chamber 720, the one or more force multiplier exhaust passages 725, the second annular chamber 735, the one or more expansion cone travel indicator ports 740, the one or more collet release ports 745, the third annular chamber 750, the collet release throat passage 755, the fifth passage 760, the one or more sixth passages 765, the one or more seventh passages 770, the one or more collet sleeve passages 775, the one or more force multiplier supply passages 790, the first lubrication supply passage 795, the second lubrication supply passage 800, the collet sleeve release chamber 805, and a standoff adaptor 3005.

Except as described below, the design and operation of the first support member 505, the debris shield 510, the second support member 515, the one or more crossover valve members 520, the force multiplier outer support member 525, the force multiplier inner support member 530, the force multiplier piston 535, the force multiplier sleeve 540, the first coupling 545, the third support member 550, the spring spacer 555, the preload spring 560, the lubrication fitting 565, the lubrication packer sleeve 570, the body of lubricant 575, the mandrel 580, the expansion cone 585, the centralizer 590, the liner hanger 595, the travel port sealing sleeve 600, the second coupling 605, the collet mandrel 610, the load transfer sleeve 615, the one or more locking dogs 620, the locking dog retainer 622, the collet assembly 625, the collet retaining sleeve 635, the collet retaining adapter 640, the outer collet support member 645, the liner hanger setting sleeve 650, the one or more crossover valve shear pins 655, the one or more collet retaining sleeve shear pins 665, the first passage 670, the one or more second passages 675, the third passage 680, the one or more crossover valve chambers 685, the primary throat passage 690, the secondary throat passage 695, the fourth passage 700, the one or more inner crossover ports 705, the one or more outer crossover ports 710, the force multiplier piston chamber 715, the force multiplier exhaust chamber 720, the one or more force multiplier exhaust passages 725, the second annular chamber 735, the one or more expansion cone travel indicator ports 740, the one or more collet release ports 745, the third annular chamber 750, the collet release throat passage 755, the fifth passage 760, the one or more sixth passages 765, the one or more seventh passages 770, the one or more collet sleeve passages 775, the one or more force multiplier supply passages 790, the first lubrication supply passage 795, the second lubrication supply passage 800, and the collet sleeve release chamber 805 of the apparatus 3000 are preferably provided as described above with reference to the apparatus 500 in FIGS. 2A to 12C.

Figure 13A:
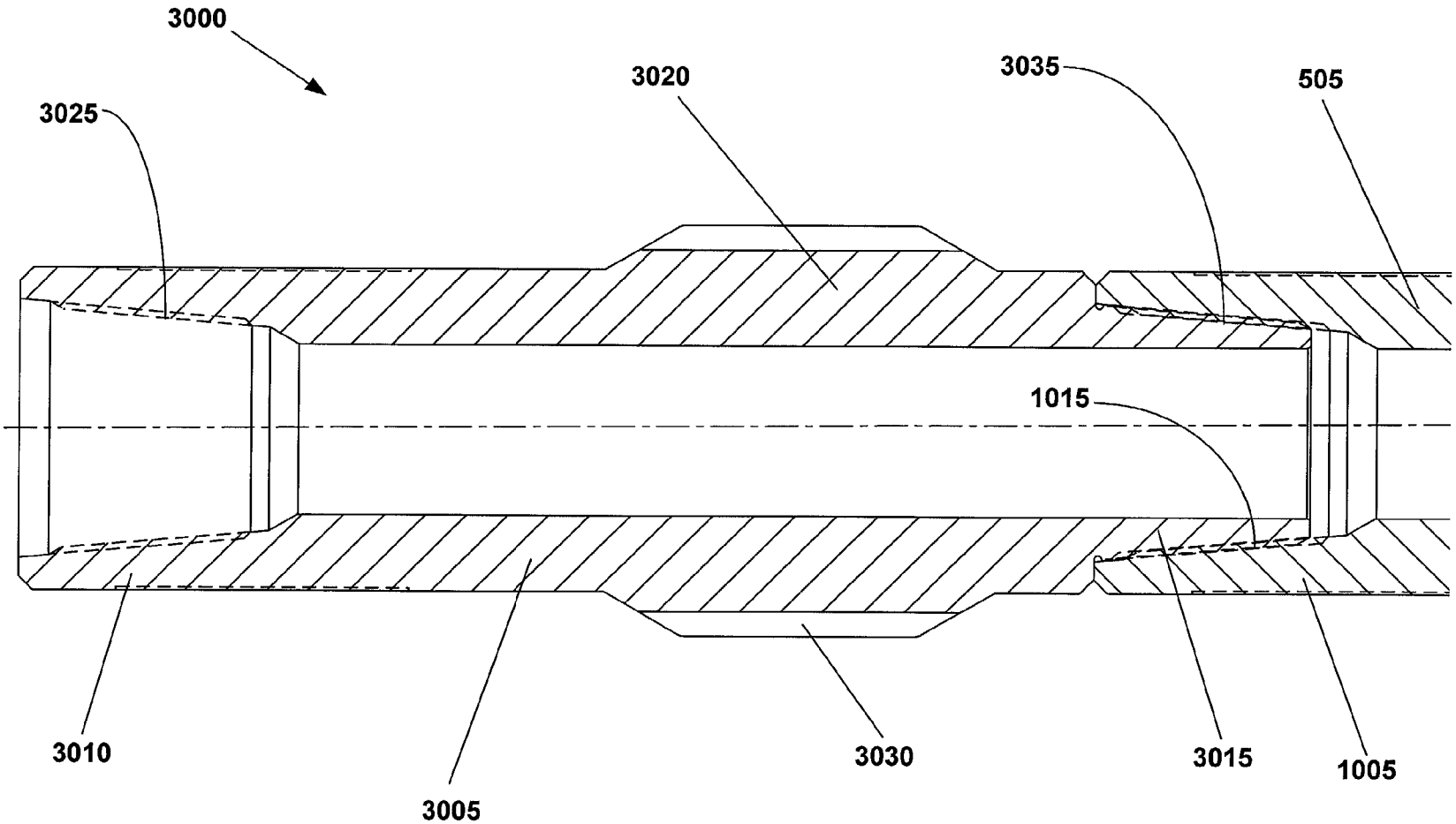
FIG. 13A is a cross-sectional illustration of a portion of an alternative embodiment of an apparatus for forming and/or repairing a wellbore, pipeline or structural support.
Figure 13B:
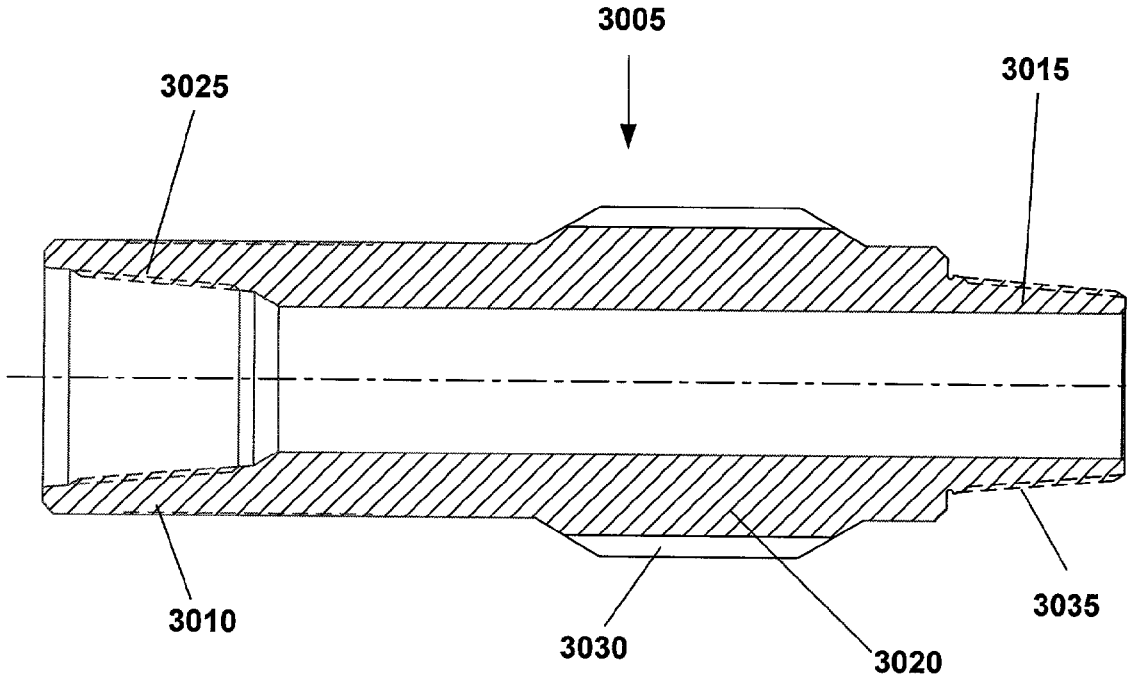
FIG. 13B is a cross-sectional view of the standoff adaptor of the apparatus of FIG. 13A.
Figure 13C:
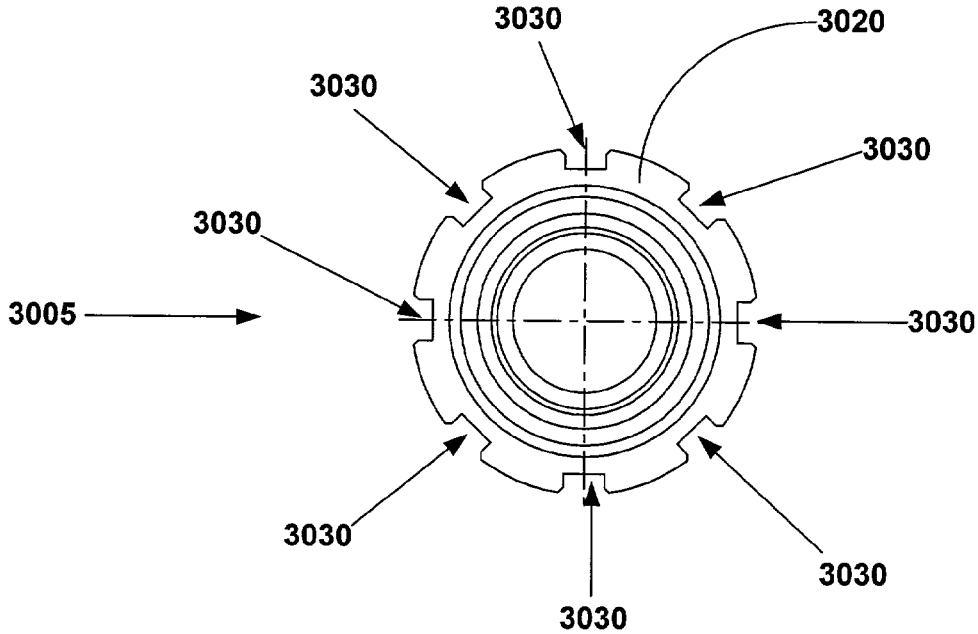
FIG. 13C is a front view of the standoff adaptor of FIG. 13B.

Referring to FIGS. 13A to 13C, the standoff adaptor 3005 is coupled to the first end 1005 of the first support member 505. The standoff adaptor 3005 preferably has a substantially annular cross-section. The standoff adaptor 3005 may be fabricated from any number of conventional commercially available materials. In a preferred embodiment, the standoff adaptor 3005 is fabricated from alloy steel having a minimum yield strength of about 75,000 to 140,000 psi in order to optimally provide high tensile strength and resistance to abrasion and fluid erosion. In a preferred embodiment, the standoff adaptor 3005 includes a first end 3010, a second end 3015, an intermediate portion 3020, a first threaded portion 3025, one or more slots 3030, and a second threaded portion 3035.

The first end 3010 of the standoff adaptor 3005 preferably includes the first threaded portion 3025. The first threaded portion 3025 is preferably adapted to be removably coupled to a conventional tubular support member. The first threaded portion 3025 may be any number of conventional threaded portions. In a preferred embodiment, the first threaded portion 3025 is a 4½" API IF JT BOX thread in order to optimally provide tensile strength.

The intermediate portion 3020 of the standoff adaptor 3005 preferably includes the slots 3030. The outside diameter of the intermediate portion 3020 of the standoff adaptor 3005 is preferably greater than the outside diameter of the liner hanger 595 in order to optimally protect the sealing members 1395, and the top and bottom rings, 1380 and 1390, from abrasion when positioning and/or rotating the apparatus 3000 within a wellbore, or other tubular member. The intermediate portion 3020 of the standoff adaptor 3005 preferably includes a plurality of axial slots 3030 equally positioned about the circumference of the intermediate portion 3020 in order to optimally permit wellbore fluids and other materials to be conveyed along the outside surface of the apparatus 3000.

The second end of the standoff adaptor 3005 preferably includes the second threaded portion 3035. The second threaded portion 3035 is preferably adapted to be removably coupled to the first threaded portion 1015 of the first end 1005 of the first support member 505. The second threaded portion 3035 may be any number of conventional threaded portions. In a preferred embodiment, the second threaded portion 3035 is a 4½" API IF JT PIN thread in order to optimally provide tensile strength.

Figure 13D:
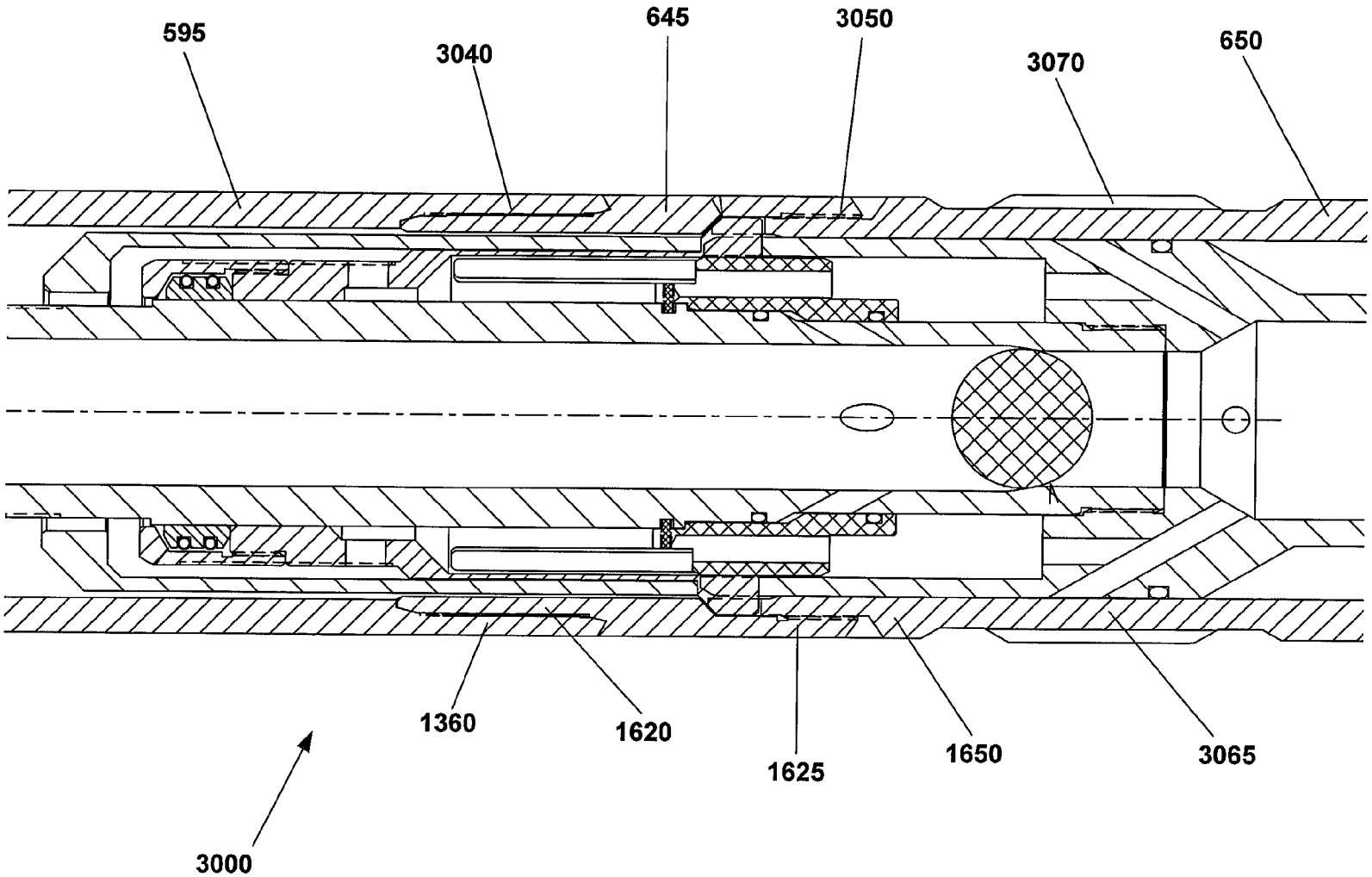
FIG. 13D is a cross-sectional illustration of another portion of an alternative embodiment of the apparatus of FIG. 13A.
Figure 13E:
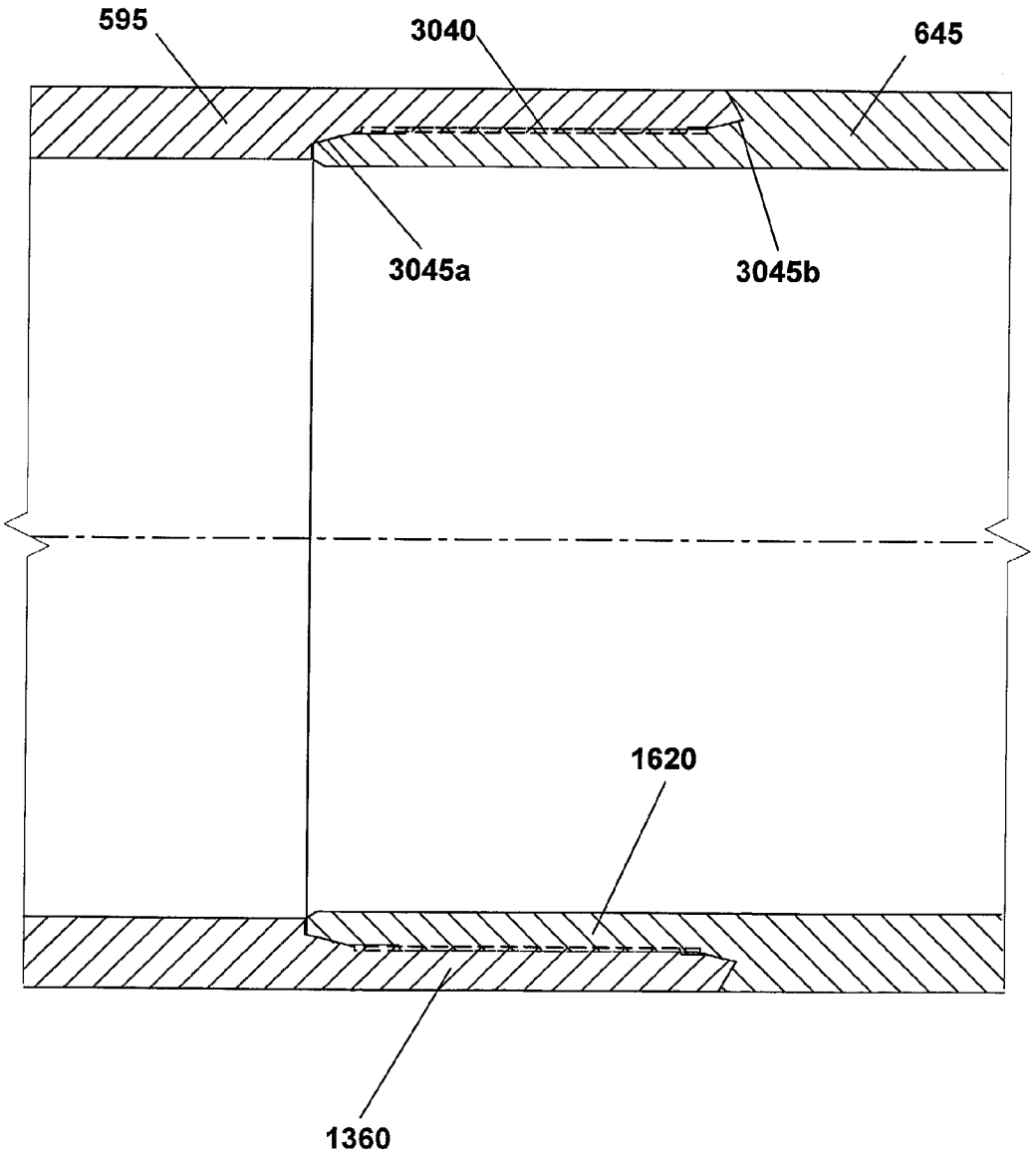
FIG. 13E is an enlarged view of the threaded connection between the liner hanger and the outer collet support member of FIG. 13D.

Referring to FIGS. 13D and 13E, in the apparatus 3000, the second end 1360 of the liner hanger 595 is preferably coupled to the first end 1620 of the outer collet support member 645 using a threaded connection 3040. The threaded connection 3040 is preferably adapted to provide a threaded connection having a primary metal-to-metal seal 3045*a* and a secondary metal-to-metal seal 3045*b* in order to optimally provide a fluidic seal. In a preferred embodiment, the threaded connection 3040 is a DS HST threaded connection available from Halliburton Energy Services in order to optimally provide high tensile strength and a fluidic seal for high operating temperatures.

Figure 13F:
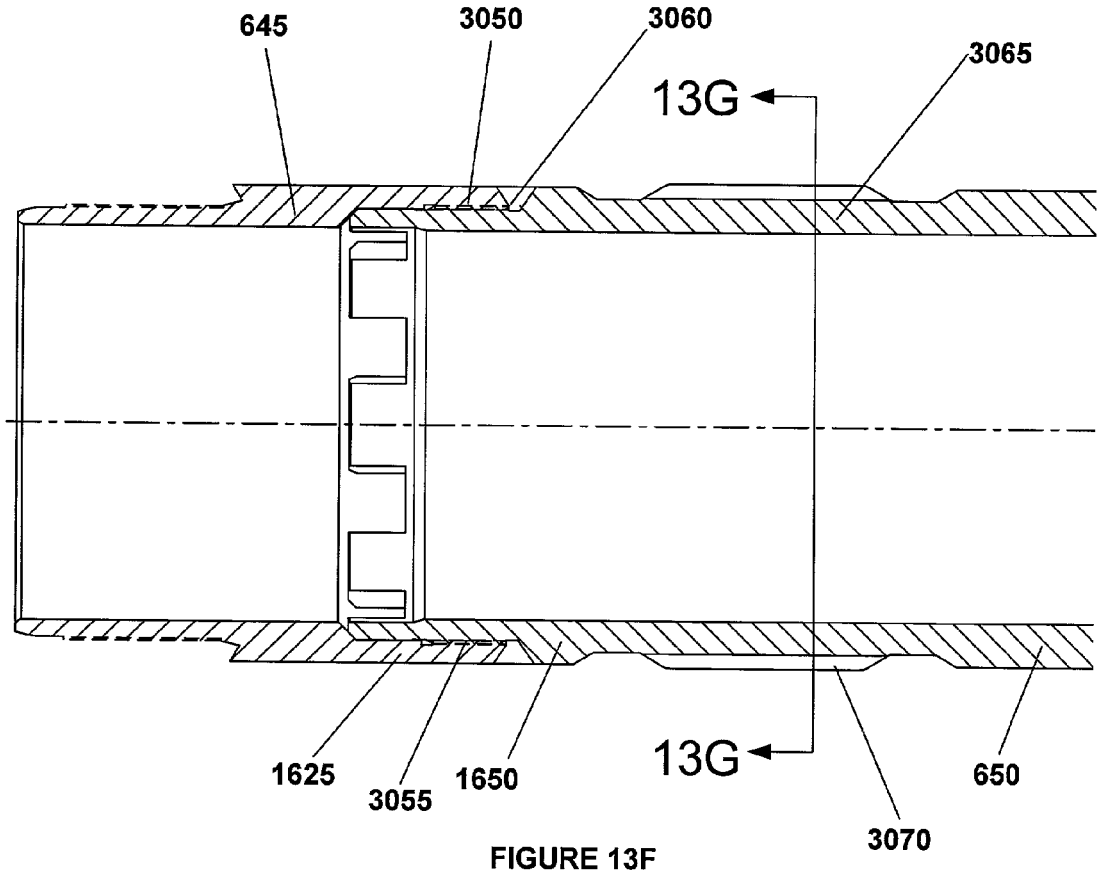
FIG. 13F is an enlarged view of the connection between the outer collet support member 645 and the liner hanger setting sleeve 650 of FIG. 13D.
Figure 13G:
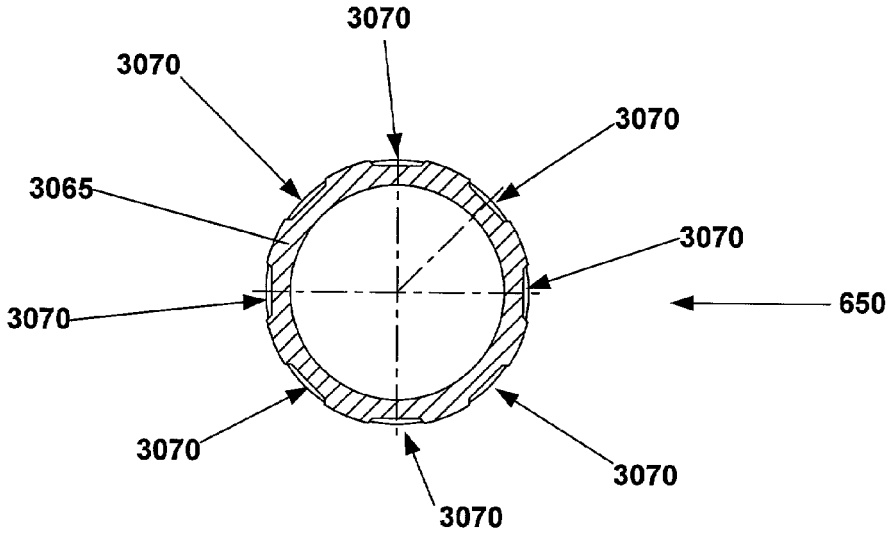
FIG. 13G is a cross-sectional view of the liner hanger setting sleeve of FIG. 13F.

Referring to FIGS. 13D and 13F, in the apparatus 3000, the second end 1625 of the outer collet support member 645 is preferably coupled to the first end 1650 of the liner hanger setting sleeve 650 using a substantially permanent connection 3050. In this manner, the tensile strength of the connection between the second end 1625 of the outer collet support member 645 and the first end 1650 of the liner hanger setting sleeve 650 is optimized. In a preferred embodiment, the permanent connection 3050 includes a threaded connection 3055 and a welded connection 3060. In this manner, the tensile strength of the connection between the second end 1625 of the outer collet support member 645 and the first end 1650 of the liner hanger setting sleeve 650 is optimized.

Referring to FIGS. 13D, 13E and 13F, in the apparatus 3000, the liner hanger setting sleeve 650 further preferably includes an intermediate portion 3065 having one or more axial slots 3070. In a preferred embodiment, the outside diameter of the intermediate portion 3065 of the liner hanger setting sleeve 650 is greater than the outside diameter of the liner hanger 595 in order to protect the sealing elements 1395 and the top and bottom rings, 1385 and 1390, from abrasion when positioning and/or rotating the apparatus 3000 within a wellbore casing or other tubular member. The intermediate portion 3065 of the liner hanger setting sleeve 650 preferably includes a plurality of axial slots 3070 equally positioned about the circumference of the intermediate portion 3065 in order to optimally permit wellbore fluids and other materials to be conveyed along the outside surface of the apparatus 3000.

In several alternative preferred embodiments, the apparatus 500 and 3000 are used to fabricate and/or repair a wellbore casing, a pipeline, or a structural support. In several other alternative embodiments, the apparatus 500 and 3000 are used to fabricate a wellbore casing, pipeline, or structural support including a plurality of concentric tubular members coupled to a preexisting tubular member.

An apparatus for coupling a tubular member to a preexisting structure has been described that includes a first support member including a first fluid passage, a manifold coupled to the support member including: a second fluid passage coupled to the first fluid passage including a throat passage adapted to receive a plug, a third fluid passage coupled to the second fluid passage, and a fourth fluid passage coupled to the second fluid passage, a second support member coupled to the manifold including a fifth fluid passage coupled to the second fluid passage, an expansion cone coupled to the second support member, a tubular member coupled to the first support member including one or more sealing members positioned on an exterior surface, a first interior chamber defined by the portion of the tubular member above the manifold, the first interior chamber coupled to the fourth fluid passage, a second interior chamber defined by the portion of the tubular member between the manifold and the expansion cone, the second interior chamber coupled to the third fluid passage, a third interior chamber defined by the portion of the tubular member below the expansion cone, the third interior chamber coupled to the fifth fluid passage, and a shoe coupled to the tubular member including: a throat passage coupled to the third interior chamber adapted to receive a wiper dart, and a sixth fluid passage coupled to the throat passage. In a preferred embodiment, the expansion cone is slidingly coupled to the second support member. In a preferred embodiment, the expansion cone includes a central aperture that is coupled to the second support member.

A method of coupling a tubular member to a preexisting structure has also been described that includes positioning a support member, an expansion cone, and a tubular member within a preexisting structure, injecting a first quantity of a fluidic material into the preexisting structure below the expansion cone, and injecting a second quantity of a fluidic material into the preexisting structure above the expansion cone. In a preferred embodiment, the injecting of the first quantity of the fluidic material includes: injecting a hardenable fluidic material. In a preferred embodiment, the injecting of the second quantity of the fluidic material includes: injecting a non-hardenable fluidic material. In a preferred embodiment, the method further includes fluidicly isolating an interior portion of the tubular member from an exterior portion of the tubular member. In a preferred embodiment, the method further includes fluidicly isolating a first interior portion of the tubular member from a second interior portion of the tubular member. In a preferred embodiment, the expansion cone divides the interior of the tubular member tubular member into a pair of interior chambers. In a preferred embodiment, one of the interior chambers is pressurized. In a preferred embodiment, the method further includes a manifold for distributing the first and second quantities of fluidic material. In a preferred embodiment, the expansion cone and manifold divide the interior of the tubular member tubular member into three interior chambers. In a preferred embodiment, one of the interior chambers is pressurized.

An apparatus has also been described that includes a preexisting structure and an expanded tubular member coupled to the preexisting structure. The expanded tubular member is coupled to the preexisting structure by the process of: positioning a support member, an expansion cone, and the tubular member within the preexisting structure, injecting a first quantity of a fluidic material into the preexisting structure below the expansion cone, and injecting a second quantity of a fluidic material into the preexisting structure above the expansion cone. In a preferred embodiment, the injecting of the first quantity of the fluidic material includes: injecting a hardenable fluidic material. In a preferred embodiment, the injecting of the second quantity of the fluidic material includes: injecting a non-hardenable fluidic material. In a preferred embodiment, the apparatus further includes fluidicly isolating an interior portion of the tubular member from an exterior portion of the tubular member. In a preferred embodiment, the apparatus further includes fluidicly isolating a first interior portion of the tubular member from a second interior portion of the tubular member. In a preferred embodiment, the expansion cone divides the interior of the tubular member into a pair of interior chambers. In a preferred embodiment, one of the interior chambers is pressurized. In a preferred embodiment, the apparatus further includes a manifold for distributing the first and second quantities of fluidic material. In a preferred embodiment, the expansion cone and manifold divide the interior of the tubular member into three interior chambers. In a preferred embodiment, one of the interior chambers is pressurized.

An apparatus for coupling two elements has also been described that includes a support member including one or more support member slots, a tubular member including one or more tubular member slots, and a coupling for removably coupling the tubular member to the support member, including: a coupling body movably coupled to the support member, one or more coupling arms extending from the coupling body and coupling elements extending from corresponding coupling arms adapted to mate with corresponding support member and tubular member slots. In a preferred embodiment, the coupling elements include one or more angled surfaces. In a preferred embodiment, the coupling body includes one or more locking elements for locking the coupling body to the support member. In a preferred embodiment, the apparatus further includes a sleeve movably coupled to the support member for locking the coupling elements within the support member and tubular member slots. In a preferred embodiment, the apparatus further includes one or more shear pins for removably coupling the sleeve to the support member. In a preferred embodiment, the apparatus further includes a pressure chamber positioned between the support member and the sleeve for axially displacing the sleeve relative to the support member.

A method of coupling a first member to a second member has also been described that includes forming a first set of coupling slots in the first member, forming a second set of coupling slots in the second member, aligning the first and second pairs of coupling slots and inserting coupling elements into each of the pairs of coupling slots. In a preferred embodiment, the method further includes movably coupling the coupling elements to the first member. In a preferred embodiment, the method further includes preventing the coupling elements from being removed from each of the pairs of coupling slots. In a preferred embodiment, the first and second members are decoupled by the process of: rotating the first member relative to the second member, and axially displacing the first member relative to the second member. In a preferred embodiment, the first and second members are decoupled by the process of: permitting the coupling elements to be removed from each of the pairs of coupling slots, and axially displacing the first member relative to the second member in a first direction. In a preferred embodiment, permitting the coupling elements to be removed from each of the pairs of coupling slots includes: axially displacing the first member relative to the second member in a second direction. In a preferred embodiment, the first and second directions are opposite. In a preferred embodiment, permitting the coupling elements to be removed from each of the pairs of coupling slots includes: pressurizing an interior portion of the first member.

An apparatus for controlling the flow of fluidic materials within a housing has also been described that includes a first passage within the housing, a throat passage within the housing fluidicly coupled to the first passage adapted to receive a plug, a second passage within the housing fluidicly coupled to the throat passage, a third passage within the housing fluidicly coupled to the first passage, one or more valve chambers within the housing fluidicly coupled to the third passage including moveable valve elements, a fourth passage within the housing fluidicly coupled to the valve chambers and a region outside of the housing, a fifth passage within the housing fluidicly coupled to the second passage and controllably coupled to the valve chambers by corresponding valve elements, and a sixth passage within the housing fluidicly coupled to the second passage and the valve chambers. In a preferred embodiment, the apparatus further includes: one or more shear pins for removably coupling the valve elements to corresponding valve chambers. In a preferred embodiment, the third passage has a substantially annular cross section. In a preferred embodiment, the throat passage includes: a primary throat passage, and a larger secondary throat passage fluidicly coupled to the primary throat passage. In a preferred embodiment, the apparatus further includes: a debris shield positioned within the third passage for preventing debris from entering the valve chambers. In a preferred embodiment, the apparatus further includes: a piston chamber within the housing fluidicly coupled to the third passage, and a piston movably coupled to and positioned within the piston chamber.

A method of controlling the flow of fluidic materials within a housing including an inlet passage and an outlet passage has also been described that includes injecting fluidic materials into the inlet passage, blocking the inlet passage, and opening the outlet passage. In a preferred embodiment, opening the outlet passage includes: conveying fluidic materials from the inlet passage to a valve element, and displacing the valve element. In a preferred embodiment, conveying fluidic materials from the inlet passage to the valve element includes: preventing debris from being conveyed to the valve element. In a preferred embodiment, the method further includes conveying fluidic materials from the inlet passage to a piston chamber. In a preferred embodiment, conveying fluidic materials from the inlet passage to the piston chamber includes: preventing debris from being conveyed to the valve element.

An apparatus has also been described that includes a first tubular member, a second tubular member positioned within and coupled to the first tubular member, a first annular chamber defined by the space between the first and second tubular members, an annular piston movably coupled to the second tubular member and positioned within the first annular chamber, an annular sleeve coupled to the annular piston and positioned within the first annular chamber, a third annular member coupled to the second annular member and positioned within and movably coupled to the annular sleeve, a second annular chamber defined by the space between the annular piston, the third annular member, the second tubular member, and the annular sleeve, an inlet passage fluidicly coupled to the first annular chamber, and an outlet passage fluidicly coupled to the second annular chamber. In a preferred embodiment, the apparatus further includes: an annular expansion cone movably coupled to the second tubular member and positioned within the first annular chamber. In a preferred embodiment, the first tubular member includes: one or more sealing members coupled to an exterior surface of the first tubular member. In a preferred embodiment, the first tubular member includes: one or more ring members coupled to an exterior surface of the first tubular member.

A method of applying an axial force to a first piston positioned within a first piston chamber has also been described that includes applying an axial force to the first piston using a second piston positioned within the first piston chamber. In a preferred embodiment, the method further includes applying an axial force to the first piston by pressurizing the first piston chamber. In a preferred embodiment, the first piston chamber is a substantially annular chamber. In a preferred embodiment, the method further includes coupling an annular sleeve to the second piston, and applying the axial force to the first piston using the annular sleeve. In a preferred embodiment, the method further includes pressurizing the first piston chamber. In a preferred embodiment, the method further includes coupling the second piston to a second chamber, and depressurizing the second chamber.

An apparatus for radially expanding a tubular member has also been described that includes a support member, a tubular member coupled to the support member, a mandrel movably coupled to the support member and positioned within the tubular member, an annular expansion cone coupled to the mandrel and movably coupled to the tubular member for radially expanding the tubular member, and a lubrication assembly coupled to the mandrel for supplying a lubricant to the annular expansion cone, including: a sealing member coupled to the annular member, a body of lubricant positioned in an annular chamber defined by the space between the sealing member, the annular member, and the tubular member, and a lubrication supply passage fluidicly coupled to the body of lubricant and the annular expansion cone for supplying a lubricant to the annular expansion cone. In a preferred embodiment, the tubular member includes: one or more sealing members positioned on an outer surface of the tubular member. In a preferred embodiment, the tubular member includes: one or more ring member positioned on an outer surface of the tubular member. In a preferred embodiment, the apparatus further includes: a centralizer coupled to the mandrel for centrally positioning the expansion cone within the tubular member. In a preferred embodiment, the apparatus further includes: a preload spring assembly for applying an axial force to the mandrel. In a preferred embodiment, the preload spring assembly includes: a compressed spring, and an annular spacer for compressing the compressed spring.

A method of operating an apparatus for radially expanding a tubular member including an expansion cone has also been described that includes lubricating the interface between the expansion cone and the tubular member, centrally positioning the expansion cone within the tubular member, and applying a substantially constant axial force to the tubular member prior to the beginning of the radial expansion process.

An apparatus has also been described that includes a support member, a tubular member coupled to the support member, an annular expansion cone movably coupled to the support member and the tubular member and positioned within the tubular member for radially expanding the tubular member, and a preload assembly for applying an axial force to the annular expansion cone, including: a compressed spring coupled to the support member for applying the axial force to the annular expansion cone, and a spacer coupled to the support member for controlling the amount of spring compression.

An apparatus for coupling a tubular member to a preexisting structure has also been described that includes a support member, a manifold coupled to the support member for controlling the flow of fluidic materials within the apparatus, a radial expansion assembly movably coupled to the support member for radially expanding the tubular member, and a coupling assembly for removably coupling the tubular member to the support member. In a preferred embodiment, the apparatus further includes a force multiplier assembly movably coupled to the support member for applying an axial force to the radial expansion assembly. In a preferred embodiment, the manifold includes: a throat passage adapted to receive a ball, and a valve for controlling the flow of fluidic materials out of the apparatus. In a preferred embodiment, the manifold further includes: a debris shield for preventing the entry of debris into the apparatus. In a preferred embodiment, the radial expansion assembly includes: a mandrel movably coupled to the support member, and an annular expansion cone coupled to the mandrel. In a preferred embodiment, the radial expansion assembly further includes: a lubrication assembly coupled to the mandrel for providing a lubricant to the interface between the expansion cone and the tubular member. In a preferred embodiment, the radial expansion assembly further includes: a preloaded spring assembly for applying an axial force to the mandrel. In a preferred embodiment, the tubular member includes one or more coupling slots, the support member includes one or more coupling slots, and the coupling assembly includes: a coupling body movably coupled to the support member, and one or more coupling elements coupled to the coupling body for engaging the coupling slots of the tubular member and the support member.

An apparatus for coupling a tubular member to a preexisting structure has also been described that includes an annular support member including a first passage, a manifold coupled to the annular support member, including: a throat passage fluidicly coupled to the first passage adapted to receive a fluid plug, a second passage fluidicly coupled to the throat passage, a third passage fluidicly coupled to the first passage, a fourth passage fluidicly coupled to the third passage, one or more valve chambers fluidicly coupled to the fourth passage including corresponding movable valve elements, one or more fifth passages fluidicly coupled to the second passage and controllably coupled to corresponding valve chambers by corresponding movable valve elements, one or more sixth passages fludicly coupled to a region outside of the manifold and to corresponding valve chambers, one or more seventh passages fluidicly coupled to corresponding valve chambers and the second passage, and one or more force multiplier supply passages fluidicly coupled to the fourth passage, a force multiplier assembly coupled to the annular support member, including: a force multiplier tubular member coupled to the manifold, an annular force multiplier piston chamber defined by the space between the annular support member and the force multiplier tubular member and fluidicly coupled to the force multiplier supply passages, an annular force multiplier piston positioned in the annular force multiplier piston chamber and movably coupled to the annular support member, a force multiplier sleeve coupled to the annular force multiplier piston, a force multiplier sleeve sealing member coupled to the annular support member and movably coupled to the force multiplier sleeve for sealing the interface between the force multiplier sleeve and the annular support member, an annular force multiplier exhaust chamber defined by the space between the annular force multiplier piston, the force multiplier sleeve, and the force multiplier sleeve sealing member, and a force multiplier exhaust passage fluidicly coupled to the annular force multiplier exhaust chamber and the interior of the annular support member, an expandable tubular member, a radial expansion assembly movably coupled to the annular support member, including: an annular mandrel positioned within the annular force multiplier piston chamber, an annular expansion cone coupled to the annular mandrel and movably coupled to the expandable tubular member, a lubrication assembly coupled to the annular mandrel for supplying lubrication to the interface between the annular expansion cone and the expandable tubular member, a centralizer coupled to the annular mandrel for centering the annular expansion cone within the expandable tubular member, and a preload assembly movably coupled to the annular support member for applying an axial force to the annular mandrel, and a coupling assembly coupled to the annular support member and releasably coupled to the expandable tubular member, including: a tubular coupling member coupled to the expandable tubular member including one or more tubular coupling member slots, an annular support member coupling interface coupled to the annular support member including one or more annular support member coupling interface slots, and a coupling device for releasably coupling the tubular coupling member to the annular support member coupling interface, including: a coupling device body movably coupled to the annular support member, one or more resilient coupling device arms extending from the coupling device body, and one or more coupling device coupling elements extending from corresponding coupling device arms adapted to removably mate with corresponding tubular coupling member and annular support member coupling slots.

A method of coupling a tubular member to a pre-existing structure has also been described that includes positioning an expansion cone and the tubular member within the preexisting structure using a support member, displacing the expansion cone relative to the tubular member in the axial direction, and decoupling the support member from the tubular member. In a preferred embodiment, displacing the expansion cone includes: displacing a force multiplier piston, and applying an axial force to the expansion cone using the force multiplier piston. In a preferred embodiment, displacing the expansion cone includes: applying fluid pressure to the expansion cone. In a preferred embodiment, displacing the force multiplier piston includes: applying fluid pressure to the force multiplier piston. In a preferred embodiment, the method further includes applying fluid pressure to the expansion cone. In a preferred embodiment, the decoupling includes: displacing the support member relative to the tubular member in a first direction, and displacing the support member relative to the tubular member in a second direction. In a preferred embodiment, decoupling includes: rotating the support member relative to the tubular member, and displacing the support member relative to the tubular member in an axial direction. In a preferred embodiment, the method further includes prior to displacing the expansion cone, injecting a hardenable fluidic material into the preexisting structure. In a preferred embodiment, the method further includes prior to decoupling, curing the hardenable fluidic sealing material.

An apparatus has also been described that includes a preexisting structure, and a radially expanded tubular member coupled to the preexisting structure by the process of: positioning an expansion cone and the tubular member within the preexisting structure using a support member, displacing the expansion cone relative to the tubular member in the axial direction, and decoupling the support member from the tubular member. In a preferred embodiment, displacing the expansion cone includes: displacing a force multiplier piston, and applying an axial force to the expansion cone using the force multiplier piston. In a preferred embodiment, displacing the expansion cone includes: applying fluid pressure to the expansion cone. In a preferred embodiment, displacing the force multiplier piston includes: applying fluid pressure to the force multiplier piston. In a preferred embodiment, the method further includes applying fluid pressure to the expansion cone. In a preferred embodiment, the decoupling includes: displacing the support member relative to the tubular member in a first direction, and displacing the support member relative to the tubular member in a second direction. In a preferred embodiment, decoupling includes: rotating the support member relative to the tubular member, and displacing the support member relative to the tubular member in an axial direction. In a preferred embodiment, the method further includes prior to displacing the expansion cone, injecting a hardenable fluidic material into the preexisting structure. In a preferred embodiment, the method further includes prior to decoupling, curing the hardenable fluidic sealing material.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. A method of controlling the flow of fluidic materials within a tubular housing that defines an inlet passage and one or more outlet passages, comprising:

injecting fluidic materials into the inlet passage;

blocking the inlet passage; and opening the outlet passages;

conveying the injected fluidic materials radially out of the inlet passages into a plurality of circumferentially spaced apart longitudinal passages defined in the tubular housing and into an annular chamber defined in the tubular housing that surrounds the inlet passage; and opening the outlet passages to permit fluidic materials within the inlet passage and the annular chamber to be conveyed out of the housing;

increasing the pressure of fluid materials outside of the housing; and displacing an expansion cone when the pressure of fluidic materials outside of the housing exceeds a predetermined level;

wherein opening the outlet passages comprises detecting the operating pressure of the injected fluidic materials; and if the detected operating pressure of the injected fluidic materials exceeds a predetermined amount, then opening the outlet passages.

2. The method of claim 1, wherein blocking the inlet passage comprises:

blocking the inlet passage by placing a ball plug into a throat passage defined in the inlet passage.

3. The method of claim 1, further comprising:

preventing debris from entering the annular chamber.

4. The method of claim 1, wherein opening the outlet passages comprises:

if the detected operating pressure of the injected fluidic materials exceeds about 500 to 3,000 psi, ten displacing valve members positioned within corresponding longitudinal valve chambers defined in the tubular housing.

5. The method of claim 1, further comprising:

controlling the rate at which the fluidic materials are conveyed out of the tubular housing through the outlet passages using variable orifices positioned within and fluidicly coupled to the outlet passages.

6. The method of claim 1, wherein the outlet passages are orthogonal to the inlet passage.

7. The method of claim 1, further comprising:

conveying the injected fluidic materials into a plurality of circumferentially spaced apart longitudinal valve chambers fluidicly coupled to corresponding outlet passages that each include corresponding movable valve members.

8. The method of claim 7, wherein opening the outlet passages comprises:

if the detected operating pressure of the injected fluidic materials exceeds a predetermined amount, then displacing the valve members positioned within the corresponding longitudinal valve chambers.

9. The method of claim 7, wherein the valve chambers are interleaved among the longitudinal passages.

10. The method of claim 1, wherein blocking the inlet passage comprises:

blocking the inlet passage by placing a ball plug into a throat passage defined in the inlet passage; and further comprising: preventing debris from entering the annular chamber.

11. The method of claim 1, wherein opening the outlet passages comprises:

detecting the operating pressure of the injected fluidic materials; if the detected operating pressure of the injected fluidic materials exceeds about 500 to 3,000 psi, then displacing valve members positioned within corresponding longitudinal valve chambers defined in the tubular housing; and controlling the rate at which the fluidic materials are conveyed out of the tubular housing through the outlet passages using variable orifices positioned within and fluidiely coupled to the outlet passages.

12. The method of claim 1, wherein the outlet passages are orthogonal to the inlet passage; and further comprising:

conveying the injected fluidic materials into a plurality of circumferentially spaced apart longitudinal valve chambers fluidiely coupled to corresponding outlet passages that each include corresponding movable valve members.

13. The method of claim 1 wherein the operating pressure is remotedly detected.

14. A method for controlling the flow of fluidic materials within a tubular housing defining an inlet passage for conveying the fluidic materials into the housing and one or more outlet passages for conveying fluidic materials out of the housing, comprising:

injecting fluidic materials into the inlet passage;

blocking the inlet passage by placing a ball plug into a throat passage defined in the inlet passage;

conveying the injected fluidic materials radially out of the inlet passage into a plurality of circumferentially spaced apart longitudinal passages defined in the tubular housing and into an annular chamber defined in the tubular housing and surrounding the inlet passage;

preventing debris from entering the annular chamber;

detecting the operating pressure of the injected fluidic materials;

if the detected operating pressure of the injected fluidic materials exceeds about 500 to 3,000 psi, then displacing valve members positioned within corresponding longitudinal valve chambers defined in the tubular housing to thereby permit fluidic materials within the inlet passage to be conveyed radially out of the tubular housing through a plurality of outlet passages;

controlling the rate at which the fluidic materials are conveyed out of the tubular housing through the outlet passages using variable orifices positioned within and fluidicly coupled to the outlet passages;

increasing the pressure of fluid materials outside of the housing; and displacing an expansion cone when the pressure of fluidic materials outside of the housing exceeds a predetermined level.

15. The method of claim 14 wherein the operating pressure is remotedly detected.

* * * * *